US006721516B2

(12) United States Patent
Aoki et al.

(10) Patent No.: US 6,721,516 B2
(45) Date of Patent: Apr. 13, 2004

(54) IMAGE FORMING APPARATUS

(75) Inventors: Katsuhiro Aoki, Kanagawa (JP); Tsukuru Kai, Kanagawa (JP); Hajime Oyama, Chiba (JP); Osamu Ariizumi, Kanagawa (JP); Hisashi Shoji, Kanagawa (JP); Takashi Hodoshima, Kanagawa (JP); Yasuo Miyoshi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 10/050,955

(22) Filed: Jan. 22, 2002

(65) Prior Publication Data

US 2002/0154917 A1 Oct. 24, 2002

(30) Foreign Application Priority Data

| | | |
|---|---|---|
| Jan. 19, 2001 | (JP) | 2001-011704 |
| Mar. 15, 2001 | (JP) | 2001-074609 |
| Mar. 22, 2001 | (JP) | 2001-083545 |
| Sep. 7, 2001 | (JP) | 2001-272135 |

(51) Int. Cl.[7] ..... G03G 15/06
(52) U.S. Cl. ..... 399/55; 399/56
(58) Field of Search ..... 399/55, 56, 258, 399/259, 265, 267, 270, 272, 276, 277

(56) References Cited

U.S. PATENT DOCUMENTS

| | | |
|---|---|---|
| 5,339,141 A | 8/1994 | Suzuki et al. |
| 5,424,814 A | 6/1995 | Suzuki et al. |

(List continued on next page.)

FOREIGN PATENT DOCUMENTS

| | | |
|---|---|---|
| JP | 5-19588 | 1/1993 |
| JP | 5-19601 | 1/1993 |
| JP | 6-102767 | 4/1994 |
| JP | 7-84439 | 3/1995 |
| JP | 11-295925 | 10/1999 |
| JP | 2000-66490 | 3/2000 |
| JP | 2000-305360 | 11/2000 |
| JP | 2001-60015 | 3/2001 |

*Primary Examiner*—Hoang Ngo
(74) *Attorney, Agent, or Firm*—Oblon, Spivak, McClelland, Maier & Neustadt, P.C.

(57) ABSTRACT

An image forming apparatus of the present invention includes a bias power supply for applying a bias $V_B$ to a developer carrier on which a developer is deposited. A charge potential deposited on an image carrier, which faces the developer carrier for forming a latent image thereon, is 400 V or below in absolute value. Assume that the potential of the image carrier is lowered to $V_L$ after exposure, that a development potential is $|V_B-V_L|$, that the maximum set value of the development potential for development is $|V_B-V_L|$max, and that the development potential varies in a range satisfying relations:

$$|V_B-V_L| \leqq |V_B-V_L|\max + |V_B-V_L|\max \times 0.2$$

$$|V_B-V_L| \geqq |V_B-V_L|\max - |V_B-V_L|\max \times 0.2$$

$$|V_B-V_L|\max \leqq 300 \text{ V}$$

Then image density varies by a width of 10% of image density corresponding to the maximum set value of the development potential or less.

79 Claims, 71 Drawing Sheets

U.S. PATENT DOCUMENTS 5,450,177 A 9/1995 Oyama
5,565,973 A 10/1996 Fujishiro et al.
5,598,254 A 1/1997 Ikesue et al.
5,655,193 A 8/1997 Fujishiro et al.
5,659,860 A 8/1997 Sasaki et al.
5,771,426 A 6/1998 Oka et al.
5,774,772 A 6/1998 Kai et al.
5,805,965 A 9/1998 Tsuda et al.
5,822,664 A 10/1998 Oka et al.
5,864,733 A 1/1999 Mae et al.
5,915,155 A 6/1999 Shoji et al.
6,081,684 A 6/2000 Naganuma et al.
6,125,243 A 9/2000 Shoji et al.
6,160,979 A 12/2000 Shoji
6,163,669 A 12/2000 Aoki et al.
6,295,437 B1 9/2001 Hodoshima et al.
6,366,751 B1 4/2002 Shakuto et al.
6,385,423 B1 5/2002 Kai
6,442,364 B2 8/2002 Kai et al.
6,449,452 B1 9/2002 Kai
6,456,806 B2 9/2002 Shoji et al.
6,505,014 B2 * 1/2003 Aoki et al. ..... 399/55

* cited by examiner

*Fig. 10*

| | EXAMPLE 1 | COMPARATIVE EXAMPLE 1 | COMPARATIVE EXAMPLE 2 |
|---|---|---|---|
| AMOUNT OF CHARGE (μC/g) | −15 | −15 | −30 |
| GAP (μm) | 400 | 600 | 400 |
| IMAGE DENSITY ESTIMATION | ○ | × | × |

*Fig. 14*

| | AMOUNT OF DEVELOPER | DRIVE TORQUE | AGITATOR SPEED | FORCE OF MAIN POLE S1 | CARRIER SATURATION MAGNETIZATION | MEAN TONER CHARGE | DEVELOPER LIFE |
|---|---|---|---|---|---|---|---|
| | [g] | [N•m] | [rpm] | [mT] | [emu/g | Q/M [μC/g] | [× 1000] |
| EX. A | 400 | 0.18 | 150 | 70 | 90 | −20 | 180 |
| EX. B | 300 | 0.12 | 110 | 70 | 90 | −19 | 210 |
| EX. C | 300 | 0.14 | 110 | 70 | 90 | −17 | 200 |
| EX. D | 300 | 0.13 | 150 | 70 | 60 | −18 | 230 |
| COMP. EX. | 300 | 0.16 | 150 | 60 | 90 | −25 | 150 |

*Fig. 24*

| | EX. 2 | COM. EX. 3 | COM. EX. 4 |
|---|---|---|---|
| AMOUNT OF CHARGE ON TONER (μC/g) | −12 | −12 | −40 |
| ROLLER RESISTANCE (Ω・cm) | $10^3$ | $10^{10}$ | $10^3$ |
| IMAGE DENSITY ESTIMATION | ○ | × | × |

| NUMBER OF PRINT | 5,000 | 10,000 | 20,000 | 30,000 |
|---|---|---|---|---|
| DOCTOR ROLLER | ○ | ○ | ○ | ○ |
| DOCTOR BLADE | ○ | △ | × | — |

*Fig. 31*

| | AMOUNT OF CHARGE [ I ] OF TONER FED [ μC/g] | AMOUNT OF CHARGE [ II ] OF TONER IN LAYER [ μC/g] | RATIO OF [ II ] TO [I] [%] | BACKGROUND CONTAMINATION RANK |
|---|---|---|---|---|
| EMBODIMENT | −15 ±2 | −12 ±2 | 125 | 5 |
| PRIOR ART | −3 ±2 | −12 ±2 | 25 | 3 |

*Fig. 38*

| | MAXIMUM VALUE A (ID/KV) OF SLOPE OF $\gamma$ CURVE | A×0.9 | | SLOPE B (ID/KV) OF $\gamma$ CURVE AROUND $V_L - V_B \fallingdotseq 400V$ |
|---|---|---|---|---|
| EX. 1 | 10 ( = 2/0.2) | 9 | > | 0 |
| COM. EX. 1 | 4 ( =1.4/0.35) | 3.6 | < | 4 ( =1.2/0.3) |
| COM. EX. 2 | 6.5 ( =1.7/0.26) | 5.9 | > | 5 ( =0.3/0.06) |

*Fig. 53*

| AMOUNT OF TONER (fC/10μm) | −6 | −5 | −4 | −3 | −2 | −1 | 0 | 1 | 2 | 3 | 4 | 5 | 6 |
|---|---|---|---|---|---|---|---|---|---|---|---|---|---|
| TONER (A3) | 0 | 8 | 35 | 187 | 550 | 1328 | 380 | 106 | 13 | 3 | 1 | 0 | 0 |
| TONER (A4) | 0 | 3 | 46 | 154 | 540 | 1254 | 531 | 136 | 58 | 4 | 0 | 0 | 0 |
| TONER (B3) | 0 | 3 | 29 | 221 | 499 | 1009 | 553 | 240 | 24 | 1 | 0 | 0 | 0 |
| TONER (B4) | 0 | 3 | 41 | 189 | 534 | 954 | 583 | 211 | 32 | 8 | 4 | 0 | 0 |

Fig. 56

| | VALUE | UNIT |
|---|---|---|
| WEIGHT | 71.7 | $g/m^2$ |
| THICKNESS | 89 | μm |
| DENSITY | 0.81 | $g/m^3$ |
| SMOOTHNESS (FRONT) | 40 | S |
| SMOOTHNESS (BACK) | 37 | S |
| VOLUME RESISTIVITY | $1.2 \times 10^{11}$ | Ω cm |

PASCHEN'S CURVE (SOLID LINE) & TYPICAL GAP VOLTAGE/GAP WIDTH CURVE (PHANTOM LINE) WITH 2 MYLAR SHEETS

*Fig. 74*

| | AMOUNT OF DEVELOPER | DRIVE TORQUE | SCREW SPEED | FORCE OF MAIN POLE | CARRIER SATURATION MAGNETIZATION | MEAN Q/M | DEVELOPER LIFE |
|---|---|---|---|---|---|---|---|
| | [g] | [N・m] | [rpm] | [T] | [emu/g] | [−μC/g] | [× 1000] |
| COM EX | 300 | 0.16 | 150 | 70 | 90 | 25 | 150 |
| CONDITION A | 400 | 0.18 | ↑ | ↑ | ↑ | 20 | 180 |
| CONDITION B | 300 | 0.12 | 110 | ↑ | ↑ | 19 | 210 |
| CONDITION C | ↑ | 0.14 | 150 | 60 | ↑ | 17 | 200 |
| CONDITION D | ↑ | 0.13 | ↑ | 70 | 60 | 18 | 230 |

Fig. 76

EMBODIMENT (16mm)

| | P1a | P1b | P1c | P2 | P3 | P4 | P5 | P6 |
|---|---|---|---|---|---|---|---|---|
| FLUX DENSITY (mT) | 62.9 | 63.8 | 78.7 | 63.6 | – | 48.1 | 64.6 | 60.0 |
| CENTER HALF-ANGLE | 334.1 (25.8) | 0 | 27.5 | 67.1 | – | 151.5 | 212.7 | 279.2 |
| HALF-WIDTH | 19.7 | 17.0 | 19.7 | 30.6 | – | 28.0 | 52.2 | 37.7 |
| POLE | N | S | N | S | | S | N | S |

PRIOR ART (16mm)

| | P1 | P2 | P3 | P4 | P5 | P6 |
|---|---|---|---|---|---|---|
| FLUX DENSITY (mT) | 75.4 | 57.2 | – | 44.1 | 57.7 | 50.7 |
| CENTER HALF-ANGLE | 0 | 69.5 | – | 153.2 | 220.6 | 297.0 |
| HALF-WIDTH | 45.3 | 45.2 | – | 34.3 | 52.5 | 41.56 |
| POLE | N | S | | S | N | S |

EMBODIMENT (20mm)

| | P1a | P1b | P1c | P2 | P3 | P4 | P5 | P6 |
|---|---|---|---|---|---|---|---|---|
| FLUX DENSITY (mT) | 87.0 | 69.8 | 77.7 | 54.0 | – | 30.0 | 72.8 | 62.2 |
| CENTER HALF-ANGLE | 337.7 (−22.3) | 0 | 22.6 | 59.1 | – | 147.8 | 203.0 | 287.6 |
| HALF-WIDTH | 17.8 | 13.4 | 17.1 | 29.7 | – | 84.9 | 42.2 | 46.6 |
| POLE | S | N | S | N | | N | S | N |

PRIOR ART (20mm)

| | P1 | P2 | P3 | P4 | P5 | P6 |
|---|---|---|---|---|---|---|
| FLUX DENSITY (mT) | 89.2 | 57.5 | – | 21.1 | 63.5 | 71.9 |
| CENTER HALF-ANGLE | 0 | 65.8 | – | 157.8 | 211.4 | 295.5 |
| HALF-WIDTH | 47.6 | 37.2 | – | 29.3 | 38.0 | 49.7 |
| POLE | N | S | | S | N | S |

Fig. 85

EMBODIMENT (30mm)

| | P1a | P1b | P1c | P2 | P3 | P4 | P5 | P6 | P7 | P8 |
|---|---|---|---|---|---|---|---|---|---|---|
| FLUX DENSITY (mT) | 92.7 | 93.2 | 90.0 | 69.4 | – | 50.0 | 54.7 | 48.5 | 85.8 | 63.6 |
| CENTER HALF-ANGLE | 345 (−15.0) | 0 | 15.6 | 60.1 | – | 140.6 | 185.7 | 220.7 | 272.3 | 311.5 |
| HALF-WIDTH | 11.6 | 9.7 | 12.1 | 24.3 | – | 26.5 | 25.9 | 20.8 | 27.2 | 19.0 |
| POLE | S | N | S | N | | N | S | N | S | N |

PRIOR ART (30mm)

| | P1 | P2 | P3 | P4 | P5 | P6 | P7 |
|---|---|---|---|---|---|---|---|
| FLUX DENSITY (mT) | 102.3 | 64.6 | – | 61.8 | 54.7 | 46.3 | 79.7 |
| CENTER HALF-ANGLE | 0 | 56.6 | – | 138.7 | 185.0 | 222.6 | 270.9 |
| HALF-WIDTH | 27.8 | 23.3 | – | 23.6 | 23.8 | 26.3 | 24.8 |
| POLE | N | S | | S | N | S | N |

IMAGE FORMING APPARATUS

BACKGROUND OF THE INVENTION

1. Field of the Invention

The present invention relates to a developing device for developing a latent image with a developer to thereby produce a corresponding toner image, an image forming process unit using the developing device, and an image forming apparatus using either one of the developing device and image forming process unit.

2. Description of the Background Art

A copier, printer, facsimile apparatus or similar electrophotographic or electrostatic image forming apparatus generally includes an image carrier implemented as a photoconductive drum or a photoconductive belt. A latent image is formed on the image carrier in accordance with image data. A developing device develops the latent image with a developer to thereby produce a corresponding toner image. Today, a magnet brush type developing system using a two-ingredient type developer, or toner and carrier mixture, is predominant over the other developing systems. The toner and carrier mixture is desirable from transferability, halftone reproducibility, and stability against varying temperature and humidity. In this type of developing system, the developer rises on a developer carrier in the form of brush chains. In a developing region where the developer carrier faces the image carrier, the toner is transferred from the developer to the latent image carried on the image carrier. The brush chains contact the latent image in the developing region.

The developer carrier is usually made up of a hollow, cylindrical sleeve and a magnet roller disposed in the sleeve for forming a magnetic field. Carrier grains rise on the sleeve along magnetic lines of force issuing from the magnet roller. Charged toner grains deposit on the carrier grains, forming a magnet brush. The magnet roller has a plurality of magnetic poles each being implemented by a, e.g., a rod-like magnet. Among them, a main pole adjoins the developing region for causing the developer to form the magnet brush. At least one of the sleeve and magnet roller rotates, conveying the developer risen on the sleeve. In the developing region, the main pole causes the developer to rise along its magnetic lines of force. The brush chains contact the surface of the image carrier while yielding. At this instant, the brush chains rub themselves against the latent image due to a difference in linear velocity between the image carrier and the sleeve, feeding the toner to the latent image.

Japanese Patent Laid-Open Publication No. 7-84439, for example, discloses an image forming apparatus using the above-described developing device and a low-potential system. The low-potential system lowers the charge potential of the image carrier to 400 V or below in order to reduce the electrostatic fatigue of the image carrier ascribable to repeated charging and exposure. This successfully extends the life of the image carrier.

The image carrier is apt to suffer from serious hazard when initially charged. Particularly, in a charging system using, e.g., a scorotron charger, charged particles derived from discharge directly fall on the image carrier, accelerating the deterioration of the image carrier due to ionization. The low-potential system is effective against such an occurrence as well.

Further, it is likely that a potential difference between the image carrier and a casing or similar member adjoining it exceeds a discharge start voltage. Discharge between the image carrier and the member adjoining it would adversely effect image quality. However, when the charge potential of the image carrier is as low as 400 V or below, the above potential difference can be reduced below a value represented by a Patchen's curve, obviating the adverse influence of discharge on image quality.

On the other hand, in the low-potential system, a development potential is lowered along with the charge potential of the image carrier. The development potential refers to the absolute value of a potential difference between the potential of the exposed portion of the image carrier and a bias applied to the developer carrier. It is therefore necessary to increase the developing ability of the developing device, so that target image density is achievable with a development potential lower than conventional. To increase the developing ability, the end of an effective developing electrode, which faces the image carrier, may be brought closer to the surface of the image carrier. Alternatively, the amount of charge to deposit on the toner may be reduced.

A decrease in development potential, however, gives rise to the following problems. The development potential varies due to the variation of the charge potential of the image carrier or that of the quality of light for forming a latent image. When the development potential is lowered, the variance of the potential increases relative to the absolute value of the potential. The amount of charge or the quantity of light varies due to the contamination of a charging member included in a charger or that of optics and varies with respect to time or space. An increase in the variance of the development potential aggravates its influence on image density. As a result, the low-potential system is more likely to lower image density or render image density irregular than the conventional high-potential system.

Particularly, to implement target image density with the low development potential, it is necessary to increase so-called a $\gamma$ value for development. The $\gamma$ value refers to the slope of the rising portion of a development characteristic curve representative of image density varying in accordance with the rise of the development potential. For this purpose, some different methods are available, e.g., one that reduces the electric resistance of magnetic carrier grains, one that increases the dielectric constant of the grains, one that reduces a gap for development, one that increases the linear velocity ratio of the developer carrier to the image carrier, and one that reduces the amount of charge of the toner. However, an increase in $\gamma$ value makes image density more susceptible to the influence of the variation of the development potential, compared to the conventional high-potential system. Moreover, an increase in $\gamma$ value is apt to deposit an excessive amount of toner on the image carrier because the magnet brush contains a sufficient amount of toner. The excessive amount of toner is greater than the minimum amount implementing saturation reflection density after fixation of a toner image on a sheet. Excessive toner deposition is therefore apt to bring about background contamination, toner scattering at the time of transfer, smearing of a line image and other defects.

Japanese Patent Laid-Open Publication No. 2000-305360 teaches a developing device using a toner and carrier mixture and constructed to insure desirable images over the entire density range. For this purpose, the developing device satisfies at a high level a developing condition for increasing image density and a developing condition for implementing a desirable low-contact image.

The key to a high quality, long life image forming apparatus is the extension of the life of the developer and faithful image formation. A developer is subjected to mechanical hazard due to its contact with magnetic grains or a metering member. More specifically, it is likely that an additive coating the individual grain is buried in the grain and lowers the fluidity or the charging ability of the grain. It is therefore extremely difficult to maintain desirable image quality. While the mechanical hazard may be reduced at the time of charging of the developer, this prevents the amount of charge from sufficiently increasing at the time of frictional charging. To form a high-definition image, the difference between the charge and the potential after exposure may be reduced as far as possible while the optics may write a latent image with as low energy as possible. In this case, the precondition is that because the potential contrast decrease, use is made of relatively low-charge toner for increasing the amount of development, i.e., increasing the developing ability.

In the event of image transfer, toner scattering occurs little because the potential of a latent image and that of the background are relatively low. Freeing the image carrier from deterioration is the effective implementation for extending the life of the image carrier. The image carrier is subjected not only to the previously mentioned optical fatigue, but also to serious hazard at the time of initial charging. This is particularly critical when use is made of a scoroton charger, as stated earlier. In light of this, it has been proposed to halve the conventional initial charge of −800 V to −400 V. However, selecting a low potential, i.e., absolutely lowering the charge potential in a negative-to-positive development system simply means lowering the development potential inclusive of the bias condition. It is therefore necessary to increase the developing ability for thereby lowering the saturation development potential. However, the problem is that a low-potential process is susceptible to the variation of the surface potential of the image carrier. This is because the absolute value of the charge potential is originally so low, the influence of irregularity is noticeable.

Technologies relating to the present invention are also disclosed in, e.g., Japanese Patent Laid-Open Publication Nos. 5-19588, 5-19601, 6-102767, 11-295925, 2000-66490 and 2001-60015.

SUMMARY OF THE INVENTION

It is a first object of the present invention to provide a developing device capable of lowering the charge potential of an image carrier to thereby extend the life of the image carrier, reduce the fall of image density and irregular image density ascribable to the variation of a development potential, and obviate excessive toner deposition, an image forming process unit using the developing device, and an image forming apparatus using either one of the developing device and image forming process unit.

It is a second object of the present invention to provide a developing device capable of increasing the developing ability to implement desirable development even when the charge potential of an image carrier is lowered, and reducing background contamination ascribable to toner of opposite polarity even when a difference between a bias for development and the background potential of the image carrier varies over a range of from 0 V to 200 V, an image forming process unit using the developing unit, and an image forming apparatus using either one of the developing device and image forming process unit.

It is a third object of the present invention to provide a developing device capable of lowering the amount of charge of a developer to thereby increase a developing ability while reducing hazard to the developer, reducing the influence of the potential variation of an image carrier, and effecting exposure with a quantity of light having low energy to thereby extend the life of the image carrier, an image forming process unit using the developing unit, and an image forming apparatus using either one of the developing device and image forming process unit.

An image forming apparatus of the present invention includes a bias power supply for applying a bias $V_B$ to a developer carrier on which a developer is deposited. A charge potential deposited on an image carrier, which faces the developer carrier for forming a latent image thereon, is 400 V or below in absolute value. Assume that the potential of the image carrier is lowered to $V_L$ after exposure, that a development potential is $|V_B-V_L|$, that the maximum set value of the development potential for development is $|V_B-V_L|\max$, and that the development potential varies in a range satisfying relations:

$$|V_B-V_L| \leqq |V_B-V_L|\max+|V_B-V_L|\max\times 0.2$$

$$|V_B-V_L| \geqq |V_B-V_L|\max-|V_B-V_L|\max\times 0.2$$

$$|V_B-V_L|\max \leqq 300\ \text{V}$$

Then image density varies by a width of 10% of image density corresponding to the maximum set value of the development potential or less.

BRIEF DESCRIPTION OF THE DRAWINGS

The above and other objects, features and advantages of the present invention will become more apparent from the following detailed description taken with the accompanying drawings in which:

FIG. 10 is a table comparing an example of the first embodiment and comparative examples with respect to the mean amount of charge of toner and a gap for development;

FIG. 14 is a table comparing examples of the first embodiment and a comparative example with respect to a drive torque for development and the amount of charge of toner;

FIG. 24 is a table comparing examples of the second embodiment and a comparative example with respect to the amount of charge of toner and the resistance of a developing roller;

FIG. 31 is a table comparing the third embodiment and a conventional developing device as to the amount of charge of toner fed and that of toner forming a thin layer;

FIG. 38 is a table comparing an example of the fourth embodiment and comparative examples with respect to a γ characteristic curve;

FIG. 53 is a table listing frequencies (numbers of grains) determined with different kinds of toner at consecutive channels in a ninth embodiment of the present invention;

FIG. 56 is a table listing the property of a sheet used for the measurement of FIG. 55;

FIG. 74 is a table showing a relation between the drive torque for development and the toner charging force;

FIG. 76 is a table comparing a magnet roller of the tenth embodiment and a conventional magnet roller with respect to magnetic flux density;

FIG. 85 is a table comparing a magnet roller of the illustrative embodiment and a conventional magnet roller with respect to magnetic flux density.

DESCRIPTION OF THE PREFERRED EMBODIMENTS

Preferred embodiments of the image forming apparatus in accordance with the present invention will be described hereinafter.

First Embodiment

Figure 1:
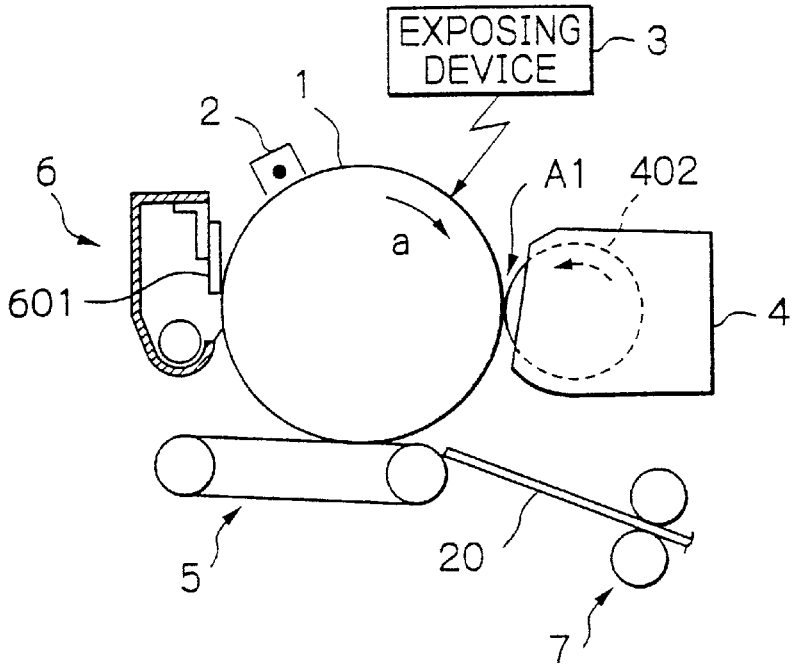
FIG. 1 is a view showing a first embodiment of the image forming apparatus in accordance with the present invention and implemented as a printer by way of example.

Referring to FIG. 1 of the drawings, an image forming apparatus embodying the present invention and mainly directed toward the first object stated earlier will be described. This embodiment is implemented as an electrophotographic laser printer by way of example. As shown, the laser printer includes an image carrier implemented as a photoconductive drum 1. Arranged around the drum 1 are a charger 2, an exposing device 3, a developing device 4 using a toner and carrier mixture, an image transferring device 5, and a cleaning device 6.

The charger 2 uniformly charges the surface of the drum 1 to preselected polarity. The exposing device 3 scans the charged surface of the drum 1 with a laser beam in accordance with image data, thereby forming a latent image on the drum 1. The developing device 4 includes a developing roller 420 and develops the latent image with charged toner deposited on the sleeve 402 to thereby form a corresponding toner image. The image transferring device or image transferring means 5 transfers the toner image from the drum 1 to a sheet or recording medium 20. The cleaning device 6 removes the toner left on the drum 1 after the image transfer. The charger 2 and exposing device 3 constitute latent image forming means. The sheet 20 is fed from a sheet tray, not shown, by a conveying device not shown. A fixing device, not shown, fixes the toner image transferred to the sheet 20.

Figure 2:
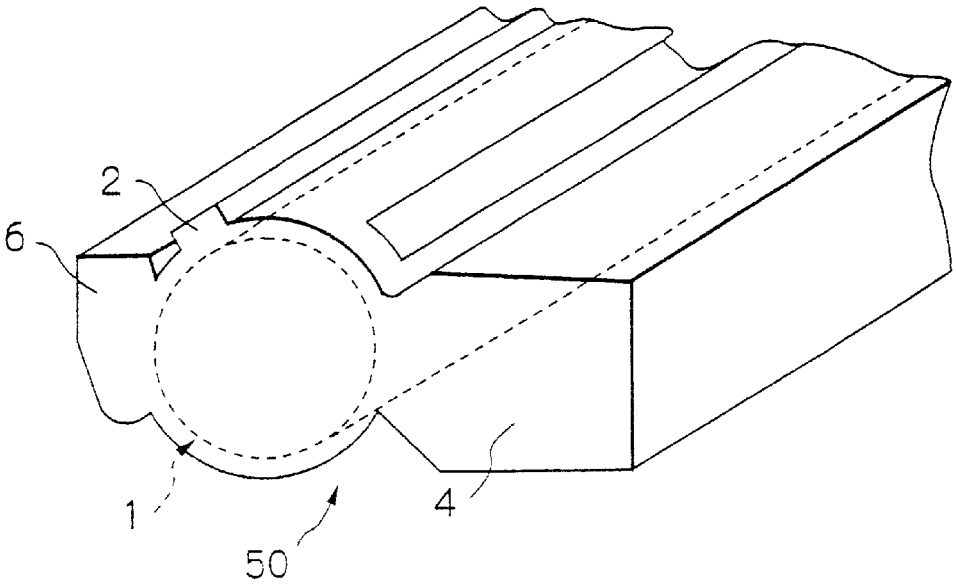
FIG. 2 is a fragmentary isometric view showing a process cartridge applicable to the first embodiment.

Part of the plurality of devices constituting the printer may be constructed into a single process unit or process cartridge removably mounted to the printer body. FIG. 2 shows a specific configuration of the process cartridge that includes the drum 1, charger 2, developing device 4, and cleaning device 6. The process cartridge allows, e.g., the drum 1 to be replaced independently of the other components. Particularly, when the process cartridge does not include the developing device 4, the drum 1 and developing device 4 different in service life from each other can be easily replaced independently of each other. Further, the developing roller 420 can be released from the drum 1 when development is not effected. This reduces toner filming on the sleeve 402 for thereby further extending the life of the developing device 4.

In operation, the charger 2 uniformly charges the surface of the drum 1, which is rotating in a direction indicated by an arrow a, to a preselected charge potential, i.e., 400 V or below in absolute value. The exposing device 3 scans the charged surface of the drum 1 with a laser beam in accordance with image data in the axial direction of the drum 1, thereby forming a latent image on the drum 1. When the drum 1 in rotation conveys the toner image to a developing region A1, the developing device 4 develops the latent image with charged toner to thereby produce a corresponding toner image. The conveying device conveys the sheet 20 to a registration roller pair 7. The registration roller pair 7 once stops the sheet 20 and then drives it at a preselected timing toward an image transfer position where the drum 1 and image transferring device 5 face each other. The image transferring device 5 applies a charge opposite in polarity to the toner image to the sheet 20. As a result, the toner image is transferred from the drum 1 to the sheet 20. The sheet 20 with the toner image is peeled off the drum 1 and fed to the fixing device, so that the toner image is fixed on the sheet 20. The sheet 20 is then driven out of the printer body. The cleaning device 6 cleans the surface of the drum 1 after the image transfer for thereby removing the toner left thereon.

Figure 3:
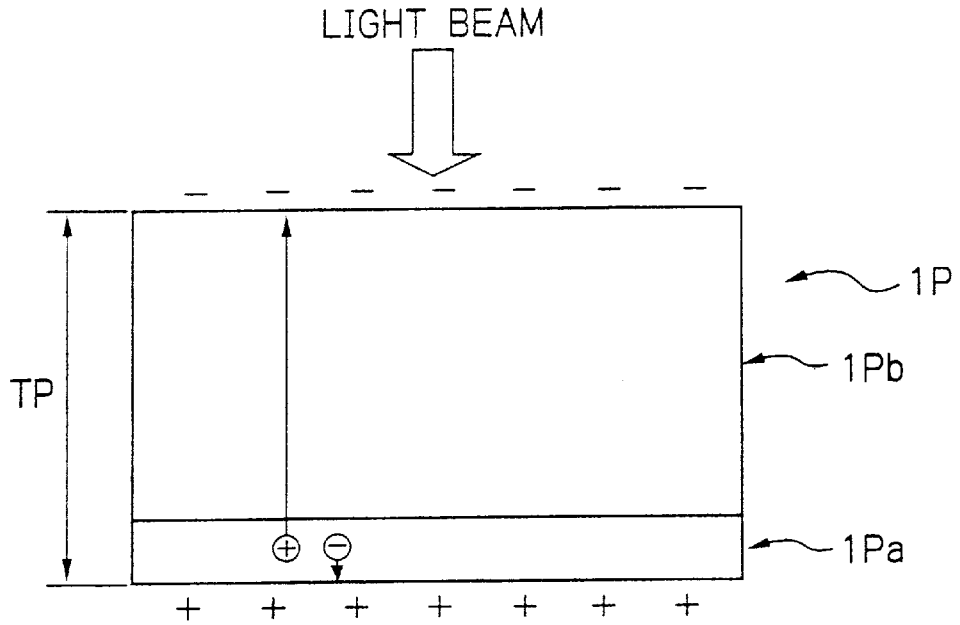
FIG. 3 is a section showing a photoconductive layer forming part of a photoconductive drum included in the first embodiment.

As shown in FIG. 3 in detail, the drum 1 is made up of an aluminum tube or similar conductive base, not shown, and a photoconductive layer 1P formed on the base. To form the photoconductive layer 1P, an organic or an inorganic photoconductor is coated on the base. The photoconductive layer 1P has a charge generating layer 1Pa and a charge transporting layer 1Pb. The charger 2 uniformly charges the surface of the photoconductive layer 1P to negative polarity. If desired, the image carrier may be implemented as a photoconductive belt made up of a relatively thin belt formed of polyethylene terephthalate (PET), polyethylene naphthalate (PEN) or nickel and a photoconductive layer formed on the belt. Also, the charger 2 may charge the photoconductive layer 1P to positive polarity, if necessary in consideration of, e.g., the chargeability of the toner.

Figure 4:
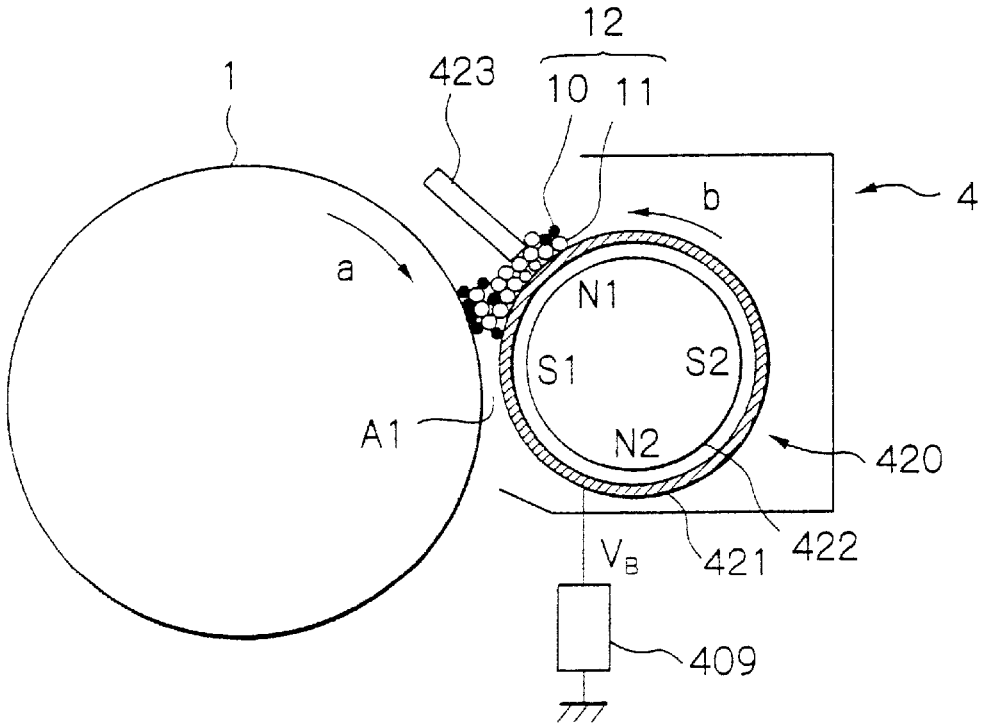
FIG. 4 is a view showing a developing device included in the first embodiment.

FIG. 4 shows a specific configuration of the developing device 4. As shown, the developing device 4 includes a casing 401 formed with an opening facing the drum 1. The developing roller or toner carrier 420 is accommodated in the casing 401 and partly exposed to the outside via the above opening. The developing roller 420 is made up of a sleeve 421 and a magnet roller 422 disposed in the sleeve 421. The casing 401 stores a two-ingredient type developer 12, i.e., a mixture of toner 10 and carrier or magnetic grains 11. An agitator, not shown, the rotation of the sleeve 421 and the magnetic force of the magnet roller 422 cooperate to agitate the developer 12. At this instant, friction acting between the toner 10 and the carrier 11 charges the toner 10 and causes part of the developer 12 to deposit on the sleeve 421. The sleeve 421 conveys the developer 12 toward the developing region A1 via a doctor or metering member 423. The doctor 423 regulates the thickness or amount of the developer 12. Part of the developer 12 blocked by the doctor 423 is returned to the casing 401. At the developing region A1, the toner 10 of the developer 12 is transferred to the drum 1 by an electric field formed between the developing roller 420 and the drum 1, developing the latent image.

The magnet roller 422 is held stationary inside the sleeve 421 and has a plurality of magnetic poles. The magnet roller 422 exerts a magnetic force on the developer 12 when the developer 12 on the sleeve 421 passes a preselected position. The developing roller 420 should preferably have a diameter of 10 mm to 30 mm. The surface of the developing roller 420 should preferably have surface roughness (ten-point mean roughness) ranging from 10 $\mu$m RZ to 20 $\mu$m RZ. For this purpose, the surface of the developing roller 420 may be roughened by sand-blast or formed with a plurality of grooves that are 1 mm to several millimeters deep each.

A drive source, not shown, causes the sleeve 421 to rotate in a direction indicated by an arrow b in FIG. 4. A bias power supply 409 is connected to the sleeve 421 in order to apply a bias voltage $V_B$ for development to the sleeve 421. The bias voltage $V_B$ forms an electric field in the developing region A1.

The magnet roller 422 has four poles N1 (N pole), S1 (S pole), N2 (N pole) and S2 (S pole) as named from the position where the doctor 423 is positioned in the direction b. However, such an arrangement of magnetic poles is only illustrative and maybe changed in accordance with, e.g., the position of the doctor 423. While the sleeve 421 rotates around the stationary magnet roller 422 in the illustrative embodiment, the latter may rotate around the former, if desired.

The magnet roller 422 causes the developer 12 to form a magnet brush on the sleeve 421. In the magnet brush, the toner 10 is mixed with the carrier or magnetic grains 11 and charged to a preselected amount thereby. The preselected amount of charge should preferably be between −10 $\mu$C/g and −30 $\mu$C/g.

In the illustrative embodiment, a doctor gap between the doctor 423 and the sleeve 421, as measured at the position where they are closest to each other, is selected to be 500 $\mu$m. The pole N1 is inclined by several degrees from the position where the doctor 423 and the sleeve 421 face each other toward the upstream side in the direction b. In this configuration, the circulation of the developer 12 in the casing 402 is facilitated. The inclination of the pole N1 should preferably be between 0 degree and 15 degrees.

In an example of the illustrative embodiment, the drum 1 had a diameter of 50 mm and was moved at a linear velocity of 200 mm/sec. The sleeve 421 had a diameter of 18 mm and was moved at a linear velocity of 240 mm/sec. The toner on the sleeve 421 was charged to −10 $\mu$C/g to −25 $\mu$C/g. A gap GP for development between the drum 1 and the sleeve 42 was selected to be 0.8 mm to 0.4 mm, which was smaller than a conventional gap, in order to enhance developing efficiency.

The toner 10 is implemented by polyester, polyol, styrene-acryl or similar resin to which a charge control agent (CCA) and a colorant are added. Silica, titanium oxide or similar additive is coated on the grains of the toner 10 for enhancing fluidity. The additive usually has a grain size of 0.1 $\mu$m to 1.5 $\mu$m. The colorant may be implemented by carbon black, phthalocyanine Blue or quinacridone by way of example. Alternatively, for the toner 10, use may be made of mother toner grains with, e.g., wax dispersed therein and on which the above additive is coated.

Further, the toner grains 10 may be implemented as magnetic toner grains containing a magnetic substance. The magnetic substance may be selected from a group of iron oxides including magnetite, hematite and ferrite, a group of metals including cobalt and nickel, a group of alloys of such metals and aluminum, copper, lead, magnesium, tin, zinc, antimony, berrylium, bismuth, cadmium, calcium, manganese, selenium, titanium, tungsten, vanadium and other metals, and mixtures thereof. The magnetic substance should preferably have a mean grain size of 0.1 $\mu$m to 2 $\mu$m and should preferably be contained by 20 parts by mass to 200 parts by mass, more preferably 40 parts by mass 150 parts by mass, in 100 parts by mass of binding resin.

The additive may be any one of oxides or composite oxides of Si, Ti, Al, Mg, Ca, Sr, Ba, In, Ga, Ni, Mn, W, Fe, Co, Zn, Cr, Mo, Cu, Ag, V and Zr. Among then, silica, titania and alumina that are the oxides of Si, Ti and Al, respectively, are desirable. Further, the additive should preferably be applied by 0.5 parts by mass to 1.8 parts by mass to 100 parts by mass of mother grains. Amounts less than 0.5 parts by mass lower the fluidity of the toner and thereby deteriorate chargeability of the toner. Moreover, such short amounts make image transferability and heat resistance short and bring about background contamination and toner scattering.

On the other hand, the amounts of the additive above 1.8 parts by mass bring about the turn-up of a blade and other defective drum cleaning and the filming of the additive separated from the toner on the drum 1 although they enhance fluidity. As a result, the durability of a cleaning blade and that of the drum 1 are lowered to degrade fixation. Furthermore, the toner is apt to scatter at thin line images. This is particularly true in a full-color image in which at least two different colors of toner are superposed on each other and therefore in a great amount. Moreover, in the case of color toner, a great amount of additive darkens an image projected by an overhead projector.

While various methods are available for measuring the amount of the additive, X-ray fluorescence analysis is predominant.

In the illustrative embodiment, the additive should preferably be subjected to surface treatment for enhancing hydrophobicity and fluidity and effecting charge control. Surface treatment should preferably use an organic silane compound, e.g., methyl trichlorosilane, octyl trichlorosilane, dimethyl chlorosilane or similar alkyl chlorosilane, dimethyl dimethoxysilane, octyl trimethoxysilane or similar alkyl methoxysilane, hexamethyl disilazane, or silicone oil. For surface treatment, the additive may be immersed in a solution containing the organic silane compound and then dried. Alternatively, such a solution may be sprayed onto the additive and then dried. The illustrative embodiment is desirably practicable with either one of such methods.

The toner 10 has a volume mean particle size preferably ranging from 3 $\mu$m to 12 $\mu$m. In the illustrative embodiment, the volume mean particle size is selected to be 6 $\mu$m and can sufficiently adapt even to resolution as high as 1,200 dpi (dots per inch) or above. While the toner 10 of the illustrative embodiment is chargeable to negative polarity, it may be of the type chargeable to positive polarity in consideration of the polarity of the drum 1.

To measure the grain size and charge distribution of the toner 10, use was made of an analyzer E-SPART ANALYZER available from HOSOKAWA MICRON CORP. The analyzer uses a double beam, frequency transition type of laser Doppler speedometer and an elastic wave that perturbs grains in an electric field. By blowing off the toner deposited on the developing roller 420 with air, the analyzer grasps the movement of the toner in an electric field to thereby output data representative of the grain size and charge of the individual toner grain.

The carrier or magnetic grains 11 each are implemented by ferrite or similar magnetic substance as a core and coated with, e.g., silicone resin. The carrier 11 has a grain size preferably between 20 $\mu$m and 50 $\mu$m and electric resistance preferably between $10^4\Omega$ and $10^6\Omega$ in terms of dynamic resistance DR.

Figure 5:
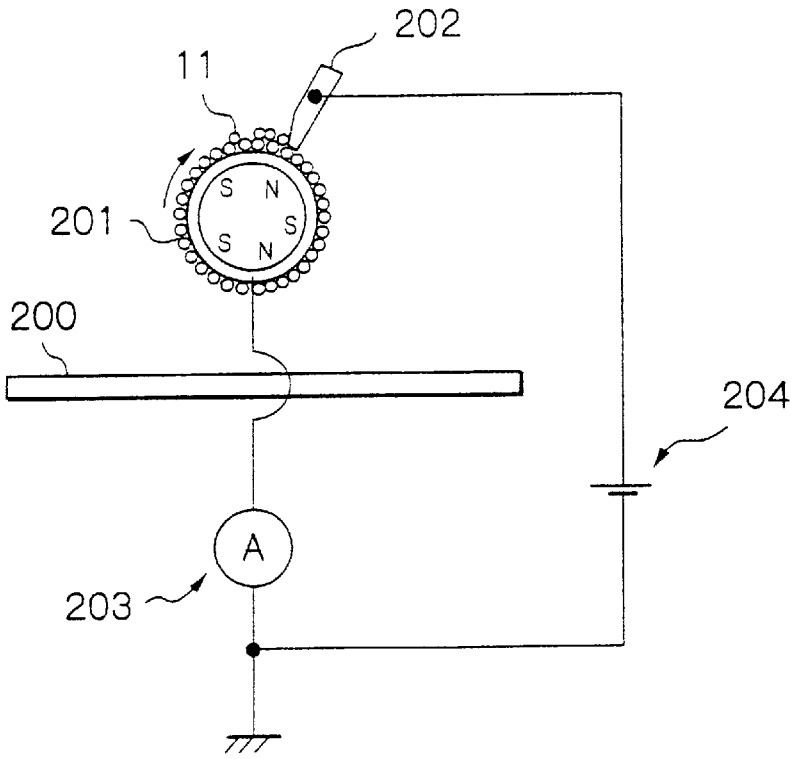
FIG. 5 is a view showing a specific arrangement for measuring the dynamic resistance of magnetic grains.

FIG. 5 shows a specific device used to measure the dynamic resistance of the magnetic grains 11. As shown, a rotatable sleeve 201 having a diameter of 20 mm and accommodating stationary magnets at preselected positions is set above a base 200, which is connected to ground. A an electrode (doctor) 202 faces the sleeve 201 with a gap g of 0.9 mm over a width W of 65 mm and a length L of 0.5 mm to 1 mm. In this condition, the sleeve 201 is rotated at a speed of 600 rpm (revolutions per minute) (linear velocity of 628 mm/sec). A preselected amount (14 g) of magnetic grains to be measured is deposited on the sleeve 201 being rotated and agitated for 10 minutes by the rotation of the sleeve 201. While no voltage is applied to the sleeve 201, an ammeter 203 measures a current Ioff (A) flowing between the sleeve 201 and the electrode 202. Subsequently, a voltage E (V) of the upper limit level as to breakdown voltage is applied from a DC power supply 204 to the sleeve 201 for 5 minutes. The upper limit is 400 V in the case of a high resistance, silicone-coated carrier or several volts in the case of an iron carrier. The ammeter 203 measures the resulting current Ion (A) flowing between the sleeve 201 and the electrode 202. By using the results of measurement, the dynamic resistance DR (Ω) is produced by:

$$DR=E/(\text{Ion}-\text{Ioff}) \quad (1)$$

Figure 6:
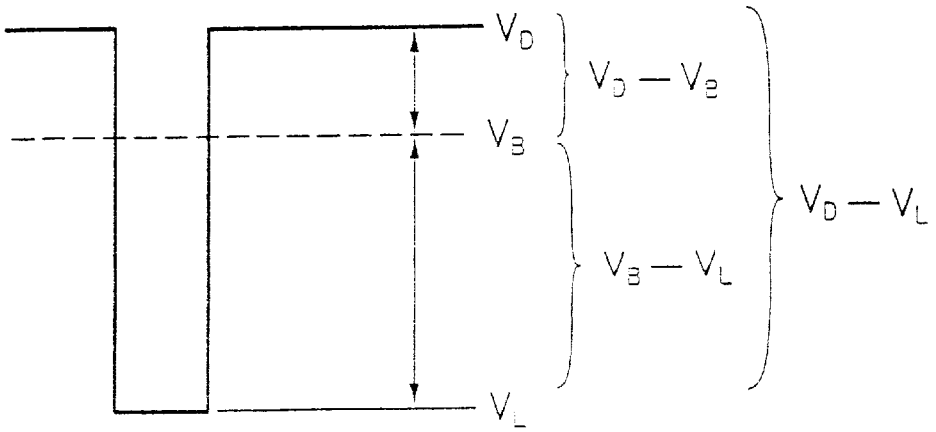
FIG. 6 shows a relation between various potentials to appear in the first embodiment.

FIG. 6 shows a relation between the surface potential of the drum 1 and the bias for development, as measured at the developing region A1. In FIG. 6, $V_D$ and $V_L$ respectively indicate a charge potential before exposure and a charge potential after exposure while $V_B$ indicates a bias voltage. The absolute value of $V_D-V_L$ is representative of an exposure potential, i.e., a difference between the potentials before and after development. The absolute value of $V_B-V_L$ is representative of a development potential, i.e., a substantial difference in development potential in the developing region A1. Further, the absolute value of $V_D-V_B$ is representative of background potential, i.e., a potential difference between the background (unexposed portion) and the bias for development.

As for negative-to-positive development, the absolute value $|V_B|$ of the bias $V_B$ is selected to be smaller than the absolute value $|V_D|$ of the charge potential $V_D$ so as not to develop the background. In addition, the background potential $|V_D-V_B|$ is selected to be lower than at least the development potential $|V_B-V_L|$, so that image density and background contamination can be balanced.

The three different potentials stated above effect image density, which is one of final image characteristics, and are therefore parameters particularly important when the various conditions of the developing process are set.

Figure 7:
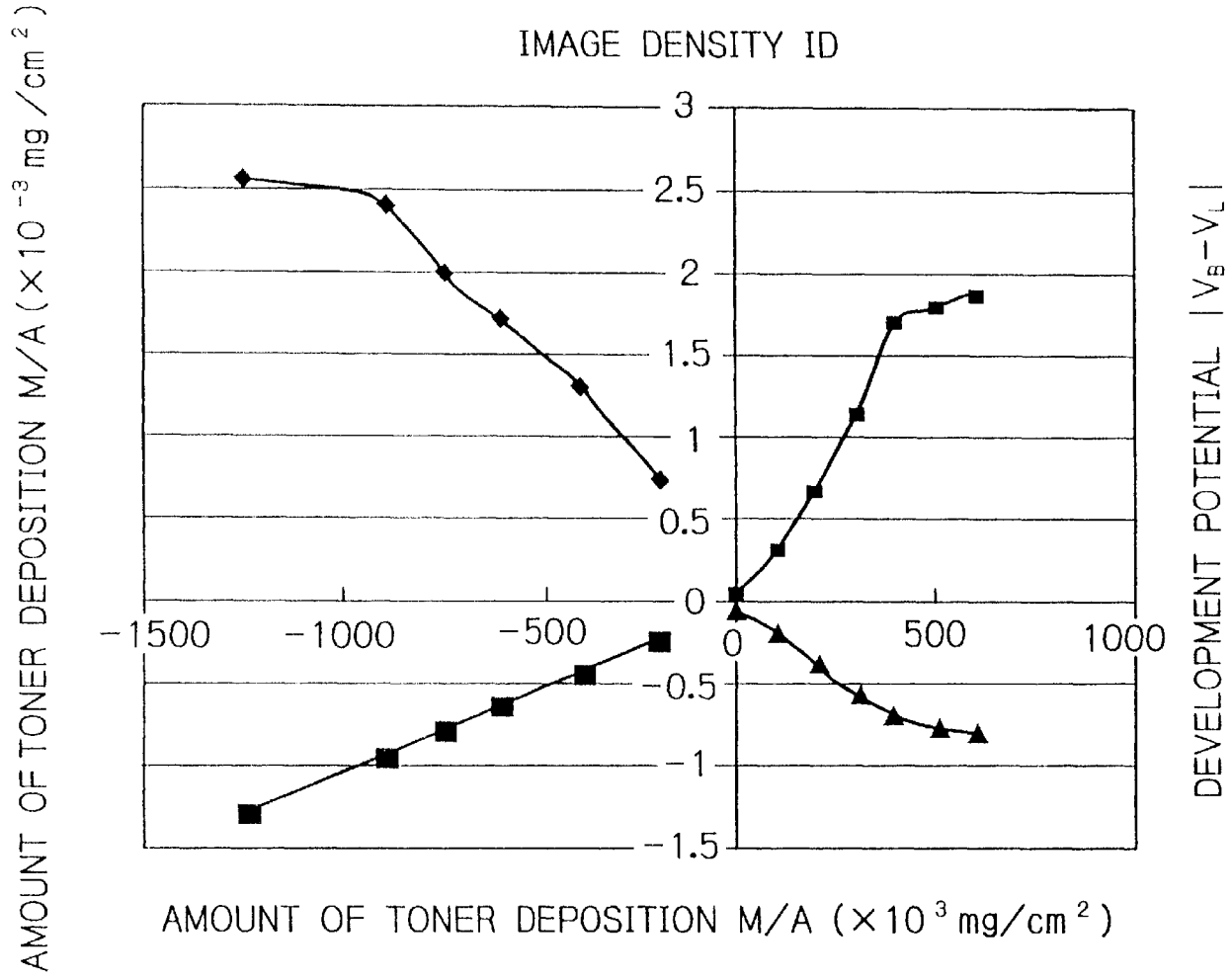
FIG. 7 is a chart representative of the developing characteristics of the first embodiment.

FIG. 7 is a quadrant chart including the first to the fourth quadrant. As shown, the first quadrant shows a relation between the development potential and the image density ID. The second quadrant shows a relation between the amount of toner deposition and the image density ID; the coloring degree of the toner is a decisive factor. More specifically, although the relation in the second quadrant is substantially linear as to characteristic, the amount of toner deposition implementing preselected image density is noticeably effected by the coloring degree. The third quadrant shows the amount of toner deposition. The fourth quadrant shows a relation between the development potential and the amount of toner deposition. More specifically, the fourth quadrant shows a relation of the amount of toner deposition to the development potential generally referred to as an m—ID characteristic.

As the curve in the first quadrant indicates, when development potential is determined, image density ID is unconditionally determined; a change in development potential results in a change in image density ID. In the actual image forming process, a change in development potential is ascribable to, e.g., a change in the charge potential of the drum charged by the charger, an increase in the potential $V_L$ after development ascribable to the optical fatigue of the drum (apparent decrease in sensitivity), a change in the amount of exposure, a change in the bias for development, and irregular density in a single image. Particularly, image density is highest in the region around the maximum development potential $|V_B-V_L|\max$ ($\leqq$300 V) particular to the illustrative embodiment, so that a change in image density ID directly translates into a change in maximum image density. In an image forming apparatus, a change in maximum image density is critical because it lowers image quality, and has noticeable influence on irregular image density as well.

In light of the above, the illustrative embodiment selects developing conditions such that when the developing potential $|V_B-V_L|$ varies over a range satisfying the following relations (2) through (4) or relations (5) through (7), image density ID does not vary by more than 10% of the target, maximum image density:

$$|V_B-V_L|\leqq|B_V-V_L|\max+|V_B-V_L|\max\times0.2 \quad (2)$$

$$|V_B-V_L|\geqq|V_B-V_L|\max-|V_B-V_L|\max\times0.2 \quad (3)$$

$$|V_B-V_L|\max\leqq300\text{ V} \quad (4)$$

$$|V_B-V_L| \leqq |V_B-V_L|\max+50\ \text{V} \quad (5)$$

$$|V_B-V_L| \geqq |V_B-V_L|\max-50\ \text{V} \quad (6)$$

$$|V_B-V_L|\max \leqq 300\ \text{V} \quad (7)$$

Figure 8:
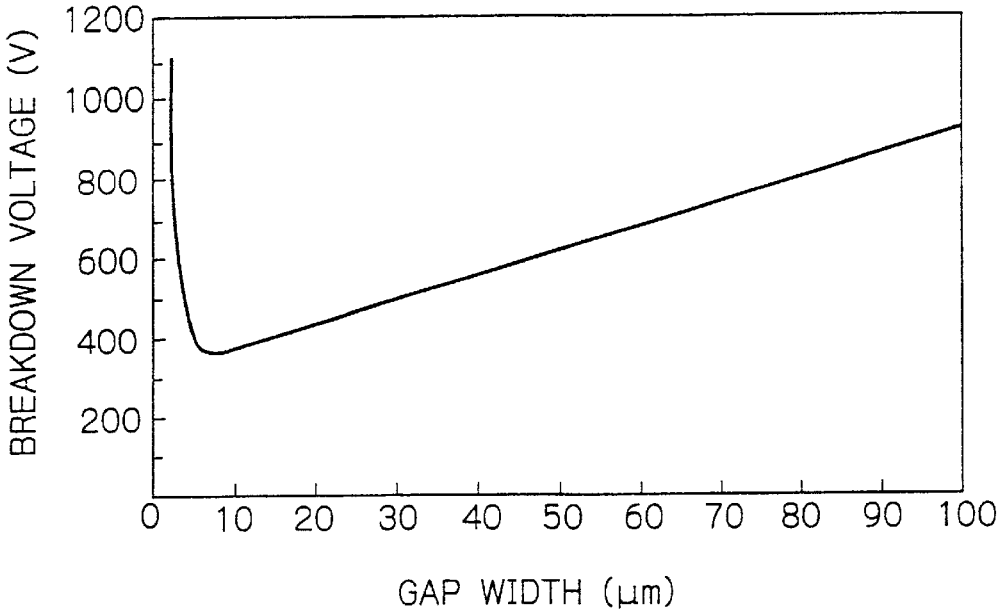
FIG. 8 is a graph showing Paschen's law.

In the illustrative embodiment, the charge potentials $V_D$ and $V_L$ of the drum 1 before and after exposure, respectively, are selected to be −350 V and −50 V by way of example. Also, the bias $V_B$ for development is selected to be −300 V. Further, the maximum value $|V_B-V_L|$max of the development potential is selected to be 250 V. In this case, Paschen's law shown in FIG. 8 is used to set the development potential $|V_D-V_L|$=300 V in order to avoid discharge between the exposed portion and the unexposed portion of the drum.

Image density ID is representative of reflection density reflected from an image developed, transferred and then fixed on a sheet. Image density ID is calculated by −log (X/Xm) where X and Xm respectively denote a quantity of light reflected from an image and a quantity of light reflected from background.

Figure 9:
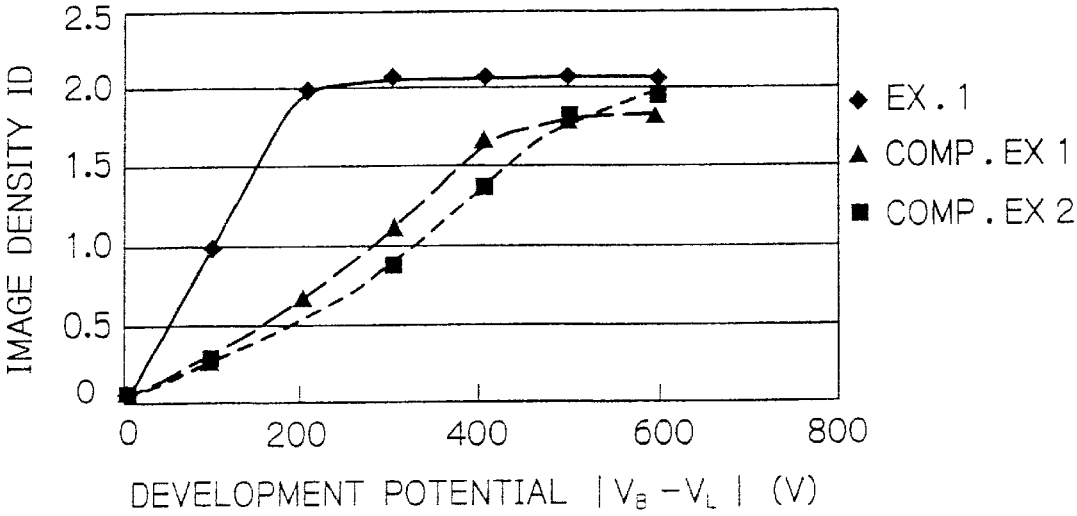
FIG. 9 is a graph showing a relation between the development potential and the image density particular to the first embodiment.

FIG. 9 show curves comparing the illustrative embodiment and comparative examples 1 and 2 with respect to the relation between the development potential $|V_B-V_L|$ and the image density ID. In the illustrative embodiment the maximum development potential $|V_B-V_L|$max is 250 V. FIG. 10 shows the mean amount of charge and development gap of the illustrative embodiment and those of the comparative examples 1 and 2. As shown, the illustrative embodiment has a lower amount of charge and a lower gap for development than the comparative examples 1 and 2.

As FIG. 9 indicates, in the illustrative embodiment, the image density ID is 2.0 when the development potential is 200 V or 2.1 when it is 250 V or 2.15 when it is 300 V. Image density ID varies by 0.15 so long as the development potential lies in the previously stated preselected range (200 V to 300V). The variation of image density ID is therefore less than 10% (=0.21) of the image density ID (2.1) corresponding to the maximum developing potential of $|V_B-V_L|$max=250 V. Stated another way, so long as the development potential lies in the preselected range (200 V to 300 V), the variation of image density ID lies in the range of ±0.1 of the image density ID (2.1) corresponding to the above maximum development potential (2.00 to 2.2), which appears to be an irregular image to eye.

It follows that even when the development potential varies by about 50 V, the fall of image density ID and irregular image density are not conspicuous because the variation image density ID lies in the particular range stated above. Actual estimation showed that images suffered from irregular image density variation little.

By contrast, in both of the comparative example 1 using a broad gap for development and comparative example 2 using a great amount of toner charge, the developing characteristic curve representative of the degree of variation of image density ID relative to the development potential has a small slope. The above curve therefore is not sufficiently close to saturation at the maximum development potential $|V_B-V_L|$max, causing image density to easily vary. This is why image density ID of the example 1 is 0.7 when the development potential is 200 V or 1.0 when it is 250 V or 1.2 when it is 300 V within the preselected range of development potential (200 V to 300 V). The image density ID of the example 1 varies by 0.5 that is greater than 10% (=0.1) of the image density ID (1.0) corresponding to the maximum development potential $|V_B-V_L|$max=250 V. Likewise, the image density ID of the example 2 is 0.55 when the developing potential is 200 V or 0.75 when it is 250 V or 0.9 when it is 300 V; the variation is 0.45 that is greater than 10% (=0.075) of the image density ID (0.75) corresponding to the maximum development potential $|V_B-V_L|$max=250 V.

In the examples 1 and 2, when the development potential varies by about 50 V, image density ID noticeably varies. As a result the fall of image density ID and irregular image density become conspicuous and lower image quality, as determined by experiments.

As stated above, the illustrative embodiment provides the drum 1 with a charge potential whose absolute value is 400 V or below. This successfully reduces the fatigue of the photoconductive layer of the drum 1 ascribable to repeated charging and exposure and thereby extends the life of the drum 1. Further, there can be reduced the fall of image density and irregular image density ascribable to the variation of the development potential $|V_B-V_L|$.

In the illustrative embodiment, the toner should preferably be implemented as spherical grains having sphericity (SF index) of 95% or above, as measured by a projection method. Such toner may be produced by causing it to contain polyester modified by polymerization or urea bond at least as a toner binder. The additive can cover toner having high sphericity with a high coating ratio.

Figure 11:
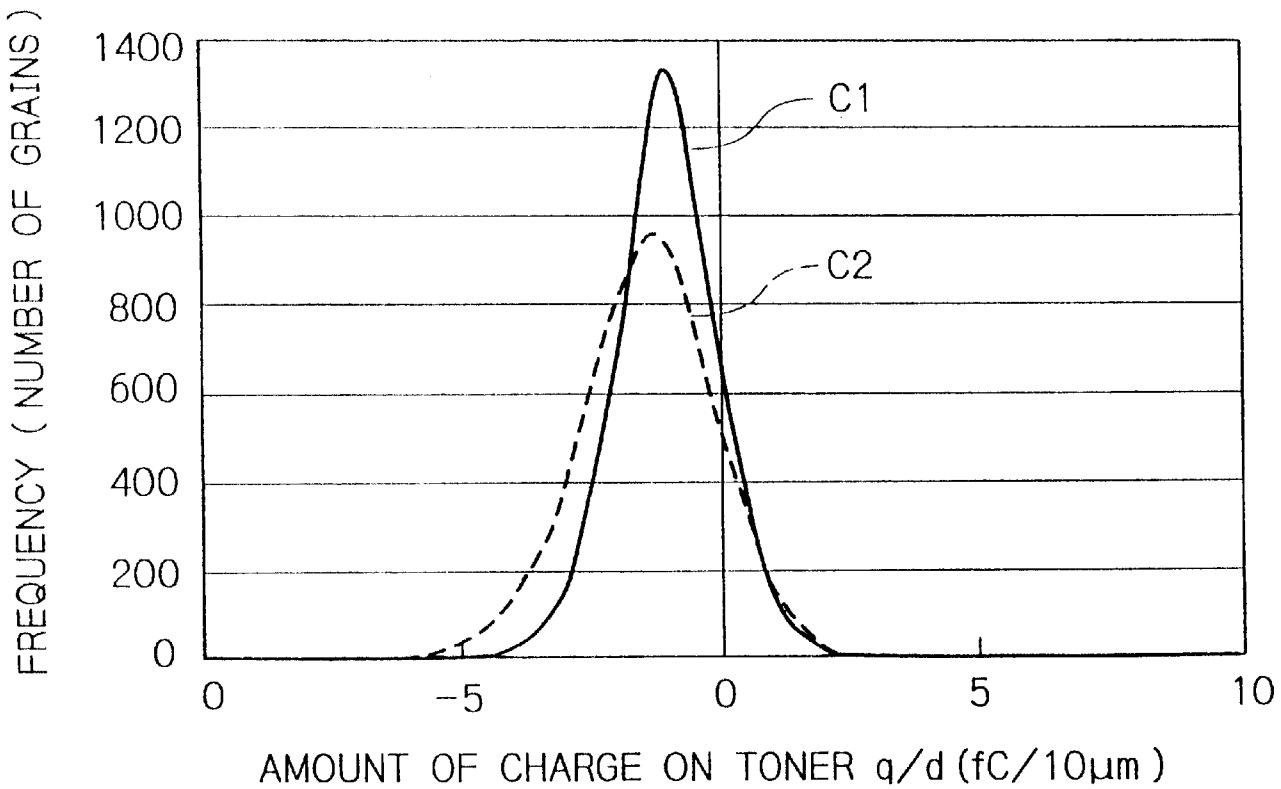
FIG. 11 is a graph showing the distribution of toner grains with respect to the amount of charge deposited on the toner grains.

FIG. 11 shows a relation between the toner charge amount and the toner number distribution determined when the spherical toner with a mean particle size of 6 μm stated above was deposited on the developing roller 420. In FIG. 11, curves C1 and C2 respectively relate to the spherical toner and comparative toner that is conventional. As shown, the curve C1 has a sharper profile than the curve C2; the profile of the curve C1 had a half-width of 1.7 (fC/10 μm)

The data shown in FIG. 11 was obtained with the previously mentioned analyzer E-SPART ANALYZER. If the charge of the toner is uniform throughout the grains, then the amount of charge is proportional to the third power of the grain size. In practice, however, the amount of charge is proportional to the grain size of toner itself. FIG. 11 therefore plots the number of toner grains in terms of a value produced by dividing the amount of charge q by the grain size d, i.e., a ratio q/d free from the influence of the grain size.

Figure 12:
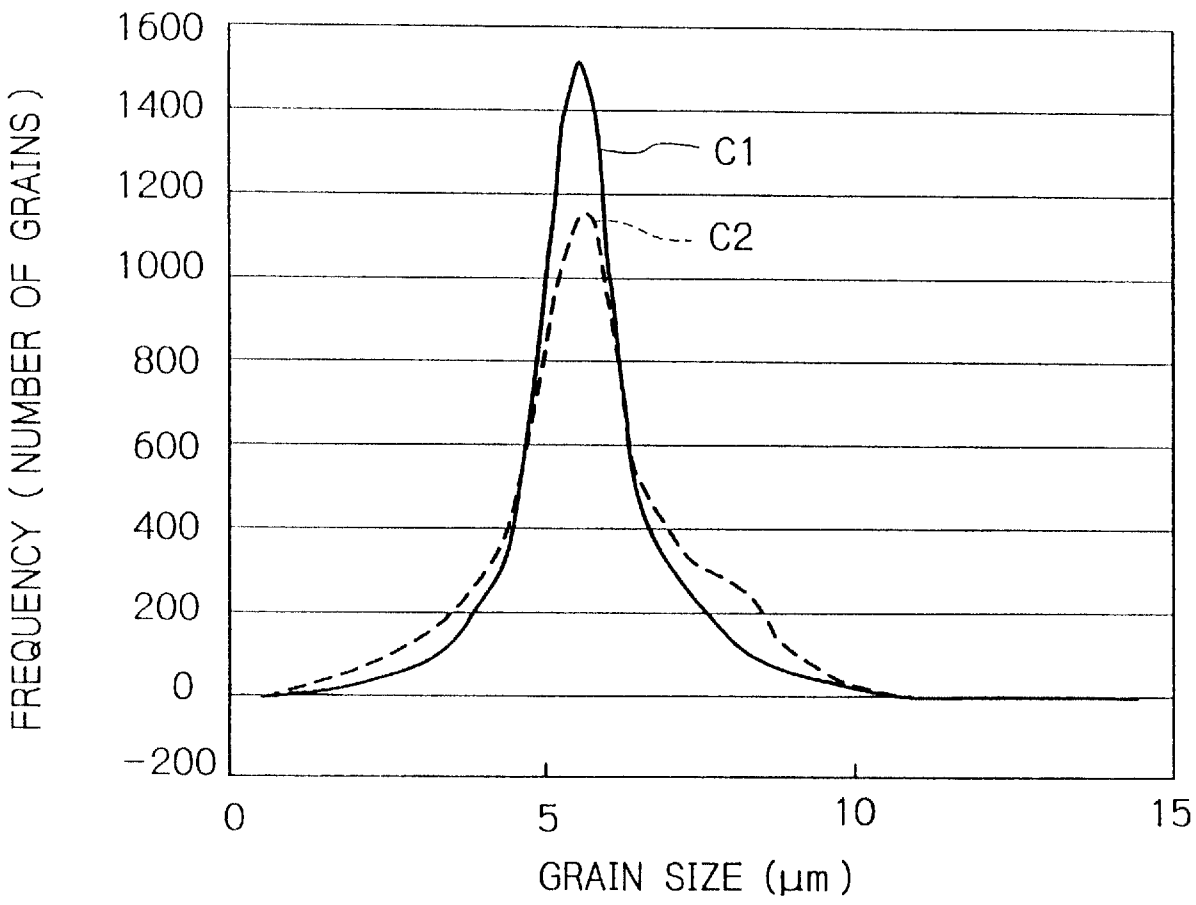
FIG. 12 is a graph showing the distribution of the number of toner grains with respect to the size of the same.

FIG. 12 shows a relation between the grain size of toner and the toner number distribution determined when the spherical toner with a mean particle size of 6 μm stated above was deposited on the developing roller 420. In FIG. 11, curves C1 and C2 respectively relate to the spherical toner and comparative toner that is conventional. As shown, the curve C1 also has a shaper profile than the curve C2. Again, the data shown in FIG. 12 was obtained with E-SPART ANALYZER.

Generally, the sharpness of the number distribution profiles shown in FIGS. 11 and 12 are represented by a half-width each; the smaller the half-width, the sharper the profile. Usually, when the profile becomes sharper, a greater amount of toner grains whose ratio q/d is close to the mean value is available. This provides the individual toner grains with substantially the same developing ability and therefore implements uniform development. By contrast, when the number distribution profile broadens, the range of the amount of charge to deposit on the toner also broadens, causing the developing ability of the individual toner grains to vary over a broad range. This causes the amount of development to vary and, if the number of toner with short charge increase, aggravates background contamination. As for aging, the spherical toner varying in charge amount over a minimum of range did not brought about background contamination even after 200,000 prints were output. The conventional toner made background contamination conspicuous when 140,000 prints were output.

Further, when 150,000 prints were output, the half-width of the number distribution profile particular to the spherical toner was 1.9 (fC/10 μm), i.e., it varied from the initial half-width of 1.7 (fC/10 μm) little. On the other hand, the half-width of the number distribution profile particular to the conventional toner was initially 2.7 (fC/10 μm) and varied to 3 (fC/10 μm) when 150,000 prints were output. Assume that the agitator of the developing device agitates the developer or that the toner on the drum surface is nipped between the cleaning blade and the drum 1 during cleaning. Then, pressure acting on the toner is apt to smash the toner. This presumably increase the ratio of toner grains smaller than toner grains of mean size or causes the small toner grains to deposit on the other toner grains, resulting in toner grains of large size and therefore broadening the number distribution profile.

Figure 13:
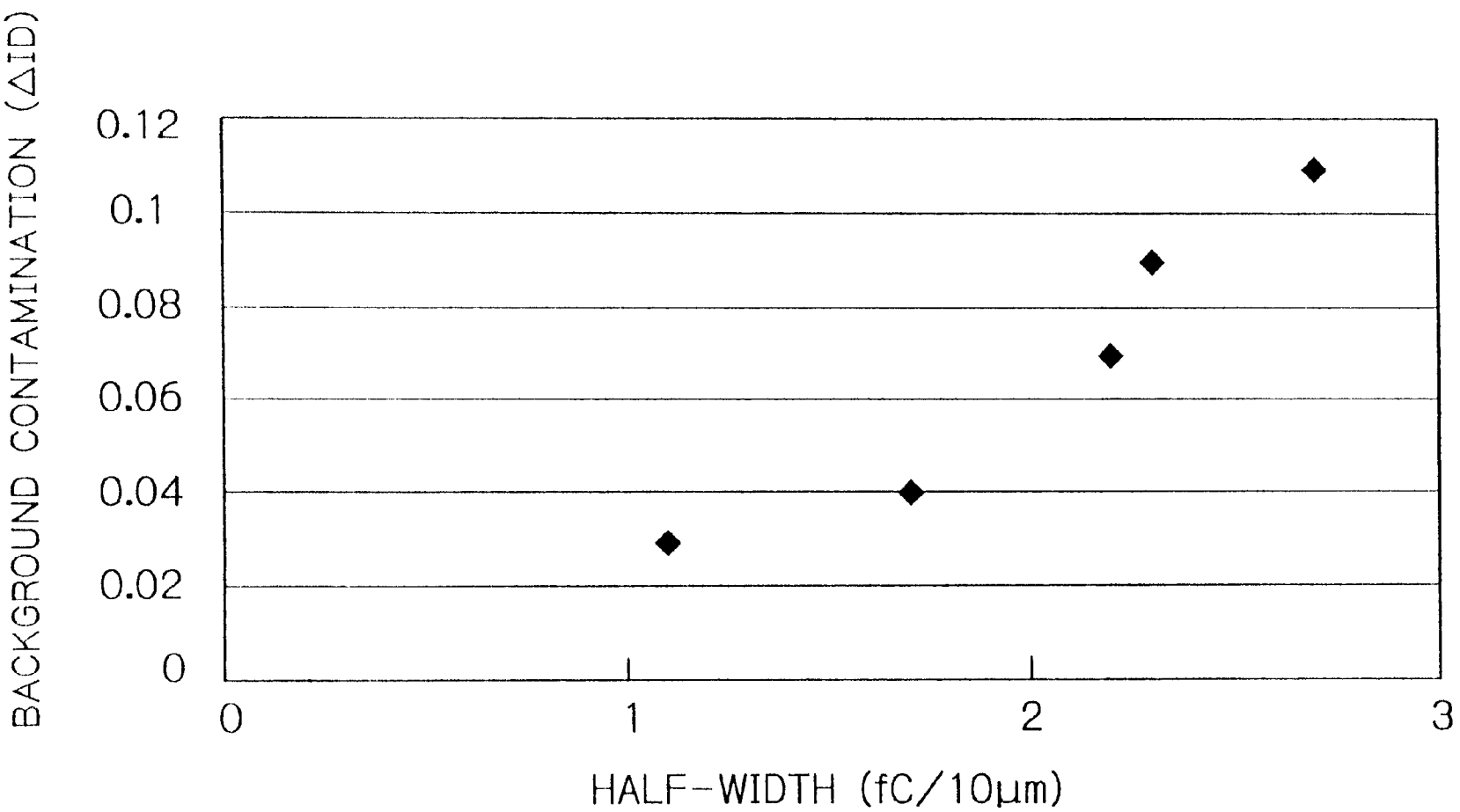
FIG. 13 is a graph showing a relation between the half-width of the half-width of the grain number profile with respect to the amount of charge and the background contamination.

FIG. 13 shows a relation between the half-width of the number distribution profile of the ratio q/d and the background contamination ΔID, which is a difference between the image density ID and reflection density from a fresh sheet. As shown, when the half-width exceeds 2.2 fC/10 μm, the limit of the background contamination ΔID exceeds 0.08. Therefore, as for the spherical toner, the half-value does not increase above 1.9 fC/10 μm smaller than 2.2 fC/10 μm despite aging, insuring a sufficient amount of charge that brings about a minimum amount of background contamination. The conventional toner increases the half-width up to 3 fC/10 μm and therefore lowers the background contamination rank.

It will be seen from the above that the spherical toner with sphericity of 90% or above maintains the half-width of the number distribution of the ratio q/d sharp and therefore maintains a great margin as to background contamination.

In the illustrative embodiment, drive torque input to the developing device 4 should preferably be 15 N.m or below. The agitation of the developer is essential for uniform charging and therefore needs major part of the drive torque input to the developing device. Factors that determine the toner charging condition by the agitator include the amount of the developer, the frequency of contact (revolution speed), the magnetic force of the pole disposed in the sleeve 421, the intensity of saturation magnetization of the carrier, and the gap between the doctor 23 and the sleeve 421. Such factors are combined to promote efficient charging of the toner. However, because the factors that promote toner charging sometimes reduce the life of the developer due to mechanical hazard, it is important to satisfy both of desirable toner charging and long developer life. Paying attention to the drive torque, which is one of the causes of stress to act on the toner, the illustrative embodiment reduces the drive torque for thereby extending the life of the developer while insuring sufficient development with a relatively small amount of charge.

FIG. 14 compares examples A through D of the illustrative embodiment and a comparative example with respect to the drive torque and the amount of charge deposited on the toner. As shown, the examples A through D each decelerate the deterioration of the developer ascribable to aging although lowering the mean amount of charge. More specifically, the examples A through D each extend the life of the developer up to 180,000 prints. By contrast, the comparative example causes the life of the developer to end when 150,000 prints are output. Particularly, by selecting the drive torque of 0.15 N.m or below to be input to the developing device 4, it is possible to extend the life of the developer up to 200,000 prints.

In the illustrative embodiment, all the magnetic poles of the magnet member 422 have influence on the conveyance of the developer 12 including the magnetic particles and the hardness of the magnet brush. The conveyance of the developer 12 and the hardness of the magnet brush are determined by the magnetic force of each pole and the saturation magnetization of the magnetic grains 11. For example, in the developing device 4 of the illustrative embodiment, assume that the main pole S1 with the highest strength has a magnetic force $M_D$ of 70 mT while the magnetic grains 11 have the intensity $M_c$ of saturation magnetization of $100\times4\Pi\times10^{-7}$ Wb.m/kg (=100 emu/g). Then, the magnet brush has adequate hardness and allows the developer to be continuously used without any stress.

More specifically, in FIG. 5, in a range indicated by hatching, the magnet brush has adequate hardness and allows the developer to be continuously used without any stress, as stated above. If $M_D$ is lower than 50 mT or if $M_c$ is lower than $35\times4\Pi\times10^{-7}$ Wb.m/kg (=35 emu/g), then a sufficiently hard magnet brush and therefore uniform development is not attainable. On the other hand, if $M_D$ is higher than 130 mT or if $M_c$ is higher than $130\times4\Pi\times10^{-7}$ Wb.m/kg, then a hard magnet brush is formed on the sleeve 421 and increases friction between the toner 10 and the magnetic grains 11. As a result, gaps between the additive is filled up in the former case or part of the toner 10 deposits on the magnetic grains 11 in the latter case (phenomenon generally referred to as toner spent). This lowers the fluidity of the toner 10 and lowers the amount of charge, thereby lowering the developing characteristic and therefore image quality.

In the illustrative embodiment, a two-level process is practicable if the quantity of light for image formation is increased and reduced in beam diameter. However, an increase in the quantity of light brings about the following problems. First, reducing the beam diameter of a large quantity of light reduces a margin as to optical design and therefore requires precision parts, resulting in an increase in cost. Second, the large quantity of light translates into a large amount of charge for charging and exposure, so that the drum 1 suffers from so-called electrostatic hazard. This reduces the service life of the drum 1.

In light of the above, in the illustrative embodiment, the initial charge potential of the drum 1 should preferably be 400 V or below, and the amount of exposure should also be reduced. Then, it is possible to form a high-definition latent image with general-purpose optical elements and to extend the life of the drum 1 by reducing electrostatic hazard.

More specifically, in the illustrative embodiment, a γ or developing characteristic curve (amount of development relative to development potential) has a great slope; that is, development is easy to effect even with a relatively low potential and saturates soon. With this developing characteristic, it is relatively easy to develop a solid image with the entire amount of toner deposited on the developing roller 420. By contrast, in the case of the conventional developing drum and writing conditions, the amount of development varies when differential sensitivity does not sufficiently fall, causing the diameter of a small dot to vary. In the illustrative embodiment, the charge potential of 400 V or below particular to the illustrative embodiment sufficiently lowers differential sensitivity when the latent image dot diameter corresponds to a latent image forming condition represented by $1/e^2$. Such low differential sensitivity insures a uniform dot image. In addition, it was experimentally found that the illustrative embodiment freed a toner image from background contamination with exposing power of 0.23 mW, which is far lower than conventional 0.47 mW.

As shown in FIG. 6, assume a zone TL where the toner contacting the surface of the drum 1 and contributing to development in the developing region A1 exists. Then, in the illustrative embodiment, the substances and thickness of the photoconductive layer 1P and the substances of the toner should preferably be selected such that a capacitance $C_{TL}$ for the unit area of the zone TL is greater than a capacitance $C_{PC}$ for the unit area of the photoconductive layer 1P formed on the conductive base 1B. This successfully reduces the edge effect during development.

More specifically, the illustrative embodiment uses the magnetic grains 11 whose resistance is as low as $10^6\Omega$ or below in terms of dynamic resistance DR. Therefore, the above region TL corresponds to a toner layer between the tip of the magnetic grains 11 on the developing roller 420 and the surface of the drum 1. For example, assume that the photoconductive layer 1P of the drum 1 has specific inductive capacity of 2.7 and thickness $T_{PC}$ of 30 $\mu$m. Then, the photoconductive layer 1P has capacitance of 79.6 pF/cm$^2$ for a unit area. Therefore, if the toner layer TL has specific inductive capacity of 3 and a thickness $T_{TL}$ of 15 $\mu$m, then the toner layer TL has capacitance $C_{TL}$ of 177 pF/cm$^2$, which satisfies the condition of $C_{PC}<C_{TL}$. Experiments were conductive with solid image and line images under the above condition. For comparison, experiments were conducted with an capacitance of 119 pF/cm$^2$ (specific inductive capacity of 2.7 and thickness $T_{PC}$ of 20 $\mu$m) and the capacitance $C_{TL}$ of the toner layer TL of 106 pF/cm$^2$ (specific inductive capacity of 3) and thickness $T_{TL}$ of 25 $\mu$m; a relation of $C_{PC}>C_{TL}$ holds that is opposite to the relation of the illustrative embodiment.

Figure 17:
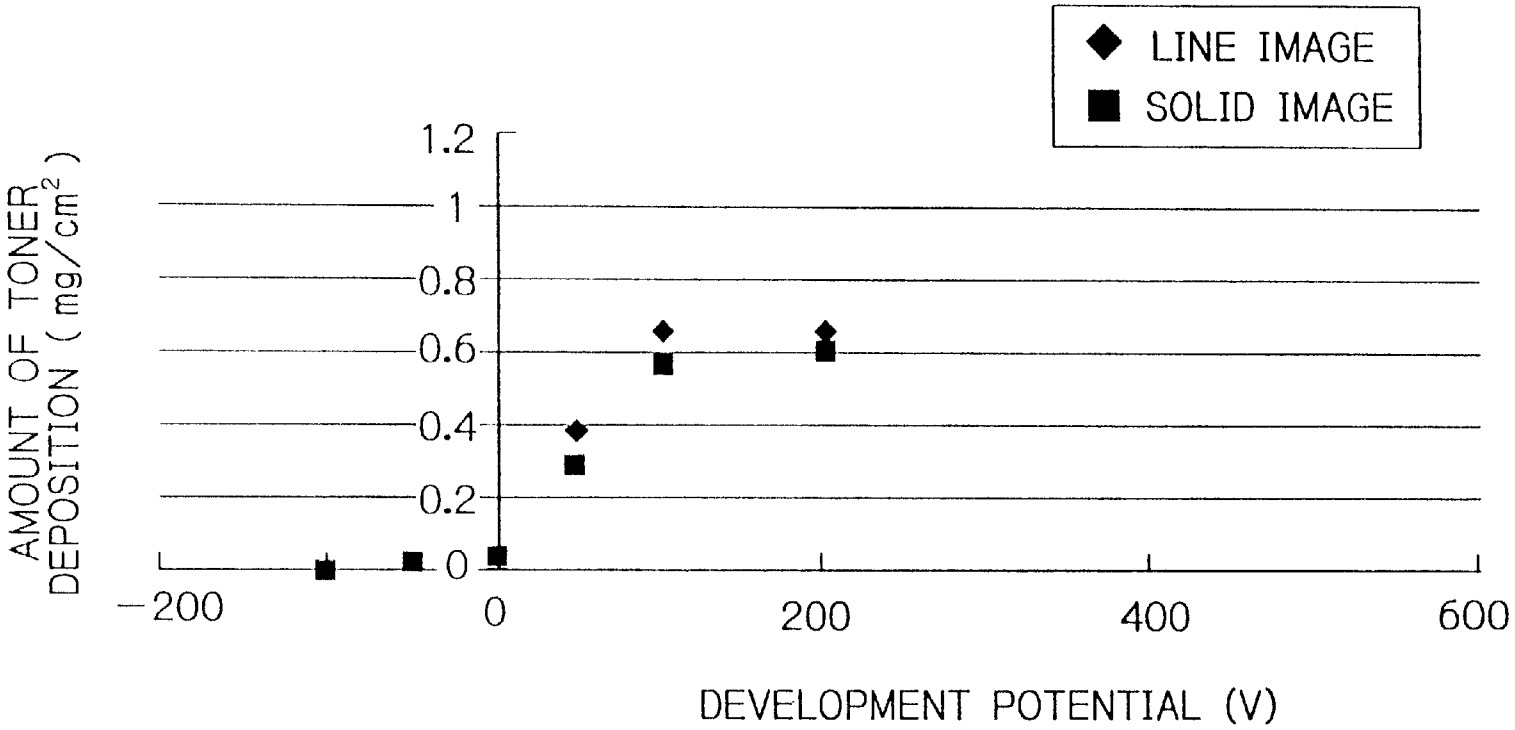
FIG. 17 is a graph showing γ characteristics determined with the first embodiment with line images and solid images.
Figure 18:
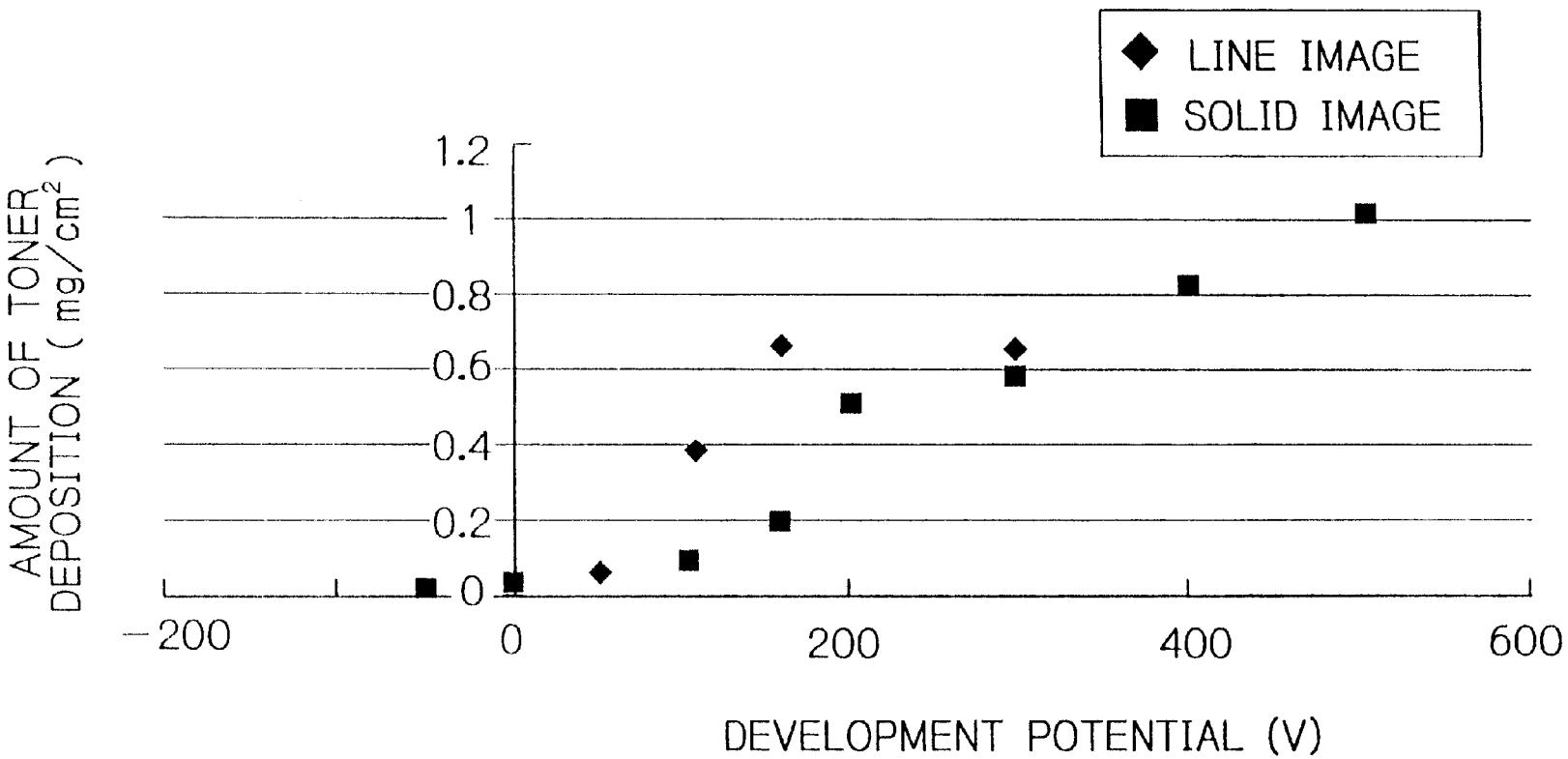
FIG. 18 is a graph showing γ characteristics determined with a comparative example with line images and solid images.

FIG. 17 shows the results of the above experiments conducted with the illustrative embodiment. As shown, in both of the solid image and line image, the $\gamma$ curve representative of a relation between the amount of toner deposition and the development potential varies in the same manner as to the slope of the rising portion and the saturation development potential at which the curve begins to saturate. This proves that a density difference between the solid image and the line image can be reduced. By contrast, as shown in FIG. 18, the $\gamma$ curve differs from the solid image to the line image; a noticeable density difference occurs even if the development potential is the same.

Figure 19:
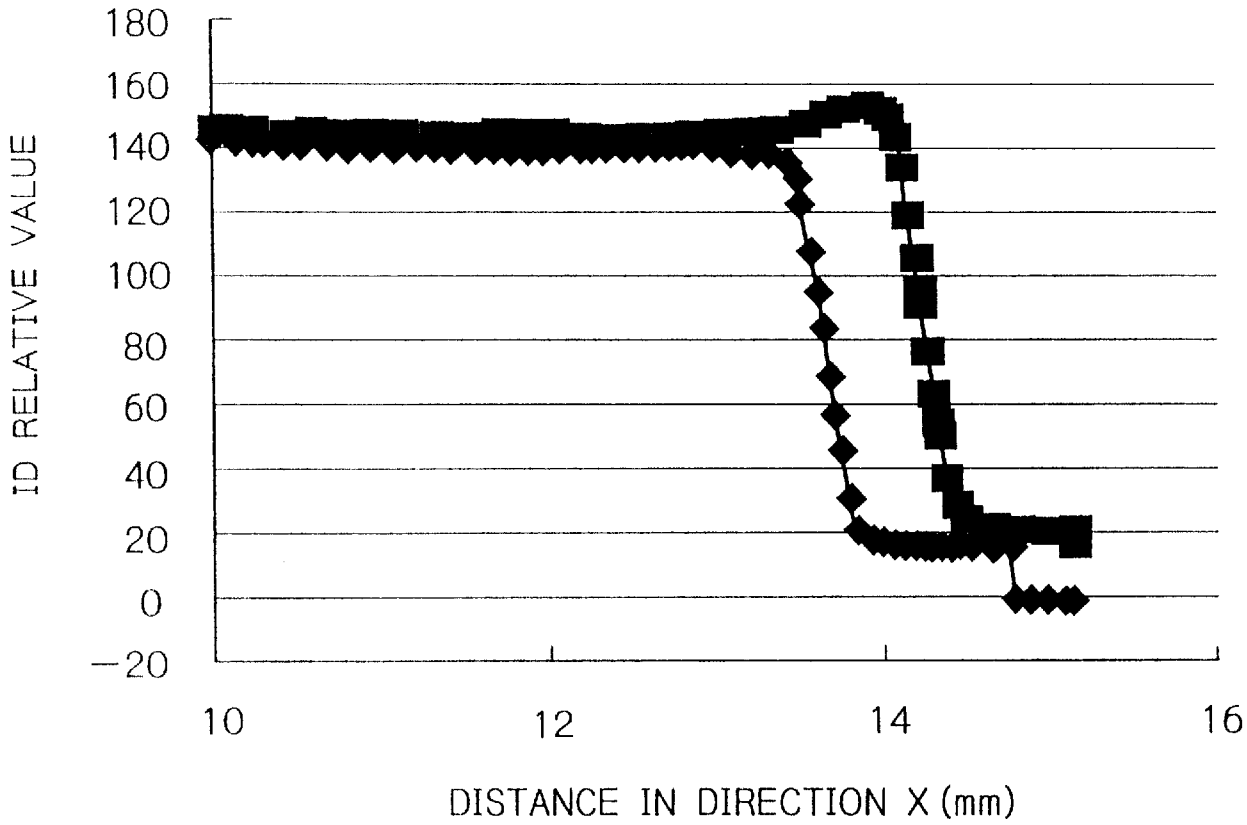
FIG. 19 is a graph showing how image density varies in the vicinity of the edge of a solid image.

Further, FIG. 19 compares the illustrative embodiment and the comparative example with respect to density variation at the edge of a solid image. As shown, the edge effect is conspicuous in the comparative example represented by squares, but it is negligible in the illustrative embodiment. This also proves that the illustrative embodiment reduces a density difference between the solid image and the line image.

Figure 20:
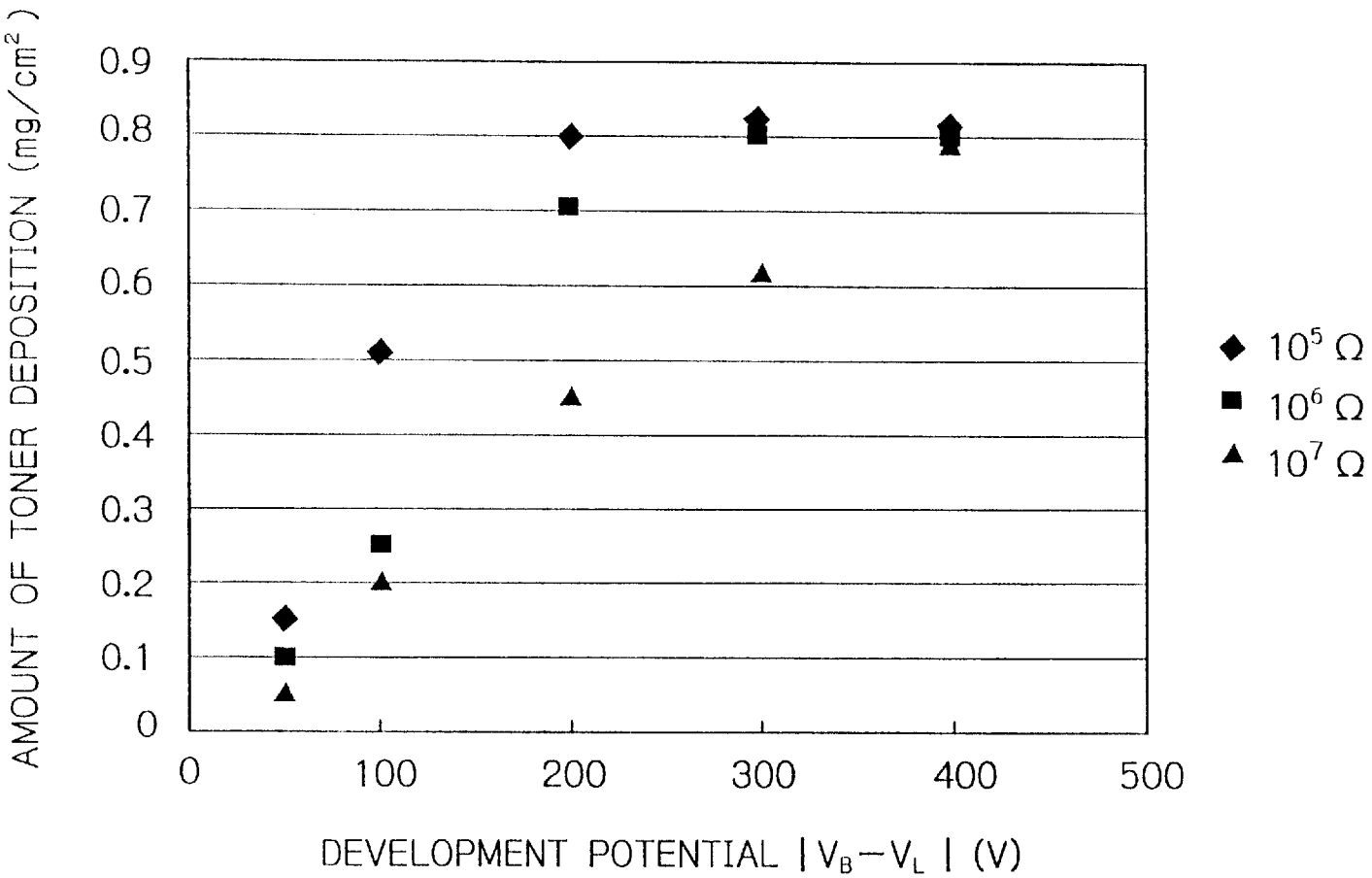
FIG. 20 is a graph indicative of the influence of the dynamic resistance of a developer layer formed on a developing roller on the γ characteristic.

In the illustrative embodiment, the dynamic resistance of the developer forming a layer on the developing roller 420 should preferably be $10^6\Omega$ or below. FIG. 20 shows developing characteristics determined with developer layers each having a particular dynamic resistance. Dynamic resistance was measured by the method described with reference to FIG. 5. As FIG. 20 indicates, the lower the dynamic resistance, the greater the slope of the $\gamma$ characteristic. As for the developer layer with dynamic resistance of $10^7\Omega$, the development potential exceeds 400 V before the amount of toner deposition saturates. With dynamic resistances of $10^5\Omega$ and $10^6\Omega$, it is possible to achieve a developing ability high enough to reach saturation before the development potential reaches 400 V, implementing development with a lower development potential.

Second Embodiment

This embodiment is also mainly directed toward the first object stated earlier and practicable with the same arrangements as the previous embodiment. In the illustrative embodiment, the developing device 4 uses a single-ingredient type developer, i.e., toner. The developing roller or toner carrier 402 conveys a toner layer deposited thereon and causes it to contact a latent image formed on the drum 1.

Figure 21:
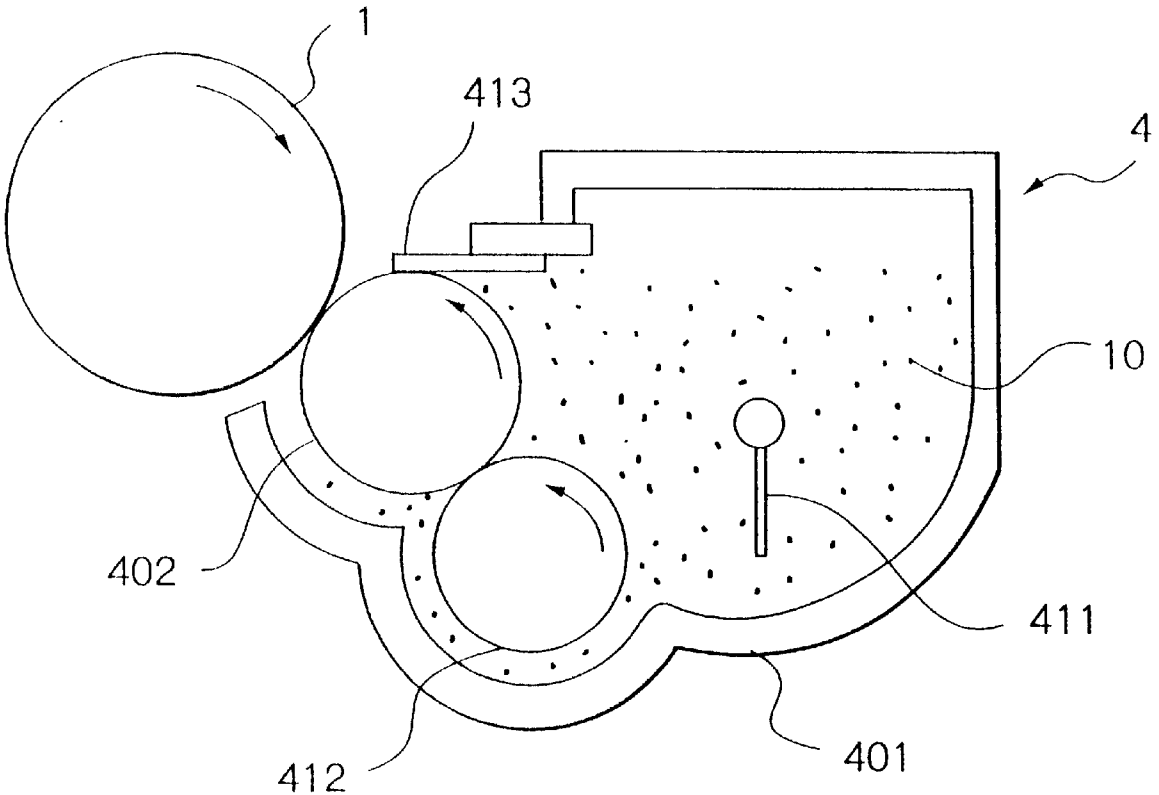
FIG. 21 is a view showing a developing device included in a second embodiment of the present invention.

Specifically, as shown in FIG. 21, the casing 401 stores the toner 10 and accommodates an agitator or agitating means 411 rotatable for agitating the toner 10. The toner 10 is therefore mechanically fed to a feed roller 412 also received in the casing 401. The feed roller 412 is formed of foam polyurethane or similar flexible material and can easily retain the toner 10 in cells having a diameter of 50 $\mu$m to 500 $\mu$m. The feed roller 412 has relatively low hardness ranging from 10° to 30° (JIS (Japanese Industrial Standards) A scale) and can uniformly contact the developing roller 402.

The feed roller 412 is rotated in the same direction as the developing roller 402 such that the surface of the former moves in a direction opposite to the surface of the latter, as seen at the contact position. Optically, a linear velocity ratio between the feed roller 412 and the developing roller 402 should be 0.5 to 1.5. The feed roller 412 may be rotated in a direction opposite to the developing roller 402. In the illustrative embodiment, the feed roller 402 and developing roller 402 are rotated in the same direction at a linear velocity ratio of 0.9. The feed roller 412 bytes into the developing roller 402 by 0.5 mm to 1.5 mm. The amount of byte, however, depends on the charging characteristic and feeding condition of the toner and should therefore be selected out of a broader range. The amount of byte depends also on the characteristic of a motor for driving the developing roller 402 and that of a gear head and should therefore be studied in consideration of the entire driveline. In the illustrative embodiment, when the effective unit width is 240 mm (A4 short edge feed), a torque ranging from 14.7 N.cm to 24.5 N.cm (1.5 kgf.cm to 2.5 kgf.cm) is required.

The toner of the illustrative embodiment is identical with the toner of the previous embodiment except that the former has a mean grain size of 6 $\mu$m.

In the illustrative embodiment, the developing roller 402 is made up of a conductive base and a surface layer formed of rubber. The developing roller 402 has a diameter of 10 mm to 30 mm and has its surface suitably roughened to surface roughness of 1 $\mu$m to 4 $\mu$m RZ. This surface roughness is 13% to 80% of the grain size of the toner and can convey the toner without causing it to be buried in the developing roller 402. Particularly, the surface roughness should preferably be between 20% and 30% of the mean toner grain size so as not to retain much toner grains of short charge. In the illustrative embodiment, the surface roughness should optimally be between 1.2 $\mu$m and 1.8 $\mu$m because the mean toner grain size is 6 $\mu$m, as stated earlier.

Rubber forming the surface of the developing roller 402 may be silicone rubber, butadien rubber, NBR, hydrine rubber or EPDM by way of example. Further, the surface of the developing roller 402 should preferably be coated with a material capable of stabilizing quality against aging. The coating material is particularly desirable when based on silicone or Teflon (trade name); the former promotes toner charging while the latter promotes toner parting. The coating material may contain carbon black or similar conductive substance for providing the surface of the developer with conductivity. The coating material should preferably be 5 $\mu$mto 50 $\mu$m thick. Thickness above 50 $\mu$m is apt to bring about cracks or similar defects. While the illustrative embodiment provides the developing roller 402 with low hardness and provides the drum 1 with high hardness, the relation in hardness may be reverse, if desired.

The feed roller 412 in rotation conveys the toner present on or in the surface thereof and charged to preselected polarity (negative polarity in the illustrative embodiment). At the point where the feed roller 412 and developing roller 402 rotating in opposite directions contact each other, the toner is charged to negative polarity due to friction. As a result, the toner is deposited on the developing roller 402 due to an electostatic force and the conveying force available with the rough surface of the roller 402. At this instant, the toner layer on the developing roller is not uniform, but is excessive in amount (1 mg/cm$^2$ to 3 mg/cm$^2$). A doctor 413 held in contact with the developing roller 402 regulates the toner layer to preselected thickness. The doctor 413 has an edge directed toward the downstream side in the direction of rotation of the developing roller 402 and has an intermediate portion contacting the roller 402. The doctor 413 may, of course, be directed toward the upstream side in the above direction or may have an edge contacting the developing roller 402.

In the illustrative embodiment, the doctor 413 is formed of SUS 304 (JIS; chrome stainless steel) or similar metal and 0.1 mmm to 0.15 mm thick. Alternatively, the doctor 413 may be formed of polyurethane rubber or similar rubber or silicone resin or similar resin having relatively high hardness. Even a material other than metal can be lowered in resistance if it contains, e.g., carbon black, so that a bias power supply can be connected to such a material for forming an electric field.

The doctor 413 should preferably be 10 mm to 15 mm long, as measured from a holder holding it. Lengths greater than 15 mm make the developing device 4 bulky and thereby prevent it from being accommodated in a compact configuration. Lengths smaller than 10 mm cause the doctor 413 to shake on contacting the surface of the developing roller 402 and thereby cause horizontal stripes and other defects to appear in an image. Pressure to act between the doctor 413 and the developing roller 402 should preferably be between 0.049 N/cm and 2.45 N/cm (5 gf/cm to 250 gf/cm). Pressures above the upper limit reduce the amount of toner to deposit on the developing roller 402 and excessively increase the amount of charge, thereby reducing the amount of development and therefore image density. Pressures below the lower limit cause lumps of toner to pass the doctor 413 without forming a uniform thin layer, critically lowering image density. In a specific example of the illustrative embodiment, the developing roller 402 had hardness of 30° (JIS A-scale) while the doctor 413 had thickness of 0.1 mm and was formed of SUS; the contact pressure was 60 gf/cm. The specific example guaranteed the target amount of toner deposition on the developing roller 402.

The angle at which the doctor 413, which is directed toward the downstream side, contacts the developing roller 402 should preferably be between 10° and 45° with respect to a line tangential to the roller 402. Part of the toner between the doctor 413 and the developing roller 402 and not necessary for the thin layer is removed from the roller 402, so that the thin layer with a target thickness of 0.4 mg/cm$^2$ to 0.8 mg/cm$^2$ for a unit area is formed. At this instant, in the illustrative embodiment, the final amount of charge deposited on the toner is between −10 $\mu$C/g and −30 $\mu$C/g.

Figure 22:
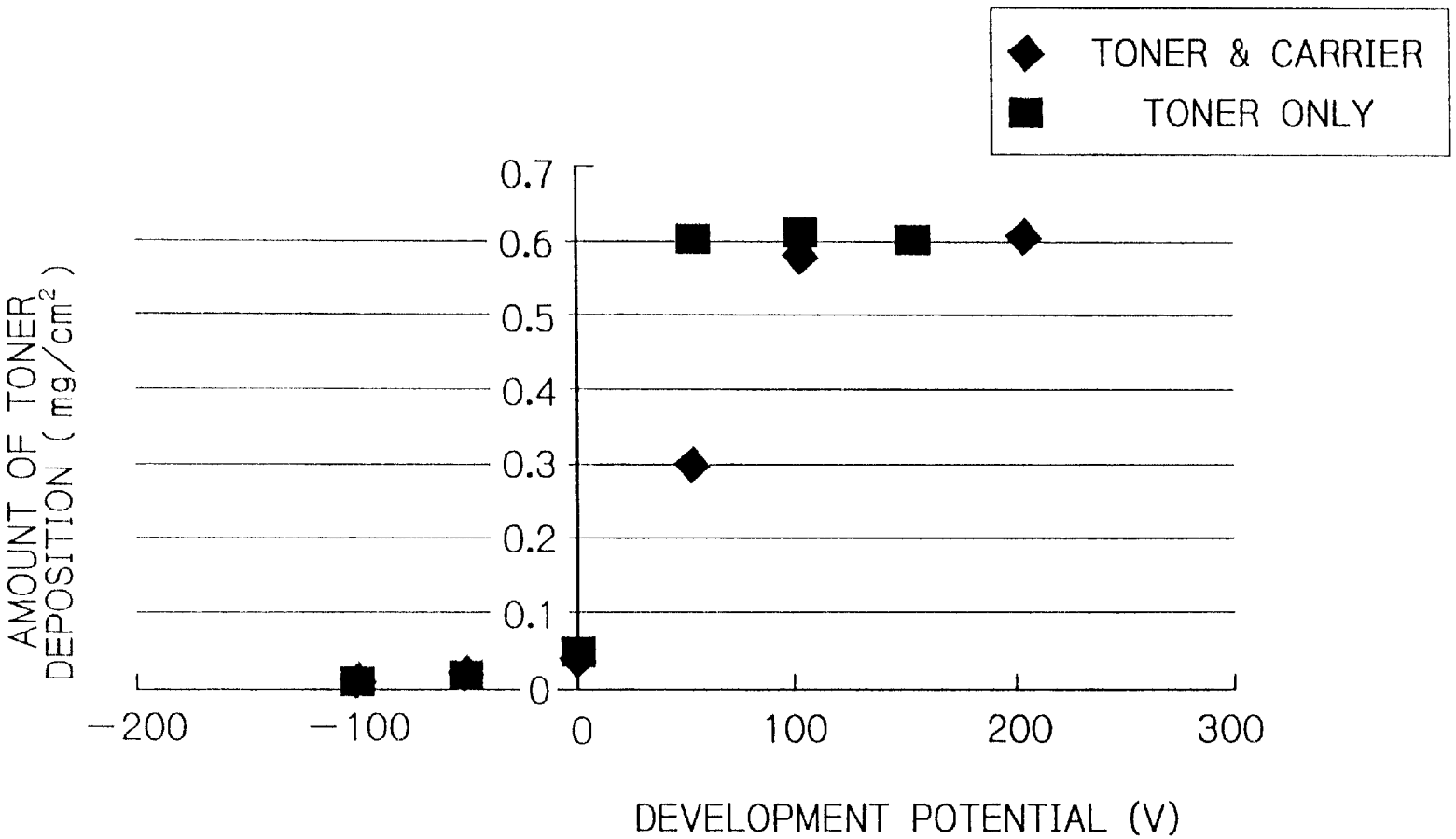
FIG. 22 is a graph showing a relation between the development potential and the amount of toner deposition determined with the second embodiment.

In the illustrative embodiment using toner only, the gap between the surface of the drum 1 and that of the developing roller 402 is even smaller than in the conventional developing device using a toner and carrier mixture. The illustrative embodiment therefore has a higher developing ability and can develop a latent image even with a lower potential. It follows that, as shown in FIG. 22, saturation is sufficiently achievable even when the development potential is 50 V.

Figure 23:
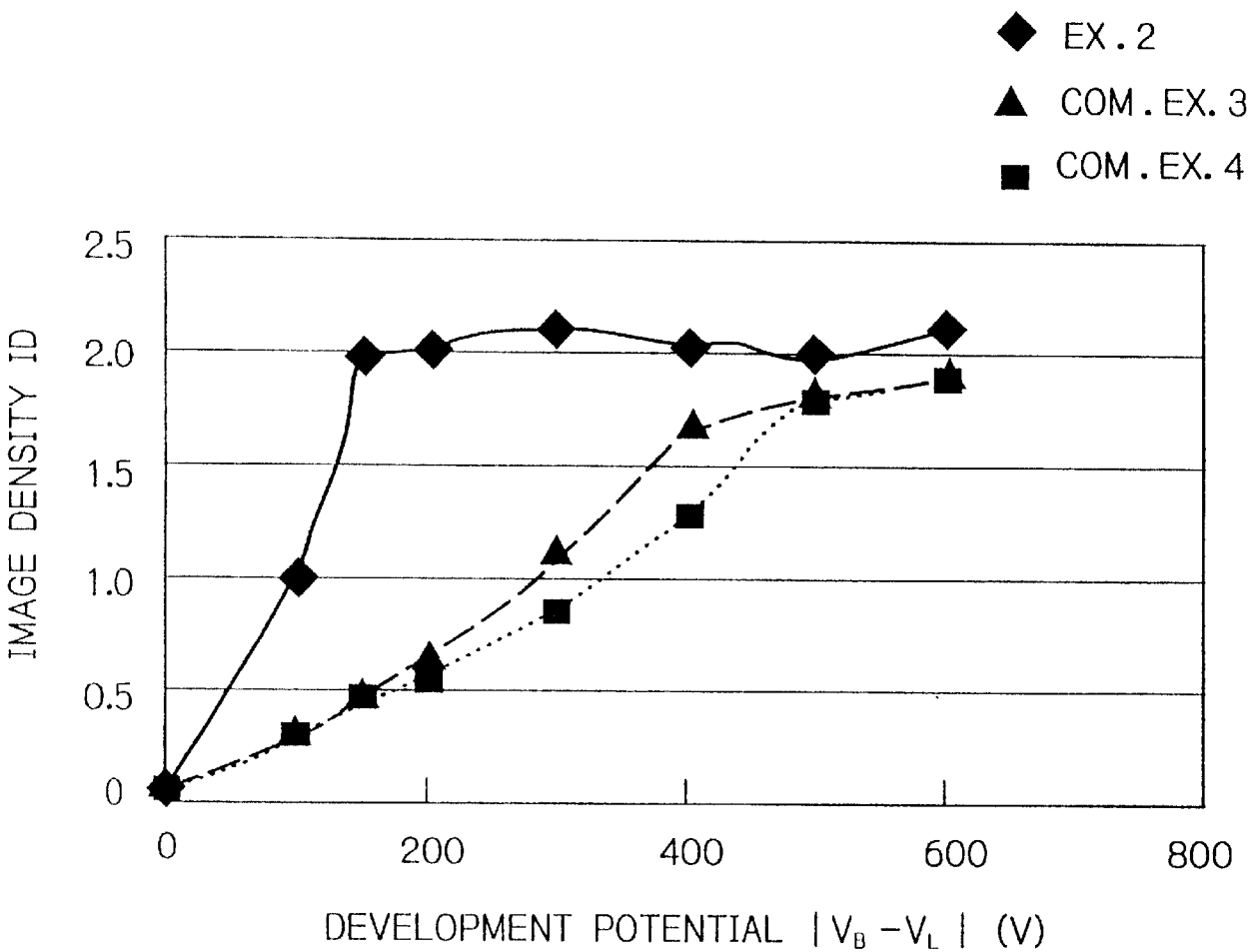
FIG. 23 is a graph showing a relation between the development potential and the image density determined with the second embodiment.

FIG. 23 compares a more specific example of the illustrative embodiment and comparative examples 3 and 4 with respect to a relation between the development potential $|V_B-V_L|$ and the image density ID. In the illustrative embodiment, the maximum development potential $|V_B-V_L|$max is 250 V. FIG. 24 lists the mean amount of toner charge and the resistance of the surface layer of the developing roller 402 particular to the illustrative embodiment and those of the examples 3 and 4.

As FIG. 23 indicates, in the illustrative embodiment, the image density ID saturates when the development potential is about 150 V. Image density ID varies by 0.15 (2.0 to 2.15) so long as the development potential lies in the previously stated preselected range (200 V to 300 V). The variation of image density ID is therefore less than 10% (=0.21) of the target maximum image density ID (2.1). Stated another way, so long as the development potential lies in the preselected range (200 V to 300 V), the variation of image density ID lies in the range of ±0.1 of the target maximum image density ID (2.1), which appears to be an irregular image to eye.

It follows that even when the development potential varies by about 50 V, the fall of image density ID and irregular image density are not conspicuous because the variation image density ID lies in the particular range stated above. Actual estimation showed that images suffered from irregular image density variation little.

By contrast, in both of the comparative example 3 providing the surface layer of the developing roller with high resistance and comparative example 4 using a great amount of toner charge, the developing characteristic curve representative of the degree of variation of image density ID relative to the development potential has a small slope. The above curve therefore is not sufficiently close to saturation at the maximum development potential $|V_B-V_L|$max, causing image density to easily vary. This is why image density ID of the comparative example 3 is 0.55 when the development potential is 200 V, 0.7 when it is 250 V or 0.85 when it is 300 V within the preselected range of development potential (200 V to 300 V). The image density ID of the comparative example 3 varies by 0.3 that is greater than 10% (=0.07) of the image density ID (0.7) corresponding to the maximum development potential $|V_B-V_L|$max=250 V. Likewise, the image density ID of the comparative example 4 is 0.65 when the developing potential is 200 V, 0.9 when it is 250 V or 1.2 when it is 300 V; the variation is 0.55 that is greater than 10% (=0.09) of the image density ID (0.9) corresponding to the maximum development potential $|V_B-V_L|$max=250 V.

In the comparative examples 3 and 4, when the development potential varies by about 50 V, image density ID noticeably varies. As a result, the fall of image density ID and irregular image density become conspicuous and lower image quality, as determined by experiments.

As stated above, even when the maximum development potential $|V_B-V_L|$max ranges from 100 V to 300 V, the illustrative embodiment, like the previous embodiment, can prevent image density ID from varying by more than 10% of the target maximum image density within the range satisfying the relations (2) through (4) or (5) through (7). There can be reduced the fall of image density and irregular image density ascribable to the variation of the development potential $|V_B-V_L|$.

Again assume the zone between the surface of the drum 1 and that of the developing roller 402 where the toner contributing to development exists. Then, in the illustrative embodiment, the material and thickness of the photoconductive layer 1P are selected such that the capacitance $C_{TL}$ for the unit area of the toner layer in the above zone is greater than the capacitance $C_{PC}$ for a unit area of the layer 1P. This successfully reduces the edge effect during development and faithfully reproduces the latent image of the drum 1 without thickening thin lines or small dots.

Figures 25, 26:
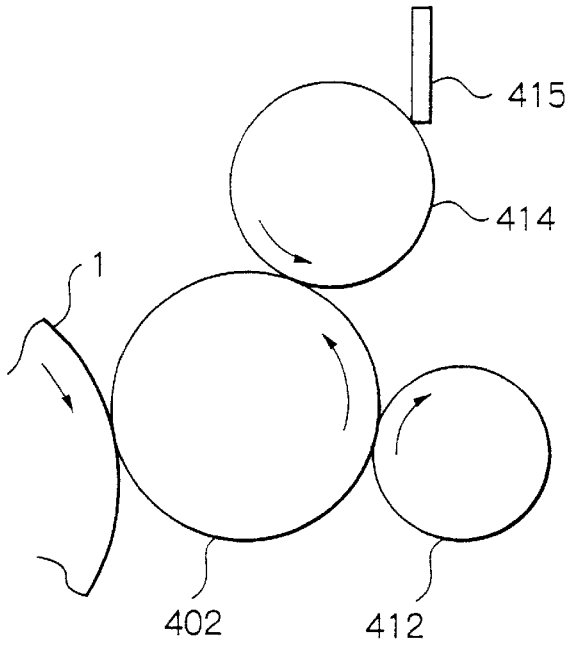
FIG. 25 is a view showing a modified form of the developing device of the second embodiment.
FIG. 26 is a table comparing a doctor blade and a doctor roller with respect to undesirable vertical stripes.

As shown in FIG. 25, the doctor 413 implemented as a blade may be replaced with a doctor roller 414. The doctor roller 414 allows the contact pressure between it and the developing roller 402 to be lowered than the doctor blade 413. This reduces mechanical hazard on the toner ascribable to aging.

FIG. 26 compares the doctor blade 413 and doctor roller 414 with respect to the appearance of vertical stripes in an image ascribable to aging. As shown, the doctor roller 414 brought about no vertical stripes even when 300,000 prints were output. By contrast, the doctor blade 413 caused vertical stripes to appear when more than 10,000 prints were output; images without such stripes were not restored unless the blade 413 were cleaned and unless the toner was replaced.

Third Embodiment

Figure 27:
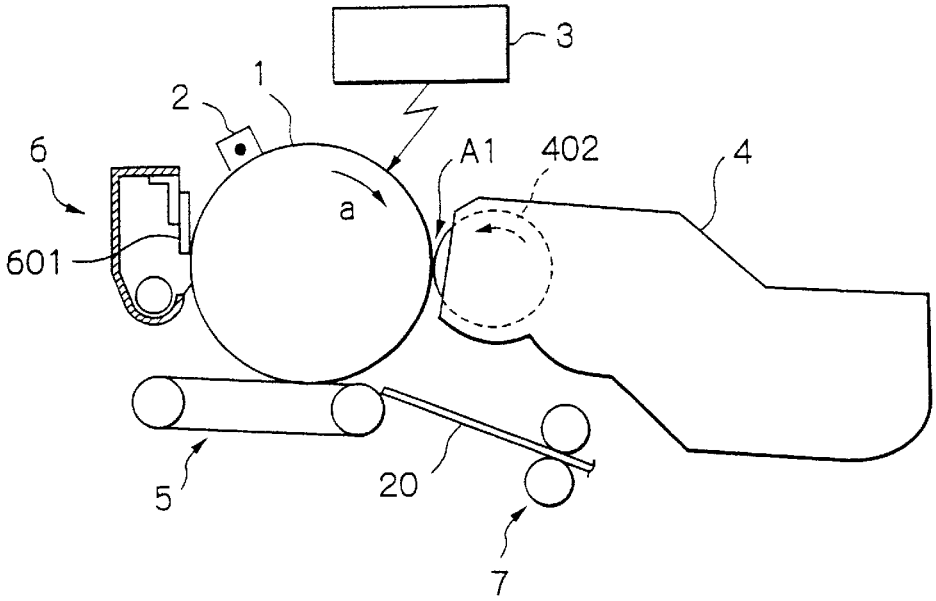
FIG. 27 is a view showing a third embodiment of the present invention.
Figure 28:
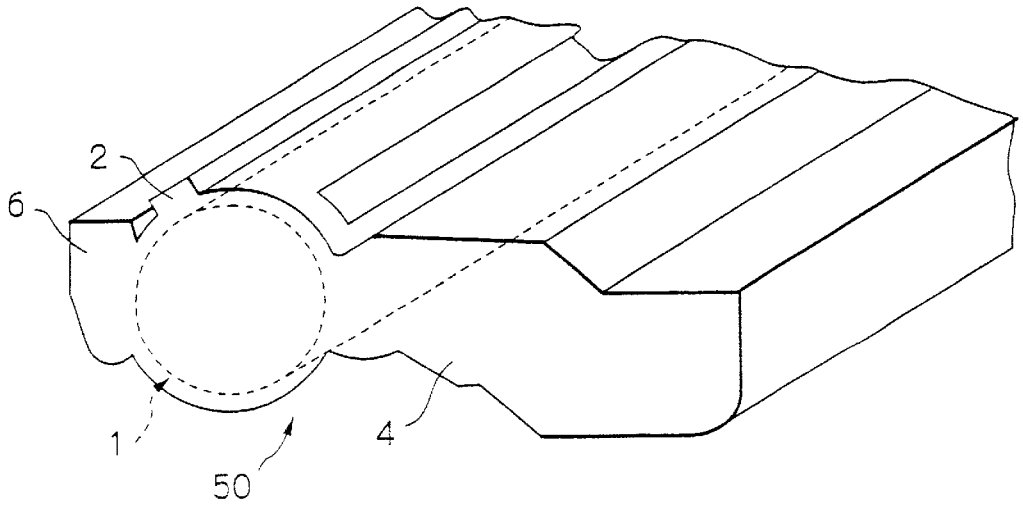
FIG. 28 is a fragmentary isometric view showing a process cartridge applicable to the third embodiment.
Figure 29:
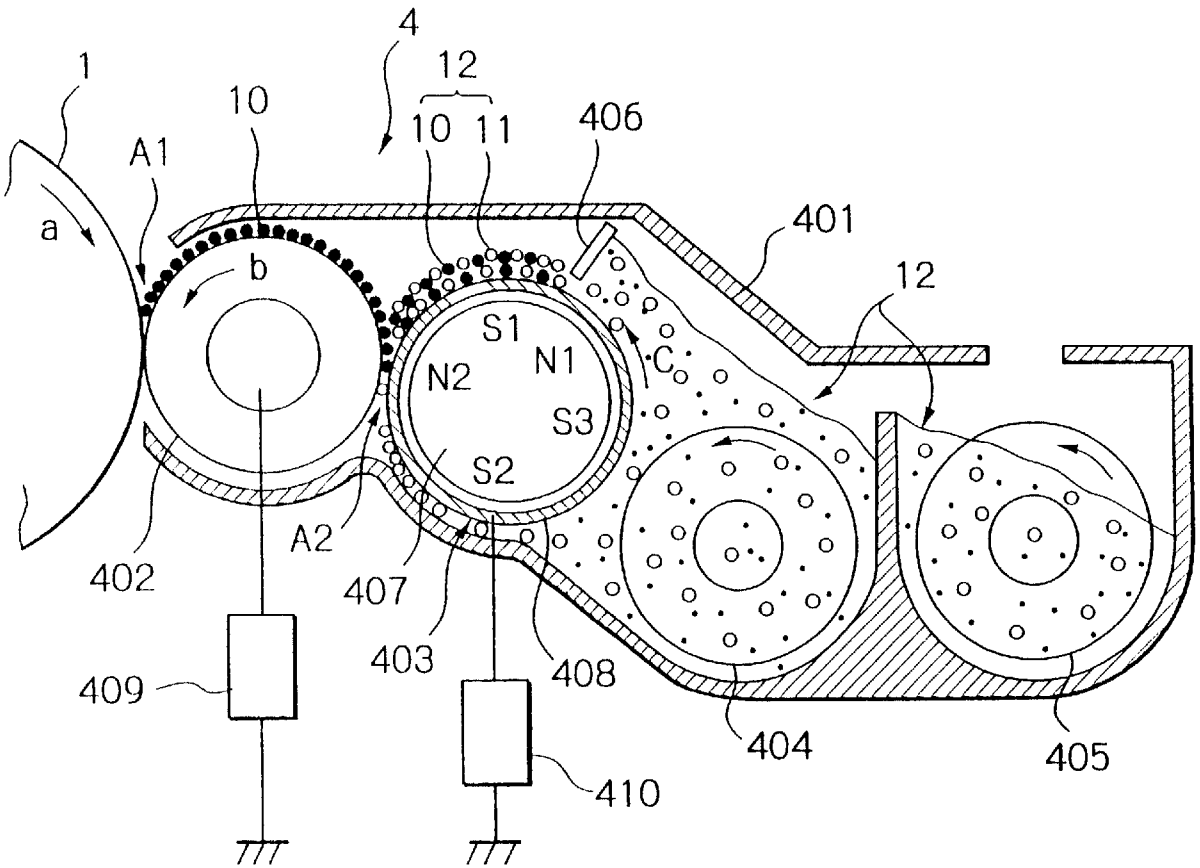
FIG. 29 is a view showing a developing device applied to the third embodiment.

FIG. 27 shows a third embodiment of the present invention. This embodiment is also mainly directed toward the first object stated earlier and practicable with the same arrangements as the first embodiment. As shown in FIG. 28, the drum 1, charger 2, developing device 4 and cleaning device 6, for example, may also be constructed into a process cartridge removably mounted to the printer body. As shown in FIG. 29, This embodiment differs from the first embodiment in that the feed member for feeding the toner to the developing roller 402 is implemented as a magnet brush roller.

Specifically, as shown in FIG. 29, the developing roller or developer carrier (toner carrier) 402, magnet brush roller or toner feeding member 403 and agitators 404 and 405 are sequentially arranged in this order, as named from the drum 1 side. The casing 402 stores the two-ingredient type developer 12. The agitators 404 and 405 agitate the developer 12 with the result that part of the developer 12 deposits on the magnet brush roller 403. The developer 12 on the magnet brush roller 403 is regulated in thickness by a doctor blade 406 and then brought into contact with the developing roller 402 in a toner feeding region A2. In the toner feeding region A2, the toner 10 is separated from the developer 12 and transferred to the developing roller 402.

In the illustrative embodiment, the drum 1 includes an aluminum tube as a base and is rigid, so that the developing roller 402 should preferably be formed of rubber. The hardness of the developing roller 402 should preferably be between 10° and 70° (JIS A-scale) and should preferably have a diameter of 10 mm to 30 mm. In the illustrative embodiment, the developing roller 402 has a diameter of 16 mm and has its surface roughened to surface roughness (ten-point mean roughness) of 1 $\mu$m to 4 $\mu$m RZ. Such surface roughness is 13% to 80% of the volume mean grain size of the toner 10 and can convey the toner 10 without causing it to be buried in the surface of the roller 402.

Rubber forming the surface of the developing roller 402 may be silicone rubber, butadien rubber, NBR, hydrine rubber or EPDM by way of example. When the drum 1 is replaced with a photoconductive belt, the developing roller 402 does not need low hardness and may therefore be replaced with a metal roller by way of example. It is desirable to coat the developing roller 402 with a suitable coating material for stabilizing quality against aging. Further, in the illustrative embodiment, the developing roller 402 is expected to simply carry the toner. The toner 10 therefore does not have to be charged by friction as in the conventional developing device using a single-ingredient type developer. It follows that the developing roller 402 should only satisfy electric resistance, surface configuration, hardness and dimensional accuracy and can therefore be selected from a broader range of materials.

The coating material applied to the developing roller 402 may be chargeable to polarity opposite to that of the toner 10 or may be chargeable to polarity identical with the latter if the developing roller 402 does not have to frictionally charge the toner. For the coating material chargeable to the same polarity as the toner 10, use may be made of a material containing silicone resin, acrylic resin, polyurethane resin or rubber. The coating material chargeable to the same polarity as the toner 10 may be implemented by, e.g., a fluorine-containing material. Teflon, for example, containing fluorine has low surface energy and has a high parting ability, causing a minimum of toner filming to occur despite aging. Resins in general applicable to the coating material include polytetrafluoroethylene (PTFE), tetrafluoroethylene-perfluoroalkylvinyl ether (PFE), tetrafluoroethylene-hexafluoropropyrene polymer (FEP), polychlorotrifuluoroethylene (PCTFE), tetrafluoroethylene-ethylene copolymer (ETFE), chlorotrifluoroethylene-ethylene copolymer (ECTFE), polyvynilidene fluoride (PVDF), and polyvinyl fluoride (PVF). The fluorine-containing material often contains carbon black or similar conductive substance. Further, the fluorine-containing material may additionally contain another resin for more uniformly coating the developing roller 402. The electric resistance of the fluorine-containing material is selected in consideration of the resistance of the base such that a bulk, volume resistivity is $10^3$ Ω.cm to $10^8$ Ω.cm. In the illustrative embodiment, the base has a volume resistivity of $10^3$ Ω.cm to $10^5$ Ω.cm, the volume resistivity of the surface layer is sometimes provided with a relatively high volume resistivity.

Figure 30A:
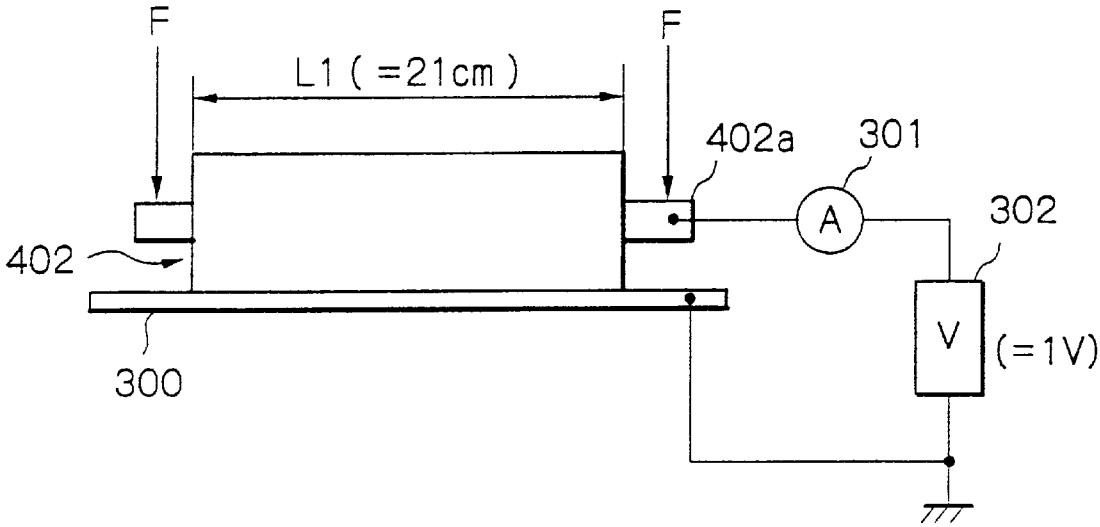
FIGS. 30A and 30B show a specific system for measuring the volume resistivity of the surface layer of a developing roller.
Figure 30B:
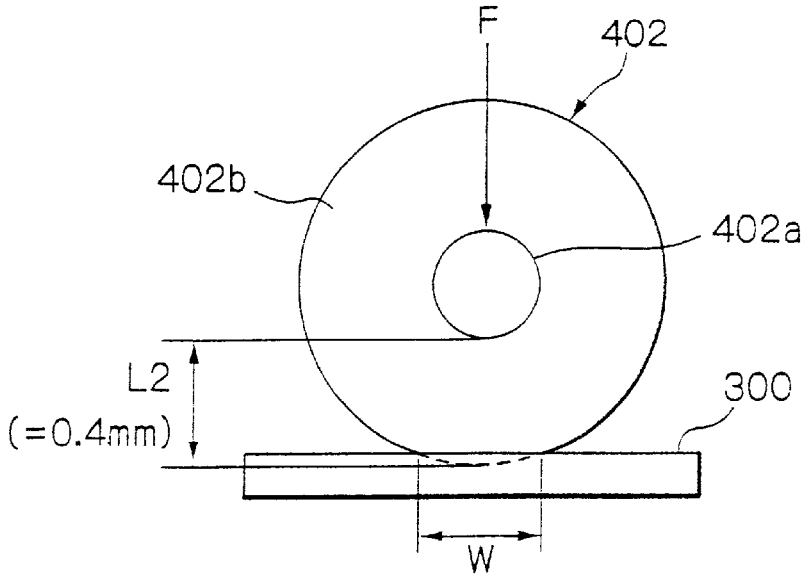

FIGS. 30A and 30B show a specific arrangement used to measure the volume resistivity of the surface of the developing roller 402. As shown, the developing roller 402 is set on a conductive base 300, which is connected to ground. A load F of 4.9 N (=500 gf) is applied to opposite ends of a core or shaft 402*a* included in the developing roller 402, so that a total load F of 9.8 N (1 kgf) acts on the roller 402. Consequently, as shown in FIG. 30B, a nip W is formed between the developing roller 402 and the base 300. A DC power supply 302 is connected to the core 402*a* via an ammeter 301. In this condition, a DC voltage V of 1 V is applied from the DC power supply 302 to the core 402*a*. The ammeter 301 measures the resulting current I (A). The voltage V (V) and measured current I (A), as well as dimensions L1 (cm), L2 (cm) and W (cm) are used to calculate the volume resistivity ρv of the elastic layer 402*b* of the developing roller 402:

$$\rho v=(V/I)\cdot(L1\times W)/L2 \tag{8}$$

The coating layer of the developing roller 402 should preferably be 5 $\mu$m to 50 $\mu$m thick. Assume that thickness is above 50 $\mu$m, and a difference in hardness between the coating layer and the base layer is great and causes stress to act. Then, the coating layer is apt to, e.g., crack. Thickness below 5 μm causes the base layer to be exposed as the surface wears, causing the toner to easily deposit on the base layer.

The toner 10 is implemented by polyester, polyol, styrene-acrylic resin or similar resin to which a charge control agent (CCA) and a colorant are added. Silica, titanium oxide or similar additive is coated on the grains of the toner 10 for enhancing fluidity. The additive usually has a grain size of 0.1 μm to 1.5 μm. The coloring agent may be implemented by carbon black, Phthalocyanine Blue or quinacridone by way of example. Alternatively, for the toner 10, use may be made of mother toner grains with, e.g., wax dispersed therein and on which the above additive is coated.

The toner 10 has a volume mean grain size preferably ranging from 3 μm to 12 μm. In the illustrative embodiment, the volume mean grain size is selected to be 7 μm and can sufficiently adapt even to resolution as high as 1,200 dpi or above. While the toner 10 of the illustrative embodiment is chargeable to negative polarity, it may be of the type chargeable to positive polarity in consideration of the polarity of the drum 1.

The carrier or magnetic grains 11 each are implemented by ferrite or similar magnetic substance as a core and coated with, e.g., silicone resin. The carrier 11 has a grain size preferably between 20 μm and 50 μm and electric resistance preferably between $10^4\Omega$ and $10^8\Omega$ in terms of dynamic resistance DR.

Referring again to FIG. 29, the magnet brush roller 403 is made up of a rotatable nonmagnetic sleeve 408 and a stationary magnet roller or magnet member 407 disposed in the sleeve 408 and having a plurality of magnetic poles. The magnet roller 407 exerts a magnetic force on the developer 12 when the developer 12 on the sleeve 408 passes a preselected position. The sleeve 408 should preferably have a diameter of 18 mm. The surface of the sleeve 408 is roughened by sand-blast such that it has surface roughness (ten-point mean roughness) ranging from 10 μm to 20 μm RZ.

The magnet roller 407 has five poles N1 (N pole), S1 (S pole), N2 (N pole), S2 (S pole) and S3 (S pole) as named from the position where the doctor 406 is positioned in the direction of rotation of the magnet brush roller 403. However, such an arrangement of magnetic poles is only illustrative and may be changed in accordance with, e.g., the position of the doctor 406. For example, four magnetic poles N1, S1, N2 and S2 may be sequentially arranged in this order from the position where the doctor 406 is positioned. While the sleeve 408 rotates around the stationary magnet roller 407 in the illustrative embodiment, the latter may rotate around the former, if desired.

The magnet roller 407 causes the developer 12 to form a magnet brush on the sleeve 408. In the magnet brush, the toner 10 is mixed with the carrier or magnetic grains 11 and charged to a preselected amount thereby. The preselected amount of charge should preferably be between −10 μC/g and −40 μC/g.

The developing roller 402 contacts the magnet brush on the magnet brush roller 403 in the toner feeding region, which adjoins the pole N2 of the magnet roller 407. Further, the developing roller 402 faces the drum 1 in the developing region A1.

In the illustrative embodiment, the gap between the doctor 406 and the magnet brush roller 403, as measured at the position where they are closest to each other, is selected to be 500 μm. The pole N1 facing the doctor 406 is inclined by several degrees from the position where the doctor 406 and the sleeve 408 face each other toward the upstream side in the direction of rotation of the sleeve 408. In this configuration, the circulation of the developer 12 in the casing 401 is facilitated.

The doctor 406 contacts the magnet brush at the position where it faces the magnet brush roller 403 in such a manner as to regulate the amount of the developer 12. At the same time, the doctor 406 promotes frictional charging of the toner 10 in the developer 12.

Drive sources respectively assigned to the developing roller 402 and magnet brush roller 403 cause the rollers 402 and 403 to rotate in directions b and c, respectively, shown in FIG. 29. The surfaces of the rollers 402 and 403 move in opposite directions to each other, as seen in the toner feeding region A2. In the illustrative embodiment, the drum 1 moves at a linear velocity of 200 mm/sec while the developing roller 402 moves at a linear velocity of 300 mm/sec. The gap between the developing roller 402 and the sleeve 408 of the magnet brush roller 403 is selected to be 0.6 mm.

A power supply 409 is connected to the shaft of the developing roller 402 for applying a bias Vb, which forms an electric field for development in the developing region A1. Also, a power supply 410 is connected to the sleeve 408 of the magnet brush roller 403 for applying a bias Vsup, which forms an electric field for toner feed in the toner feeding region A2.

In the illustrative embodiment, the agitators 404 and 405, the rotation of the sleeve 408 and the magnetic force of the magnet roller 407 cooperate to agitate the developer 12. At this instant, friction acting between the toner 10 and the carrier 11 charges the toner 10. The magnet brush roller 403 conveys the developer 12 deposited thereon toward the toner feeding region A2 via the doctor 404. The doctor 406 regulates the thickness or amount of the developer 12. Part of the developer 12 blocked by the doctor 406 is returned to the casing 401.

In the toner feeding region A2, the toner 10 is separated from the magnet brush and transferred to the developing roller 402 in the form of a thin toner layer. The developing roller 402 in rotation conveys the toner 10 to the developing region A1. The electric field formed in the developing region A1 causes the toner 10 to selectively deposit on a latent image formed on the drum 1.

The illustrative embodiment and the conventional developing device using a single-ingredient type developer will be compared hereinafter with respect to the amount of charge of the toner deposited on the magnet brush roller 403 and that of the toner transferred to from the roller 403 to the developing roller 402. For experiments, the illustrative embodiment and conventional developing device used the same toner. FIG. 31 shows the amount of charge of toner present on the magnet brush roller 403 immediately before the transfer to the developing roller 402 or that of toner present on the conventional toner feed roller and the amount of charge deposited on the developing roller 402 in the form of a thin layer, as determined by experiments. In FIG. 31, background contamination ranks were set on the basis of the previously stated difference ΔID; rank 3, for example, shows that the difference ΔID is between 0.08 and 0.04.

In the conventional developing device, the amount of toner to deposit on a developing roller is as great as 1 $mg/cm^2$ to 3 $mg/cm^2$. While a doctor implemented as a blade scrapes off part of the toner, it cannot check toner grains charged in a broad range of amounts. Therefore, as FIG. 31 indicates, although the mean amount of charge was as great as −12 C/g when the toner actually formed a thin layer, the resulting image belonged to rank 3 or average rank. As for the illustrative embodiment, although the mean amount of charge measured on the developing roller 402 during development was also −12 $\mu$C/g, the resulting image belonged to rank 5 far higher than rank 3.

Experiments showed that the following relation holds in the illustrative embodiment between the grain size of toner, the charge distribution and image quality. Again, E-SPART ANALYZER was used to determine the grain size of toner and charge distribution. For the analysis, 3,000 toner grains were sampled to determine a distribution.

Figure 32:
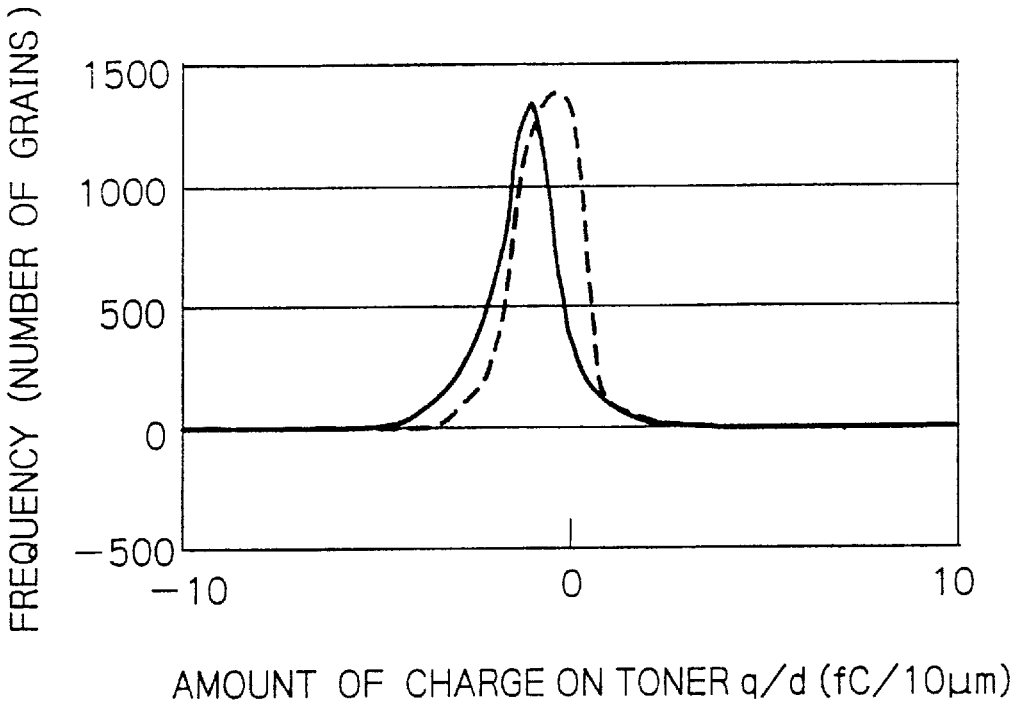
FIG. 32 is a graph showing the results of measurement of a distribution of the amount of charge of toner on the developing roller.

FIG. 32 shows a relation between the amount of charge and the degree or number of toner grains. In FIG. 32, a dotted curve shows a distribution particular to the toner of the magnet brush 403 that is about to reach the toner feeding region A2, while a solid curve shows a distribution particular to the toner deposited on the developing roller 402. As shown, when the toner is transferred from the magnet brush roller 404 to the developing roller 402, the peak amount of charge shifts to the higher charge side. This proves that the illustrative embodiment reduces the margin as to background contamination less than the conventional developing device, which lacks the magnet brush roller 404, and therefore successfully maintains the margin.

Figure 33:
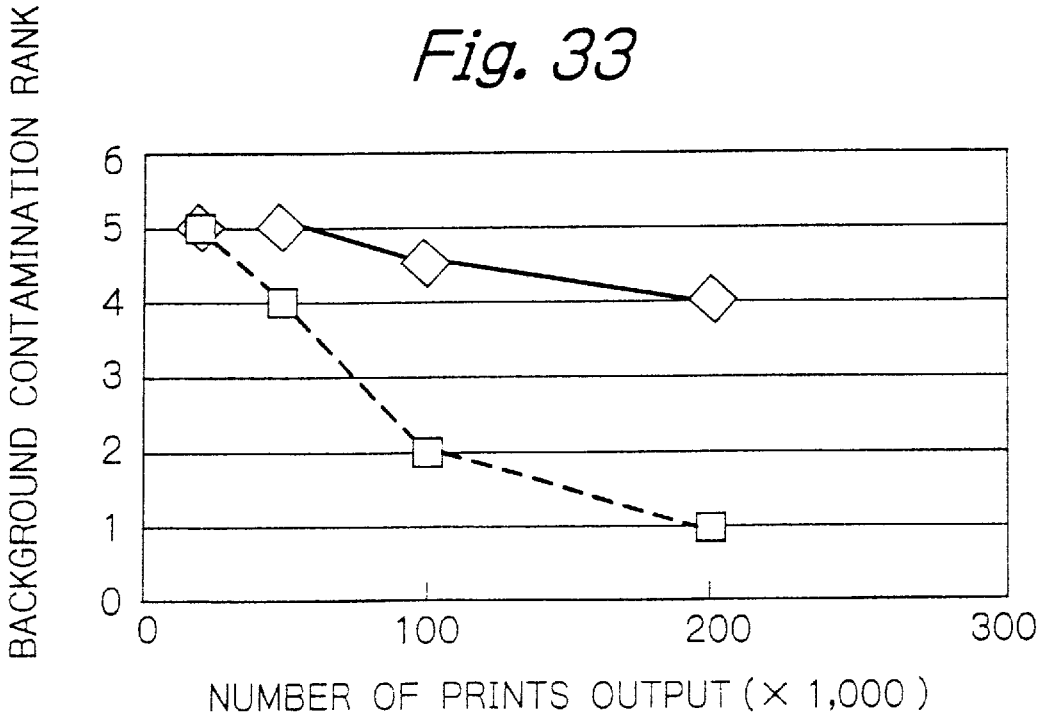
FIG. 33 is a graph showing how background contamination occurs with the elapse of time.

FIG. 33 compares the illustrative embodiment (rhombs) and the conventional developing device (squares) with respect to background contamination in relation to aging. As shown, the conventional device noticeably lowered the background contamination rank when 50,000 prints were output. By contrast, the illustrative embodiment maintained an acceptable background contamination level even when 200,000 prints were output.

Figure 34:
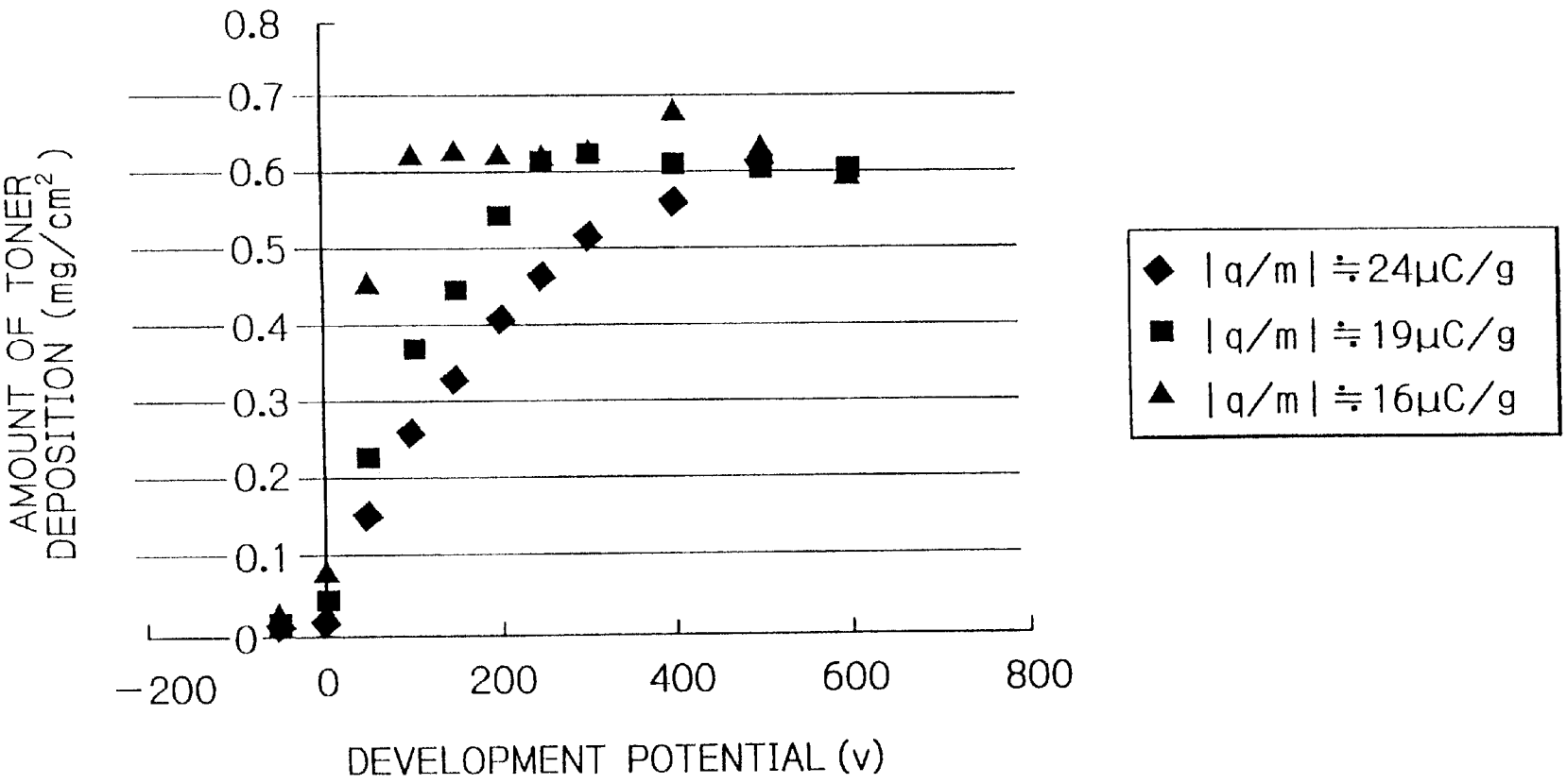
FIG. 34 is a graph showing a relation between the development potential and the amount of toner deposition with respect to the mean amount of charge of toner.

As stated above, in the illustrative embodiment, the toner deposited on the developing roller 402 is scattered little as to the amount of charge. Therefore, as shown in FIG. 34, The illustrative embodiment can lower the amount of charge to thereby enhance the developing ability while reducing the number of grains of short charge and grains of opposite charge. This realizes saturation development with a low development potential.

Figure 35:
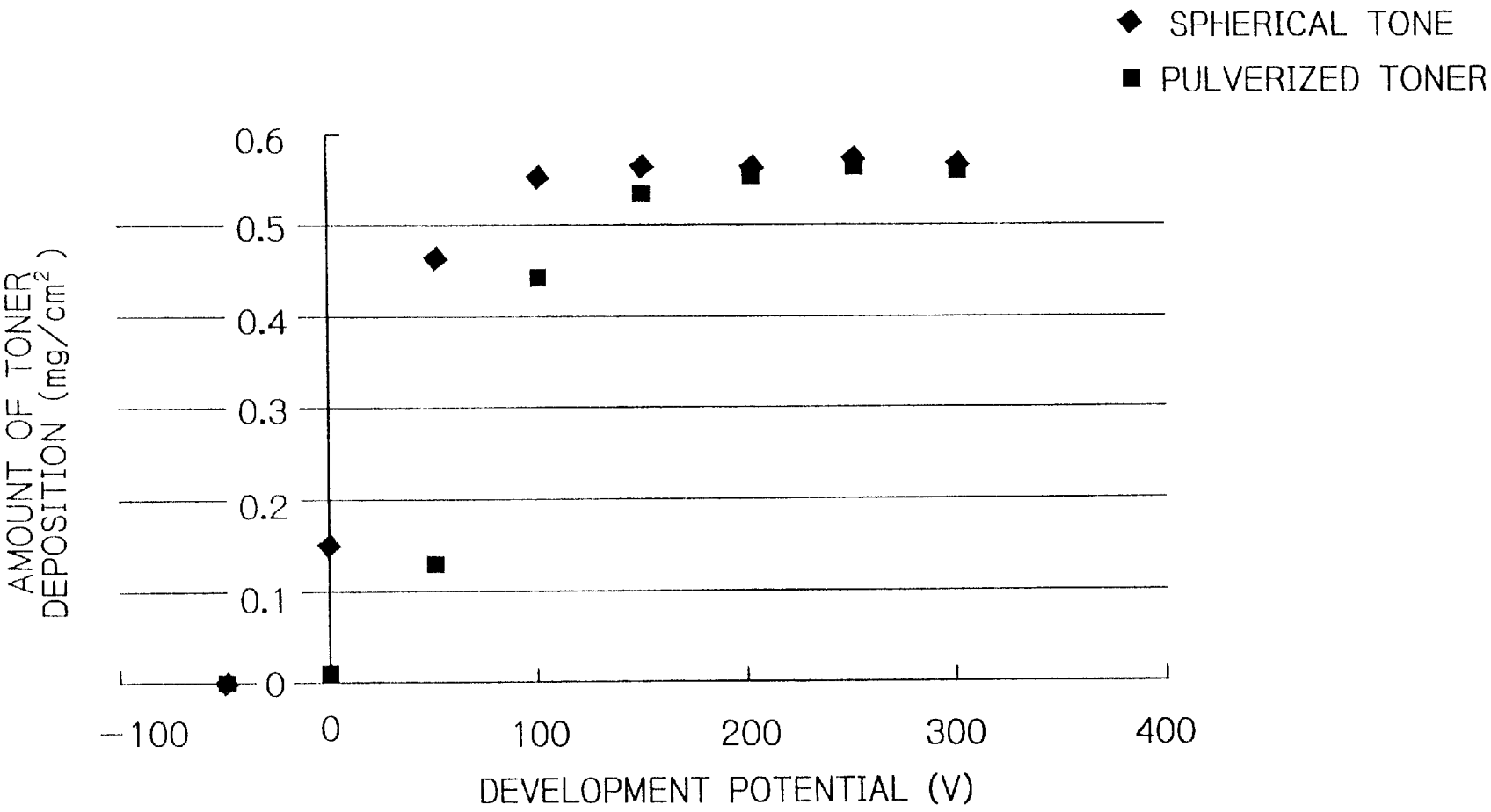
FIG. 35 is a graph comparing spherical toner and pulverized toner with respect to the development potential and the amount of toner deposition.

In the illustrative embodiment, too, use should preferably be made of spherical toner whose sphericity is 95% or above. The spherical toner makes the number distribution profile more shaper, as stated earlier. Consequently, as shown in FIG. 35, saturation development is achievable with a lower development potential than in the case of the conventional pulverized toner.

As stated above, the illustrative embodiment allows toner with a minimum of irregularity in the amount of charge to develop a latent image formed on the drum 1. Therefore, even when the amount of charge to deposit on the toner is reduced to enhance the developing ability, i.e., to implement saturation development with the low potential process, there can be reduced the number of toner grains of short charge and toner grains of opposite charge. It follows that the variation of image density ID can be reduced to 10% of the target, maximum image density or below within the range that satisfies the relations (2) through (4) or (5) through (7), as in the first embodiment. In addition, the fall of image quality, e.g., background contamination ascribable to the above undesirable toner grains can be reduced.

Further, only the charged toner can be separated from the magnet brush formed on the magnet brush roller 403 and then transferred to the developing roller 402. This makes it needless to frictionally charge the toner on the developing roller 402 with a blade or similar contact member. Consequently, there can be obviated toner filming on the developing roller 402 and the variation of the developing characteristic ascribable to the wear of the developing roller and that of a contact member.

In the illustrative embodiment, the distribution of the amount of toner charge differs from the developing roller 402 to the magnet brush roller 403. Assume that the distribution on the magnet brush roller 403 differs from a desired distribution due to, e.g., a limitation on a frictional charging characteristic on the roller 403. Then, the above difference in distribution between the developing roller 402 and the magnet brush roller 403 allows the toner with a desired distribution of the amount of charge to deposit on the developing roller 402. This realizes high-quality toner images free from background contamination and short image density (omission of dots). In addition, the amount of toner to remain on the drum 1 after image transfer decreases because of no background contamination, so that the cleaning device 6 can be reduced in size.

The toner on the developing roller 402 is scattered little as to the amount of charge and insures stable saturation development particularly in the case of a bilevel process. Therefore, images free from granularity ascribable to background contamination and short image density (omission of dots) can be stably output.

Moreover, the developing region A1 includes the zone where the toner contributing to development is present between the drum 1 and the developing roller 402. The substances and thickness of the photoconductive layer 1P and the substances and thickness of the toner are selected such that the capacitance $C_{TL}$ for a unit area in the above zone is greater than the capacitance $C_{PC}$ for a unit area of the photoconductive layer 1P. This successfully reduces the edge effect during development and prevents thin lines and small dots from being thickened, faithfully reproducing a latent image formed on the drum 1.

Fourth Embodiment

A fourth embodiment of the present invention to be described hereinafter is also directed toward the first object stated earlier. Assume that the $\gamma$ value for development is increased to effect saturation development with a low development potential, as stated earlier. Then, the illustrative embodiment reduces the deposition of excess toner on the drum 1, which would bring about background contamination, toner scattering, smearing of a thin line image and other critical defects.

Figure 36:
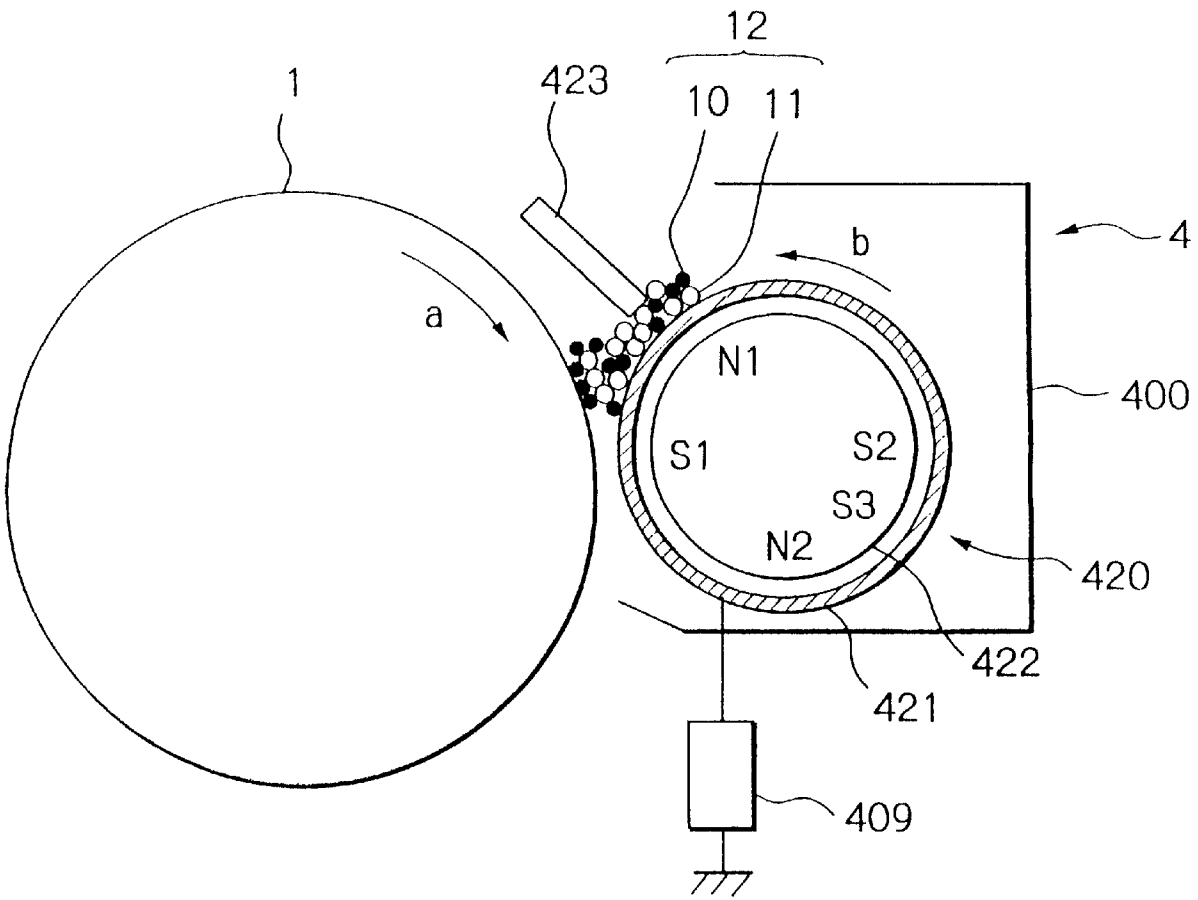
FIG. 36 is a view showing a developing device included in a fourth embodiment of the present invention.

FIG. 36 shows a developing device included in the illustrative embodiment. This embodiment is also practicable in the same manner as the first embodiment as to the formation of a latent image. In this embodiment, too, part of a plurality of devices constituting a printer may be constructed into a process cartridge.

In the illustrative embodiment, the toner 10 forming part of the developer 12 may be implemented as magnetic toner containing a magnetic substance. The magnetic substance may be selected from a group of iron oxides including magnetite, hematite and ferrite, a group of metals including cobalt and nickel, a group of alloys of such metals and aluminum, copper, lead, magnesium, tin, zinc, antimony, berrylium, bismuth, cadmium, calcium, manganese, selenium, titanium, tungsten, vanadium and other metals, and mixtures thereof. The magnetic substance should preferably have a mean grain size of 0.1 $\mu$m to 2 $\mu$m and should preferably be contained by 5 parts by mass to 20 parts by mass, more preferably 15 parts by mass, in 100 parts by mass of binder resin.

While an additive may not be applied to the toner 10, today it is often applied for enhancing the fluidity and uniform charging of the toner. The additive may be any one of oxides or composite oxides of Si, Ti, Al, Mg, Ca, Sr, Ba, In, Ga, Ni, Mn, W, Fe, Co, Zn, Cr, Mo, Cu, Ag, V and Zr. Among them, silica, titania and alumina that are the oxides of Si, Ti and Al, respectively, are desirable. Further, the additive should preferably be applied by 0.5 parts by mass to 1.8 parts by mass, more preferably 0.7 parts by mass to 1.2 parts by mass, to 100 parts by mass of mother grains. Amounts less than 0.5 parts by mass lower the fluidity of the toner and thereby deteriorate chargeability of the toner. Moreover, such short amounts make image transferability and heat resistance short and bring about background contamination and toner scattering.

On the other hand, the amounts of the additive above 1.8 parts by mass bring about the turn-up of a blade and other defective drum cleaning and the filming of the additive separated from the toner on the drum 1 although they enhance fluidity. As a result, the durability of a cleaning blade and that of the drum 1 are lowered to degrade fixation. Furthermore, the toner is apt to scatter at thin line images. This is particularly true in a full-color image in which at least two different colors of toner are superposed on each other and therefore in a great amount. Moreover, in the case of color toner, a great amount of additive darkens an image projected by an overhead projector.

While various methods are available for measuring the amount of the additive, X-ray fluorescence analysis is predominant.

In the illustrative embodiment, the additive should preferably be subjected to surface treatment for enhancing hydrophobicity and fluidity and effecting charge control. Surface treatment should preferably use an organic silane compound, e.g., methyltrichlorosilane, octyltrichlorosilane, dimethylchlorosilane or similar alkyl chlorosilane, dimethyldimethoxysilane, octyltrimethoxysilane or similar alkyl methoxysilane, hexamethyldisilazane, or silicone oil. For surface treatment, the additive may be immersed in a solution containing the organic silane compound and then dried. Alternatively, such a solution may be sprayed onto the additive and then dried. The illustrative embodiment is desirably practicable with either one of such methods.

The toner 10 has a volume mean grain size preferably ranging from 3 m to 12 $\mu$m. In the illustrative embodiment, the volume mean grain size is selected to be 6 $\mu$m and can sufficiently adapt even to resolution as high as 1,200 dpi or above. Use was made of the analyzer stated earlier for measuring the volume mean particle size of the toner.

The magnetic grains 11 forming the other part of the developer 12 each has a core formed of metal or resin and contains ferrite or similar magnetic substance. The surface layer of each magnetic grain may or may not be coated with, e.g., silicone resin. The magnetic grains 11 should preferably have a grain size of 20 $\mu$m to 50 $\mu$m and electric resistance of $10^2\Omega$ to $10^7\Omega$ in terms of dynamic resistance DR. The dynamic resistance DR is measured by the same method as in the first embodiment.

The magnet roller 422 is held stationary inside the sleeve 421 and has a plurality of magnetic poles. The magnet roller 422 exerts a magnetic force on the developer 12 when the developer 12 on the sleeve 421 passes a preselected position. In the illustrative embodiment, the sleeve 421 has a diameter of 18 mm. The surface of the sleeve 421 has surface roughness ranging from 5 $\mu$m to 50 $\mu$m RZ. For this purpose, the surface of the sleeve 421 may be roughened by sandblast or formed with a plurality of grooves that are 1 mm to several millimeters deep each.

The magnet roller 422 has five poles N1 (N pole), S1 (S pole), N2 (N pole), S3 and S2 (S pole) as named from the position where the doctor 423 is positioned in the direction of rotation of the sleeve 421. The magnet roller 422 causes the developer 12 to form a magnet brush on the sleeve 421. In the magnet brush, the toner 10 is mixed with the carrier or magnetic grains 11 and charged to a preselected amount thereby. In the illustrative embodiment, the preselected amount of charge should preferably be between −5 $\mu$C/g and −30 $\mu$C/g. To measure the amount of charge, the analyzer described in relation to the first embodiment was also used.

In the illustrative embodiment, the gap between the doctor 423 and the sleeve 421, as measured at the position where they are closest to each other, is selected to be 500 $\mu$m. The pole N1 is inclined by several degrees from the position where the doctor 423 and the sleeve 421 face each other toward the upstream side in the direction of rotation of the sleeve 421. In this configuration, the circulation of the developer 12 from the doctor 423 is facilitated.

In the developing device 4, a hopper 400 stores the developer made up of the toner 10 and magnetic grains 11. An agitator, not shown, the rotation of the sleeve 421 and the magnetic force of the magnet roller 422 agitate the developer 12. At this instant, the toner 10 is charged to preselected polarity due to friction acting between it and the magnetic grains 11. The doctor 423 regulates the developer 12 deposited on the sleeve 421. Part of the developer 12 blocked by the doctor 423 is returned to the hopper 400.

The toner 10 of the developer 12 deposited on the sleeve 421 deposits on a latent image formed on the drum 1 due to a bias applied to the sleeve 421, developing the latent image. In the illustrative embodiment, the drum 1 has a diameter of 50 mm and moves at a linear velocity of 200 mm/sec. The sleeve 421 has a diameter of 18 mm and moves at a linear velocity of 240 mm/sec. The toner on the sleeve 421 is charged to −5 $\mu$C/g to −30 $\mu$C/g. A gap GP between the drum 1 and the sleeve 421 may be 0.8 mm to 0.2 mm as conventional; a smaller gap GP promotes more efficient development.

Figure 37:
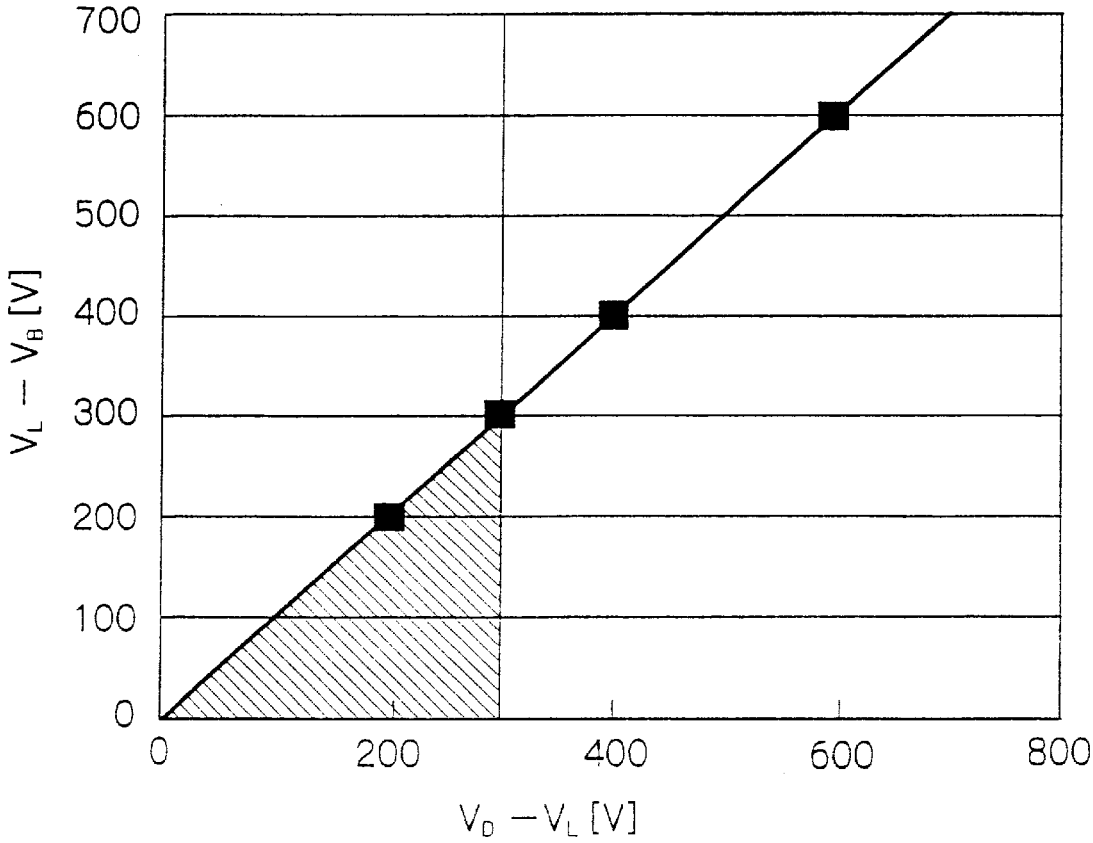
FIG. 37 is a graph showing a relation between potential differences.

Developing conditions particular to the illustrative embodiment will be described hereinafter. In the illustrative embodiment, the drum 1 has a uniform potential $V_D$ of −300 V before exposure and has a potential $V_L$ of 50 V after exposure while the bias $V_B$ for development is −250 V; the development potential ($V_L-V_B$) is 200 V. FIG. 37 shows a relation between $|V_D-V_L|$ (abscissa) and $|V_L-V_B|$ (ordinate). The range where $|V_D-V_L|$ is smaller than 300 V is set on the basis of Paschen's law in order to avoid discharge between the exposed portion and the unexposed portion of the drum 1. It was experimentally found that when the potential difference was 400 V or less, discharge occurs little, as shown in FIG. 8. Theoretically, too, it was proved that a potential difference of 315 V or less caused no discharge.

In FIG. 37, an oblique line is representative of $|V_D-V_L|=|V_L-V_B|$. In the illustrative embodiment that effects negative-to-positive development, the values $V_D$, $V_L$ and $V_B$ are of the same polarity, so that $|V_D|-|V_B|$ is greater than zero in a range indicated by hatching. More specifically $|V_D-V_L|$ and $|V_D-V_B|$ can have values lying in the range indicated by hatching.

In the illustrative embodiment, too, the relation between the development potential and the image density ID described with reference to FIG. 9 holds. FIG. 38 compares the example 1 and comparative examples 1 and 2 with respect to the slopes of curves.

Assume that an amount of toner necessary for implementing the saturation image density ID is X and expressed as:

$$X=0.6\times\text{grain size}\times\text{true specific gravity/transfer ratio} \quad (9)$$

Then, in the illustrative embodiment, the amount of toner to deposit on the drum 1 is selected to be 1.5 times as great as X. Assume that the toner has a grain size of 6.8 μm, true specific gravity of 1.05 g/cm$^3$ and transfer ratio of 90%, and that the necessary amount of 60%. Then, X is produced by:

$$X = 0.8\times10^{-4}\ (\text{cm})\times1.05\ (\text{g/cm}^3)/0.9\times0.6$$
$$= 0.476\ (\text{mg/cm}^2)$$

Consequently, 1.5×X=0.714 (mg/cm$^2$) holds.

Figure 39:
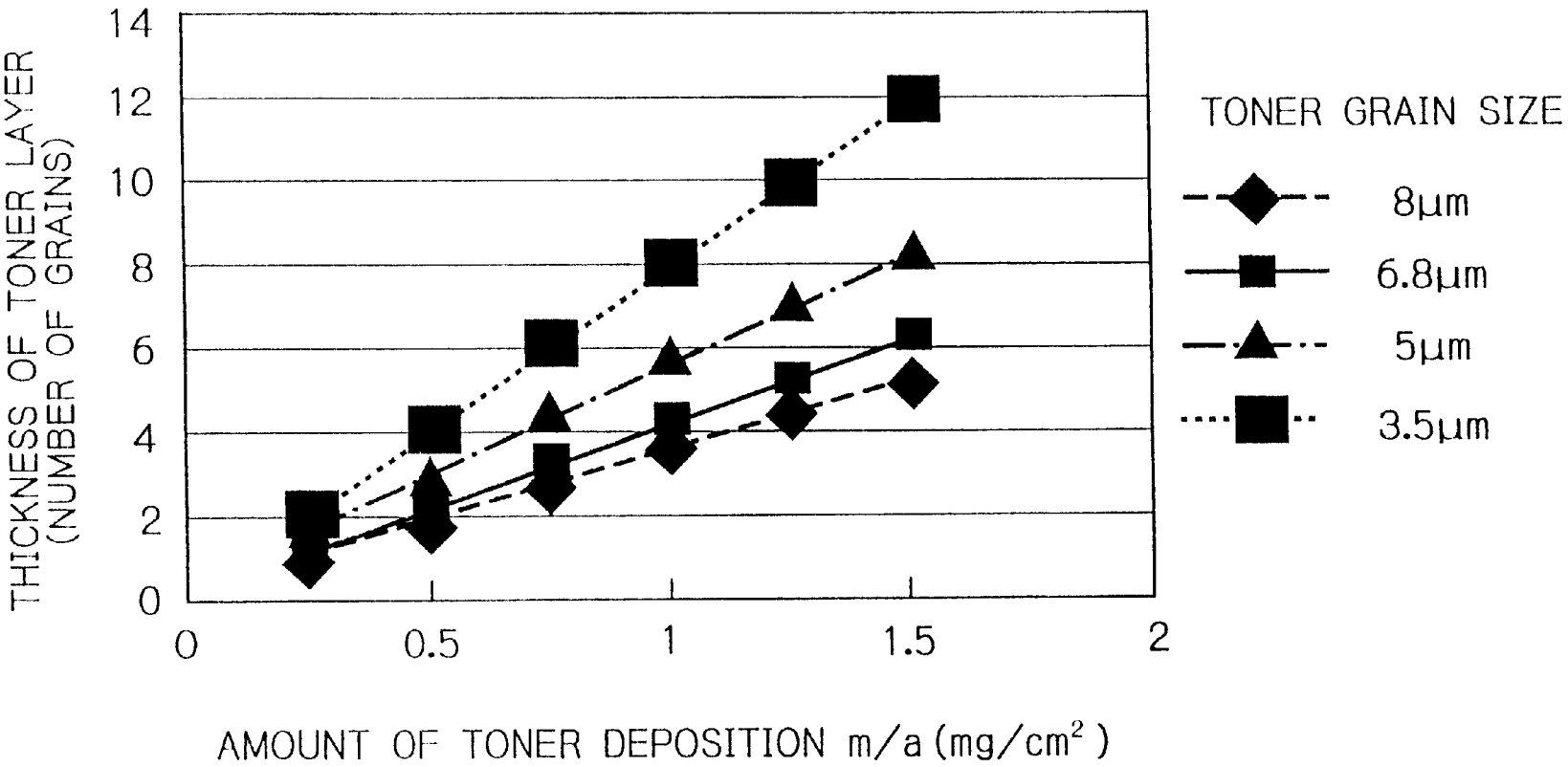
FIGS. 39 and 40 are graphs each showing a particular relation between the amount of toner deposited on a photoconductive drum and the thickness of a toner layer with respect to the grain size of toner.
Figure 40:
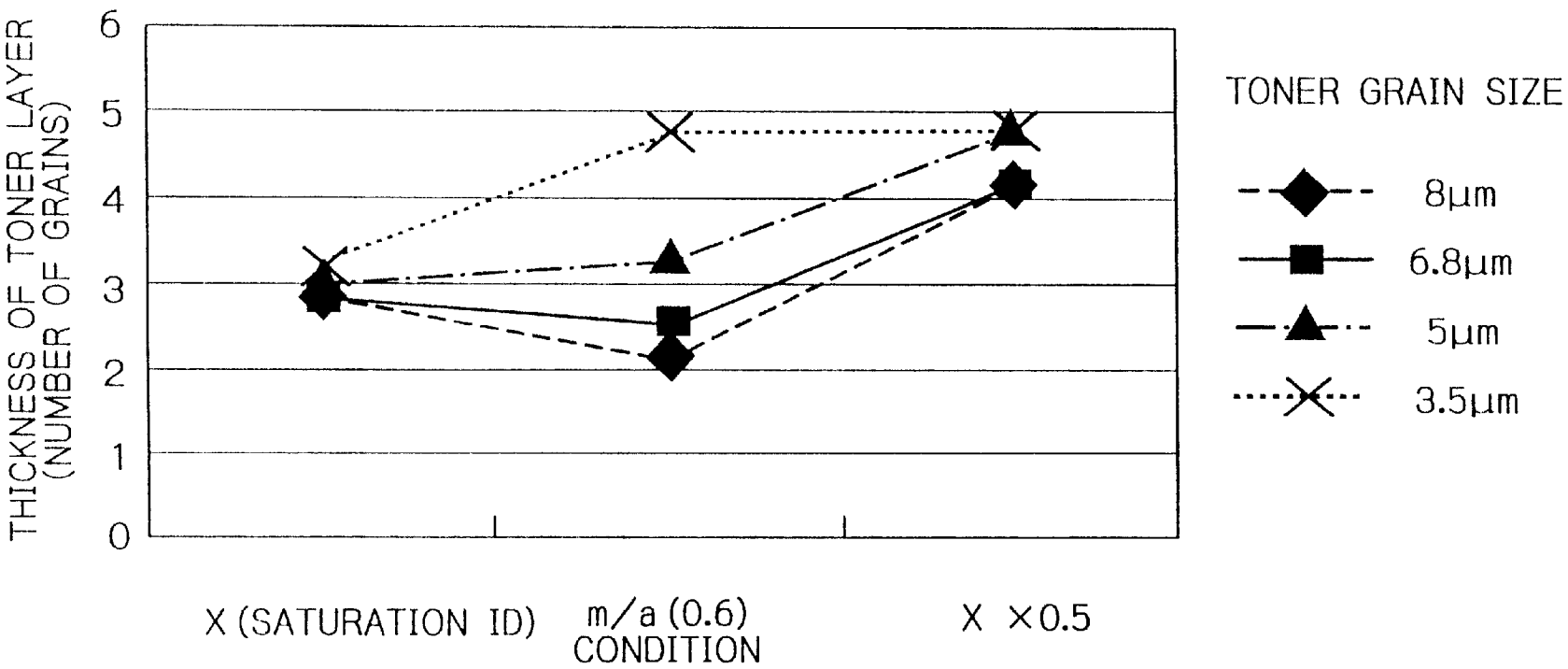

FIG. 39 shows a relation between the amount of toner deposition and the thickness of toner layer in terms of the number of toner grains by using the grain size of toner as a parameter. FIG. 40 shows, also by using the grain size of toner as a parameter, the thickness of toner layer when the amount of toner on the drum 1 is coincident with the necessary amount X, when it is 0.6 mg/cm$^2$ and when it is 1.5 times as great as X in terms of the number of toner grains. As shown, when the amount of toner on the drum 1 is 1.5 times as great as X, the toner thickness includes five layers or less. When the toner forms five layers, electrostatic adhesion is about 1/25 of adhesion achievable when it forms a single layer, managing to retain the toner. However, six or more layers reduce the adhesion to 1/36 and cause the toner to scatter particularly in the event of transfer. As shown in FIG. 40, when the maximum amount of toner to deposit on the drum 1 is 0.6 mg/cm$^2$, the toner forms five or less layers on the drum 1 and therefore does not scatter in the event of transfer.

In a color image forming apparatus in particular, toner is easy to scatter because toner layers are superposed on each other. The illustrative embodiment that reduces the amount of toner to deposit on the drum 1 successfully prevents the toner from scattering even in a color image forming apparatus.

In the illustrative embodiment, to limit the toner feeding ability of the magnet brush, the ratio of the amount of toner used for development to the amount of toner fed to the magnet brush should preferably be 70% or above so as not to provide the magnet brush with an excessive feeding ability. Ratios of 70% and 80% will be compared with a comparative ratio of 60% hereinafter.

Assume that the necessary amount of toner to deposit on the drum 1 is 0.7 mg/cm$^2$ and satisfied when the toner grain size and carrier grain size are 6.8 μm and 5 μm, respectively, and when the sleeve 421 moves at a linear velocity ratio of 2 to the drum 1. Then, the amount of developer 12 to be scooped up is 10 mg/cm$^2$ for the ratio of 70%, 11.6 mg/cm$^2$ for the ratio of 60% or 81.75 mg/cm$^2$ for the ratio of 80%.

Figure 41:
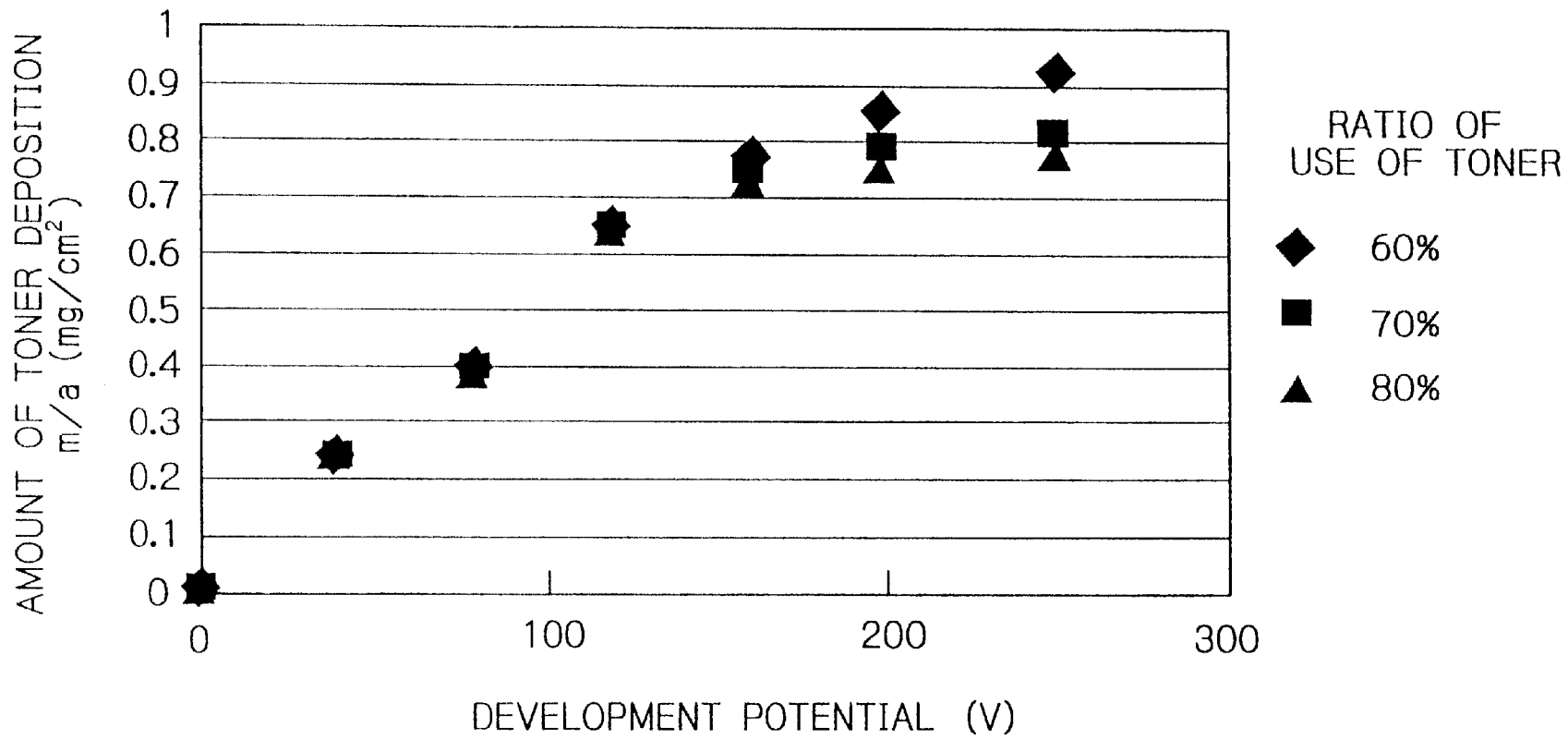
FIG. 41 is a graph showing a relation between the development potential and the amount of toner deposition with respect to a ratio by which toner is used.

FIG. 41 shows a relation between the development potential (abscissa) and the amount of toner deposited on the drum 1 (ordinate) by using the above ratio as a parameter. As shown, when the development potential increased by accident, the illustrative embodiment maintained the acceptable amount of toner deposition of about 0.8 mg/cm$^2$ for both of the ratios of 70% and 80%. By contrast, the comparative ratio of 60% increased the amount of toner deposition to about 0.92 mg/cm$^2$, which was excessive and caused the toner to scatter in the event of transfer.

Fifth Embodiment

This embodiment is also directed toward the first embodiment stated earlier. The illustrative embodiment limits the development potential $V_P$ or the height of the magnet brush to thereby reduce the toner feeding ability of the magnet brush to an adequate degree. The illustrative embodiment is identical with the fourth embodiment as to the basic construction and operation.

In the illustrative embodiment, the development potential $V_P$ is controlled to reduce potential variation. For this purpose, a potential sensor, not shown, is located to face part of the drum 1 where a latent image exists. The output of the potential sensor is used to control the difference between the above two factors to a constant value. Therefore, even when the charge potential or the amount of exposure varies at the time of initial charging, there can be reduced the variation of the development potential $V_P$. In a comparative example not executing the above control, the development potential $V_P$ varied by $\Delta V_D$ of +20 V as to the charge potential and by $\Delta V_L$ of +10 V as to exposure, i.e., by 30 V in total. As a result, the amount of development increased by 0.4 mg/cm$^2$ and caused the toner to scatter, lowering the rank from 4 to 2.5.

The height of the magnet brush to be controlled during development is measured on the assumption that the drum 1 is absent. Specifically, for a gap of 400 μm for development, the height of the magnet brush is selected to be 750 μm that is less than two times of the above gap. This height will be compared with a height of 820 μm that is more than two times as great as the above gap. While the toner content TC is basically maintained at 5% by mass, the doctor gap GD is varied to vary the amount of toner to be scooped up and therefore the height of the magnet brush.

Figure 42:
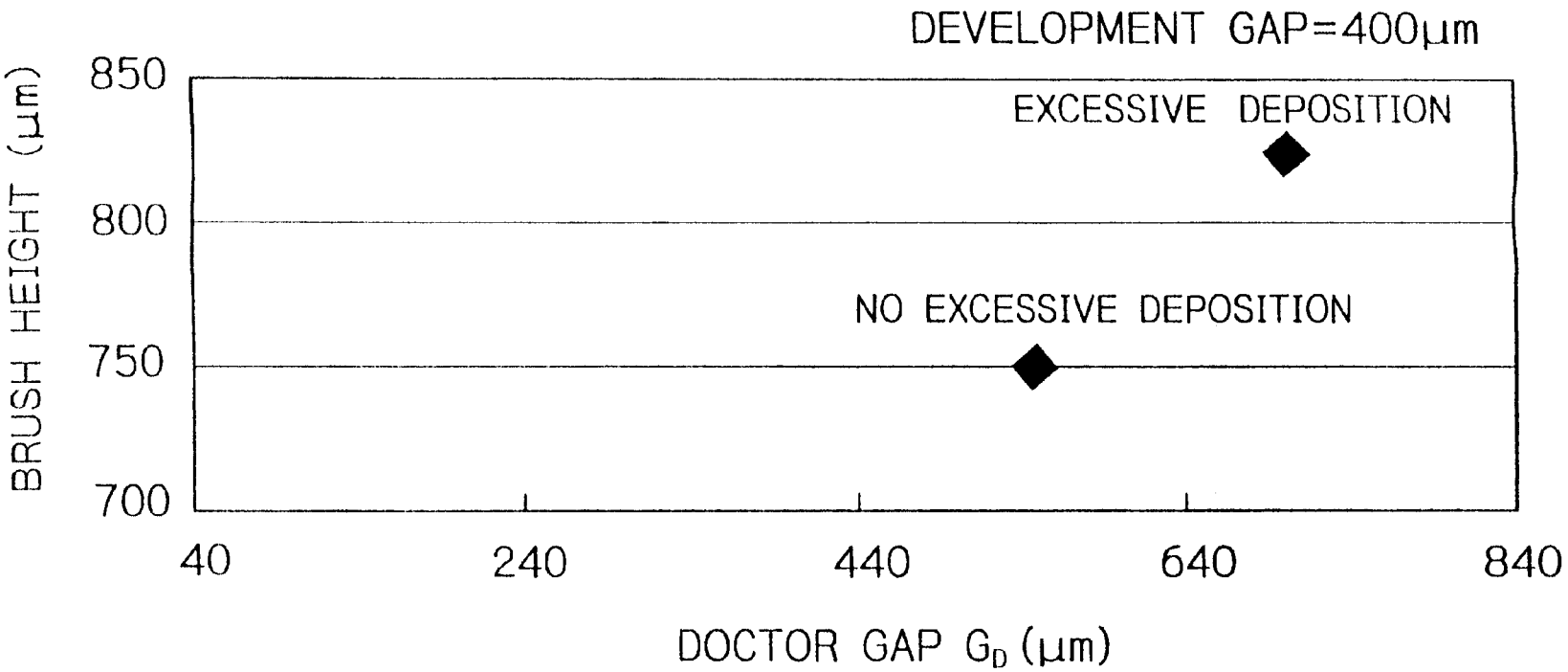
FIG. 42 is a graph showing a relation between a doctor gap and the height of a magnet brush.
Figure 43:
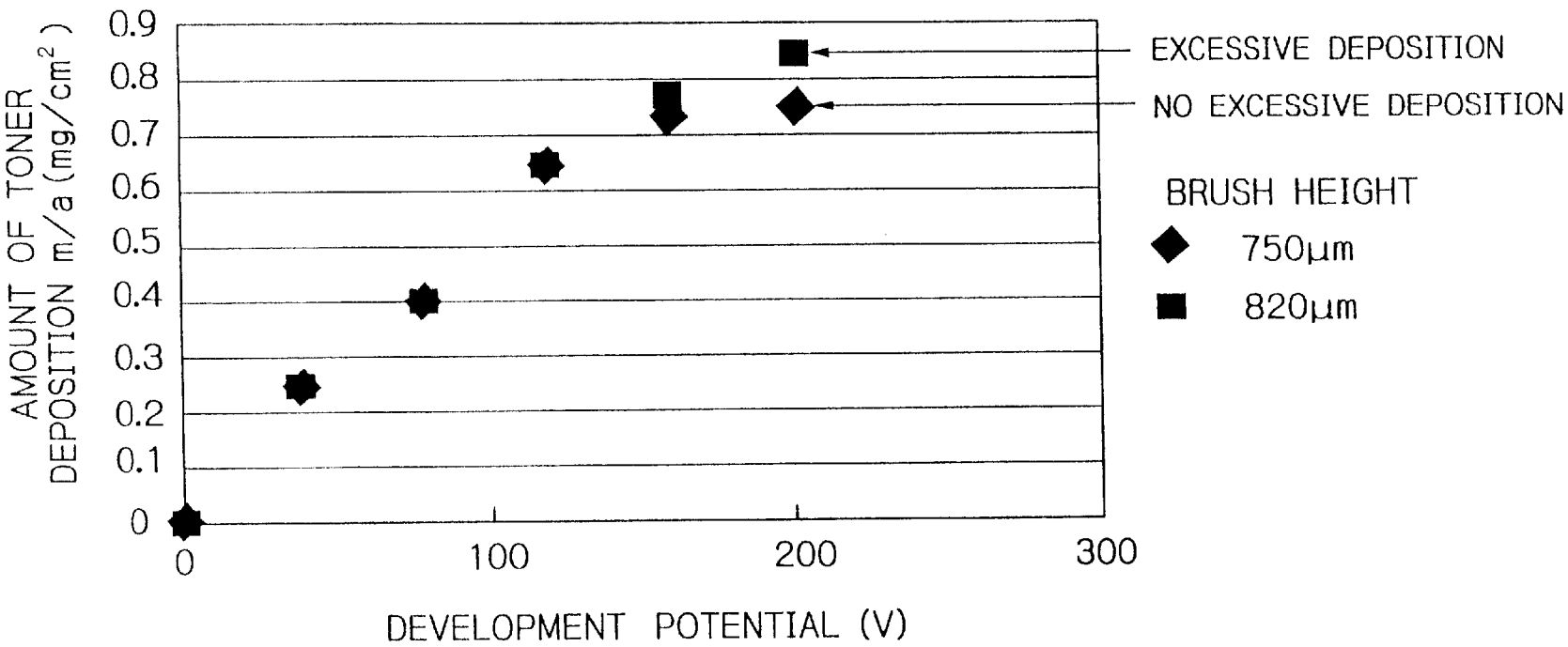
FIG. 43 is a graph showing a relation between the development potential and the amount of toner deposition with respect to the height of the magnet brush.

FIG. 42 compares an example of the illustrative embodiment and a comparative example as to the height of the magnet brush. In the example, the doctor gap GD and the amount of toner scooped up were 550 μm and 60 mg/cm$^2$, respectively. In the comparative example, the doctor gap GD and the amount of toner scooped up were 700 μm and 80 mg/cm$^2$, respectively. FIG. 43 shows the γ characteristic of the example of the illustrative embodiment and that of the comparative example. As shown, the amount of toner deposition was about 0.81 mg/cm$^2$ and adequate in the illustrative embodiment, but was 0.93 mg/cm$^2$ and excessive in the comparative example. The comparative example therefore caused the toner to scatter.

Sixth Embodiment

This embodiment is also directed toward the first object stated earlier. Briefly, the illustrative embodiment limits the ratio by which the toner grains cover the individual magnetic grain or carrier grain to 50% or less. This is also successful to reduce the toner feeding ability of the magnet brush. The illustrative embodiment is identical with the fourth embodiment as to basic construction and operation.

The ratio Tn by which the toner grains cover the individual carrier grain is a function of the addition ratio TC of the additive and expressed as:

$$100C\cdot\sqrt{3} \quad (10)$$
$$Tn$$
$$2\pi(100-C)\ (1+r/R)^2(r/R)\ (r/c)$$

where C denotes the toner content TC (% by mass), r denotes the radius of toner grains, R denotes the radius of carrier grains, ρr denotes the true specific gravity of toner grains, and ρt denotes the true specific gravity of carrier grains.

Figure 44:
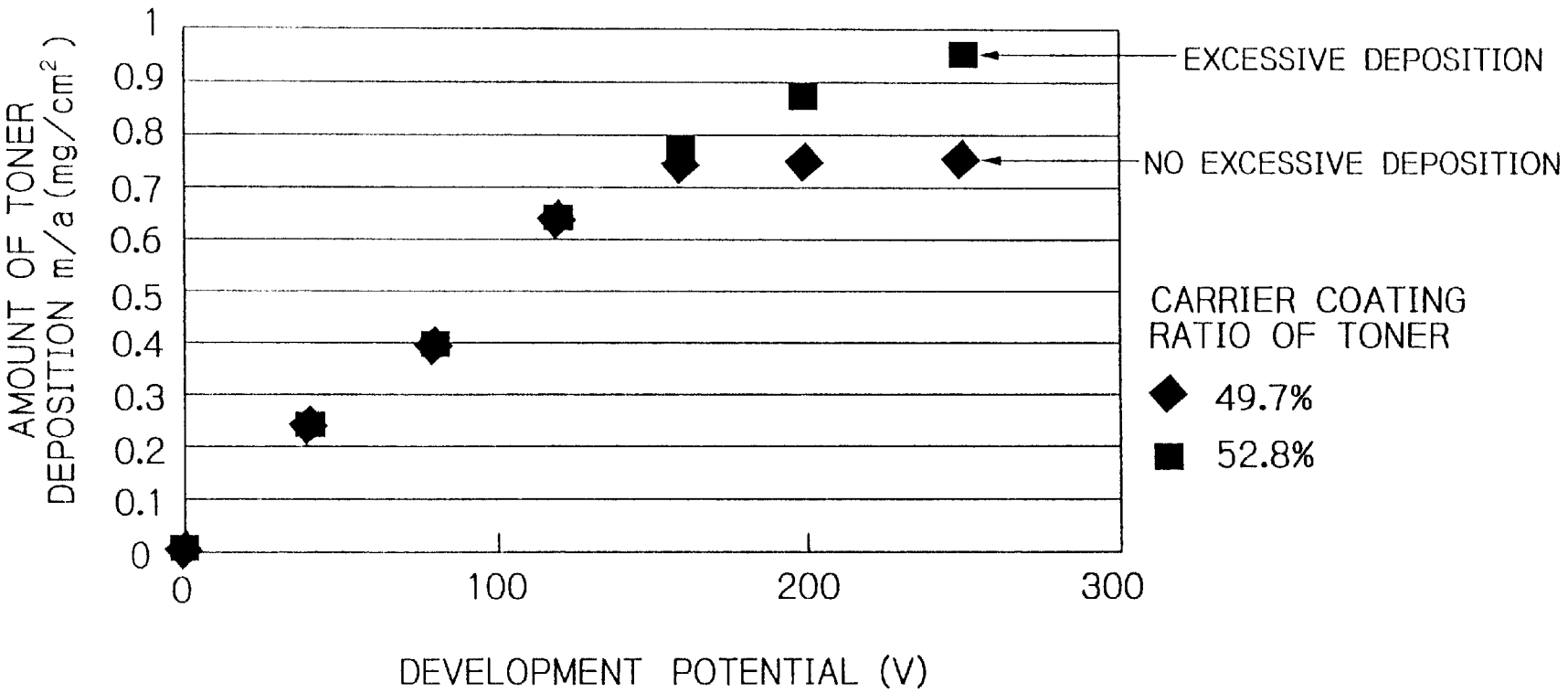
FIG. 44 is a graph showing a relation between the development potential and the amount of toner deposition with respect to the ratio by which toner grains covers the individual magnetic grain or carrier grain.

FIG. 44 shows a relation between the coating ratio of toner grains and the excessive deposition of toner (excessive saturation). As shown, so long as the coating ratio is 50% or less, the amount of toner to be fed can be controlled and insures a margin as to excessive saturation. However, when the coating ratio exceeds 50%, the toner feeding ability of the magnet brush increases and is apt to bring about excessive saturation. When the toner grain size and carrier grain size are 6.8 $\mu$m and 50 $\mu$m, respectively, and when the toner content is 7% by mass, the coating ratio is about 50%. When the toner content exceeded 7% by mass, the development potential $V_P$ varied as a result of a change in the quantity of light. When the development potential $V_P$ increased by +30 V, the amount of toner deposition increased to 0.95 mg/cm$^2$ at 250 V for the toner content of 7.2% by mass. As a result, the toner scattered at the time of transfer and critically lowered imaged quality. On the other hand, when the toner content was 6.8% by mass, the amount of toner deposition was controlled to 0.77 mg/cm$^2$ even when the development potential $V_P$ increased under the same conditions, practically obviating toner scattering.

Seventh Embodiment

This embodiment is also directed toward the first object stated earlier. To reduce the toner feeding ability of the magnet brush, the illustrative embodiment limits the linear velocity ratio of the sleeve 421 to the drum 1, the amount of developer to be scoop up to the sleeve 421, and the magnetic force to act on the sleeve 421. This embodiment is identical with the fourth embodiment as to basic construction and operation.

More specifically, the illustrative embodiment limits at least one of (1) the linear velocity ratio of the sleeve 421 to the drum 1, (2) the amount of developer to be scooped up to the magnet brush, and (3) the pressure to be exerted on the drum 1 by the magnet brush, which is made soft. The factors (1) through (3) will be sequentially described in detail hereinafter.

(1) Linear Velocity Ratio

Figure 45:
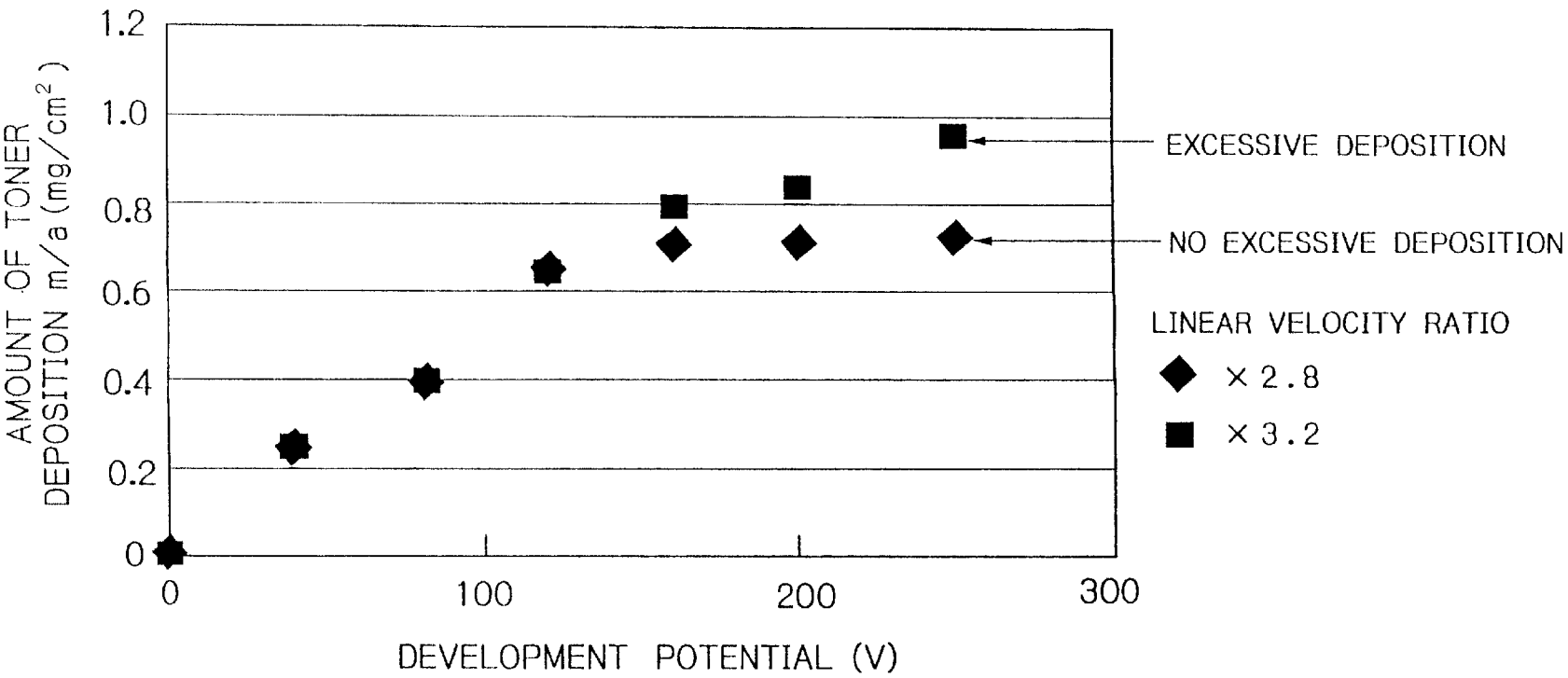
FIG. 45 is a graph showing a relation between the development potential and the amount of toner deposition with respect to a linear velocity ratio of a sleeve to a photoconductive drum.

The linear velocity ratio of the sleeve 421 to the drum 1 should preferably be 3 or below. Such a lower ratio successfully reduces the toner feeding ability and thereby obviates the excessive deposition of toner. An example of the illustrative embodiment in which the linear velocity ratio was 2.8 and a comparative example in which it was 3.2 will be compared hereinafter. FIG. 45 shows toner scattering ranks ascribable to excessive toner deposition in relation to different linear velocity ratios VD/VP of the sleeve 421 to the drum 1; the ordinate and abscissa respectively indicate the amount of toner deposited on the drum 1 and the development potential. In both of the example and comparative examples, the toner grains had a diameter of 6.8 $\mu$m, the carrier grains had a diameter of 50 $\mu$m while the toner content TC was 5% by mass. When the linear velocity ratio was 2.8, the toner feeding ability was reduced and maintained toner deposition at an adequate level of 0.73 mg/cm$^2$ for the development potential VP of 250 V. By contrast, when the linear velocity ratio of 3.2 particular to the comparative example, the amount of toner deposition was 0.96 mg/cm$^2$ and brought about toner scattering at the time of transfer.

(2) Scooping of Developer

The amount of developer to be scooped up and deposited on the sleeve 421 should preferably be 60 mg/cm$^2$ or below. By so reducing the amount of developer to deposit on the sleeve 421, it is possible to limit the toner feeding ability and therefore to obviate excess toner deposition. A specific example of the illustrative embodiment that scoops up the developer by 58 mg/cm$^2$ and a comparative example that scoops it up by 64 mg/cm$^2$ will be compared hereinafter.

Figure 46:
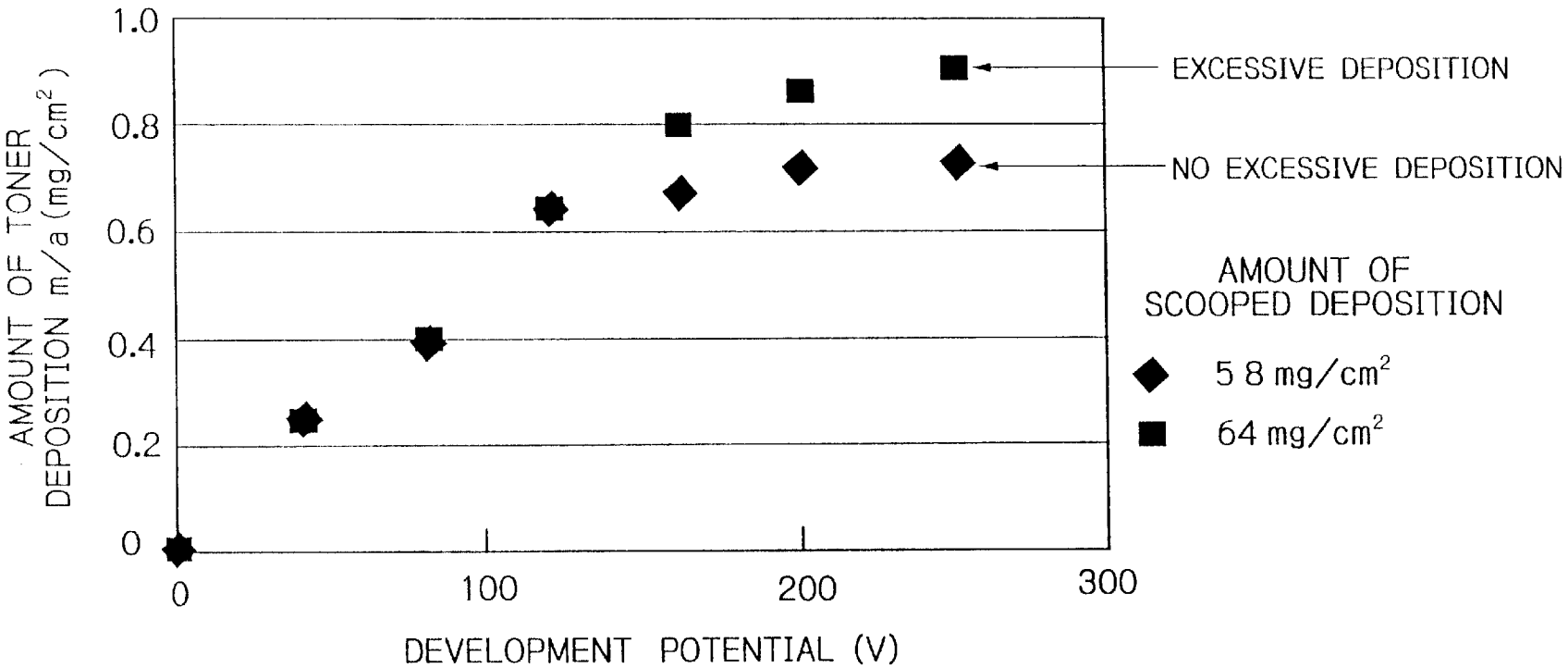
FIG. 46 is a graph showing a relation between the development potential and the amount of toner deposition with respect to the amount of the developer scooped up.

FIG. 46 shows toner scattering ranks to occur at the time of transfer with respect to different scooping amounts; the ordinate and abscissa respectively indicate the amount of toner deposited on the drum 1 and the development potential. In both of the example and comparative example, the toner and carrier had a diameter of 6.8 $\mu$m and a diameter of 50 $\mu$m, respectively, and the toner content TC was 5% by mass. When the developer was scooped up by 58 mg/cm$^2$, the excess toner deposition was 0.73 mg/cm$^2$ and adequate. By contrast, when the scooping amount was 64 mg/cm$^2$, the excessive toner deposition was 0.94 mg/cm$^2$and brought about toner scattering.

(3) Pressure of Magnet Brush Acting on Drum 1

The magnet brush formed on the sleeve 421 should preferably be soft enough to reduce pressure to act on the drum 1. This also reduces the toner feeding ability and thereby obviates excessive toner deposition. Torque for development and the amounts of toner charges vary in accordance with some parameters of the illustrative embodiment, as described with reference to FIG. 14. By selecting such parameters within the range of the examples A through D of the illustrative embodiment, it is possible to reduce the developing ability and therefore to obviate excessive toner deposition.

While the pole S1 of the magnet roller or magnet member 422 plays the role of a main pole, all the poles effect the conveyance of the developer including the magnetic grains and the hardness of the magnet brush. This is determined by the magnetic force of the individual pole and the saturation magnetization of the magnetic grains. In the illustrative embodiment, the main pole S1 exerts a magnetic force $M_D$ of 70 mT while the magnetic grains 11 have the intensity of magnetic saturation $M_C$ of $100\times4\Pi\times10^{-7}$ Wb.m/kg (=100 emu/g). In these conditions, the magnet brush has adequate hardness and can be continuously used without any stress despite aging.

Figure 47:
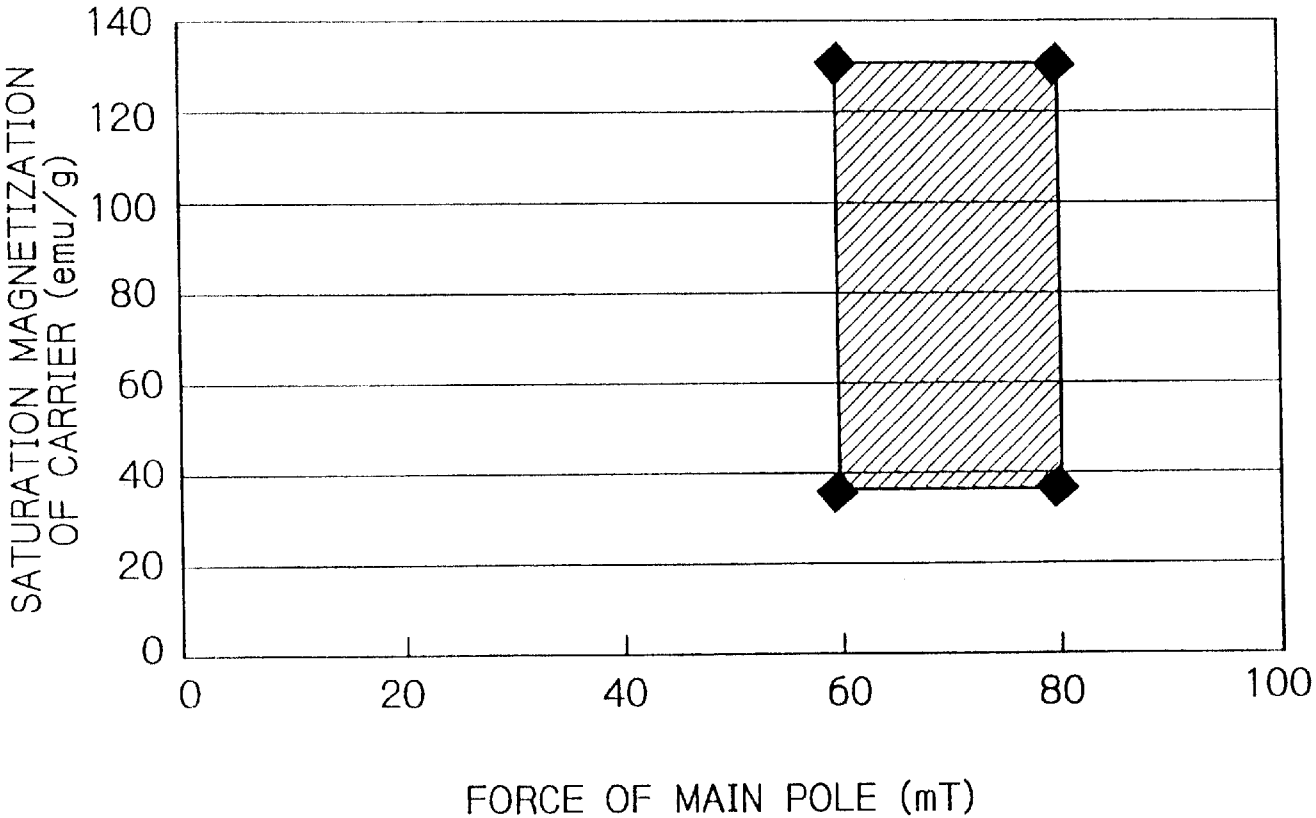
FIG. 47 is a graph showing a range in which the magnetic force of a main magnetic pole and magnetic grains are adequate.

In FIG. 47, in an area indicated by hatching, the magnetic force $M_D$ of the main pole S1 and the saturation magnetization of the magnetic grains 11 are adequate. When the magnetic force $M_D$ was lower than 60 mT or when the saturation magnetization $M_C$ of the main pole S1 was lower than $30\times4\Pi\times10^{-7}$ Wb.m/kg (=30 emu/g), a magnet brush strong enough to insure uniform development was not attained. Further, when the magnetic force $M_D$ was higher than 80 mT or when the saturation magnetization $M_C$ was higher than $140\times4\Pi\times10^{-7}$ Wb.m/kg (=140 emu/g), a strong magnet brush was formed and increased the amount of toner feed, resulting in toner scattering. In the range indicated by hatching in FIG. 47, an adequately strong magnet brush was formed and insured uniform development without any toner scattering.

While the first to seventh embodiments shown and described have concentrated on negative-to-positive development, the present invention is similarly practicable with positive-to-positive development.

The present invention is applicable even to an image forming apparatus of the type including an intermediate image transfer body. In this type of apparatus, a toner image formed on a photoconductive drum is transferred to the intermediate image transfer and then transferred to a sheet. This type of apparatus may be implemented as a color image forming apparatus sequentially forming toner images of different colors on the drum while transferring them to an intermediate image transfer belt one above the other and then transferring the resulting composite color image to a sheet. Further, the image forming apparatus may be implemented as a tandem image forming apparatus including a plurality of image forming units arranged side by side along a path on which an intermediate image transfer belt moves.

While the illustrative embodiments have been described in relation to a printer, the present invention is, of course, applicable to any other image forming apparatus, e.g., a copier or a facsimile apparatus.

As stated above, the first to seventh embodiments directed toward the first object achieve various unprecedented advantages, as enumerated below.

(1) The amount of charge to deposit on an image carrier decreases and reduces the fatigue of the image carrier ascribable to repeated charging and exposure. This extends the service life of the image carrier. In addition, in a particular range of variation of a development potential, the variation of image density is confined in a particular width. This reduces a decrease in image density and irregular image density ascribable to the variation of development potential.

(2) Not only image density sufficiently higher than saturation image density is insured, but also background contamination and other defects ascribable to the excessive deposition of toner on the image carrier is obviated.

(3) When use is made of a two-ingredient type developer, the variation of image density can be surely confined in the above range.

(4) The edge effect is reduced during development.

(5) The size of the development potential that forms a preselected electric field for development can be reduced. This also achieves the above advantage (3) and is also true when use is made of a single-ingredient type developer.

(6) There can be reduced a contact pressure at a nip between a developer carrier and a metering member, so that the toner is free from critical mechanical hazard ascribable to aging.

(7) The developer carrier conveys the toner with a minimum of irregularity in the amount of charge to a developing region. This more surely confines the variation of image density in the preselected range when use is made of a single-ingredient type developer.

(8) The toner feeding ability of a magnet brush formed on the developer carrier can be surely reduced.

(9) The fluidity of toner is guaranteed. Further, there can be controlled, e.g., the variation of the characteristic of the developer ascribable to an additive, which may be buried in toner and magnetic grains, and toner filming on the image carrier ascribable to an excessive amount of additive.

(10) An image forming process unit allows, e.g., the image carrier included therein to be replaced independently of the other components.

Eighth Embodiment

This embodiment is directed toward the second object stated earlier and is identical with the first embodiment as to basic construction and operation described with reference to FIGS. 1, 2, 4 and 5. The illustrative embodiment uses a two-ingredient type developer made up toner and magnetic grains. The magnetic grains have dynamic resistance of $10^2\Omega$ or above, but $10^6\Omega$ or below. Assume that the toner of the developer deposited on the developing roller 420 has a mean amount of charge of 10 $\mu$C/g or above, but 25 $\mu$C/g or below in absolute value. Then, in the illustrative embodiment, the distribution of the number of toner grains with respect to the grain size on the developing roller 420 has a profile whose half-width is 28% or less of the peak grain size of the profile.

In the illustrative embodiment, the developing roller 420 should preferably have a diameter of 18 mm while the mean amount of toner charge on the roller 420 should preferably be between −10 $\mu$C/g and −25 $\mu$C/g. The illustrative embodiment deposits a mean amount of charge of about −20 $\mu$C/g on the toner.

For the toner 10, use is made of SR (Spherical high-Resolution) toner grains that are extremely close to a sphere. While toner produced by polymerization belongs to spherical toner, it is essentially different from SR toner. The illustrative embodiment enhances the sphericity of toner and thereby makes the profile of the number distribution sharp by using the following materials. SR toner is dry toner containing polyester modified by urea bond at least as a toner binder.

[I] Urea-Modified Polyester

Urea-modulated polyesters (i) include reaction products of polyester prepolymers (A) having an isocyanate group and amines (B). Polyester prepolymers (A) with an isocyanate group include polyester, which is a condensation polymer of polyol (1) and polycarboxilic acid (2), and having an active hydrogen group and further caused to react with polyisocyanate (3). The active hydrogen group may be any one of hydroxyl groups (alcoholic hydroxyl group and phenolic group), amino group, carboxyl group and mercapto group. Among them, the alcoholic hydroxyl group is desirable.

Polyol (1) may be any one of diol (1-1) and trivalent or higher polyol (1-2). Among them, diol (1-1) or a mixture of diol (1-1) and some polyol (1-2) is desirable.

Diol (1-1) may be selected from a group of alkoxylene glycols including ethylene glycol, 1,2-propyrene glycol, 1,3 kk-propyrene glycol, 1,4-butanediol and 1,6-hexanediol, a group of alkylene ether glycols including diethylene glycol, triethylene glycol, dpropyrene glycol, polyethylene glycol, polypropyrene glycol and polytetramethylene glycol, a group of alicyclic diols including 1,4-cyclohexanedimethanol and hydrogenated bisphenol A, a group of bisphenols including bisphenol A, bisphenol F and bisphenol S, a group of alicyclic diols to which alkylene oxides (ethylene oxide, propyrene oxide, butylene oxide and so forth) are added, and a group of bisphenols to which alkylene oxides (ethylene oxide, propylene oxide, buthylene oxide and so forth) are added. Among them, alkylene glycols having two to twelve carbons and bisphenols with alkylene oxides added thereto are preferable. A combination of bisphenols with alkylene oxides added thereto and alkylene glycols with two to twelve carbons are more preferable.

Trivalent or higher polyols (1-2) may be selected from a group of trivalent to octavalent or higher polyvalent aliphatic alcohols including glycerin, trimethylolethane, trimethylolpropane, pentaerythriol and sorbitol, a group of trivalent or higher phenols including trisphenol PA, phenolic novolak and cresol novolak, and the trivalent polyphenols to which alkylene oxides are added.

Polycarboxylic acids include dicarboxylic acid (2-1) and trivalent or higher polycarboxylic acid (2-2); (2-1) or a mixture of (2-1) and some (2-2) is desirable.

Dicarboxylic acids include alkylene dicarboxylic acids (succinic acid, adipic acid, and sebacic acid), alkenylene dicarboxyl acids (maleic acid and fumaric acid), and aromatic dicarboxylic acids (phthalic acid, isophthalic acid, terephthalic acid and naphtalene dicarboxylic acid). Among them, alkenylene dicarboxylic acids having four to twenty cargons and aromatic dicarboxylic acids having eight to twenty carbons are desirable.

Trivalent or higher polybarboxylic acids include aromatic polycarboxylic, e.g., trimellitic acid and pyromellitic acid.

Polycarboxylic acids (2) may be caused to react on polyols (1) by using the acid unhydrides of the above substances or lower alkylesters (methylester, ethylester and isopropylester).

The ratio of polyol (1) to carboxylic acid (2) is usually 2/1 to 1/1, preferably 1.5/1 to 1/1 or more preferably 1.3/1 to 1.02/1, in terms of the equivalent weight ratio of hydroxyl group to carboxyl group (OH/COOH).

Polyisocyanates (3) include a group of aliphatic polyisocyanates (tetramethylene di-isocyanate, hexamethylene di-isocyanate and 2,6-di-isocyanate methyl caproate, a group of alicyclic polyisocyanates including isophorone di-isocyanate and cyclohexylmethane di-isocyanate, aromatic di-isocyanates including torylene di-isocyanate and diphenylmethane di-isocyanate), a group of aromatic, aliphatic di-isocyanates including α, α, α', α'-tetramethylxylilene diosocyante, a group of isocyanurates, polyisocyanates blocked by phenol derivatives, oximes or caprolactums, and combinations of two or more of the same.

The ratio of the polyisocyanate (3) is usually 5/1 to 1/1, preferably 4/1 to 1.2/1 or more preferably 2.5/1 to 1.5/1, in terms of equivalent weight ratio of NCO/OH. Ratios NCO/OH above 5 degrade low-temperature fixation. If the molar ratio of NCO is less than 1, then the urea content of modified polyester decreases and degrades resistance to hot offset. The content of the polyisocyanate (3) portion of prepolymer (A), which has an isocyanate group at the end, is usually 0.5 to 40% by mass, preferably 1 to 30% by mass or more preferably 2 to 20% by mass. A content below 0.5% degrades resistance to hot offset and is disadvantageous when it comes to compatibility of heat-resistant keeping ability and low-temperature fixation. A content above 40% by mass degrades low-temperature fixation.

Prepolymer (A) with the isocyanate group usually contains one or more isocyanate groups for a single molecule and should preferably contain one point five to three molecules, more preferably one point eight to two point five isocyanate groups in average. Less than one isocyante group lowers the molecular weight of urea-modulated polyester, degrading resistance to hot offset.

Amines (B) include diamine (B1), trivalent or higher polyamine (B2), aminoalcohol (B3), aminomercaptan (B4), amino acid (B5), and substances produced by blocking the amino groups of B1 through B5.

Diamines (B1) may be selected from a group of aromatic diamines including phenylene diamine, diethyltoluene diamine and 4,4'-diaminodiphenyl methane, a group of alicyclic diamines including 4,4'-diamino-3,3' dimethyldicyclohexyl methane, diamine cyclohexane and isophorone diamine), and a group of aliphatic diamines including ethylene diamine, tetramethylene diamine and hexamethylene diamine. Trivalent or higher polyamines (B2) icnlude diethylene triamine and triethylene tetramine. Aminoalcohols (B3) include ethanol amine and hydroxyethyl anyline. Aminomercaptans (B4) include aminoethyl mercaptan and aminopropyl mercaptan. Amino acids (B5) include amino propionic acid and amino caproic acid. The substances (B6) include ketimine compounds and oxysazoline compounds derived from amines and ketones of B1 through B5. Among such amines (B), B1 and a mixture of B1 and some B2 are desirable.

Use may be made of an extension stopping agent for adjusting the molecular weight of the urea-modified polyester. The extension stopping agent may be any one of, e.g., monoamines (diethylamine, dibutylamine and raurylamine and blocked versions thereof (ketimine compounds).

The ratio of amine (B) is usually 1/2 to 2/1, preferably 1.5/1 to 1/1.5or more preferably 1.2/1 to 1/1.2, in terms of the equivalent weight ratio of isocyanate group NCO contained in the prepolymer (A), which has an isocyanate group, to the amino group NHx of amine (B). A ratio above 2 or below 1.2 reduces the molecular weight of urea-modified polyester (i) and thereby degrades resistance to hot offset. In the illustrative embodiment, polyester (i) modified by urea bond may contain urethane bond together with urea bond. The molar ratio of urea bond to urethane bond is usually 100/0 to 10/90, preferably 80/20 to 20/80 or more preferably 60/40 to 30/70. A molar ratio less than 10% degrades resistance to hot offset.

[II] Production of Urea-Modified Polyester

Urea-modified polyester (i) is produced by a one shot method or a prepolymer method. Urea-modulated polyester (i) has a weight mean molecular weight that is usually 10,000 or above, preferably 20,000 to 10,000,000 or more preferably 30,000 to 1,000,000. A molecular weight below 10,000 degrades resistance to hot offset. The number mean molecular weight of urea-modified polyester is not limited when use is made of non-modified polyester (ii), which will be described later; any number mean modular weight easily implementing the weight mean molecular weight suffices. When urea-modified polyester (i) is used alone, the number mean molecular weight is usually 20,000 or below, preferably 1000 to 10,000 or more preferably 2,000 to 8,000. A number mean molecular weight above 20,000 degrades low-temperature fixation and, in the case of a full-color apparatus, low-temperature fixation.

[III] Content of Non-Modulated Polyester

The binder for the toner of the illustrative embodiment may contain not only urea-modulated polyester (i), but also non-modified polyester (ii) mentioned earlier. Non-modulated polyester (ii) enhances low-temperature fixation and, in the case of a full-color apparatus, improves gloss.

Non-modified polyester (ii) may be implemented by the condensation polymer of polyol (1) and polycarboxyl acid (2) like urea-modulated polyester (i). Preferable condensation polymers are also the same as the polymers mentioned in relation to urea-modulated polyester (i). Non-modified polyester (ii) may even be polyester modified by chemical bond other than urea bond, e.g., urethane bond.

Urea-modulated polyester (i) and non-modulated polyester (ii) should preferably be at least partly compatible from the low-temperature fixation and hot offset resistance standpoint. It is therefore preferable that polyesters (i) and (ii) are analogous in composition to each other. When the polyester (i) contains the polyester (ii), the weight ratio of (ii) to (i) is usually 5/95 to 70/30, preferably 5/95 to 30/70 or more preferably 5/95 to 25/75 or even more preferably 7/93 to 20/80. A weight ratio of the polyester (i) below 5% degrades resistance to hot offset and is disadvantageous when it comes to the compatibility of heat-resistant keeping ability and low-temperature fixation.

Non-modified polyester (ii) has a peak molecular weight that is usually 1,000 to 30,000, preferably 1,500 to 10,000 or more preferably 2,000 to 8,000. A peak molecular weight below 1,000 degrades heat-resistant keeping ability while a peak molecular weight above 10,000 degrades low-temperature fixation. The peak molecular weight should even more preferably be 10 to 120 or particularly preferably 20 to 80. A hydroxyl group value less than 5 is disadvantageous when it comes to the compatibility of heat-resistant keeping ability and low-temperature fixation.

Non-modulated polyester (ii) has an acid value that is usually 1 to 30, preferably 5 to 20. With such an acid value, the polyester (ii) tends to be charged to negative polarity.

The toner binder has a glass transition point Tg that is usually 50° C. to 70° C., preferably 55° C. 65° C. A glass transition point below 50° C. degrades the heat-resistant keeping ability of the toner while a glass transition temperature above 70° C. degrades low-temperature fixation. In the illustrative embodiment, the dry toner with urea-modified polyester resin exhibits a higher heat-resistant keeping ability than the conventional polyester-based toner despite that the glass transition point is low. As for the storage elastic modulus of the toner binder, temperature TG' at which the modulus is 10,000 dyne/cm$^2$ at a frequency of 20 Hz is usually 100° C. or above, preferably 110° C. to 200° C. Temperature below 100° C. degrades resistance to hot offset. As for the viscosity of the toner binder, temperature TGη at which the viscosity is 1,000 poise is usually 180° C. or below, preferably 90° C. to 160° C. Temperature above 180° C. degrades low-temperature fixation. That is TG' should preferably be higher than Tη for implementing the compatibility of low-temperature fixation and resistance to hot offset. Stated another way, a difference TG'–Tη should preferably be 0° C. or above. More preferably, the difference should be 10° C. or above, particularly 20° C. or above. The difference has not upper limit. Further, a difference Tη–Tg should preferably be 0° C. to 100° C., more preferably 10° C. to 90° C. or particularly preferably 20° C. to 80° C.

Specific methods of producing the dry toner of the present invention will be described hereinafter.

[IV] Production of Toner Binder

The toner binder may be produced by the following specific method. First, polyol (1) and polycarboxylic acid (2) mentioned earlier are heated to 150° C. to 280° C. in the presence of tetrabutoxytitanate, dibutyltine oxide or similar conventional esterified catalyst. Water is removed with pressure being reduced, if necessary. As a result, polyester with a hydroxyl group is produced. Subsequently, at 40° C. to 14° C., polyisocyanate (3) is caused to act on the polyester to thereby produce prepolymer (A). The prepolymer (A) is caused to act on amine (B) at 0° C. to 140° C. to thereby produce urea-modified polyester (i) modified by urea bond.

A solvent may be used at the time of the reaction of the polyisocyanate (3) and the reaction of the prepolymer (A) and amine (B), as needed. The solvent may be selected from aromatic solvents including toluene and xylene, ketones including acetone, methyl ethyl ketone and methyl isobutyl ketone, esters including ethyl acetate, amides including dimethylformamide and dimethylacetoamide and ethers including tetrahydrofurane that are inert to isocyanates (3).

Assume that non-modified polyester (ii) not modified by urea bond is used. Then, the polyester (ii) is produced in the same manner as the polyester having a hydroxy group and then dissolved in the solution derived from the reaction of the urea-modified polyester (i).

The dry toner may be produced by, but not limited to, the following procedure.

[V] Production of Toner in Water-Based Medium

For the production of the dry toner, use may be made of water or water and a solvent miscible with water. The solvent miscible with water may be any one of, e.g., alcohols including methanol, isopropanol and ethylene glycol, dimethyl formaldehyde, tetrahydrofurane, and lower ketones including acetone and methyl ethyl ketone.

To form the toner grains, a dispersion implemented by the prepolymer (A) having an isocyanate group may be caused to react on (B). Alternatively, use may be made of the urea-modified polyester (i) produced beforehand.

To stably form the dispersion implemented by the urea-modified polyester (i) or the prepolymer (A) in the water-based medium, a composition, which is the raw material of the toner and implemented by the polyester (i) or the prepolymer (A), may be added to the water-based medium and then dispersed by a shearing force.

The composition or raw material includes a colorant, a colorant masterbatch, a parting agent, a charge control agent, and non-modified polyester resin. While the prepolymer and raw material may be mixed when the dispersion is to be formed in the water-based medium, it is preferable to mix the raw material beforehand and then add the resulting mixture in the medium.

In the illustrative embodiment, the raw material does not have to be mixed when grains are to be formed in the water-based medium, but may be added after the formation of the grains. For example, after the formation of grains not containing the colorant, the colorant may be added by a conventional dyeing method.

Any conventional method may be used for the dispersion. For example, there may be used a low-speed shearing type, high-speed shearing type, friction type, high-pressure jet type, ultrasonic type or similar type of facility. The high-speed shearing type of facility is desirable when consideration is given to the grain size of 2 μm to 20 μm. As for the high-speed shearing type of dispersing facility, a revolution speed is usually 1,000 rpm to 30,000 rpm, preferably 5,000 rpm to 20,000 rpm, although it is open to choice. A dispersing time is usually 0.1 minute to 5 minutes in the case of the batch system although it is also open to choice. A dispersing temperature is usually 0° C. to 150° C. (pressurization), preferably 40° C. to 98° C. Usually, higher dispersing temperature is desirable because it maintains the viscosity of the dispersion including the urea-modified polyester (i) and prepolymer (A) low and therefore promotes easy dispersion.

The water-based medium is used in an amount that is usuallyu 50 parts by mass or 2,000 parts by mass, preferably 100 parts by mass to 1,000 parts by mass, to 100 parts by mass of the toner composition, which contains the urea-modified polyester (i) and the prepolymer (A). An amount below 50 parts by mass cannot promote desirable dispersion of the toner composition, failing to provide toner grains with a target grain size. An amount above 20,000 parts by mass is not cost effective. A dispersant maybe used, if desired. A dispersant makes the grain size distribution sharp and stabilizes dispersion.

As for a dispersant for emulsifying and dispersing an oiliness layer in which the toner composition is dispersed with the toner composition in the water-containing liquid, use maybe made of an anionic surfactant, a cationic surfactant or a nonionic surfactant. The cationic surfactant may be any one of alkylbenzene phosphoric acid, α-olefin phosphoric acid, phosphate, etc. The cationic surfactant may be any one of amino chloride type surfactants including alkylamine salt, aminoalcohol fatty acid derivative, polyamine fatty acid derivative and imidazoline, and quaternary ammonium salt type surfactants including alkyltrimethyl ammonium salt, pyridium salt, alkylisoquinolium salt, and benzetonium chloride. The nonionic surfactant may be any one of fatty acid amide derivatives and polyvalent alcohol derivatives, e.g., alanine, dodecyl di(aminoethyl)glycine, di(octylaminoethyl)glycine and N-alky-N,N-dimethylammonium betaine and other ampholytic surfactants.

When a surfactant having a fluoroalkyl group is used, the effect can be enhanced with an extremely small amount. This kind of surfactant may be any one of anionic surfactants including fluoroalkyl carboxilic acid and metal salts thereof, perfluorooctane sulfonyl glutamic acid dinatrium, 3-[megafluoroalkyl(C6–C11)oxy]-1-alkyl(C3–C4) sulfonic acid natrium, 3-[omega-fluoroalkanoil(C6–C8)-N-ethylamino]-1-propane sulphonic acid natrium, fluoroaklyl(C11=C20) carboxylic acid and metal salts, perfluoroalkyl cargoxilic acid (C7–C13) and metals salts tehreof, perfluoroalkyl (C4–C12) sulfonic acid and metal salts thereof, perfluorooctane sulfonic acid diethanolamide, N-propyl-N-(2 hydroxyethyl)perfluorooctane sulfoneamide, perfluoroalkyl (C6–C10) sulfoneamide propyl trimethyl ammonium salt, perfluoroaklyk (C6–C10)-N-ethylsulfonile glycine salt, and monoperfluoroalkyl (C6–C16) ethyphosphoric acid ester.

The above surfactants are put on the market as Surflon S-111, S112 and S113 (Asahi Glass Co., Ltd), Florade FC-93, FC-95, FC-98 and FC-129 (Sumitomo 3M), Unidyne DS-101 and DS-102 (Taikin Kosay-Sha), Megafac f-110, F-120, F-113, F-191, F-812 and F-833 (DAINIPPON INK & CHEMICALS INC), Ectop EF-102, 103, 104, 105, 112, 123A, 123B, 306A, 501, 201 and 204 (Tokem Products), and Futagent F-100 and F150 (Neos).

Cationic surfactants include fatty acid primary or secondary ammonium salts having a fluoroalkyl grouo or fatty acid quaternary ammonium salts including secondary amine acid, perfluoroalkyl (C6–C10) sulfone amidopropyl trimethyl ammonium salt, benzalconium salt, benzetonium chloride, pyridium salt, and indazolinium salt.

Inorganic compound dispersants scarcely soluble in water include tribase calcium phosphase, calcium carbonate, titanium oxide, coloidal silica, and hydroxy apatite.

To stabilize dispersion drops, use may be made of a high molecular, protective colloid. The protective colloid may be selected from a group of acids including acrylic acid, methacrylic acid, α-cyanoacrylic acid, α-cyanomethacrylic acid, itaconic acid, crotonic acid, fumaluc acid, maleic acid and maleic unhydride, a group of (metha) acrylic monomers with a hydroxy group including acrylic acid β-hydroxyethyl, methacryulic acid β-hydroxyethyl, acrylic acid β-hydroxypropyl, methacrylic β-hydroxypropyl, acrylic acid γ-hydroxypropyl, methacrylic acid γ-hydroxypropyl, acrylic acid 3-chloro-2-hydroxypropyl, methacrylic acid 3-chloro-2-hydroxypropyl, diethylene glycol monoacrylic acid ester, diethylene glycol monomethacrylic acid ester, glycerine monomethacrylic acid ester, N-methylolacrylamide, and N-methyrolmethacrylamide, vinyl alcohol or enters with vinyl alcohol including vinylmethyl ether, vinylethyl ether, and vinylpropyl ether, estsers containing vinyl alcohol and a carboxyl group including vinyl acetate, propyonic acid vinyl and vinyl butylate, acrylamide, methacrylamid and diacetone acrylamide and methyrol compounds thereof, a group of acid chlorides including acrylic acid chloride and methacrylic acid chloride, a group of homopolymers or copolymers of vinylpyridine, vinylpyrrolidone, vinylimidazole, ethyleneimine and others having nitrogen atoms or a hyterocycle thereof, a grouop of polyoxyethylene-based substances including polyoxyehtylene, polyoxypropyrene, polyoxyethylene alkylamine, polyoxypropyrene alkylamine, polyoxyethylene alkylamide, polyoxypropyrene alkylamide, polyoxyethylene nonyl phenylether, polyoxyethylene lauryl phenylether, polyoxyethylene stearyl phenylether and polyoxyethylene nonyl phenylether, and celluloses including methyl cellulose, hydroxyethyl cellulose and hydroxypropyl cellulose.

To remove the organic solvent from the emusified dispersion prepared by the above method, the entire system may be heated little by little in order cause the solve to fully evaporate. Alternatively, the emulsified dispersion may be sprayed in a dry atmosphere in order to fully remove the solvent non-soluble in water, thereby forming toner grains; at the same time, the water-based dispersant may be caused to evaporate.

The dry atmosphere mentioned above is usually implemented by air, nitrogen gas, carbon dioxide gas, combustion gas or similar heated gas heated, particularly a stream of air hated to temperature above the boiling point of the solvent having the highest boiling point. A spray dryer, a belt dryer or similar simple dryer can implement target quality in a short period of time.

Assume that calcium phosphate salt, for example, soluble in acid and alkali is used as a dispersion stabilizer. Then, After calcium phosphate salt has been dissolved by hydrochloric acid, the grains are rinsed to remove calcium phosphate salt. Alternatively, decomposition using an enzyme may be effected.

When a dispersant is used, it may be left on the surfaces of toner grains. However, rinsing should preferably be effected after extension and/or crosslinking from the toner charge standpoint.

Further, to lower the viscosity of the toner composition, a solvent in which the urea-modified ester (i) and prepolymer (A) are soluble may be used. This desirably implements a sharp grain size distribution. The solvent has is volatile and has a boiling point lower than 100° C. and is easy to remove. For the solvent, use may be made of toluene, xylene, benzene, methylene chloride, 1,2-dichloroethane, monochlorobenzene, methyl acetate, ethyl acetate, methyl ethyl ketone or methyl isobutyl ketone or a combination thereof. Particularly desirable are toluene, xyline and other aromatic solvents and methylene chloride, 1,2-dichloroethane chloroform and other halogenated hydrocabons. The solvent is used in an amount that is usually 0 parat by mass to 300 parts by mass, preferably 0 part by mass to 100 parts by mass or more preferably 25 parts by mass to 70 parts by mass, to 100 parts by mass of prepolymer (A).

When the above solvent is used, it is removed after extension and/or crosslinking by being heated at normal pressure or reduced pressure. While the extending and/or cross-linking reaction time depends on the combination of the isocyanate structure of the prepolymer (A) and amine (B), it is usually 10 minutes to 40 hours, preferably 2 hours to 24 hours. Reaction temperature is usually 0° C. to 150° C., preferably 40° C. to 98° C. Further, a conventional catalyst, e.g., dibutyl laurate or dioctyltine laurate may be used, as needed.

To remove the organic solvent from the emusified dispersion prepared by the above method, the entire system may be heated little by little in order cause the solve to fully evaporate. Alternatively, the emulsified dispersion may be sprayed in a dry atmosphere in order to fully remove the solvent non-soluble in water, thereby forming toner grains; at the same time, the water-based dispersant may be caused to evaporate.

The dry atmosphere mentioned above is usually implemented by air, nitrogen gas, carbon dioxide gas, combustion gas or similar heated gas heated, particularly a stream of air hated to temperature above the boiling point of the solvent having the highest boiling point. A spray dryer, a belt dryer or similar simple dryer can implement target quality in a short period of time.

Assume that the grain size distribution is broad at the time of dispersion by emulcification, and that rinsing and drying are effected while maintaining such a distribution. Then, the grains may be classified to a desired grain size distribution. Specifically, a cyclone, decanter, centrifugal separator or similar device may be used to remove fine grains in a liquid.

While powder obtained by drying may, of course, be classified, classifiying the grains in a liquid is more desirable from the efficiency standpoint. Needless fine grains and coarse particles may be returned to a kneading step and again used. Such needless particles may be in a wet state.

While the dispersant should preferably be removed from the dispersion as soon as possible, the removal of the dispersant should preferably be effected at the same time as the classification.

The dried toner powder and the alien grains including the grains of parting agent, charge control agent, fluidizer and colorant are mixed together or the resulting mixture is subjected to a mechanical impact. This prevents the alien grains from parting from the surfaces of the composite grains. More specifically, a blade may be rotated at high speed for exerting an impact force on the mixture. Alternatively, the mixture may be introduced in a high-speed air stream and accelerated thereby, so that the grains hit against each other or against a suitable plate. For this purpose, there may be used an apparatus produced by modifying Ong Mill (trade name) available from HOSOKAWA MICRONS CO., LTD. or I MILL (trade name) available from NIPPON NEUMATIC CO, TLD. for lowering air pressure for pulverization, Hybridization System (trade name) available from Nara Machinery Co., Ltd, Cryptron System (trade name) available from KAWASAKI HEAVY INDUSTRIES LTD. or an automatic mortar.

The toner produced by the method described above can be provided with relatively high sphericity. Assuming that a projected image has circularity of SR, then the circularity SR can be SR≧0.97. Let SR be defined as (circumference of circle identical in area with projected grain image/circumference of projected grain image). The closer the toner grain to sphere, the closer the value to 100%.

A blade or similar cleaning member may fail to sufficiently scrape off the toner having such sphericity. This is because the distance between the grain surface and the drum 1 decreases in a microscopic sense, intensifying non-electrostatic adhesion. While the cleaning member may more strongly contact the drum 1, the former effects the rotation or accurate movement of the latter, resulting in banding.

In light of the above, in the illustrative embodiment, a lubricant is applied to the surface of the drum 1 in order to reduce the coefficient of friction $\mu$ to 0.1 or above, but 0.4 or below. This allows the cleaning blade 601 to easily scrape off the toner left on the drum 1 after image transfer. Although the parting agent is present on the surface of the individual toner grain, the probability that the toner grain directly contacts the drum 1 is reduced to thereby obviate filming. This is because the cleaning is easy to perform and because the lubricant covers the surface of the drum 1.

In the illustrative embodiment, the resin used for the toner 10 may be polyester, polyol, styrene-acryl or similar binder resin.

The parting agent may be implemented by any conventional wax, e.g., low-molecular polyethylene, low-molecular polypropylene or similar low-molecular polyolefin wax or similar synthetic hydrocarbon wax, beeswax, carnauba wax, rice wax, montan wax or similar natural wax, paraphine wax, microcrystalline wax or similar oil wax, stearic acid, palmitic acid, myristic acid or similar higher fatty acid or a metal salt thereof, higher fatty acid amide, or modified was thereof. While such waxes maybe used alone or in combination, a desirable parting ability is achievable with one or more of de-free fatty acid type carnauba wax, montan wax and oxidized rice wax.

Carnauba wax should preferably have a fine crystal and an acid value of 5 or below and has a grain size of 1 $\mu$m or below when dispersed in the binder resin. Montan wax, which generally refers to montan wax derived from ore, should preferably have a fine crystal and an acid value of 5 to 14. Oxidized rice wax is rice bran wax oxidized in air and should preferably have an acid value of 10 to 30.

In the above condition, the parting agent should preferably have a melting point of 80° C. to 125° C. A melting point above 80° C. provides the toner with durability while a melting point below 125° C. allows the toner to rapidly melt at the time of fixation. The parting agent content of the toner is usually 1 part by mass to 15 parts by mass, preferably 2 parts by mass to 10 parts by mass, to 100 parts by mass of binder resin. An amount below 1 part by mass cannot sufficiently obviate offset while an amount above 15 parts by mass lowers transferability and durability. The toner of the illustrative embodiment causes a minimum of parting agent to be exposed to the outside, so that the penetration of the parting agent is not limited. However, the penetration should preferably be 5 or below.

In the illustrative embodiment a colorant, a charge control agent, a magnetic substance and an additive may be added to the toner, as needed. The colorant may be implemented by any one of conventional dyes and pigments.

Yellow colorants include naphthol yellow, Hansa yellow (GR, A, RN, R), pigment yellow L, benzidine yellow (G, GR), permanent yellow (NCG), valcan fast yellow (5G, R), quinoline yellow lake, benzoimidazolone yellow, and isoindolinone yellow.

Red colorants include blood red, red lead oxide, cadmium red, cadmium mercury red, antimony red, permanent red 4R, para red, fire red, parachloroolt nitroanyline red, lithol fast scarlet G, brilliant scarlet, permanent red (F2R, F4R, FRL, FRLL, F4RH), fast scarlet VD, brilliant scarlet G, permanent red (F5R, FBB), pigment scarlet 3B, bordeaux 5B, toluidine maroon, permanent bordeaux F2K, helio bordeaux 2K, helio bordeaux F2K, helio bordeaux BL, bordeaux 10B, BON maroon light, BON maroon medium, eosin lake, rhodamine lake B, rhodamine lake Y, alizarin lake, thioindigo red, quinacridone red, pyrazolone red, polyazo red, chrome vermilion, bendizine orange, and oil orange.

Blue colorants include cobalt blue, alkal blue lake, peacock blue lake, Victoria blue lake, metal-free phthalocyanine blue, phthalocyanine blue, fast sky blue, indanthrene blue (RS, BC), indigo, ultramarine blue, anthoraquinone blue, fast violet B, methyl violet lake, cobalt purple, manganese purple, dioxane violet, anthoraquinone violet, chrome green, zink green, chrome oxide, emerald green, pigment green B, naphthol green B, green gold, acid green lake, phthalocyanine green, and anthoraquinone green.

Black colorants include carbon black oil farness black, channel black, lamp blak, acetylene black, anyline black and other adine pigments, metal salt azo-pigments, metal oxides, and composite metal oxides.

Other colorants include titania, zinc oxide, lithopone, nigrosine dyes, and iron black.

The content of the colorant is usually 1 part by mass to 30 parts by mass to 100 parts by mass of the binder resin.

Charge control agent of the kind charging the toner to positive polarity may be any one of nigrosine and modified substances thereof, tributyl benzyl ammonium-1-hydroxy-4-naphthosulfone salt, tetrabutylammonium tetrafuloroborate and other quaternary ammonium salts, dibutyl tinoxide, dioctyl tin oxide, dicyclohexyl tin oxide and other diorgano tin oxides, dibutyl tin borate, dioctyl tin borate, dicyclohexyl tin borate and other diorgano tin borates.

Charge control agent of the kind charging the toner to negative polarity include complexes and salts of salicylic acid and salts of organic boron.

The content of the charge control agent should preferably be 0.5 part by mass to 8 parts by mass to 100 parts by mass of binder resin.

Further, the toner may contain a magnetic substance to constitute magnetic toner. For example, the toner may contain any one of magnetite, hematite, ferrite or similar iron oxide, cobalt, nickel or similar metal or an alloy of such metal and aluminum, copper, lead, magnesium, manganese, selenium, tungsten or vanadium or a mixture thereof. The magnetic substance should preferably have a mean grain size of 0.1 $\mu$m to 2 m and has a content of 20 parts by mass, preferably 40 parts by mass to 150 parts by mass, to 200 parts by mass to 100 parts by mass of binder resin.

The additive may be any one the oxides or composite oxides of Si, Ti, Al, Mg, Ca, Sr, Ba, In, Ga, Ni, Mn, W, Fe, Co, Zn, Cr, Mo, Cu, Ag, V, Zr and so forth as in the first embodiment. Among them, silica, titania and alumina that are the oxides of Si, Ti and Al, respectively, are desirable.

The illustrative embodiment is identical with the first embodiment as to the amount of the additive, method of measuring the additive content, volume mean grain size of toner, method of measuring it, and so forth. In the illustrative embodiment, the magnetic grains should preferably have dynamic resistance DR OF $10^2\Omega$ or above, but $10^6\Omega$ or below.

A more specific example of the illustrative embodiment will be described hereinafter. The toner 10 had an amount of charge of −10 $\mu$C/g to −20 $\mu$C/g while the magnetic grains 11 had dynamic resistance of $10^5\Omega$. With the developer made up of such toner 10 and magnetic grains 11, there was achieved a developing ability high enough to cause the amount of toner deposition M/A to saturate when the development potential VB−VS was about 200 V. In a comparative example in which the toner 10 had an amount of charge of −15 $\mu$C/g to −35 $\mu$C/g while the magnetic grains 11 had dynamic resistance of $10^{10}\Omega$, the amount of toner deposition M/A saturated when the development potential VB−VS exceeded 400 V.

Figure 48:
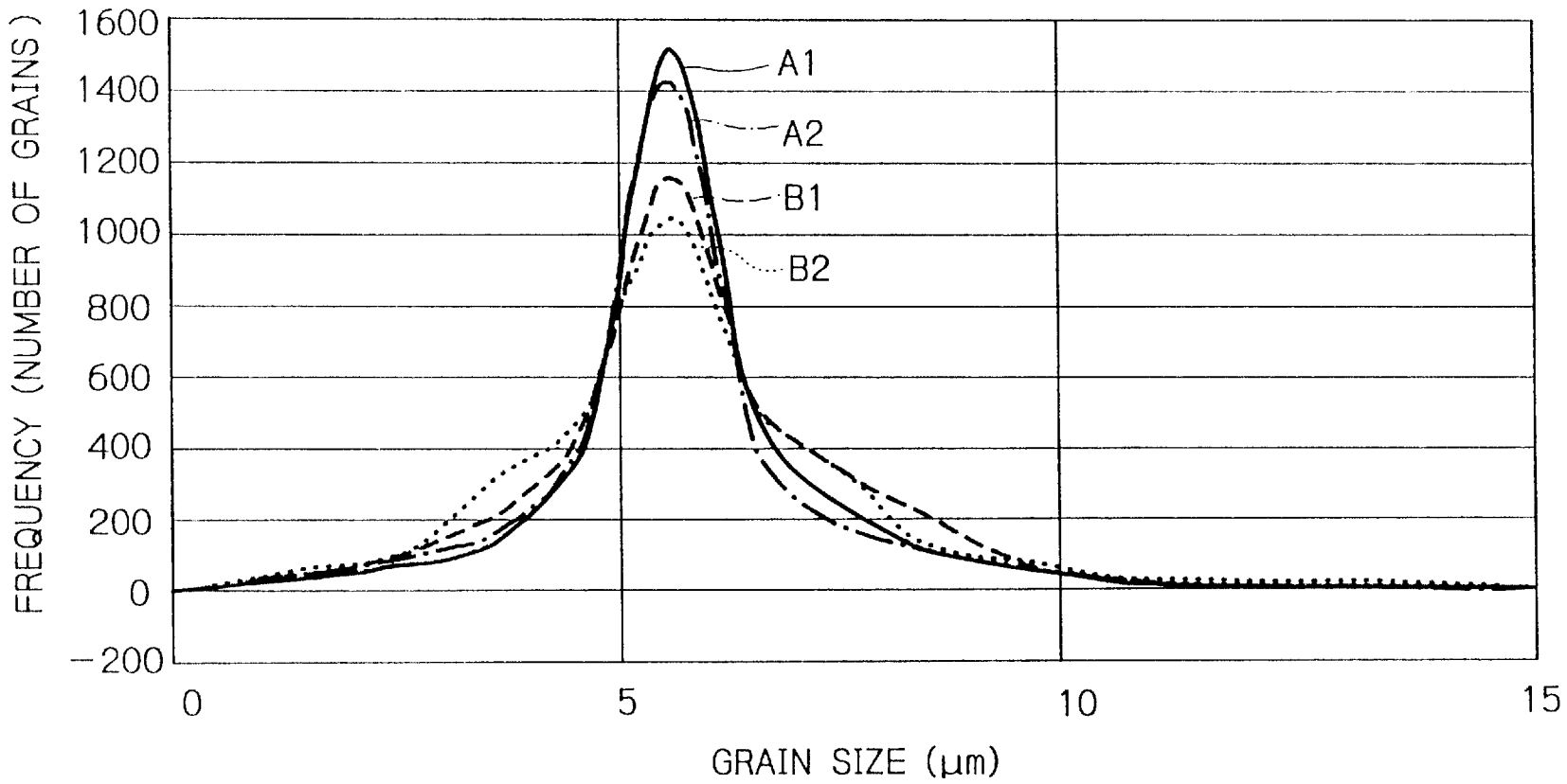
FIG. 48 is a graph showing a distribution of the number of toner grains particular to an eighth embodiment of the present invention.
Figure 49:
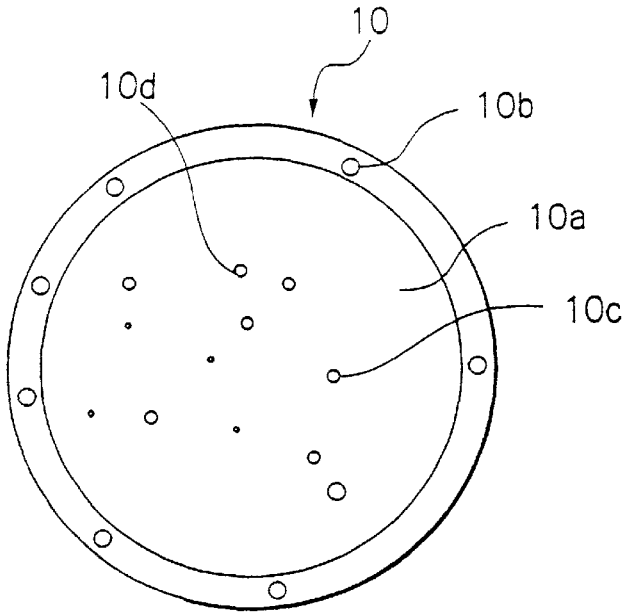
FIG. 49 is a section of a spherical toner grain applied to the eighth embodiment.

FIG. 48 compares the two kinds of toner used in the above example as to the distribution of the number of toner grains with respect to the grain size of toner. In FIG. 48, curves A1 and A2 respectively show the profile of the SR (spherical) toner and that of the pulverized toner of the illustrative embodiment. As shown in FIG. 49, the SR toner 10 of the illustrative embodiment is covered with the colorant 10*c*, parting agent 10*d* and other additives. Curves B1 and B2 show the profiles of the grain number distributions of pulverized toner of the comparative examples. The four kinds of toner all have a profile whose peak grain size is 5.5 $\mu$m. On the other hand, a half-value of the profile, which is an index relating to the sharpness of the profile, is 1.43 $\mu$m (26% of the peak grain size of 5.5 $\mu$m) in the toner A1, 1.55 $\mu$m (28%) in the toner A2, 1.77 $\mu$m (32%) in the toner B1, or 2.00 $\mu$m (36%) in the toner B2.

Figure 50:
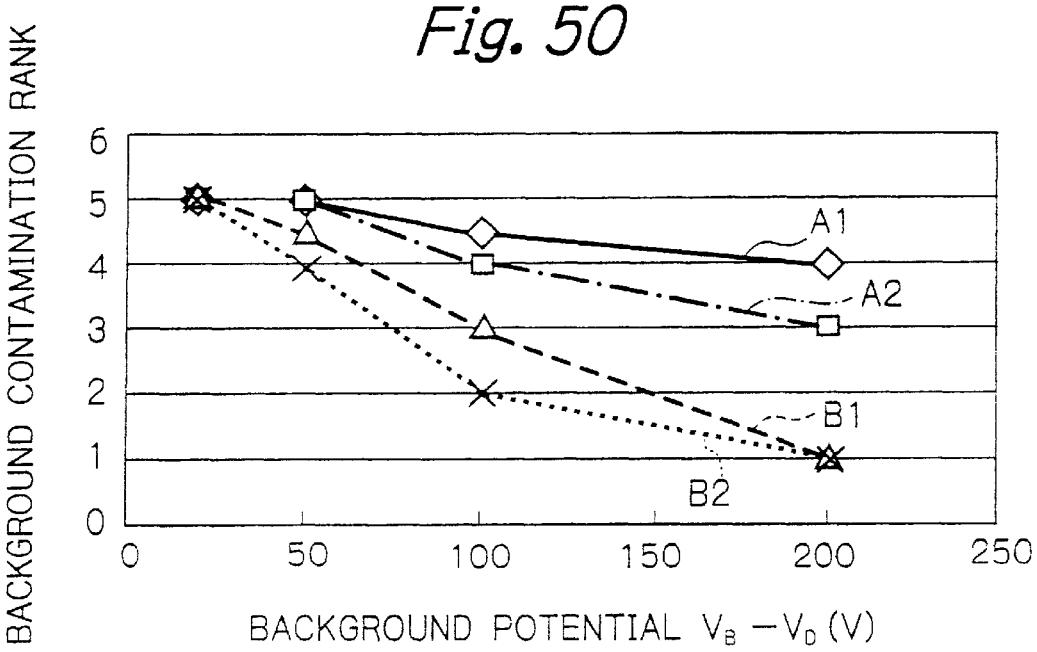
FIG. 50 is a graph showing a relation between the background potential and the background contamination rank determined with the eighth embodiment.

FIG. 50 compares the four kinds of toner with respect to a relation between the background potential and the background contamination rank. Assume that the background potential of the drum 1 is VD, and that the bias for development applied to the developing roller 402 is VB. Then, the background potential is expressed as VB−VD. The background potential VD was selected to be −400±40 V. As FIG. 50 indicates, in the illustrative embodiment in which the half-value of the profile of the grain number distribution is 28% of the peak grain size (5.5 $\mu$m) or below, the ratio of toner grains of opposite polarity to the entire toner grains decreases. As a result, when the background potential varies between 0 V and 200 V, there can be reduced background contamination ascribable to the above undesirable toner grains, raising the background contamination rank to 3 or above.

Ninth Embodiment

This embodiment is also directed toward the second object stated earlier. This embodiment is identical with the third embodiment as to basic construction and operation as well as to the configuration of the surface layer of the developing roller and coating material. Further, this embodiment is identical with the third embodiment as to the description relating to FIGS. 30A and 30B.

Figure 51:
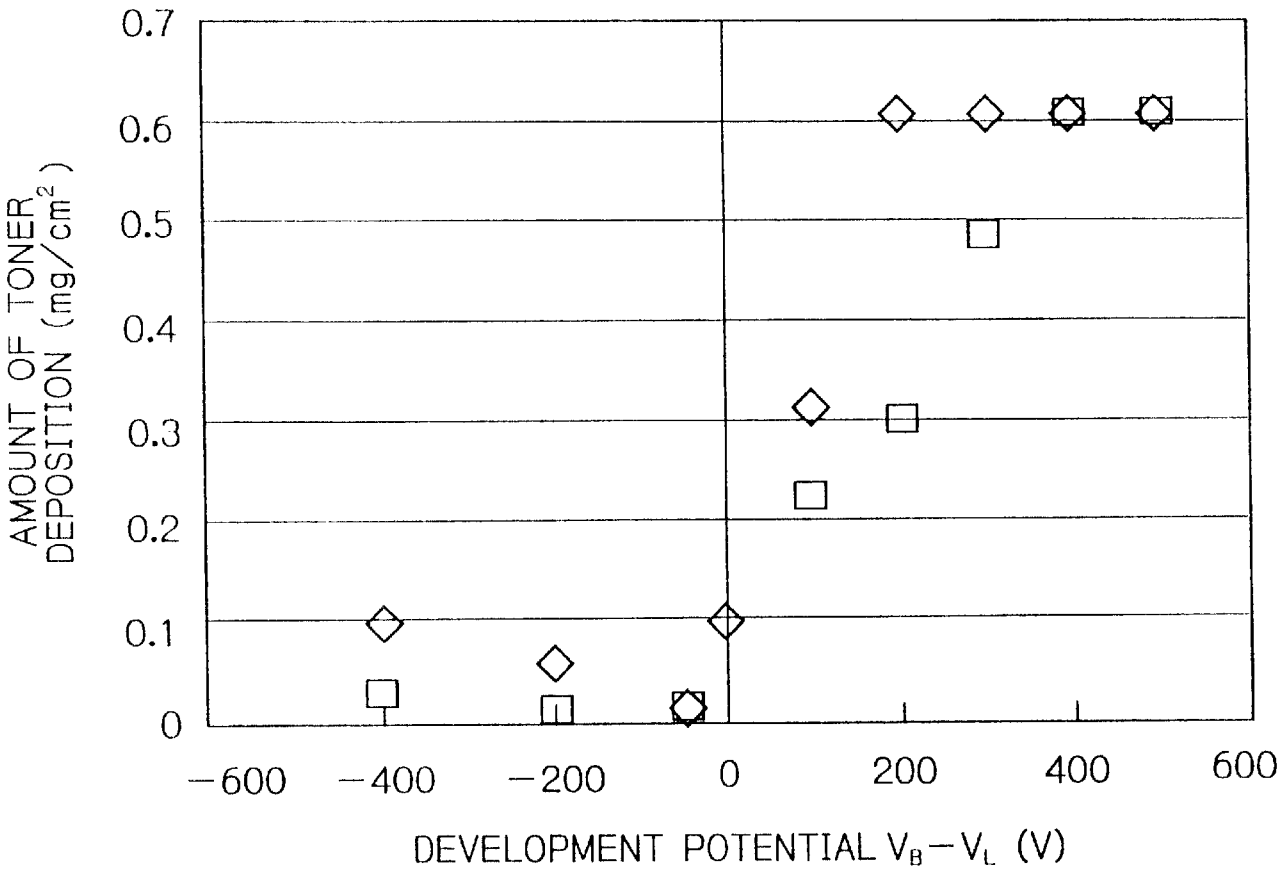
FIG. 51 is a graph showing the development potential and the amount of toner deposition determined with the eighth embodiment.

In a specific example of the illustrative embodiment, the toner was charged by an amount of −10 $\mu$C/g to −20 $\mu$C/g while the magnetic grains 11 had dynamic resistance of $10^5\Omega$. The developer 12 with such toner 10 and magnetic grains 11 implemented a high developing ability. More specifically, as data D1 shown in FIG. 51 ($\gamma$ characteristic) indicates, the amount of toner deposition M/A saturated when the development potential VB−VS was about 200 V. For comparison, a $\gamma$ characteristic was measured with a developer made up of toner charged by an amount of −15 $\mu$C/g to −35 $\mu$C/g and magnetic grains with dynamic resistance of $10^{10}\Omega$. As data D2 shown in FIG. 51 indicates, the comparative developer caused the amount of toner deposition M/A to saturate when the development potential $V_B-V_S$ exceeded 400 V.

Figure 52:
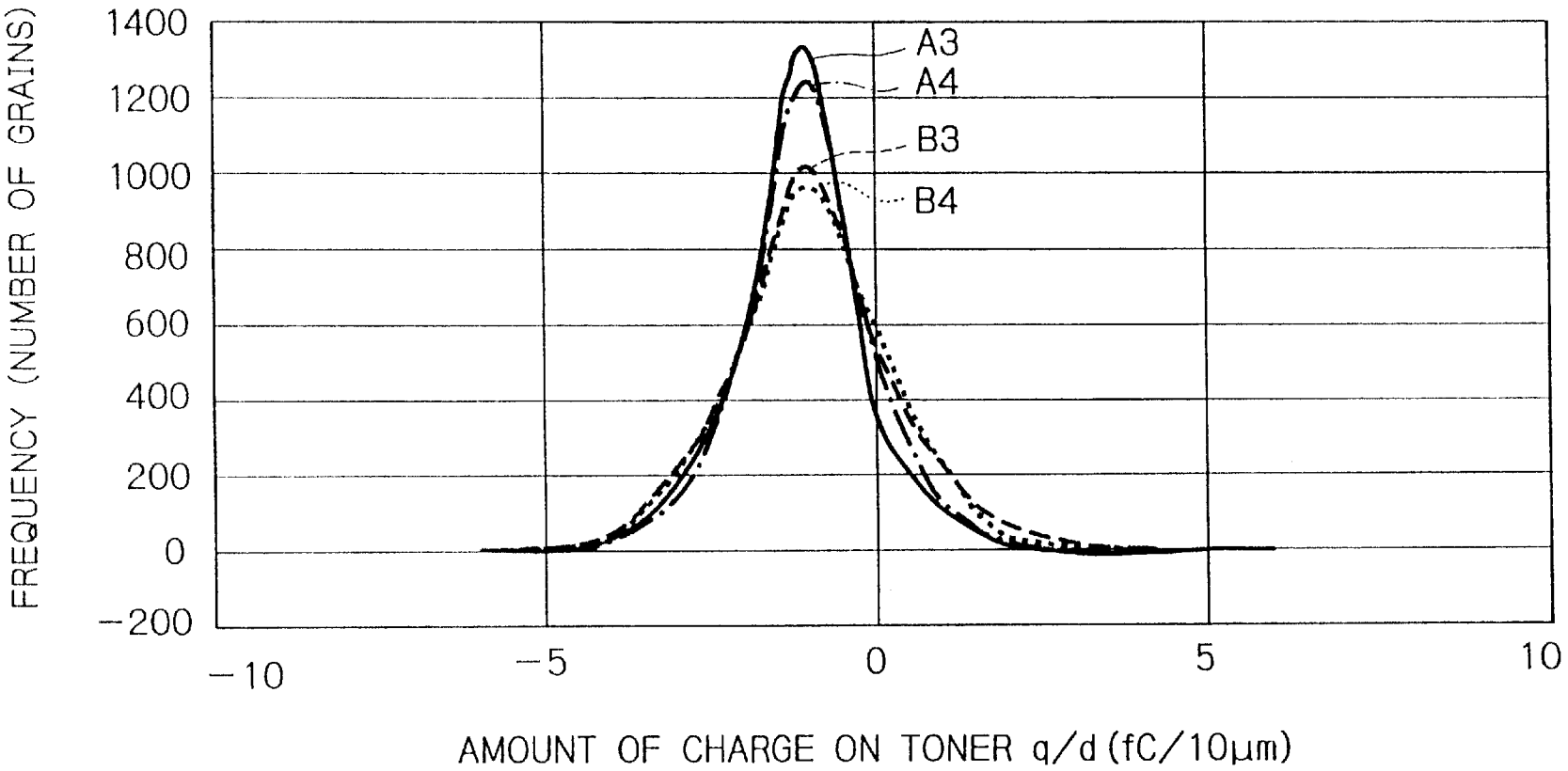
FIG. 52 is a graph showing a distribution of the number of toner grains with respect to the amount of charge of toner determined with the eighth embodiment.

FIG. 52 shows a grain number distribution in relation to the amount of toner charge and determined with two kinds of toner on the developing roller 402 of the illustrative embodiment. In FIG. 52, curves A3 and A4 pertain to the examples of the illustrative embodiment while curves B3 and B4 pertain to comparative examples. To measure the amount of toner charge q/d (fC/10 $\mu$m), use was made of E-SPART ANALYZER; 3,000 toner grains were sampled and measured by a channel width of 1 fC/10 $\mu$m. FIG. 53 is a table listing frequency (number of grains) measured with each of four different kinds of toner A3, A4, B3 and B4 on the consecutive channels.

The sharpness of the grain number distribution profiles with respect to the amount of charge particular to the four kinds of toner A3, A4, B3 and B4 was determined. For this purpose, use was made of a ratio of the mean number of grains on the channels adjoining the peak number of grains to the peak number of grains in the grain number distribution profile as an index. The ratios determined with the toners A3, A4, B3 and B4 were 35%, 43%, 52% and 59%, respectively.

Figure 54:
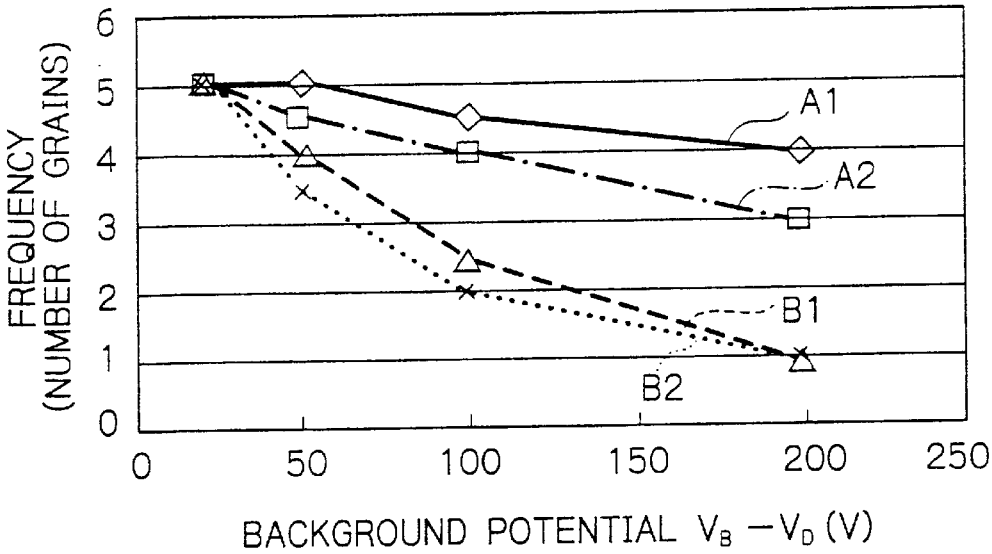
FIG. 54 is a graph showing a relation between the background potential and the background contamination rank determined with the ninth embodiment.

FIG. 54 shows curves indicative of a relation between the background potential and the background contamination rank as to the toners A3, A4, B3 and B4. As shown, even when the above ratio of the grain number profile on the developing roller 402 is 43% or above (embodiment), the ratio of toner grains charged to opposite polarity to all toner grains decreases. Therefore, even when the background potential varies over the range of from 0 V to 200 V, background contamination ascribable to the above undesirable toner grains is reduced, so that background contamination rank 3 or above is achievable.

In the illustrative embodiment as well as in the eighth embodiment, it is preferable to more surely obviate background contamination by providing the drum 1 whose surface has a coefficient of friction lying in a preselected range. Specifically, the maximum coefficient of friction $\mu$ should preferably be between 0.1 and 0.4. Such a maximum coefficient of fiction allows a minimum of needless toner, which would contaminate background, to deposit on the drum 1 in the developing region. In addition, friction between the drum 1 and the cleaning blade 601 of the cleaning device 6 decreases and extends the life of the drum 1.

The illustrative embodiment applies a lubricant to the surface of the drum 1 at preselected timing in order to confine the maximum coefficient of friction in the range mentioned above. For this purpose, any one of conventional methods may be used. Japanese Patent Laid-Open Publication No. 4-372981, for example, teaches that for toner whose volume mean grain size of 4 $\mu$m to 10 $\mu$m, a substance that lowers the coefficient of friction of a drum is fed to the drum, and that a lubricant may be directly coated on the drum every time a preselected number of prints are output or a member supporting a lubricant may be held in contact with the drum either constantly or every time a preselected number of prints are output. If desired, the photoconductive material forming the surface of the drum 1 itself may contain a lubricant beforehand.

Figure 55:
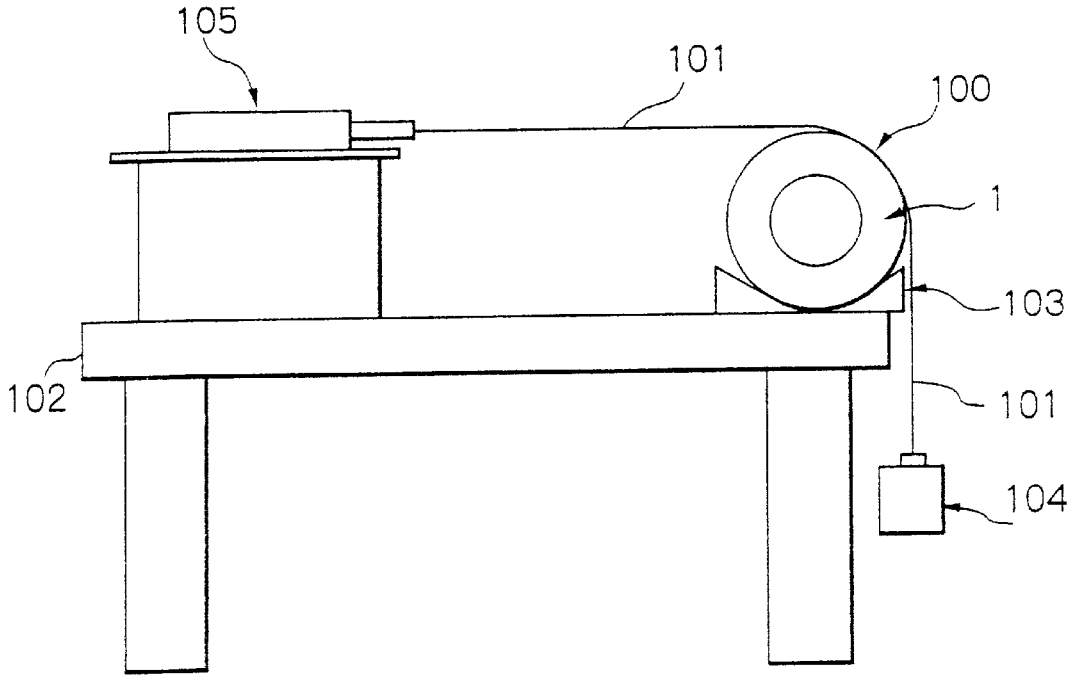
FIG. 55 shows a specific system for measuring the maximum coefficient of friction particular to the surface of a photoconductive element.

FIG. 55 shows a specific system used to measure the maximum coefficient of friction $\mu$ of the drum 1. First, an A4 sheet TYPE 6200 available from RICOH CO., LTD. is cut in a size of 297 mm×30 mm. Subsequently, threads 101 are fastened to opposite sides of the sheet to prepare a sample sheet 100. FIG. 56 lists the property of the sample sheet 100. On the other hand, the drum 1 is set on a support member 103 mounted on a table 102. The sample sheet 100 is put on the drum 1 with its reverse side contacting the drum 1. Thereafter, a weight 104 of 0.98 N (=100 g heavy) is attached to one of the two strings 101 while a digital force gauge (digital push-pull gauge) 105 is connected to the other thread 101. At the time when the sample sheet 100 begins to move due to the weight 104, the gauge 105 is read. Assuming that a value read on the gauge 105 is F (N), then the maximum coefficient of static friction $\mu$ is produced by:

$$\mu=\{1n(F/0.98)\}/(\Pi/2) \tag{11}$$

The surface of the drum 1 without lubrication had the maximum coefficient of static friction $\mu$ of 0.5 to 0.6, which tended to increase with the elapse of time. By contrast, the drum 1 with lubrication had the maximum coefficient of friction $\mu$ of 0.1 to 0.4.

Figure 57:
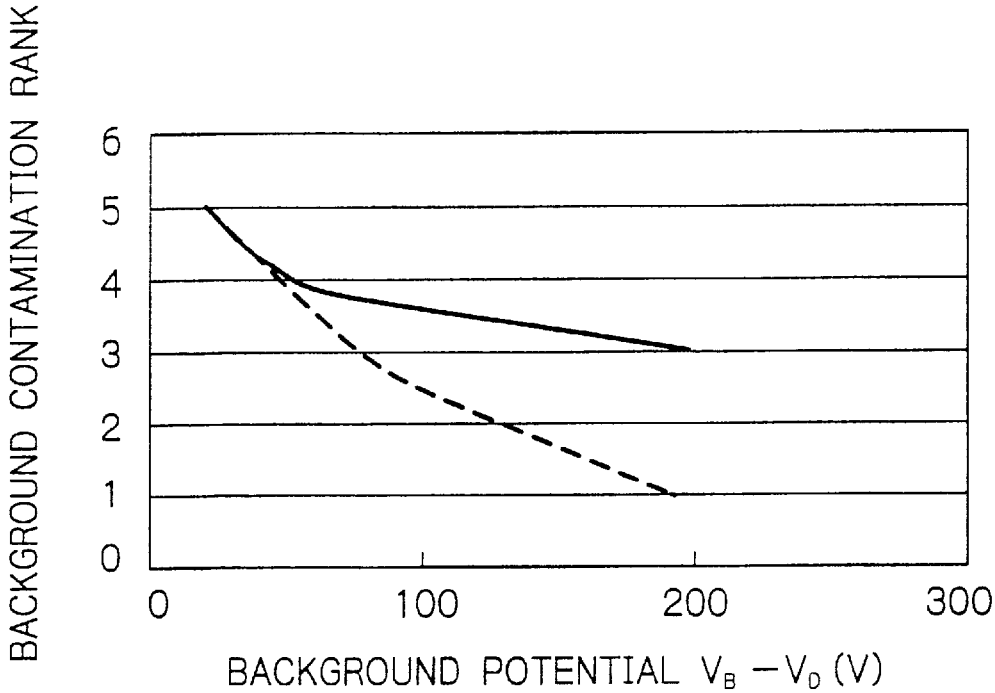
FIG. 57 is a graph showing a relation between the background contamination rank and the background potential.

FIG. 57 compares the drum 1 with lubrication (solid curve) and the drum 1 without it (dotted curve) with respect to a relation between the background potential and the background contamination rank. Considering the toner charge distribution particular to the illustrative embodiment, when the maximum coefficient of static friction $\mu$ of the drum 1 is between 0.1 and 0.4, the adhesion of the toner to the drum 1 is relatively weak. Therefore, the developer pressed against the drum 1 during development removes background contamination to occur during usual development with a scavenging force. It follows that background contamination ascribable to a $\gamma$ value higher than usual is successfully removed, insuring a uniform image free from background contamination. More specifically, assume that the background potential VD is −400±40 V, that the potential $V^L$ after exposure is −100±20 V, and that the bias $V_B$ for development is −250 V. Then, when the maximum coefficient of static coefficient $\mu$ was between 0.1 and 0.4, background contamination ranks 3 to 3.5 were achieved, which were contrastive to background contamination ranks 1 to 2 without lubrication. As FIG. 57 also indicates, the background ranks 3 to 3.5 are achievable at background potential of 100 V to 200 V so long as the coefficient of friction $\mu$ lies in the above range.

If the maximum coefficient of static friction $\mu$ is less than 0.1, then the scavenging force of the developer increases and prevents the toner between the drum 1 and the developer from sufficiently depositing on a latent image, resulting in short image density. If the coefficient of friction $\mu$ is greater than 0.4, then the background of the drum 1 is easily contaminated; it is necessary to increase the pressure of the developer acting on the drum 1 or to increase of linear velocity ratio. Such an extra measure, however, is apt to bring about banding and other defects in an image.

In the illustrative embodiment as well as in the eighth embodiment, the optical writing condition of the exposing device 3 should preferably be so selected as to reduce a beam spot diameter and increase writing energy. The optical writing condition will be described hereinafter by using a parameter referred to as differential sensitivity S. Differential sensitivity S is represented by a relation between the surface potential V (E) of the drum 1 and the amount of exposure E to hold when a light beam equivalent to the light beam of the exposing device 3 uniformly exposes the drum 1. More specifically, assume that the drum 1 is exposed by a certain amount of exposure E, and that the surface potential of the drum 1 is V(E+ΔE) when the above amount of exposure E is increased by a small value ΔE. Then differential sensitivity is expressed as:

$$S=|V(E+\Delta E)-V(E)|/\Delta E \tag{12}$$

Generally, differential sensitivity S decreases with an increase in the amount of exposure E. A value that makes differential sensitivity sufficiently small refers to an amount of exposure capable of using the range of the attenuation characteristic of the drum 1 that implements desired stability. The desired stability, in turn, refers to the following. Assume a bilevel process that renders tonality of an image on the basis of the density of, among pixels constituting the image, pixels on which toner deposits for a unit area. Then, the desired stability allows a plurality of dots with a uniform diameter and preselected density to be formed and prevents such dots from noticeably varying with the elapse of time. In practice, however, short density sometimes occurs due to an increase in potential after exposure caused by the deterioration of the drum 1. In this respect, an amount of exposure implementing a potential after exposure that does not degrade image quality is the above-mentioned value that makes differential sensitivity sufficiently small. For example, the above value reduces the differential sensitivity S of the photoconductive layer to one-third of the maximum value or below. From the developing condition standpoint, it is desirable to develop a latent image by saturation development in order to form a plurality of dots with a uniform diameter and preselected density.

As shown in FIG. 3, the drum 1 of the illustrative embodiment has a photoconductive layer it having a thickness TP. The thickness TP and beam spot diameter Db are selected to satisfy a relation:

$$2TP<Db<8TP$$

Assume that the surface of the drum 1 has coordinates (x,y), and that the light beam on the drum 1 has an energy distribution of P(x,y,t) (W/m$^2$). Then, an exposure amount distribution E(x,y) (J/m$^2$) is expressed as:

$$E(x,y)=\int P(x,y,t)dt \tag{14}$$

The beam spot diameter Db is the minimum diameter at $1/e^2$ of the peak value of the distribution E(x,y) represented by the equation (14).

Figure 58:
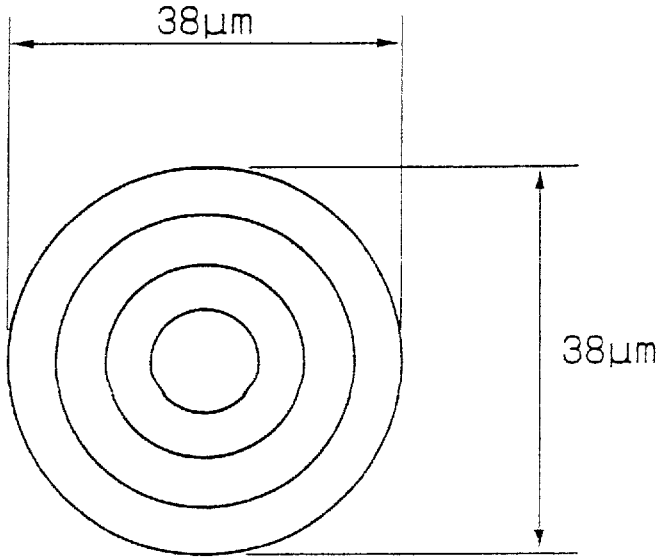
FIG. 58 shows the distribution of the amount of exposure as measured on a photoconductive element.

FIG. 58 shows an exposure amount distribution on the drum 1. As shown, in the illustrative embodiment, when the surface of the drum 1 is scanned by about 20 μm in the subscanning direction for forming one pixel of latent image, the beam spot diameter is about 38 μm in both of the main and subscanning directions. That is, the distribution is approximately a 38 μm gauss distribution in both of the main and subscanning directions. It follows that the beam spot diameter Db, which is the minimum diameter at $1/e^2$ of the peak value of the exposure amount distribution, is 38 μm.

Figure 59:
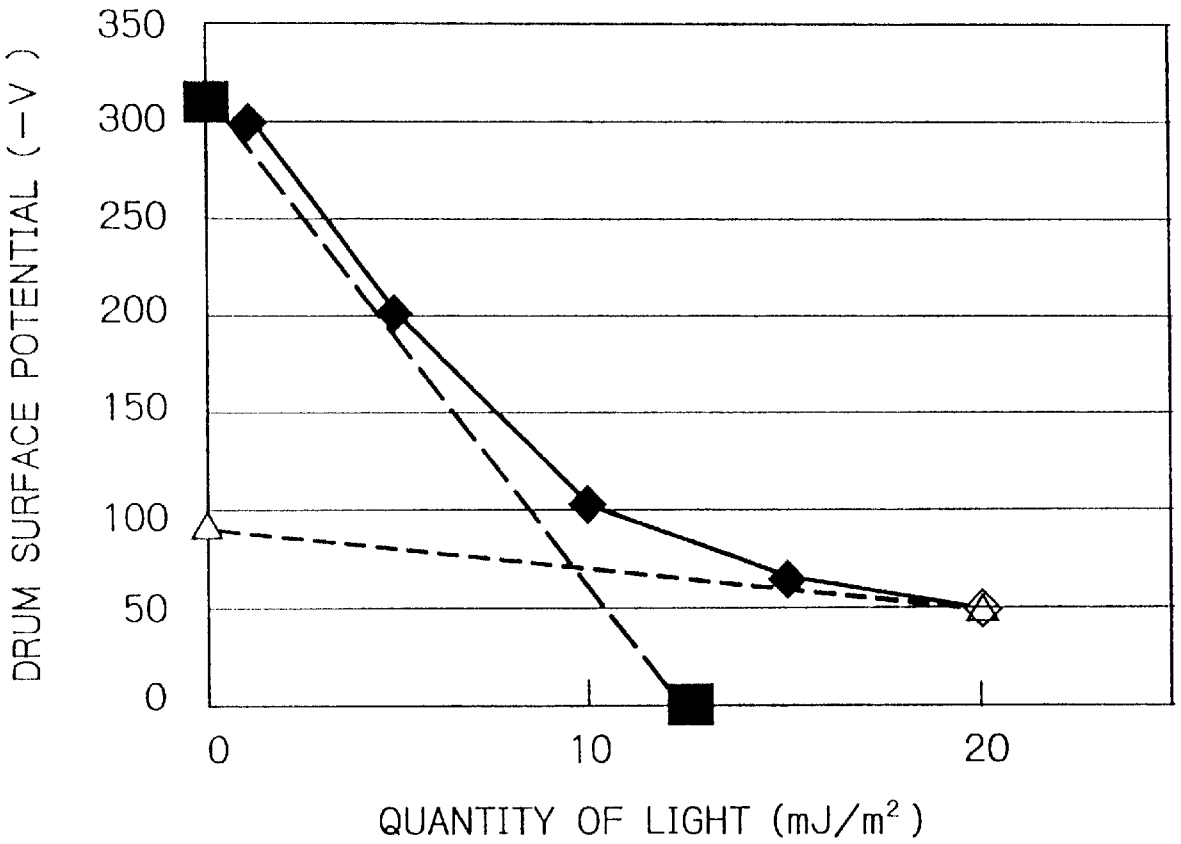
FIG. 59 is a graph showing a relation between the amount of exposure and the surface potential of a photoconductive element.

FIG. 59 shows a relation between the attenuation of the surface potential of the drum 1 and the amount of exposure, as determined by experiments. In FIG. 59, rhombs indicate measured data while squares, triangles and dashed lines connecting them are plotted for describing differential sensitivity; the slope of each dashed line is representative of differential sensitivity. In the illustrative embodiment, the exposing device 3 is adjusted such that the light beam has a wavelength of 670 nm while exposure power is 01.23 mW on the surface of the drum 1. In this condition, there is set up the amount of exposure at the peak of the distribution, i.e., the maximum amount of exposure in the beam spot diameter Db that makes the differential sensitivity of the photoconductive layer 1t sufficiently small.

In the attenuation characteristic shown in FIG. 59, the maximum differential sensitivity is 28 $V.m^2/mJ$. The amounts of exposure corresponding to differential sensitivity S that is one-third of the above maximum sensitivity or less make the differential sensitivity sufficiently small. In this connection, in FIG. 59, the amount of exposure E at the peak of the exposure amount distribution is 20 $mJ/m^2$, and differential sensitivity S corresponding thereto is 5 $V.m^2/mJ$, which is about one-fifth of the maximum differential sensitivity.

To achieve a high developing ability and a γ characteristic that rises with a sharp slope, the illustrative embodiment, as well as the eighth embodiment, limits the dynamic resistance of the magnetic grains, the volume resistivity of the developing roller, the amount of charge to deposit on the toner (μC/g), and so forth. A developing device with such a high developing ability relatively easily maintains the amount of toner on a developing roller constant for thereby developing a solid image with the entire amount of toner. In practice, as for a small dot, the amount of development is apt to vary when differential sensitivity does not sufficiently decrease with the conventional drum and under conventional writing conditions, causing the dot diameter to vary. However, differential sensitivity is sufficiently lowered at the portion of the dot diameter where the latent image forming condition is represented by $1/e^2$. This allows dots with a uniform diameter and uniform density to be formed. In this case, because the differential sensitivity of a latent image is sufficiently lowered, even a developing device with a high γ characteristic does not develop background. This presumably increases a margin as to background contamination.

Assume that the drum 1 has a wall thickness of 15 μm, and that image transfer is, e.g., 95% short of 100% and leaves toner grains scattered on the drum 1. Even in such a condition, the light beam is partly transmitted through the toner grains or turns round, eventually implementing a uniform potential after exposure. For example, when exposure power was raised from 0.23 mW to o0.47 mW, a sufficiently uniform image without background contamination was achieved.

As stated above, the eighth and ninth embodiments described above have various unprecedented advantages, as enumerated below.

(1) The developing ability of the developing device can be increased to effect desirable development even when the charge potential of a latent image is lowered. Even when the difference between the bias for development and the background potential of the image carrier varies between 0 V and 200 V, background contamination ascribable to toner grains charged to opposite polarity is reduced.

(2) Charged toner contained in a two-ingredient type developer is fed from the toner feeding member to the toner carrier and deposited thereon. It is therefore not necessary to use a contact member for frictionally charging toner deposited on the toner carrier. In addition, there are obviated toner filming on the toner carrier and the variation of the developing characteristic ascribable to the wear of the toner carrier and contact member.

(3) Even when, e.g., the surface potential of the image carrier or the amount of charge deposited on the developer varies due to varying environment, there can be obviated background contamination around pixels on which toner is deposited and short image density.

(4) High-quality images are achievable that are free from background contamination ascribable to toner of opposite polarity.

(5) Discharge occurs little between the image carrier and members around it, so that the image carrier is free from noticeable deterioration.

(6) Non-electrostatic adhesion acting between the surface of the image carrier and the toner is weakened, further reducing background contamination.

(7) Latent images representative of dots are stable in diameter even when the potential of the image carrier varies, so that images are preventing from varying.

Tenth Embodiment

This embodiment is mainly directed toward the third object stated earlier. First, the background potential $|V_D-V_B|$ is so selected as to be smaller than at least the development potential $|V_B-V_L|$, as described with reference to FIG. 6 in relation to FIG. 1. Three potentials, i.e., the background potential, development potential and exposure potential shown in FIG. 6 are decisive when it comes to various developing conditions. Such potentials determine the final image characteristics and relate to image density.

Figure 60:
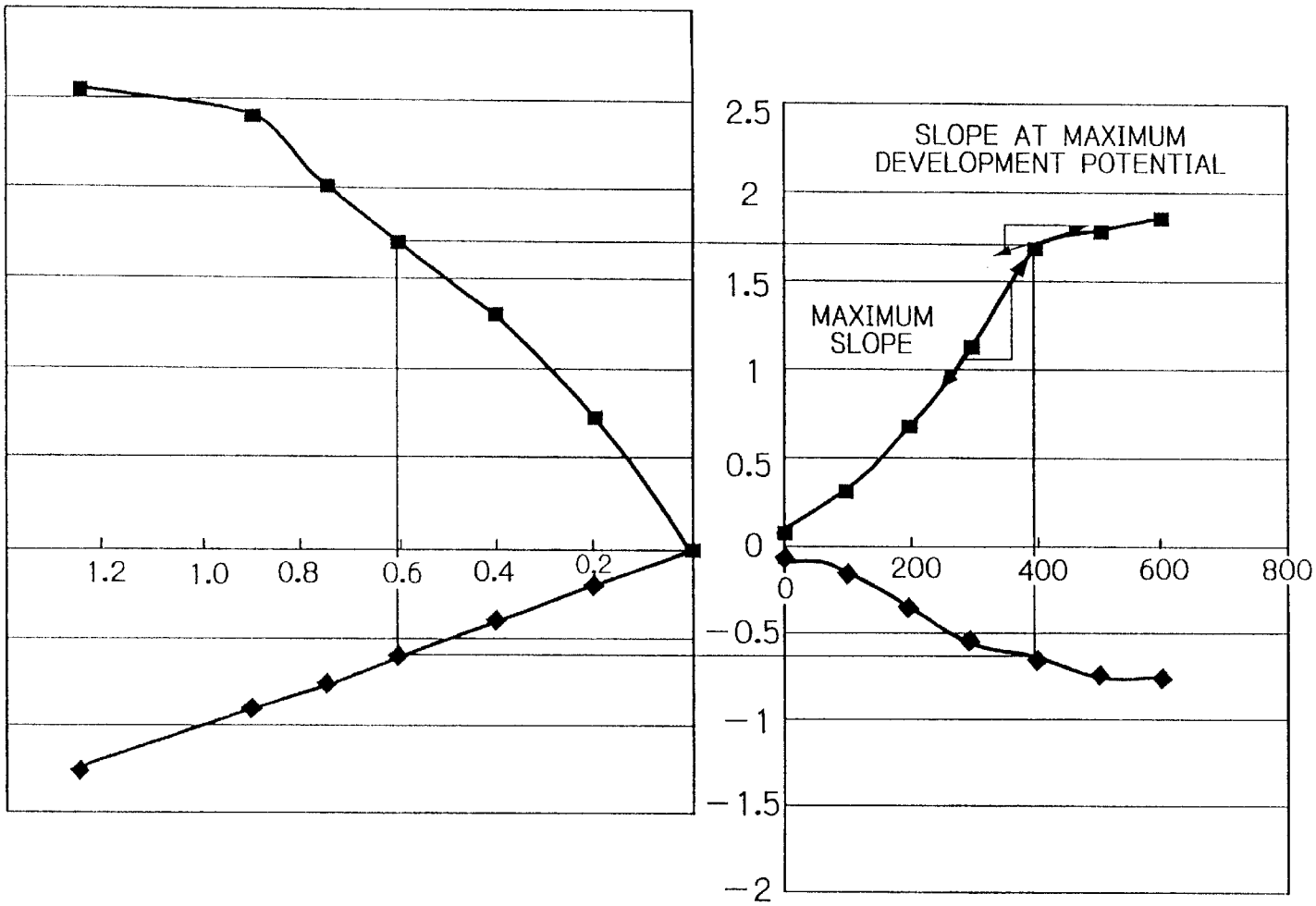
FIG. 60 is a chart showing a relation between the image carrier and the image characteristics.

FIG. 60 is a quadrant chart showing a relation between the amount of toner deposition and the image carrier and a relation between the development potential and image density and the development potential and the amount of toner deposition. Specifically, the first quadrant in FIG. 60 shows a relation between the development potential and the image density ID. The second quadrant shows a relation between the amount of toner deposition and the image density ID. As for this relation, the coloring degree of the toner is a critical factor. Specifically, while the characteristic is substantially linear, the amount of toner deposition implementing preselected image density noticeably depends on the coloring degree of the toner. The third quadrant shows the amount of toner deposition itself. The fourth quadrant shows a relation between the development potential and the amount of toner deposition, i.e., so-called m-ID characteristic.

The relation shown in the first quadrant is unconditionally determined when the development potential is determined; a change in development potential directly translates into a change in image density ID. In the actual image forming process, the development potential varies when the charge deposited on the image carrier by the charging member varies or when $V_L$ rises (apparent decrease in sensitivity), the amount of exposure varies or the bias for development varies due to the optical fatigue of the image carrier. The variation results in irregularity in a single image as well. Particularly, at and around the development potential of 400 V, image density is maximum with the result that the variation translates into the variation of the maximum image density. In an image forming apparatus, the variation of the maximum image density lowers image quality and is therefore critical.

To stabilize image density in the low-potential process, the illustrative embodiment makes the slope of the development potential and ID characteristic at and around the development potential of 400 V smaller than 0.9 times the maximum value of the same slope. It is to be noted that the maximum value of the development potential and ID slope corresponds to about one-half of the amount of toner deposition implementing saturation image density.

However, in the image forming apparatus of the type described, developing conditions for high image density and developing conditions for an attractive low-contrast image are not compatible with each other. It is therefore difficult to improve both of a high-density portion and a lower-density portion at the same time. More specifically, image density is increased if, e.g., the gap between the image carrier and the sleeve is reduced or if the developing region is increased in width. On the other hand, an attractive low-contrast image is achieved if the above gap is increased or if the developing region is reduced in width.

Figure 61:
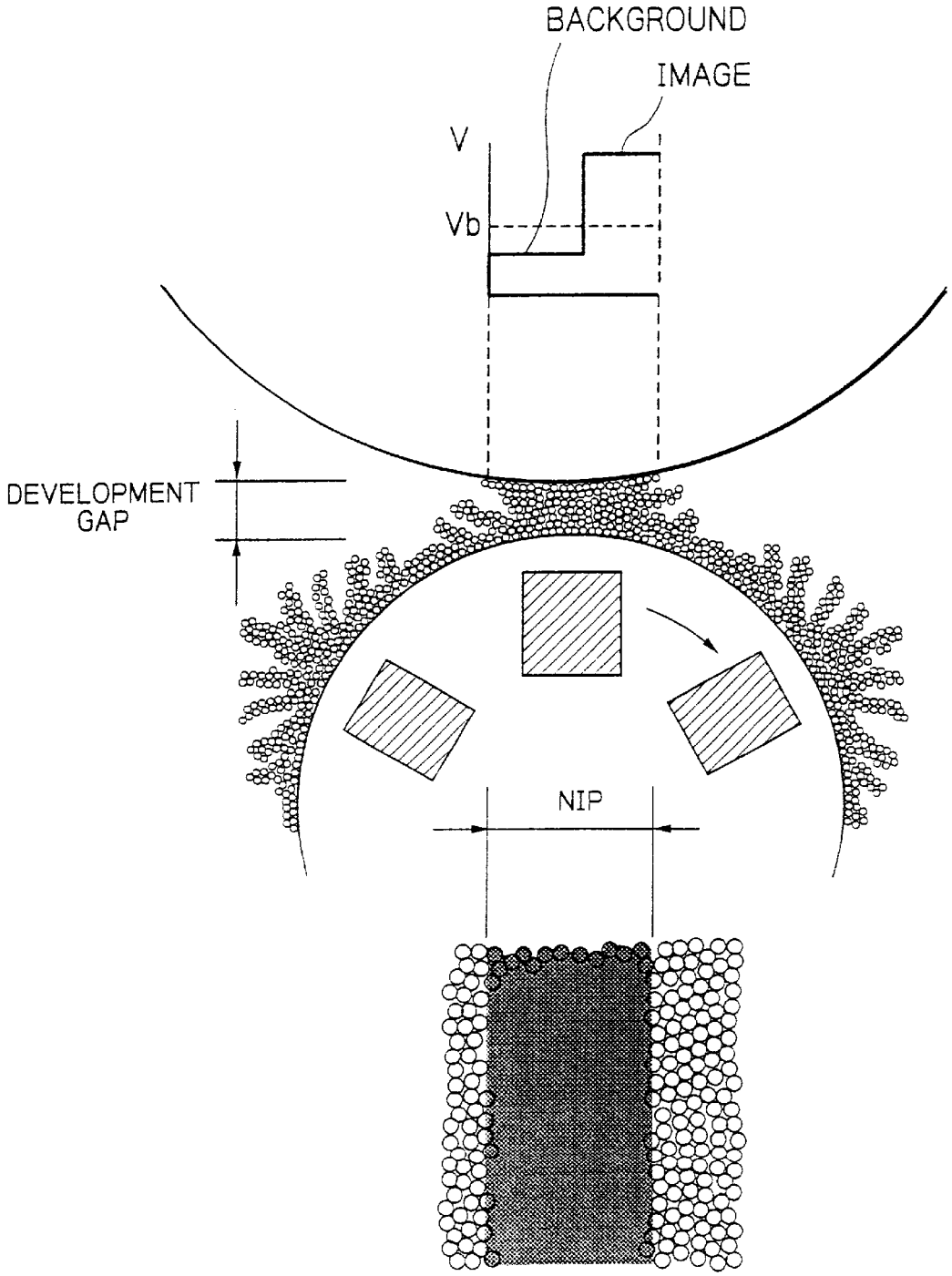
FIG. 61 shows a conventional gap for development and a conventional nip for comparison.

For example, when importance is attached to an attractive low-contrast image, it is likely that the crossing portion of solid lines or the trailing edge portion of a black solid image or that of a halftone solid image is lost. Further, a horizontal line is developed with a smaller width than a vertical line originally having the same width as the horizontal line. In addition, a solitary small dot is not developed at all. FIG. 61 demonstrates such phenomena.

As shown in FIG. 61, the magnet brush formed on the sleeve contacts the image carrier at the nip. The phenomena described above occurs when the image carrier and sleeve differ in linear velocity from each other. For example, the sleeve is moved at a linear velocity 2.5 times as high as the linear velocity of the image carrier. When the main pole of the sleeve is implemented by a magnet having a half-width of 48°, the above nip was about 4 mm wide while the gap for development was 0.4 mm.

Figure 62A:
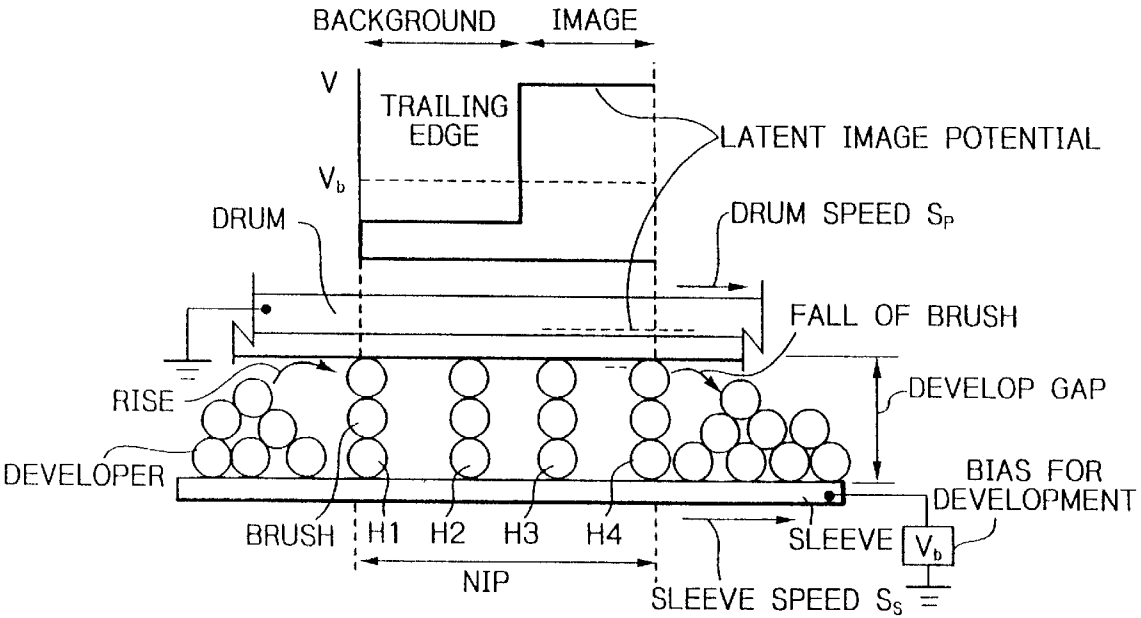
FIGS. 62A and 62B demonstrate the behavior of toner grains deposited on carrier grains in relation to the position of a latent image.
Figure 62B:
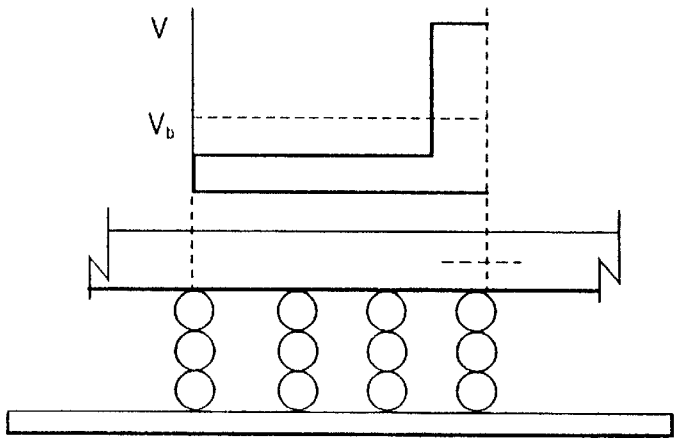

Reference will be made to FIGS. 62A and 62B for describing the behavior of the toner grains deposited on the carrier grains at the nip shown in FIG. 61. More specifically, FIGS. 62A and 62B show a relation between the surface potential of the latent image and the bias for development, the position of the latent image at the nip, and the movement of the magnet brush around the nip. FIG. 62A shows a condition in which the boundary between the background portion and the image portion of the latent image is located substantially at the center of the nip. The sleeve and image carrier move in the same direction; the former moves at a velocity Ss higher than a velocity Sp at which the latter moves. Therefore, assuming that the image carrier is in a halt relative to the sleeve, then the magnet brush moves in the following manner. The magnet brush rises at a position H1 with the result that the carrier grains at the end of the brush starts contacting the image carrier. At a position H2, the magnet brush moves while rubbing itself against the background portion. At a position S3, the magnet brush passes the image portion. Subsequently, at a position H4, the magnet brush falls down with the result that the carrier grains at the end of the brush are released from the image carrier. The carrier grains at the end of the magnet brush move from the position Hi to the position H4 while remaining substantially at the same height; the individual carrier grains roll themselves.

Figure 63A:
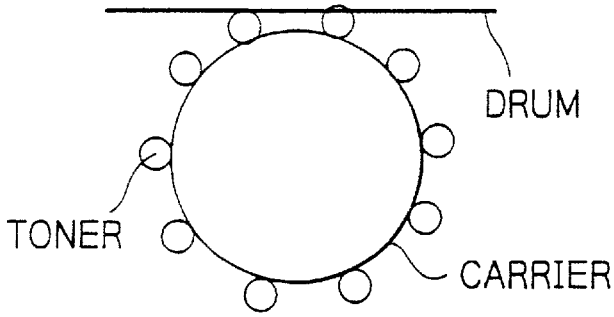
FIGS. 63A through 63D model the deposition of toner grains on the individual carrier grain at the nip of a magnet brush.
Figure 63B:
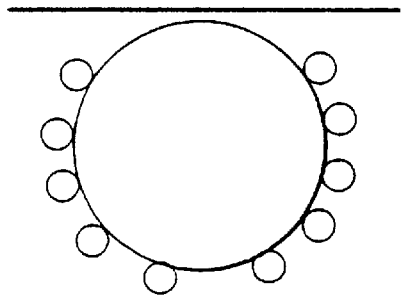

FIGS. 63A through 63D model the consecutive conditions of the toner grains deposited on the carrier grains at the end of the magnet brush between the positions H1 and H4. The position H1 corresponds to FIG. 63A while the positions H2, H3 and H4 correspond to FIGS. 63B, 63C and 63D, respectively. As shown in FIG. 63A, at the position H1 close to the inlet of the nip, the toner grains are relatively uniformly deposited on the each carrier grain. As shown in FIG. 63B, at the position H2, the electric field formed by the bias $V_B$ and the potential of the background portion of the latent image is directed toward the sleeve. Therefore, the toner grains move away from the image carrier (toner drift). As a result, as shown in FIG. 63B, the number of toner grains decreases in the vicinity of the image carrier. More specifically, because the carrier grain moves in the nip while rolling itself, the number of toner grains present on the carrier grain in the vicinity of the image carrier decreases with an increase in nip width, increasing the surface area of the carrier grain.

Figure 63C:
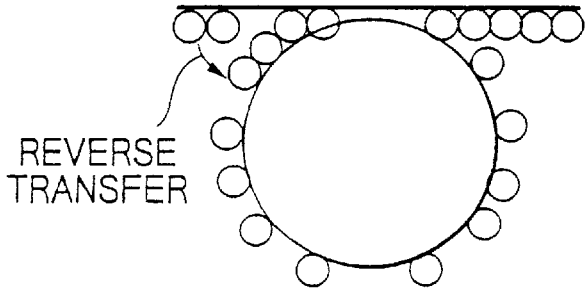
Figure 63D:
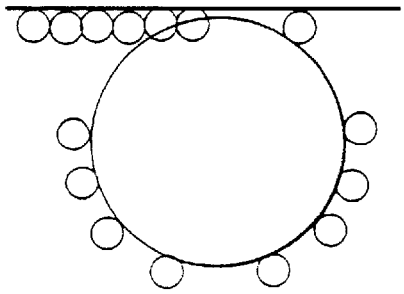

At the position H3, the electric field formed by the bias $V_B$ and the potential of the image portion of the latent image is directed from the sleeve toward the image carrier. However, the toner grains moved downward cannot instantaneously deposit on the latent image carried on the image carrier. As a result, toner grains transferred from part of the magnet brush moved away from the image portion to the image carrier are again transferred to the carrier grain due to the counter charge of the carrier grain. Consequently, as shown in FIG. 63C, the number of toner grains on the carrier grain increases while the number of toner grains at the trailing edge of the latent image decreases. As the number of toner grains increase due to such reverse transfer, the counter charge decreases and allow the toner grains to again move upward toward the end of the magnet brush. The electric field directed from the sleeve toward the image carrier causes the toner grains, including the reversely transferred toner grains, to deposit on the image carrier.

As shown in FIG. 62B, assume that the sleeve and image carrier start moving relative to each other with the elapse of time, causing the trailing edge of the image portion to approach the position H4. Then, the magnet brush falls down, i.e., ends development in the condition of FIG. 63C, i.e., after many toner grains have been reversely transferred from the image carrier to the carrier grain of the magnet brush. As a result, the trailing edge of a toner image is lost. This problem is particularly serious with a halftone image. Further, when the linear velocity ratio is relatively great, the magnet brush causes a great impact to act on the image carrier on contacting the image carrier and thereby reduces adhesion between the carrier grain and the toner grains, making it easy for the toner grains to move.

The trailing edge of a toner image is jagged when lost. A mechanism that makes the trailing edge jagged will be described hereinafter. The developer on the sleeve, which rotates around a stationary magnet, forms a magnet brush along the magnetic lines of force issuing from the magnet. The magnet brush fully rises at a position where the pole of the magnet has a peak, and falls down along the surface of the sleeve when a tangential pole between poles is high. The magnet brush is conveyed by the sleeve while repeating such behavior. This is particularly noticeable when a doctor or metering member causes the developer to form a thin layer.

When the magnet brush enters the developing region, the developer conveyed between the main pole and the pole immediately preceding it along the surface of the sleeve rises in accordance with the magnetic field of the main pole and rubs itself against the image carrier, developing the latent image. After the development, the magnet brush falls down and is conveyed toward the downstream side along the surface of the sleeve.

Assume that the magnet brush starts rising in accordance with the magnetic field of the main pole, but with irregularity in the axial direction of the sleeve. Then, the position at which the magnet brush contacts the image carrier is irregular in the axial direction of the sleeve. More specifically, the condition in which the magnet brush fully rises at a position not coinciding with the peak of the main pole is scattered in the axial direction of the sleeve. This, coupled with the fact that, the chains of the magnet brush adjoining each other in the axial direction of the sleeve attract each other, divides the magnet brush into large chains. Such large chains contact the image carrier at different positions in the axial direction of the sleeve. This occurs even after the magnet brush has rubbed itself against the image carrier. This is why the trailing edge of a toner image lost due to the counter charge ascribable to toner drift is jagged. If the magnet brush uniformly rises in the axial direction of the sleeve in accordance with the magnetic field of the main pole, then the omission of the trailing edge and therefore the jagged trailing edge will be obviated.

Figure 64:
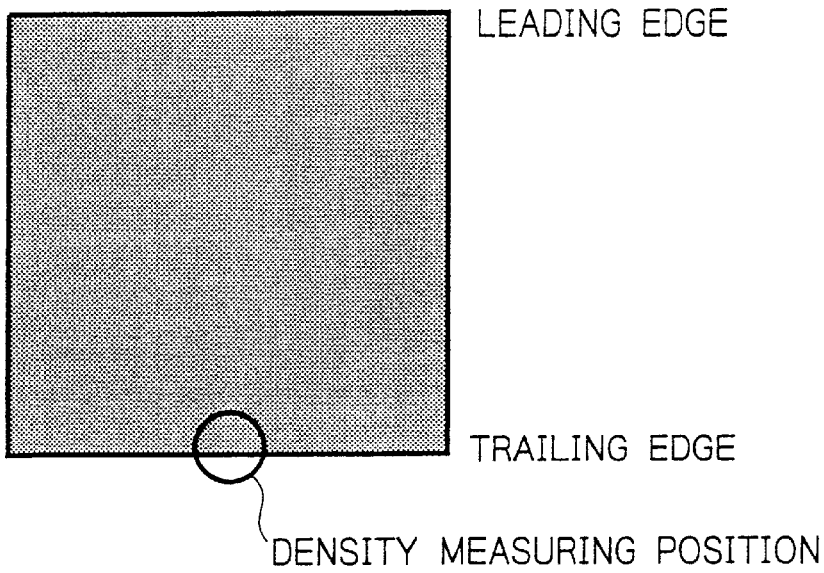
FIG. 64 shows a specific solid image free from the omission of a trailing edge.
Figure 65:
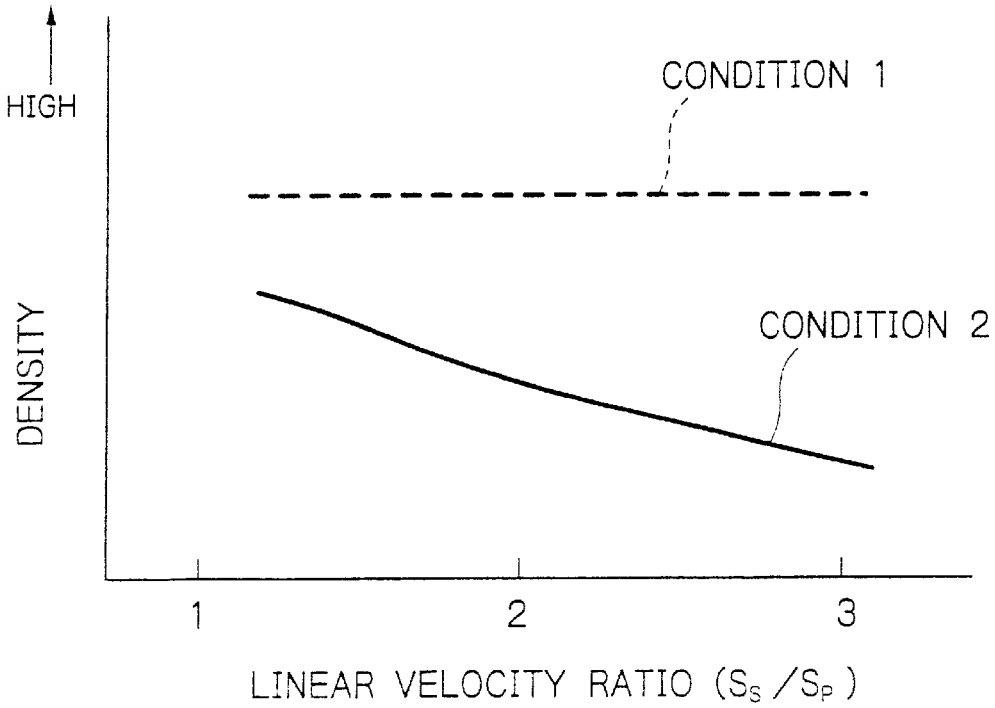
FIG. 65 is a graph showing a relation between a linear velocity ratio of a sleeve to a photocoductive element and the image density.

FIG. 64 shows a specific solid image sized several centimeters square. The density of the solid image was measured over about 5 mm as measured from the trailing edge. FIG. 65 shows a relation between the edge of the tailing edge of the solid image shown in FIG. 64 and the ratio of the sleeve linear velocity Ss to the image carrier linear velocity Sp. In FIG. 65, a condition 2 indicates the density characteristic of the image shown in FIG. 64 (nip width for development of about 4 mm). As shown, when the ratio Ss/Sp is increased from about 1.1, density increases at the portion other than the portion where the omission of the tailing edge occurs. This, however, makes the condition shown in FIG. 63C noticeable and therefore aggravates the omission of the trailing edge. Moreover, the omission of the trailing edge extends over a broad range, resulting in irregular results of measurement.

To solve the above problem, the illustrative embodiment finds a condition that avoids the transition from the behavior described with reference to FIGS. 62*a*, 62*b* and 63A through 63D to the condition shown in FIG. 63C. The illustrative embodiment then finds a method implementing a condition 1 shown in FIG. 65. In the condition 1, the density at the trailing edge does not decrease despite an increase in ratio Ss/Sp or increases in accordance with an increase in toner supply when the ratio Ss/Sp increases.

One solution to the above-described problem may be to reduce a potential difference between the bias $V_B$ for development and the potential of the background portion of a latent image to zero. However, this solution is not practical because the toner has a charge distribution and because a potential difference must be set up that does not bring about background contamination in accordance with the toner grains of low charge, which might bring about background contamination. When use is made of magnetic toner grains containing a magnetic substance, the movement of the toner grains caused by the previously stated electric field is slowed down due to the electric field of the sleeve, making it difficult for the condition of FIG. 63B to occur. However, this is not an effective solution because toner deposition on the image portion decreases as well and prevents the density of the entire image from increasing and because the magnetic toner grains cannot implement color toner. While another solution may be to improve the carrier characteristic and the configuration of the carrier surface, modifying the carrier only for such a purpose is not practical when consideration is given to, e.g., durability.

Factors for insuring high image quality include the reproducibility of thin lines, particularly horizontal-to-vertical ratio, the reproducibility of dots, and uniform toner deposition. These factors should be achieved together with the obviation of the omission of the trailing edge and jagged trailing edge.

The illustrative embodiment achieves both of high image quality and the extension of life at the same time. Specifically, the illustrative embodiment deposits a smaller amount of charge on the developer than the conventional device to enhance the developing ability while reducing the charge potential of the image carrier and hazard to the developer. This implements exposure with a small quantity of low-energy light beam and thereby forms a high-definition latent image, which insures a high-quality image. Further, there can be reduced the omission of the trailing edge and jagged trailing edge of an image, particularly a low-contrast image.

Figure 66:
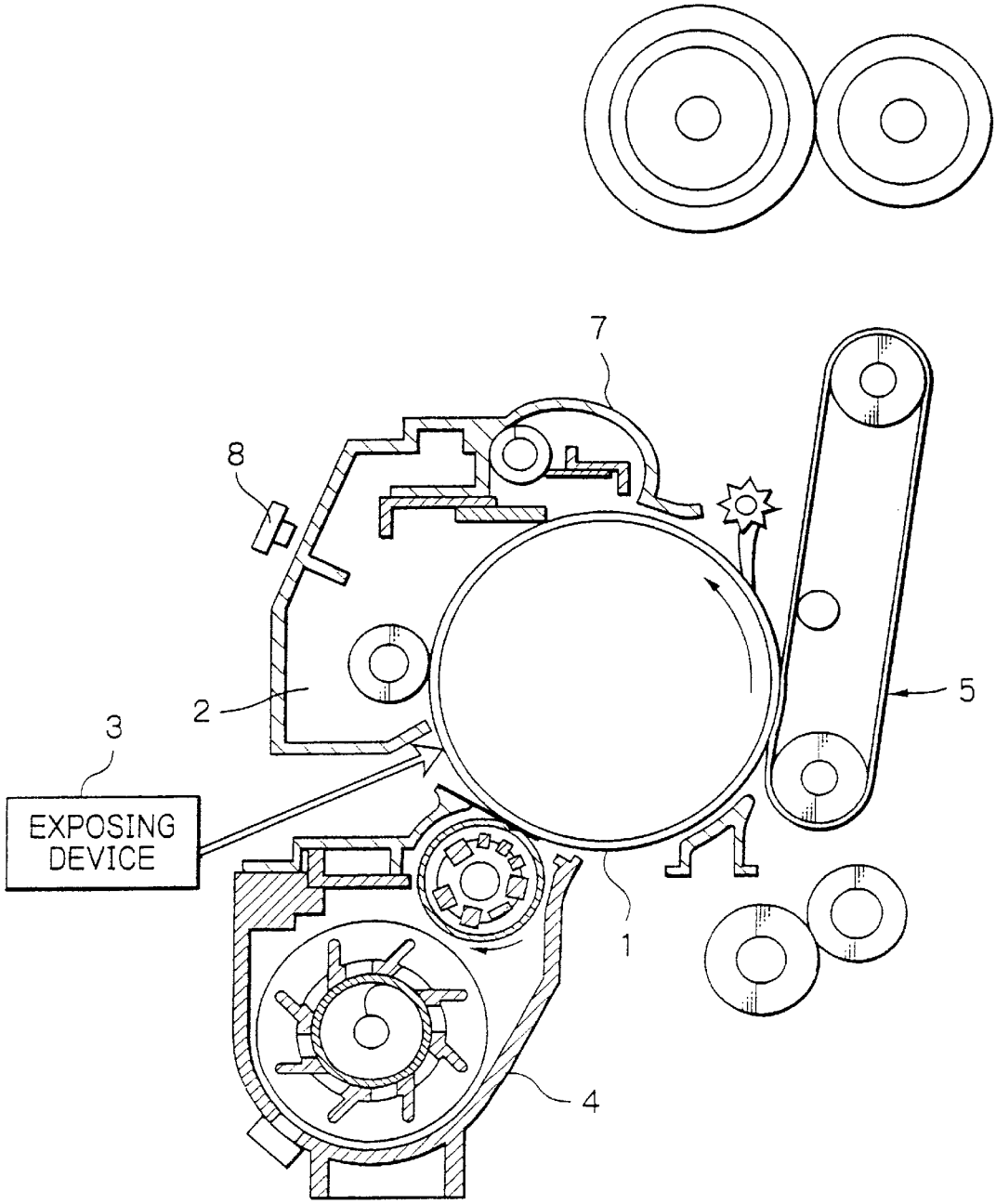
FIG. 66 shows a photoconductive element unit including a developing device representative of a tenth embodiment of the present invention.

A more specific configuration of the illustrative embodiment will be described hereinafter. FIG. 66 shows a photoconductive element unit including the developing device. As shown, the photoconductive element unit includes the photoconductive element or image carrier implemented as a drum 1. Arranged around the drum 1 are a charger 2, an exposing device 3, a developing device 4, an image transferring device 5, a cleaning device 7, and a discharge lamp 8. The charger 2 uniformly charges the surface of the drum 1. The exposing device 3 scans the charged surface of the drum 1 imagewise with a laser beam, thereby forming a latent image. The developing device 4 develops the latent image to thereby form a corresponding toner image. The image transferring device 4 transfers the toner image from the drum 1 to a sheet. The cleaning device 7 removes toner left on the drum 1 after the image transfer. The discharge lamp 8 discharges the surface of the drum 1 cleaned by the cleaning device 7.

The operation of the photoconductive element unit is analogous to the operation of the first embodiment. The illustrative embodiment is also practicable with magnetic toner containing a magnetic substance. The illustrative embodiment is identical with the first embodiment as to the various factors relating to the magnetic toner. In the illustrative embodiment, the toner has a volume mean particle size of 5 $\mu$m. Also, the illustrative embodiment is identical with the first embodiment as to the carrier and a method of measuring its dynamic resistance DR.

Figure 67:
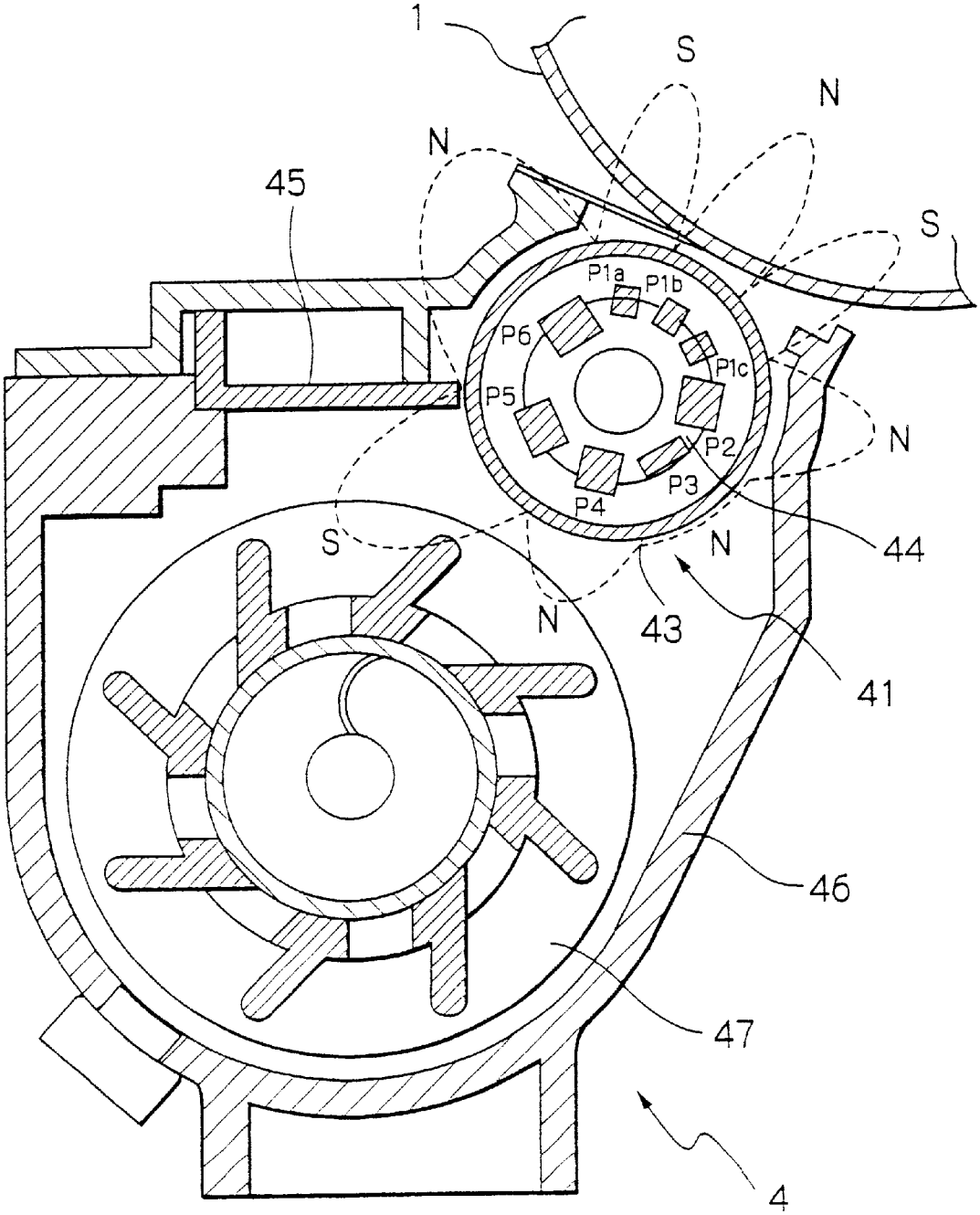
FIG. 67 shows the developing device of the tenth embodiment in detail.

FIG. 67 shows the developing device 4 in detail. As shown, a developing roller or developer carrier 41 faces the drum 1. A developing region where the drum 1 and magnet brush contact each other is formed between the drum 1 and the developing roller 41. The developing roller 41 is made up of a rotatable sleeve 43 and a stationary magnet roller or magnet member 44 accommodated in the sleeve 43. The sleeve 43 is formed of aluminum, brass, stainless steel, conductive resin or similar nonmagnetic material and rotatable clockwise, as viewed in FIG. 67. The surface of the sleeve 43 is roughened to surface roughness of 10 $\mu$m RZ to 20 $\mu$m RZ. For example, the surface of the sleeve 43 may be roughened by sand-blast or may be formed with a plurality of grooves that are 1 mm to several millimeters deep each. The drum 1 is made up of a core formed of, e.g., aluminum and a photoconductive layer formed by coating an organic photoconductor on the core.

In the illustrative embodiment, the drum 1 has a diameter of 60 mm and moves at a linear velocity of 240 mm/sec. The sleeve 43 has a diameter of 20 mm and moves at a linear velocity of 600 m/sec; the linear speed ratio of the sleeve 43 to the drum 1 is 2.5. The gap for development between the drum 1 and the sleeve 43 is 0.4 mm. Assuming that the carrier grain size is 50 $\mu$m, then it has been customary to form a gap of 0.65 mm to 0.8 mm, which is more than ten times as great as the carrier grain size. In the illustrative embodiment, the gap should preferably be ten times as great as the carrier grain size or less (0.55 mm). A greater gap would make it difficult to achieve desirable image density.

A doctor 45 is positioned upstream of the developing region in the direction of developer conveyance (clockwise as viewed in FIG. 67) and implemented as a blade. The doctor 45 regulates the amount of the developer deposited on the sleeve, i.e., the eight of brush chains forming a magnet brush. A doctor gap of 0.4 mm is formed between the doctor 45 and the sleeve 43. A screw 67 is positioned at the opposite side to the drum 1 with respect to the developing roller 41. The screw 47 scoops up the developer stored in a casing 46 toward the developing roller 41.

Figure 68:
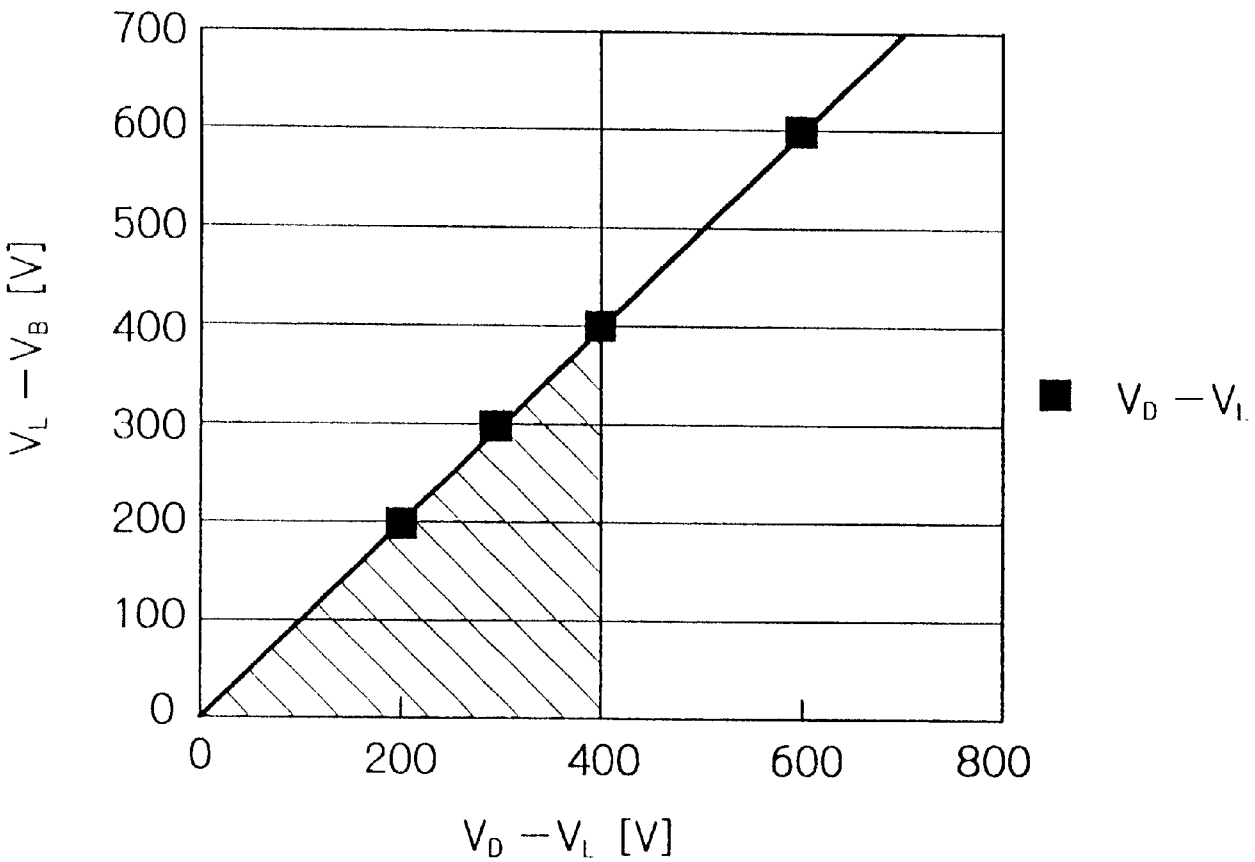
FIG. 68 is a graph showing a relation between potentials.
Figure 69:
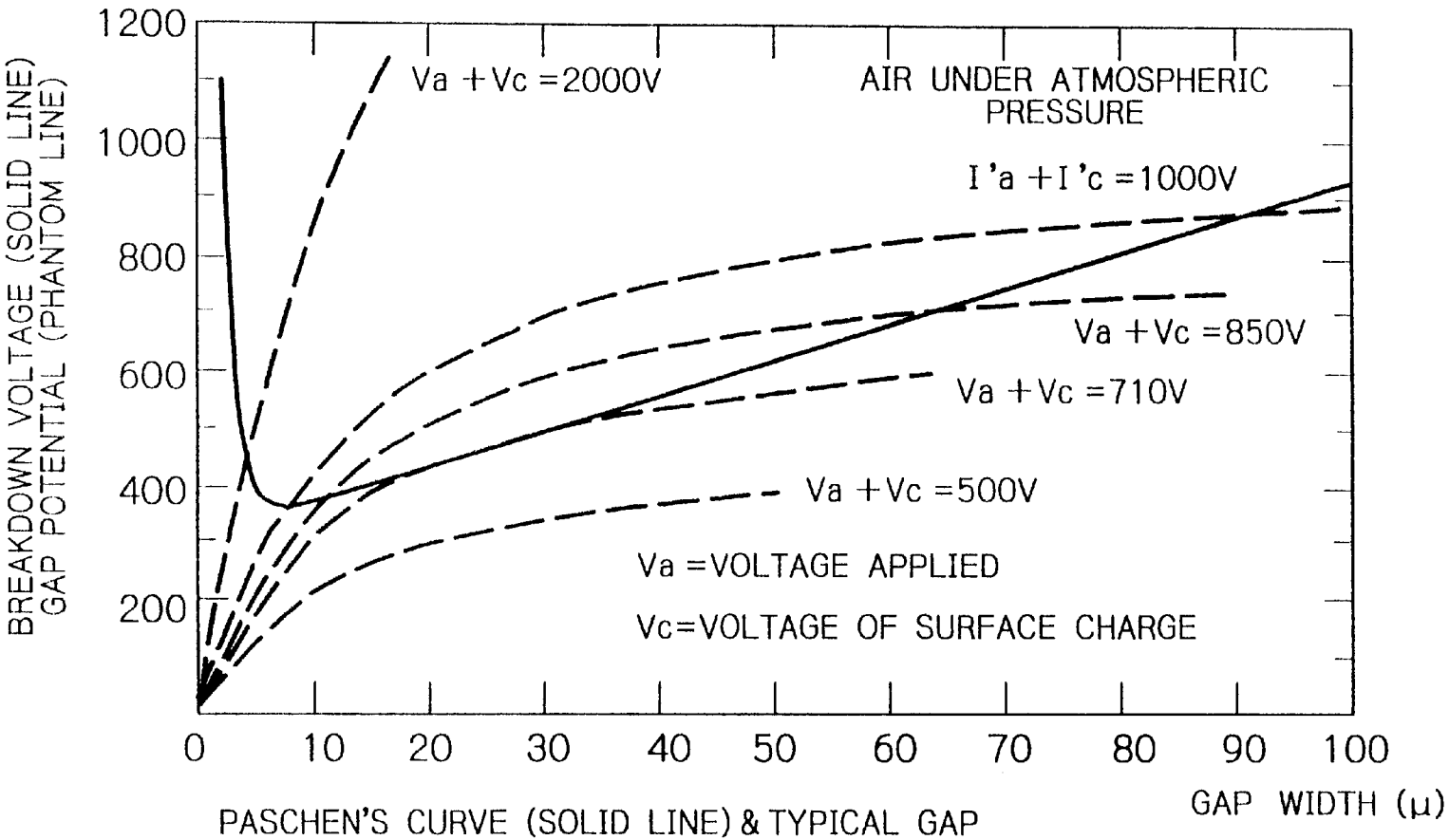
FIG. 69 is a graph demonstrating Paschen's law.

Developing conditions will be described hereinafter. In the illustrative embodiment, the drum 1 is uniformly charged to a potential $V_D$ before development and has a potential $V_L$ of −50 V after exposure. The development potential is therefore $V_L-V_B$=200 V. A bias $V_B$ for development is selected to be −250 V. The development potential is therefore $V_L-V_B$=200 V. In this case, $|V_D-V_L|>|V_L-V_B|$ is 400 V>300 V. FIG. 68 shows a relation between $|V_D-V_L|$ (abscissa) and $|V_L-V_B|$ (ordinate). The range where $|V_D-V_L|$ is smaller than 400 V is set on the basis of Paschen's law in order to avoid discharge between the exposed portion and the unexposed portion of the drum 1. It was experimentally found that when the potential difference was 400 V or less, discharge occurred little, as shown in FIG. 69. In FIG. 68, an oblique line is representative of $|V_D-V_L|>|V_L-V_B|$. In the illustrative embodiment that effects negative-to-positive development, the values $V_D$, $V_L$ and $V_B$ are of the same polarity, so that $|V_D|-|V_B|$ is greater than zero in a range indicated by hatching. More specifically $|V_D-V_L|$ and $|V_D-V_B|$ can have values lying in the range indicated by hatching.

Referring again to FIG. 67, the magnet roller 44 forms magnetic fields for causing the developer deposited on the sleeve 43 to rise in the form of a magnet brush. More specifically, the carrier grains of the developer rise in the form of brush chains on the sleeve 43 along the magnetic lines of force in the normal direction. The charged toner grains deposit on such carrier grains, forming a magnet brush. The magnet brush moves in the same direction as the sleeve 43 (clockwise as viewed in FIG. 67) due to the rotation of the sleeve 43.

Figure 70:
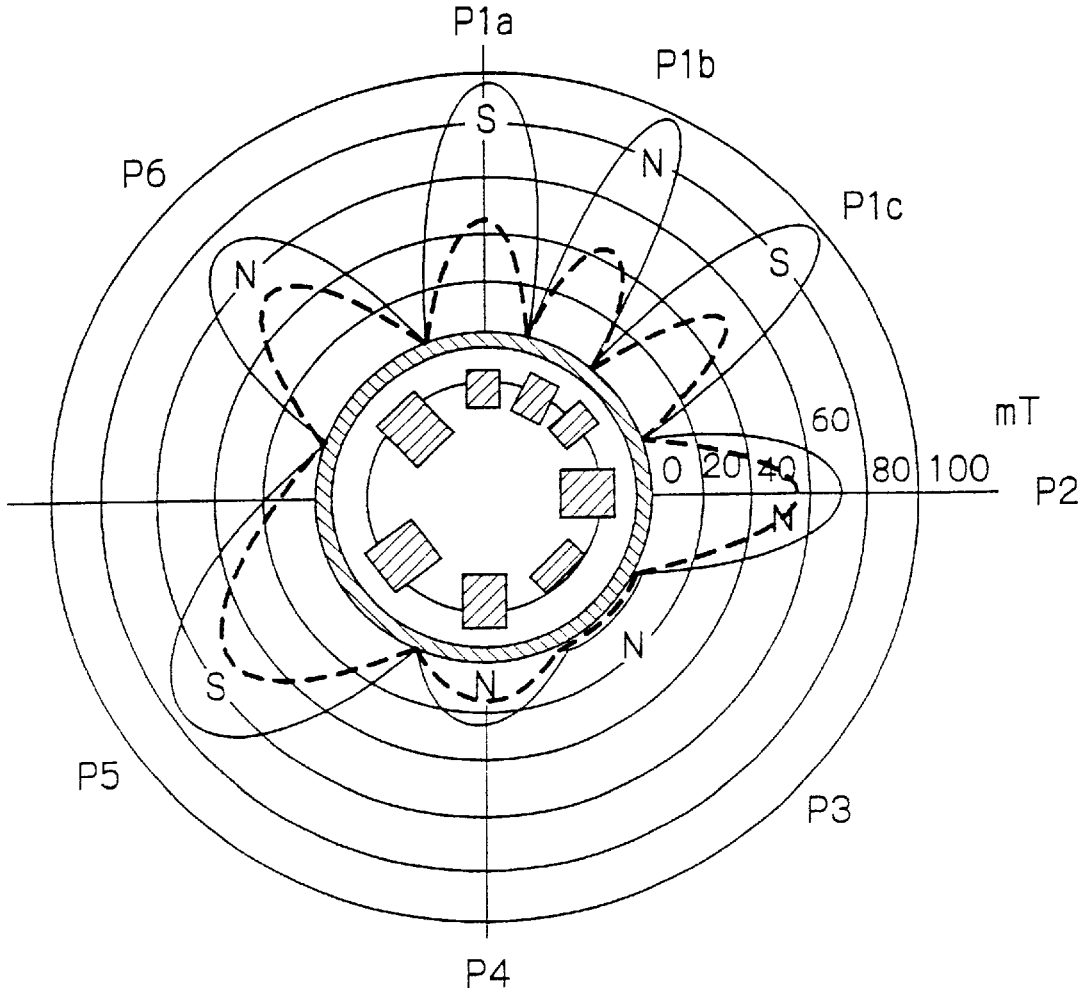
FIG. 70 is a chart showing the distribution of magnetic forces of a developing roller included in the tenth embodiment together with the sizes of magnetic forces.

The magnet roller 44 has a plurality of magnetic poles implemented by magnets. More specifically, as shown in FIG. 70 as well, a pole or main pole P1*b* causes the developer to rise in the form of chains in the developing region. Poles P1*a* and P1*c* help the main pole P1*b* form a magnetic force. A pole P4 scoops up the developer to the sleeve 43. Poles P2 and P3 convey the developer scooped up to the sleeve 43 to the developing region. All of the poles P1*b*, P1*a*, P1*c*, P4, P5, P2 and P3 are oriented in the radial direction of the sleeve 43. While the magnet roller 44 is shown as having eight poles, additional poles may be arranged between the pole P3 and the doctor 45 in order to enhance the scoop-up of the developer and the ability to follow a black solid image. For example, two or more additional poles may be arranged between the pole P3 and the doctor 45.

Particularly, as shown in FIG. 67, the poles P1*a*, P1*b* and P1*c*, which belong to a pole group P1, are implemented by magnets that sequentially decrease in cross-sectional area in this order. While these magnets are formed of a rare earth metal alloy, they may alternatively be formed of, e.g., a samarium alloy, particularly a samarium-cobalt alloy. An iron-neodium-boron alloy, which is a typical rare earth metal alloy, has the maximum energy product of 358 kJ/m$^3$. An iron-neodium-boron alloy bond, which is another typical rare earth metal alloy, has the maximum energy product of 80 kJ/m$^3$ or so. Such magnets guarantee a magnetic force required of the surface of the developing roller 41 despite their small cross-sectional area. A ferrite magnet and a ferrite bond magnet, which are conventional, respectively have the maximum energy products of about 36 kJ/m$^3$ and 20 kJ/m$^3$. If the sleeve 43 is allowed to have a greater diameter, then use maybe made of a ferrite magnet or a ferrite bond magnet having a relatively great size or having a tip tapered toward the sleeve 43 in order to reduce a half-width.

If desired, the magnets with small cross-sectional areas may be replaced with a single magnet roller formed by dispersing magnetic powder in resin. Further, the magnets other than one forming the pole group P1 may be molded integrally with each other while the magnets of the pole group P1 may be formed integrally or as a plurality of magnets. In addition, a sectorial magnet maybe adhered to a magnet roller shaft.

In the illustrative embodiment, the poles P4, P6, P2 and P3 are N poles while the poles P1*a*, P1*c* and P5 are S poles. As shown in FIG. 70, the main magnet P1*b* had a magnetic force of 85 mT or above, as measured on the developing roller 41. It was experimentally found that if the main pole P11*b* had a magnetic force of 60 mT or above, defects including the deposition of the carrier grains were obviated. A magnetic force lower than 60 mT brought about carrier deposition. A tangential magnetic force is the force that relates to carrier deposition. While the magnetic forces of the poles P1*b* and P1*c* must be increased to increase the tangential magnetic force, carrier deposition can be obviated if either one of the poles P1*b* and P1*c* has its magnetic force increased. The magnets P1*a* and P1*b* were 2 mm wide each. In this condition, the pole P1*b* had a half-width of 16°.

Figure 71:
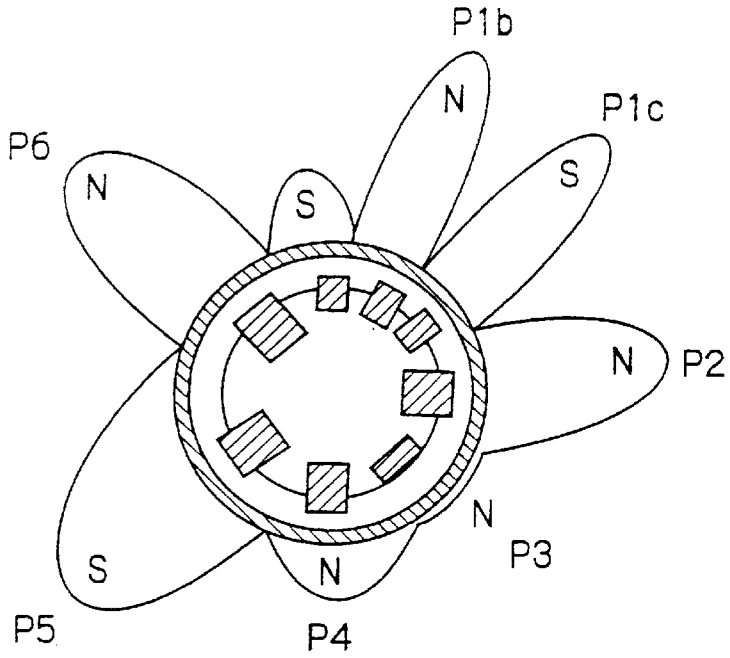
FIG. 71 shows a magnetic force distribution determined when one of the magnets shown in FIG. 70 is absent.

As shown in FIG. 71, only the auxiliary magnet P1*c* may be positioned downstream of the main magnet P1*b*. In this configuration, the half-width of the main magnet P1*b* is the same as in the configuration of FIG. 67; the magnetic force of the main pole P1*b* decreases only by several percent. While the auxiliary magnet P1*a* is absent at the upstream side of the main magnet P1*b*, the magnetic force at the upstream side decrease to about 30 mT, as determined by experiments. However, this position is usually shielded by an inlet seal and not exposed to the image forming section, so that the developer can be fed to the main pole. By reducing the width of the magnet, it is possible to further reduce the half-width, as determined by experiments. When the main pole was implemented by a 1.6 mm wide magnet, the half-width was as small as 12°.

Figure 72:
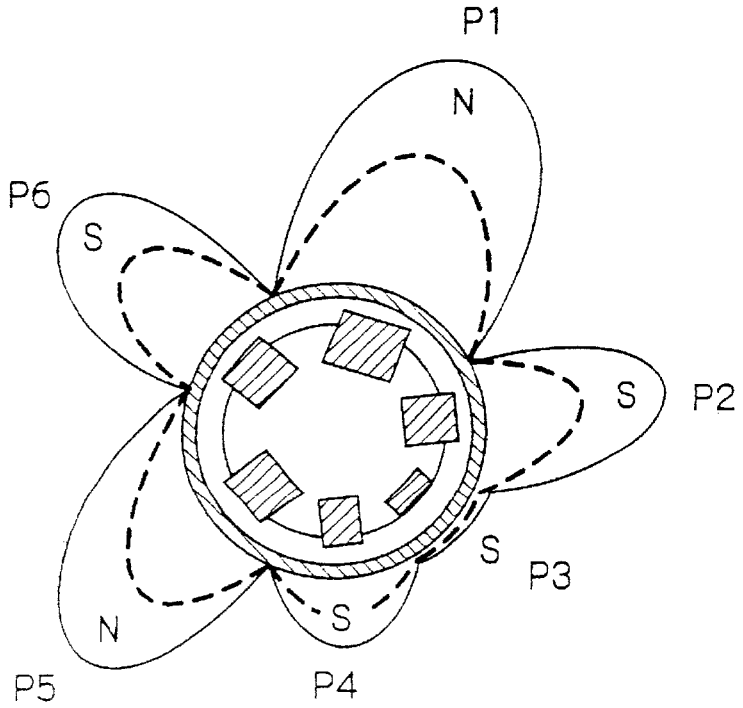
FIG. 72 shows the magnetic force distribution of a conventional developing roller for comparison.

Referring to again to FIG. 70, the attenuation ratio of the magnetic flux density in the normal direction will be described specifically. FIG. 70 shows a magnetic force pattern in the normal direction. In FIG. 70, solid lines show magnetic flux densities measured on the surface of the sleeve 43 while dashed lines show flux densities in the normal direction, which were measured at a position spaced from the sleeve surface by 1 mm. For comparison, FIG. 72 shows a magnetic force pattern particular to a conventional magnet roller. For measurement, use was made of a gauss meter HGM-8300 and an axial probe TYPE A1 available from ADS. The flux densities were recorded by a circle chart recorder.

In the illustrative embodiment, the flux density of the main pole P1*b* in the normal direction, as measured on the sleeve surface, was 95 mT. The flux density of the main pole P1*b* at the distance of 1 mm from the sleeve surface was 44.2 mT; the flux density varied by 50.8 mT. In this case, the attenuation ratio of the flux density in the normal direction was 53.5%. It is to be noted that the attenuation ratio is produced by subtracting the peak flux density at the position spaced by 1 mm from the sleeve surface from the peak flux density on the sleeve surface and then dividing the resulting difference by the latter peak flux density.

The auxiliary magnet P1*a* upstream of the main magnet P1*b* had a flux density of 93 mT in the direction normal to the sleeve surface on the sleeve surface or a flux density of 49.6 at the position spaced from the same by 1 mm; the flux density varied by 43.4 mT, and the attenuation ratio 46.7%. The other auxiliary magnet P1*c* downstream of the main magnet P1*b* had a flux density of 92 mT in the direction normal to the sleeve surface on the sleeve surface or a flux density of 51.7 mT at the position spaced from the same by 1 mm; the flux density varied by 40.3 mT, and the attenuation ratio was 3.8%.

In the illustrative embodiment, only the brush portion formed by the main magnet P1*b* contacts the drum 1 and develops a latent image. In this condition, the magnet brush was about 1.88 mm long at the above position when measured without contacting the drum 1. Such a length of the magnet brush was shorter than conventional length and (about 3 mm), so that the magnet brush of the illustrative embodiment was denser than the conventional magnet brush.

For a given distance between the metering member or doctor and the sleeve, i.e., for a give amount of developer to pass the metering member, the illustrative embodiment made the magnet brush shorter and more dense than the conventional magnet brush at the developing region, as determined by experiments. This will also be understood with reference to FIG. 70. Because the flux density in the normal direction measured at the distance of 1 mm from the sleeve surface noticeably decreases, the magnet brush cannot form a chain at a position remote from the sleeve surface and is therefore short and dense. In this connection, the flux density available with the main pole of a conventional magnet roller (FIG. 72) was 73 mT on the sleeve surface or 51.8 mT at the distance of 1 mm from the sleeve surface; the flux density varied by 21.2 mT, and the attenuation ratio was 29%.

Figure 73:
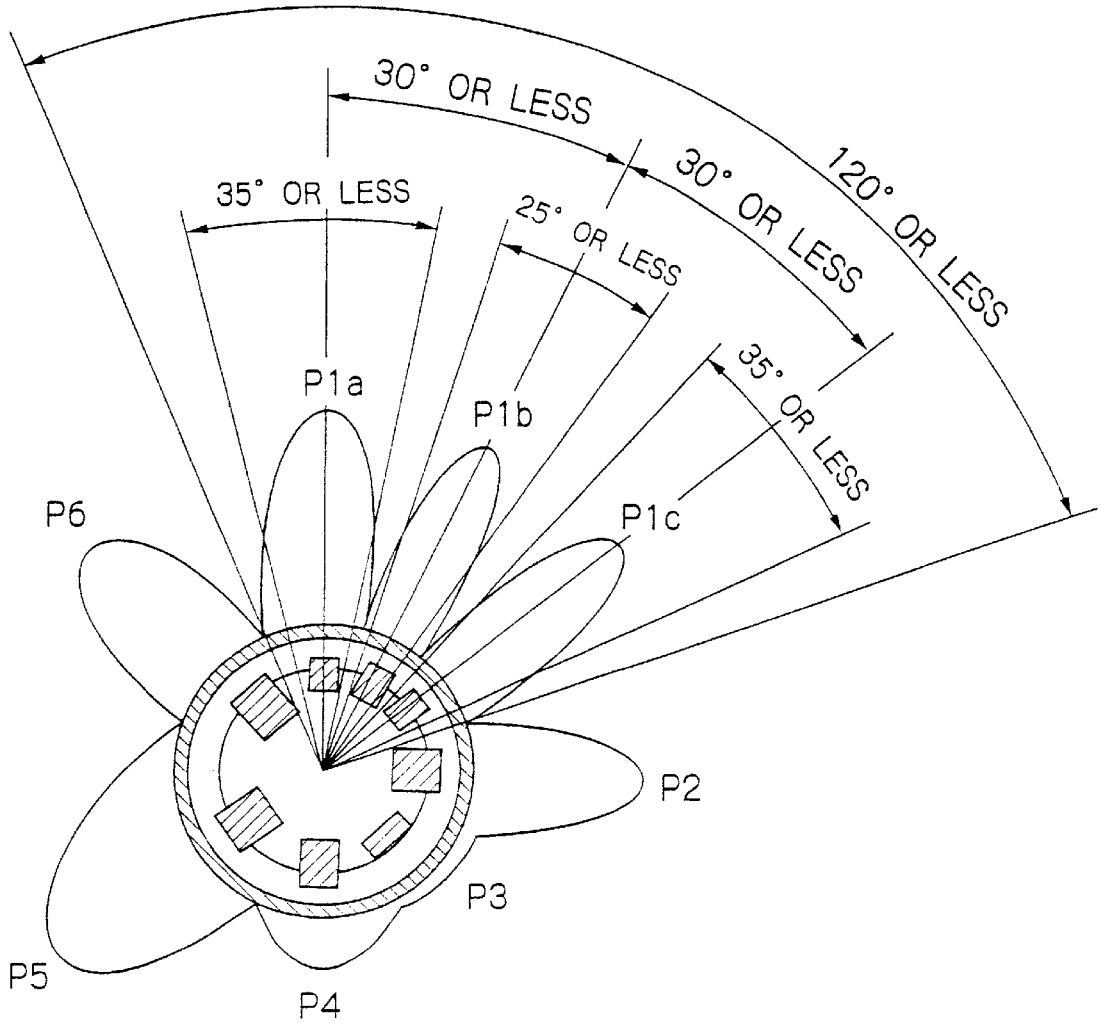
FIG. 73 shows a relation between a main magnet and auxiliary magnets with respect to angular position.

FIG. 73 shows the positional relation between the main pole P1*b* and the auxiliary poles P1*a* and P1*c* on the basis of FIG. 70. As shown, when the maximum magnetic force of the main magnet in the normal direction is 95 mT, the half-value is 47.5 mT, and the half-width is 22°. The half-width of the main magnet above 22° results in defective images.

The auxiliary magnets P1*a* and P1*c* each are provided with a half-width of 35° or less. Because the magnets P2 and P6 positioned outside of the auxiliary magnets P1*a* and P1*c* have a great half-width each, the half-width at each of the magnets P1*a* and P1*c* cannot be reduced relative to the main magnet P1*b*. Further, the angle between the main magnet P1*b* and each of the auxiliary magnets P1*a* and P1*c* is selected to be 30° or less. In the illustrative embodiment in which auxiliary poles are formed at both sides of the main pole, the half-width at the main pole is selected to be 16°, and therefore the above angle is selected to be 22°. In addition, polarity transition points (0 mT and where the S pole and N pole replace each other) between the auxiliary magnets P1*a* and P1*c* and the magnets P2 and P6 make an angle of 120° or less therebetween.

In the illustrative embodiment, the drive torque necessary for the developer is selected to be 0.15 N.m. The agitation of the developer needs substantial part of the drive torque for development because it is essential for uniformly charging the toner. Various factors known in the art that determine the torque for agitation include the amount of developer, an agitating member (e.g. screw), the area and frequency of contact of the agitating member with the developer, the magnetic forces of the magnetic poles, the saturation magnetization of the carrier of the developer, and the gap between the doctor 45 and the sleeve 43. While such conditions have heretofore been combined to promote efficient charging of the toner, they bring about mechanical hazard that reduces the life of the developer, as stated earlier.

Paying attention to the development torque exerting stress on the toner, the illustrative embodiment contemplates a configuration for reducing the development torque while insuring a sufficient developing characteristic despite the relative small amount of charge. FIG. 74 shows a relation between the development torque and the amount of charge to deposit on the toner determined by varying some different parameters, which relate to the developing device. FIG. 74 shows a comparative example representative of conventional conditions and conditions (A) through (D) relating to the illustrative embodiment. When any one of the conditions (A) through (D) was selected, the deterioration of the developer due to aging was reduced although the mean amount of charge was reduced. More specifically, the maximum life of the developer was extended to 230,000 prints, which is a considerable improvement over the conventional 150,000 prints.

Figure 15:
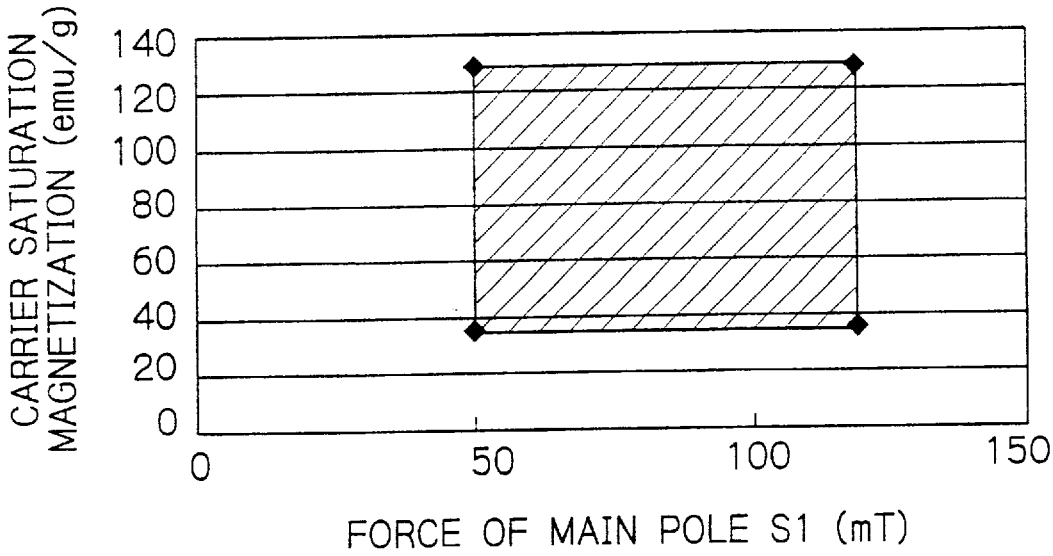
FIG. 15 is a graph showing a range in which the maximum magnetic force (magnetic flux density) of a developing roller and the saturation magnetization of magnetic grains are adequate.
Figure 16:
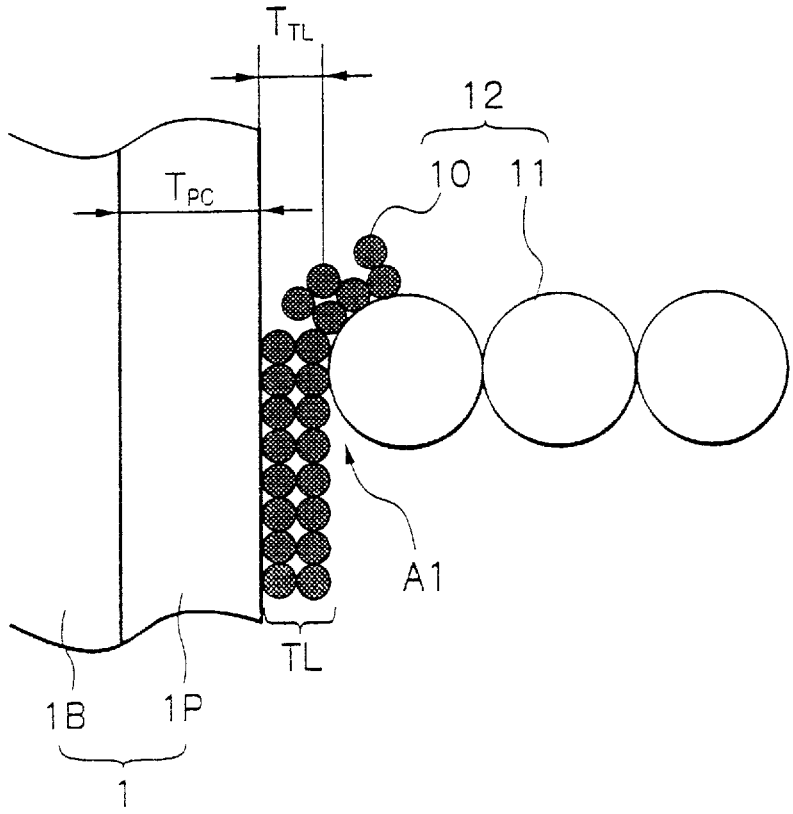
FIG. 16 shows toner grains and magnetic grains present in a developing region in the first embodiment.
Figure 75:
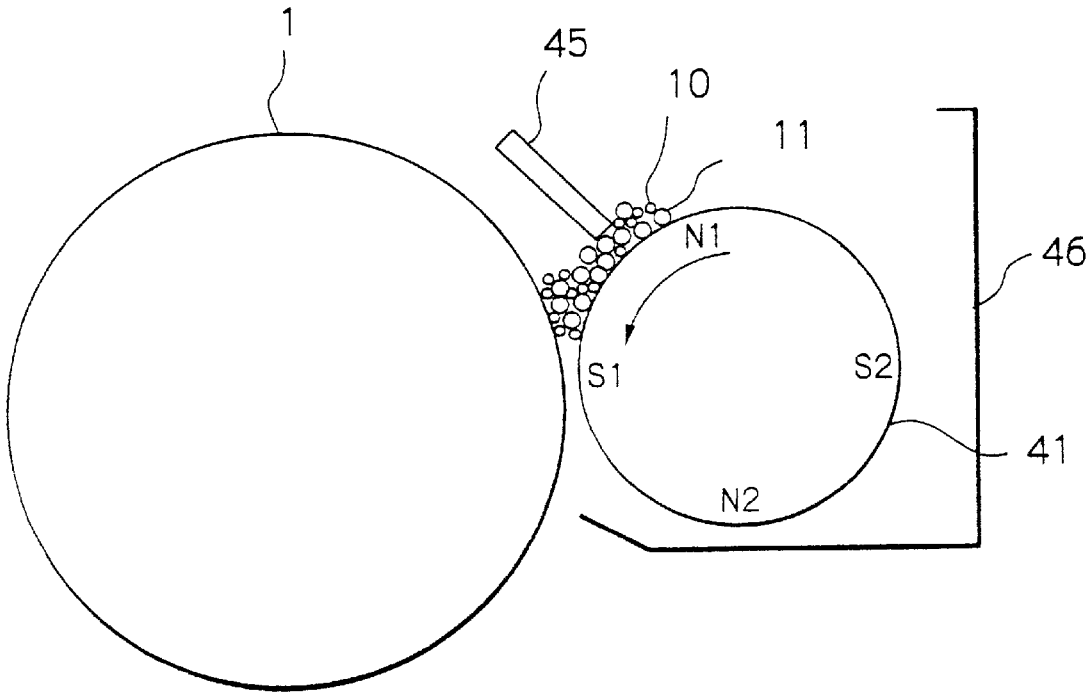
FIG. 75 shows an arrangement relating to the drive torque.

FIG. 75 shows the developing roller 41 with magnetic poles S1, S2, N1 and N2. Not only the main pole S1 but also the other poles S2, N1 and N2 effect the conveyance of the developer, including the carrier, and the hardness of the magnet brush. In the illustrative embodiment, the main pole S1 exerts a magnetic force MD of 70 T while the saturation magnetization MC of the carrier is 100 emu/g. Under these conditions, the magnet brush has adequate hardness and can be continuously used without any stress acting on the magnet brush. As shown in FIG. 15, a sufficiently firm magnet brush is not achievable when MD is lower than 60 T or when MC is lower than 60 emu/g, resulting in non-uniform development. When MD is higher than 80 T or when MC is higher than 130 emu/g, a firm magnet brush is formed on the sleeve and intensifies friction acting between the toner and carrier, resulting in the previously stated toner spent. This critically degrades the development characteristic due to a decrease in the fluidity of the toner as well in the amount of charge and thereby lowers image quality.

The bias applied to the sleeve transfers the toner from the sleeve to the drum 1, thereby developing a latent image formed on the drum 1 to thereby produce a toner image. In the illustrative embodiment, the drum 1 and sleeve move at linear velocities of 200 mm/sec and 300 mm/sec, respectively. The drum 1 has a diameter of 50 mm, the hopper has a diameter of 18 mm, and the sleeve has a diameter of 16 mm. The toner on the sleeve is charged by −10 $\mu$C/g to −30 $\mu$C/g. The drum 1 has a wall thickness of 28 $\mu$m. The beam spot diameter is 50×60 $\mu$m while the quantity of light is 0.23 mW. The drum 1 is uniformly charged to −300 V before exposure and has a potential $V_L$ of −100 V after exposure. The bias for development is −250 V, i.e., the development potential $V_L-V_B$ is 150 V.

It has been proposed to provide the quantity of light with high density and reduce a beam spot diameter to thereby effect a bilevel process. However, an increase in the quantity of light brings about the following problems. First, reducing the beam diameter of a large quantity of light reduces a margin as to optical design and therefore requires precision parts, resulting an increase in cost. Second, the large quantity of light translates into a large amount of charge for charging and exposure, so that the drum 1 suffers from so-called electrostatic hazard. This reduces the service life of the drum 1.

In light of the above, in the illustrative embodiment, the initial charge potential of the drum 1 and therefore the quantity of exposing light is reduced. This makes it possible to form a high-definition latent image with general-purpose optical elements and to extend the life of the drum 1 by reducing electrostatic hazard.

More specifically, in the illustrative embodiment, a γ or developing characteristic curve (amount of development relative to development potential) has a great slope; that is, development is easy to effect even with a relatively low potential and saturates soon. With this developing characteristic, it is relatively easy to develop a solid image with the entire amount of toner deposited on the developing roller 420. By contrast, in the case of the conventional developing drum and writing conditions, the amount of development varies when differential sensitivity does not sufficiently fall, causing the diameter of a small dot to vary. In the illustrative embodiment, the charge potential is originally low and lowers differential sensitivity when the latent image dot diameter corresponds to a latent image forming condition represented by $1/e^2$. Such low differential sensitivity insures a uniform dot image. In addition, it was experimentally found that the illustrative embodiment freed a toner image from background contamination with exposing power of 0.23 mW, which is far lower than conventional 0.47 mW.

In the illustrative embodiment the capacitance $C_D$ of the developer layer is selected to be higher than the capacitance $C_P$ of the drum 1. The specific inductive capacity and thickness of the illustrative embodiment are 2.7 and 30 $\mu$m, respectively. Therefore, the capacitance $C_P$ of the drum is 79.6 pF/cm$^2$ for a unit area. Assuming that the toner layer is 15 $\mu$m thick and has a specific inductive capacity of 3, then the capacitance $C_D$ of the developer layer is 177 pF/cm$^2$. This satisfies the relation of $C_D>C_P$. In the conventional arrangement, the specific inductive capacity is 2.7 while the thickness is 20 $\mu$m. Therefore, the capacitance $C_P$ is 119 pF/cm$^2$. Assuming that the toner layer has a specific inductive capacity of 3 and is 25 $\mu$m thick, then $C_{TL}$ is 106 pF/cm$^2$; $C_P>C_D$ holds.

FIGS. 17 and 18 compare the above relations in terms of γ value. As shown in FIG. 18, in the conventional arrangement, the γ curve of solid images and that of lines and dots are noticeably different from each other. By contrast, as shown in FIG. 17, in the illustrative embodiment, the two γ curves are close to each other. Further, FIG. 9 compares the conventional arrangement and illustrative embodiment with respect to density variation at the edges of a solid image. As shown, the conventional arrangement makes the edge effect conspicuous while the illustrative embodiment reduces it and can therefore reduce the difference between the density of solid images and that of lines and dots.

FIG. 20 shows a developing characteristic determined by the resistance of the developer layer in terms of γ characteristic dependent on the dynamic resistance of the developer layer. Dynamic resistances were measured by the method described with reference to FIG. 5. As FIG. 20 indicates, the lower the dynamic resistance, the greater the slope of the γ characteristic. As for the developer layer with a dynamic resistance of $10^7\Omega$, the development potential exceeds 400 V before the amount of toner deposition saturates. With dynamic resistances of $10^5\Omega$ and $10^6\Omega$, it is possible to achieve a developing ability high enough to reach saturation before the development potential reaches 400 V, implementing development with a lower development potential.

FIG. 76 compares specific magnet rollers particular to the illustrative embodiment and implemented by FeNdB bond and conventional magnet rollers with respect to flux density and so forth. The magnet rollers had diameters of 10 mm and 20 mm. For measurement, use was made of the axial probe and gauss meter available from ADS mentioned earlier. A hall element for measuring the flux density in the normal direction and tangential direction was spaced by 0.5 mm from the sleeve surface.

With the conditions described above, it is possible to reduce the omission of the trailing edge and jagged trailing edge. Specifically, the half-width of the main pole is reduced to implement the rise and fall of a short magnet brush for thereby reducing the nip width. In this condition, the movement of the toner grains away from the end of the magnet brush shown in FIG. 62B (toner drift) is reduced as far as possible. In the axial direction of the sleeve, the rise and fall of the magnet brush is uniformed.

Figure 77:
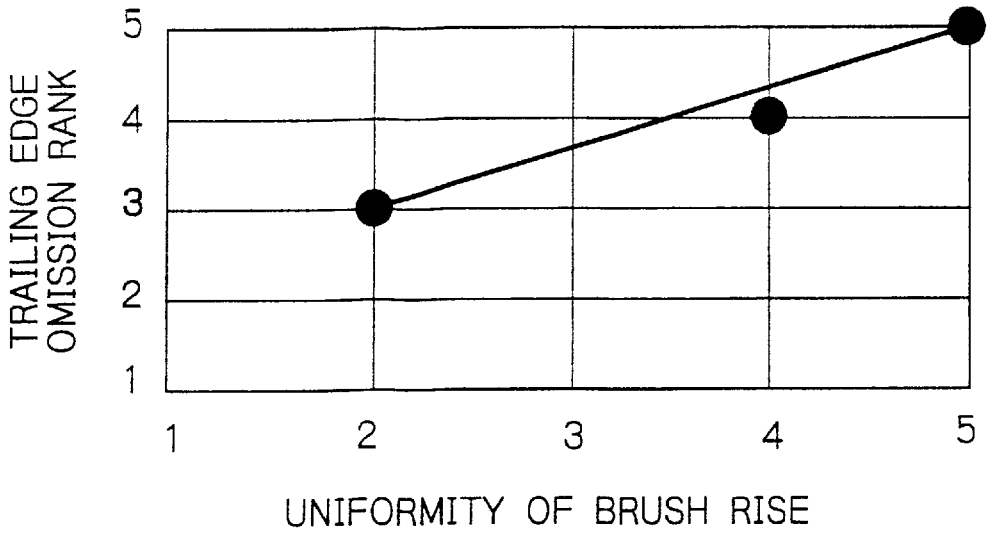
FIG. 77 is a graph showing a relation between the uniformity of the rise of the magnet brush and the degree of the omission of a trailing edge.

FIG. 77 shows a relation between the uniformity of the rise of the magnet brush caused by the main pole and the trailing edge omission rank; the lower the rank, the more irregular the rise of the magnet brush. As FIG. 77 indicates, the trailing edge omission rank becomes higher as the magnet brush rises more uniformly.

Figure 78A:
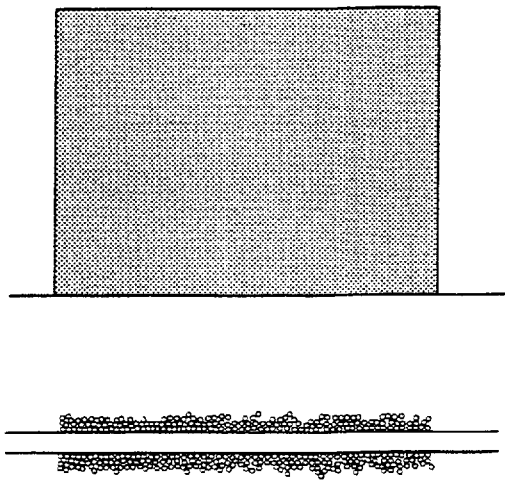
FIGS. 78A and 78B show a specific image without the omission of a trailing edge and a specific image with the omission of a trailing edge, respectively.
Figure 78B:
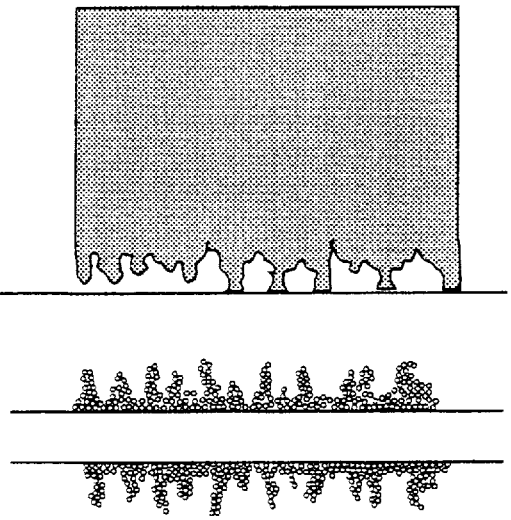

FIG. 78B shows a specific image to be output when the rise of the magnet brush is not uniform. As shown, because the portion of the magnet brush contacting the image carrier is not uniform, the behavior of the toner grains differs from one position to another position in the axial direction of the sleeve. As a result, the distance by which the individual toner grain moves is dependent on the charge of the non-image portion, resulting in irregular toner density around the image carrier in the axial direction of the sleeve. This causes the trailing edge of the image to be lost and makes the trailing edge jagged.

FIG. 78A shows a specific image to be output when the rise of the magnet brush is uniform. As shown, because the magnet brush contacts the image carrier uniformly in the axial direction of the sleeve, the toner grains move uniformly and prevent the trailing edge of the image from being lost.

The magnet brush should preferably be uniformly released from the image carrier as uniformly as it is brought into contact with the image carrier. Specifically, when the magnet brush that is about to leave the developing region uniformly falls down in the axial direction of the sleeve, a uniform amount of scavenging is achieved. If the magnet brush falls down non-uniformly in the axial direction of the sleeve, then the amount of scavenging becomes irregular and causes the magnet brush to sweep off the trailing edge of an image, rendering the image defective.

Figure 79:
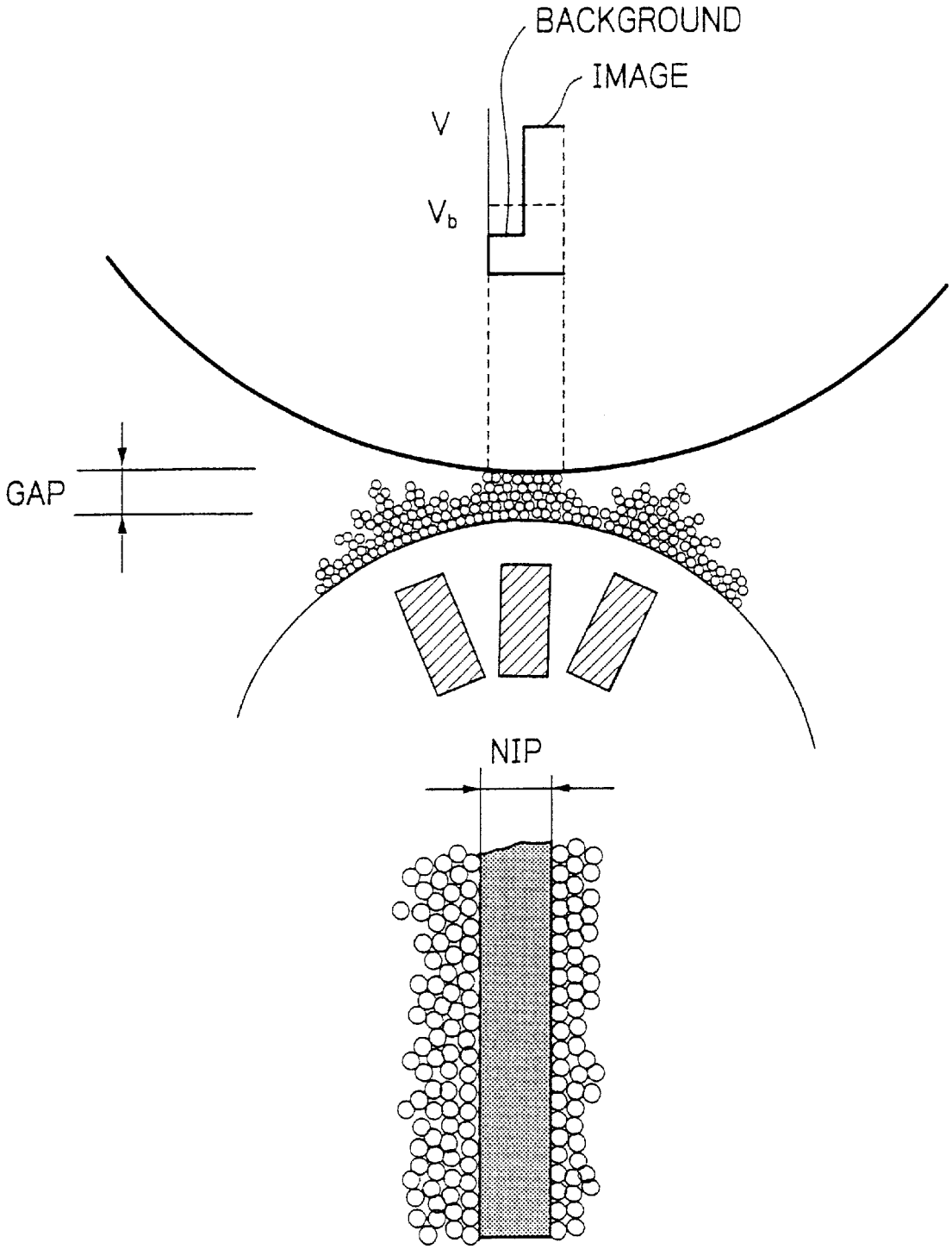
FIG. 79 shows the size of a gap and a nip for development in a developing region included in the tenth embodiment.

The illustrative embodiment not only reduces the omission of the trailing edge and jagged trailing edge, but also improves the reproducibility of a horizontal line (horizontal-to-vertical ratio), the reproducibility of a dot, and uniform toner deposition. FIG. 79 demonstrates why such improvements are achievable with the illustrative embodiment and is contrastive to FIG. 61.

Assume that the main pole is further controlled to allow only a single chain of carrier grains to contact the drum 1. Then, development can be effected with a nip with greater than (carrier grain size × ratio Ss/Sp).

Figure 80:
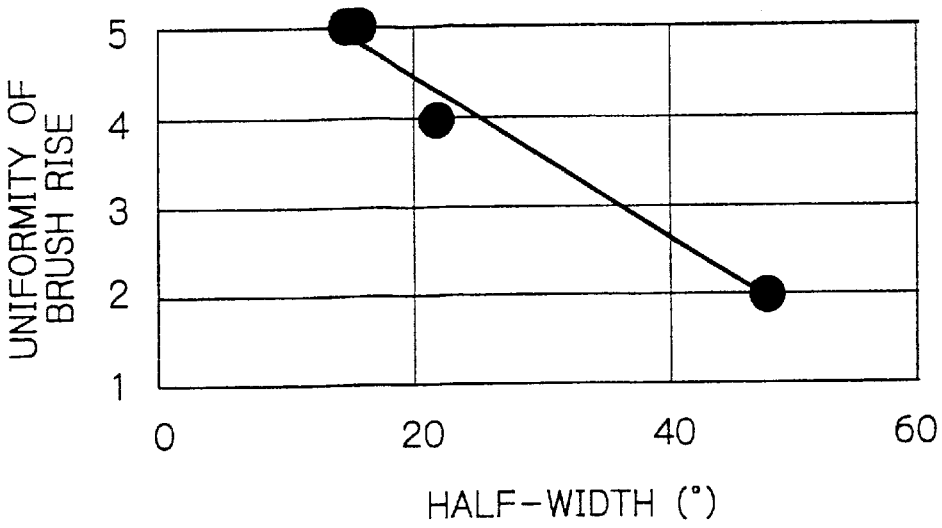
FIG. 80 is a graph showing a relation between the half-width of a main magnetic pole and the uniformity of the rise of a magnet brush.

The uniformity of the magnet brush may be represented by a half-width. FIG. 80 shows a relation between the half-value of the main pole and the uniformity of the rise of the magnet brush. As shown, the smaller the half-width, the more uniform the rise of the magnet brush. As FIG. 77 indicates, the uniform rise of the magnet brush insures an attractive image.

Figure 81:
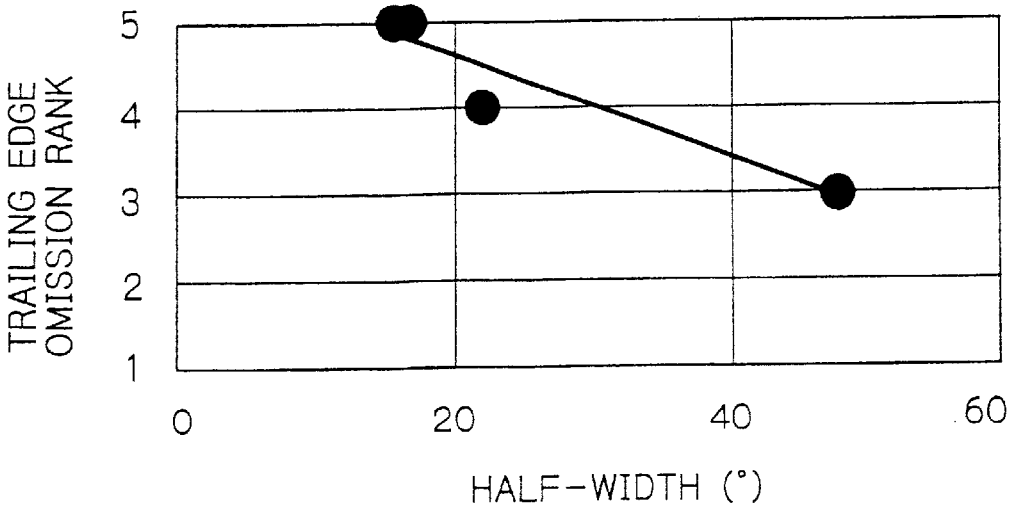
FIG. 81 is a graph showing a relation between the half-width of the main magnetic pole and the degree of omission of a trailing edge.

FIG. 81, which is derived from a relation between FIGS. 77 and 80, indicates that by reducing the half-width, it is possible to raise the trailing edge omission rank. Specifically, the smaller the half-width, the more uniform the rise of the magnet brush (FIG. 80). The more uniform the rise of the magnet brush, the higher the trailing edge omission rank (FIG. 77).

The uniform rise of the magnet brush is attainable if use is made of a magnet roller with a high attenuation ratio for forming the main pole. Experiments showed that a small half-width increased the attenuation ratio. To reduce the half-width, the width of the magnet in the circumferential direction of the sleeve may be reduced. This, however, increases the magnetic lines of force to turn round to nearby magnets and thereby lowers the flux density in the tangential direction at a position remote from the sleeve surface. More specifically, there exists between the magnet roller and the sleeve a substantial gap that is the sum of a space for fixing the magnet roller and allowing the sleeve to rotate and the wall thickness of the sleeve. The substantial gap causes the flux density in the tangential direction to substantially concentrate at the sleeve side. As a result, the greater the distance from the sleeve surface, the lower the flux density in the tangential direction.

A magnet roller with a high attenuation ratio forms a short, dense magnet brush while a magnet roller with a low attenuation ratio forms a long, rough magnet brush. Specifically, a magnetic field formed by a magnet roller with a high attenuation ratio is easily attracted by nearby magnets (e.g. P1*a* and P1*c* adjoining P1*b*). In this condition, the flux density turns round in the tangential direction rather than it extends in the normal direction, making it difficult for the developer to form a magnet brush in the normal direction. Consequently, a short, dense magnet brush is formed. For example, the magnet brush formed by the magnet P1*b* having a high attenuation ratio is more stable when dense and short than when long and rough. A conventional magnet roller with a low attenuation ratio cannot form a short magnet brush even if a greater amount of developer is scooped up to the sleeve.

To increase the attenuation ratio, the auxiliary magnets adjoining the main magnet may be brought closer to the main magnet in the circumferential direction of the sleeve. This configuration increases the magnetic lines of force issuing from the main pole and turning round to the auxiliary poles and thereby increases the attenuation ratio.

The illustrative embodiment reduces the half-width of the main pole to thereby realize the rise and fall of a short magnet brush and to uniform the rise and fall in the axial direction of the sleeve. It was experimentally found that such a configuration satisfied the condition 1 of FIG. 30, i.e., prevented the density of the trailing edge from being lowered even when the linear velocity ratio was increased.

Figure 82:
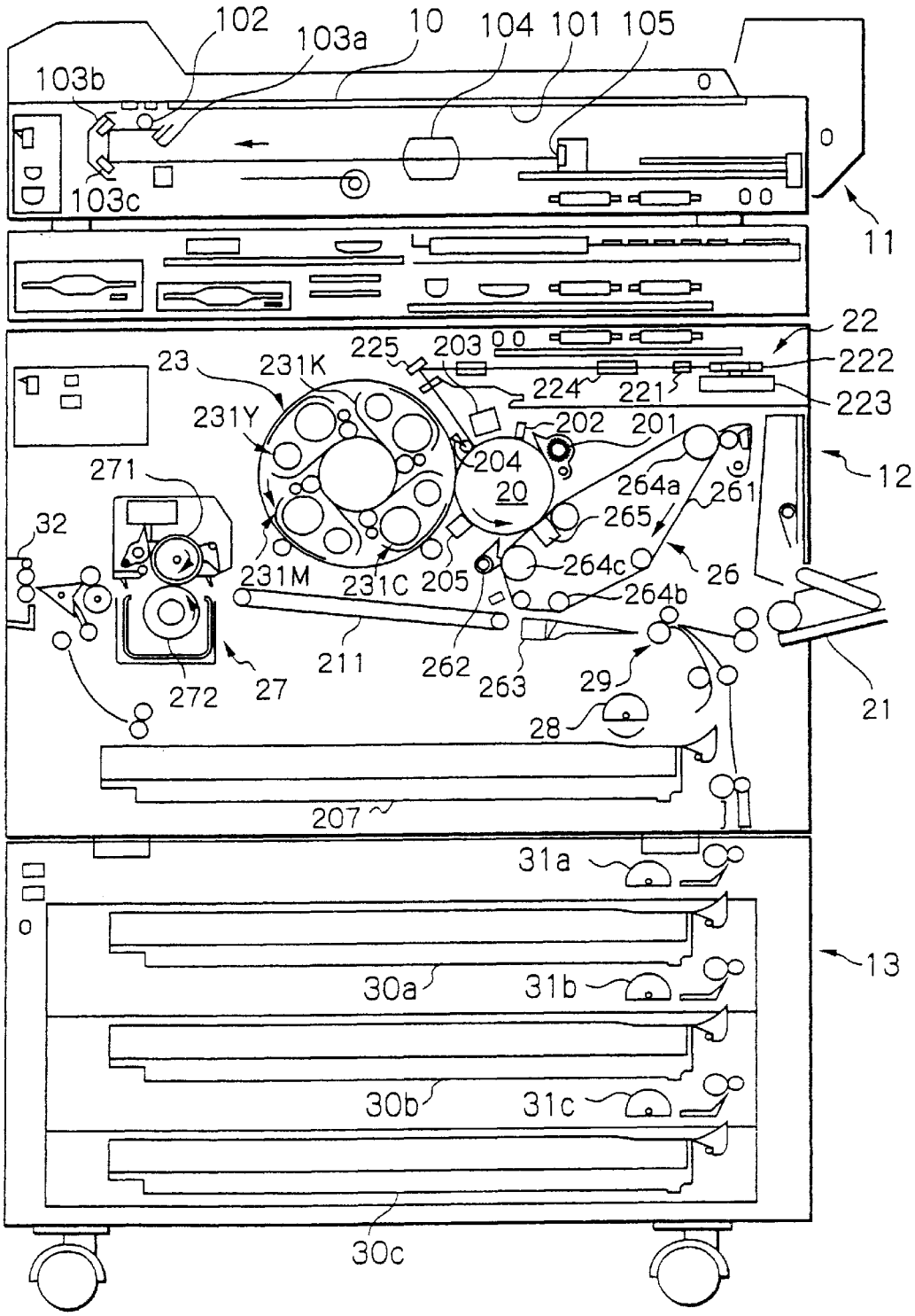
FIG. 82 shows a color copier to which the tenth embodiment is applied.

Reference will be made to FIG. 82 for describing an electrophotographic color copier to which the illustrative embodiment is applied. As shown, the color copier includes a color scanner 11, a color printer 12, and a sheet bank 13.

In the color scanner 11, a lamp 102 illuminates a document 10 laid on a glass platen 101. The resulting imagewise reflection from the document 10 is focused on a color sensor 105 via mirrors 103*a*, 103*b* and 103 and a lens 104. The color sensor 105 reads the document information color by color, e.g., R (red), G (green) and B (blue) while transforming the information of each color into a particular electric signal. In the specific configuration, the color sensor 105 is implemented by a CCD (Charge Coupled Device) array or similar image sensor and reads R, G and B information at the same time. An image processing section, not shown, processes the R, G and B signals on the basis of a signal strength level to thereby output Bk (black), C (cyan), M (magenta) and Y (yellow) color image data.

More specifically, in response to a scanner start signal synchronous to the operation of the color printer 12, the color scanner 11 causes optics including the lamp 102 and mirrors 103*a* through 103*c* to move to the left, as viewed in FIG. 82, while scanning the document 10. By repeating such a scanning stroke four consecutive times, the color scanner 11 sequentially outputs B, C, M and Y color data. In response to each of the B color data through the Y color data, the color printer 12 forms a toner image of a particular color. The resulting toner images of four different colors are superposed on each other to complete a full-color image.

The color printer 12 includes a photoconductive drum or image carrier 20, an optical writing unit 22, a developing unit implemented as a revolver 23, an intermediate image transferring device 26, and a fixing device 27. The drum 20 is rotatable counterclockwise, as viewed in FIG. 82. Arranged around the drum 20 are a drum cleaner 201, a discharge lamp 202, a charger 203, a potential sensor 204, selected one of developing sections constituting the revolver 23, a density pattern sensor 205, and a belt 261 included in the intermediate image transferring device 26.

The optical writing unit 22 converts the color image data output from the color scanner 11 to an optical signal and scans the drum 20 with the optical signal, thereby forming a latent image on the drum 20. The writing unit 22 includes a semiconductor laser or light source 221, a laser driver, not shown, a polygonal mirror 222, a motor 223 for driving the polygonal mirror 222, an f/θ lens 224, and a mirror 225.

The revolver 23 includes a Bk developing section 231K, a C developing section 231C, an M developing section 231M and a Y developing section 231Y as well as a driveline, which will be described later, for causing the revolver 23 to revolve counterclockwise, as viewed in FIG. 82. The developing sections 231K through 231Y each include a sleeve for development and a paddle. The sleeve causes a magnet brush formed thereon to contact the surface of the drum 20 for developing the latent image. The paddle scoops up a developer to the sleeve while agitating it. Toner forming part of the developer, which is stored in each developing section 231, is charged to negative polarity by friction acting between it and ferrite carrier. A bias for development is applied to the sleeve and implemented by a negative DC voltage Vdc biased by an AC voltage Vac, biasing the sleeve to a preselected potential relative to the metallic core of the drum 20. When the copier is in a stand-by state, the Bk developing section 231K of the revolver 23 is located at a developing position.

On the start of a copying operation, the color scanner 11 starts reading Bk color image data out of the document 10 at a preselected timing. Optical writing using a laser beam and latent image formation start in accordance with the color image data. Let a latent image based on the Bk image data be referred to as a Bk latent image. This is also true with latent images based on C, M and Y image data. Before the leading edge of the Bk latent image arrives at the developing position, the Bk sleeve is rotated to develop the Bk latent image with Bk toner from the trailing edge to the leading edge. As soon as the trailing edge of the Bk latent image moves away from the developing position, the revolver 23 is rotated to bring the next developing section (usually the C developing section) to the developing position. This rotation is completed at least before the leading edge of the latent image derived from the next image data arrives at the developing position.

The intermediate image transferring unit 26 includes the previously mentioned belt 261, a belt cleaner 262, and a corona discharger 263. The belt 261 is passed over a drive roller 264*a*, a roller 264*b*, a roller 264*c*, and a plurality of driven rollers. A motor, not shown, causes the belt 261 to move via the drive roller 264*a*. The belt cleaner 262 includes an inlet seal, a rubber blade, a discharge coil, and a mechanism for bringing the inlet seal and rubber blade into and out of contact with the belt 261, although not shown specifically. After the transfer of the Bk image or first toner image from the drum 20 to the belt 261, the above mechanism releases the input seal and blade from the belt 261 while the transfer of the second to fourth images are under way. The corona discharger 263 applies an AC+DC voltage or a DC voltage to the belt 261 for thereby transferring a full-color toner image to a sheet or recording medium.

The sheet bank 13 includes a plurality of sheet cassettes 30*a*, 30*b* and 30*c* each being loaded with sheets of particular size. This is true with a sheet cassette 207 disposed in the color printer 12. A pickup roller 28, 31*a*, 31*b* or 31*c* pays out a sheet from associated one of the sheet cassettes 207 and 30*a* through 30*c* toward a registration roller pair 29. An OHP sheet, thick sheet or similar special sheet may be fed from a manual feed tray 21 by hand, as needed.

In operation, on the start of an image forming cycle, the drum 20 and belt 261 start rotating counterclockwise and clockwise, respectively. A Bk toner image, a C toner image, an M toner image and a Y toner image are sequentially formed on the drum 20 while being sequentially transferred to the belt 261 one above the other.

The formation of the Bk toner image will be described more specifically. The charger 203 uniformly charges the surface of the drum 20 to about −700 V by corona discharge. The semiconductor laser 221 scans the charged surface of the drum 20 by raster scanning in accordance with the Bk color signal. The scanned or exposed portion of the drum 20 loses a potential corresponding to the quantity of incident light, forming a Bk latent image. Bk toner deposited on the Bk sleeve contacts the Bk latent image. While the Bk toner does not deposit on the portion of the drum 20 where the charge is left, it deposits on the exposed portion where the charge is absent. As a result, a Bk toner image is formed on the drum 20. An image transfer unit 265 transfers the Bk toner image from the drum 20 to the belt 261 rotating at a constant speed in contact with the drum 20. Let the image transfer from the drum 20 to the belt 261 be referred to as belt transfer.

The drum cleaner 201 removes some toner left on the drum 20 after the belt transfer. The toner collected by the drum cleaner 201 is delivered to a waste toner tank, not shown, via a pipe not shown.

After the formation of the Bk image, a C image forming step begins with the drum 20. Specifically, the color scanner 11 starts reading C image data out of the document 20 at a preselected timing. Optical writing using the laser beam forms a C latent image in accordance with the C image data. The revolver 23 is rotated after the trailing edge of the Bk latent image has moved away from the developing position, but before the leading edge of the C latent image arrives the developing position, locating the C developing section 231C at the developing position. The C developing section 232C then develops the C latent image. As soon as the trailing edge of the C latent image moves away from the developing position, the revolver 23 is again rotated to locate the M developing section 231M at the developing position. This is also completed before the leading edge of the M latent image arrives at the developing position.

M and Y image forming steps are identical with the Bk and C image forming steps except for the color and will not be described specifically in order to avoid redundancy.

The Bk, C, M and Y toner images are sequentially transferred from the drum 20 to the belt 261 one above the other, completing a full-color image. The corona discharger 263 transfers the full-color image to a sheet.

The fixing device 27 fixes the full-color toner image on the sheet. Specifically, in the fixing device 27, a heat roller 271 heated to preselected temperature and a press roller 272 nip the sheet therebetween and fix the toner image with heat and pressure. An outlet roller pair 32 drives the sheet with the fixed toner image, or print, out of the copier body to a tray, not shown, face up.

The drum cleaner 201 (brush roller and rubber blade) cleans the surface of the drum 20 after the belt transfer. A discharge lamp 202 uniformly discharges the cleaned surface of the drum 20. On the other hand, the previously mentioned mechanism again presses the blade of the belt cleaner against the surface of the belt 261 to thereby clean the belt surface.

Figure 83:
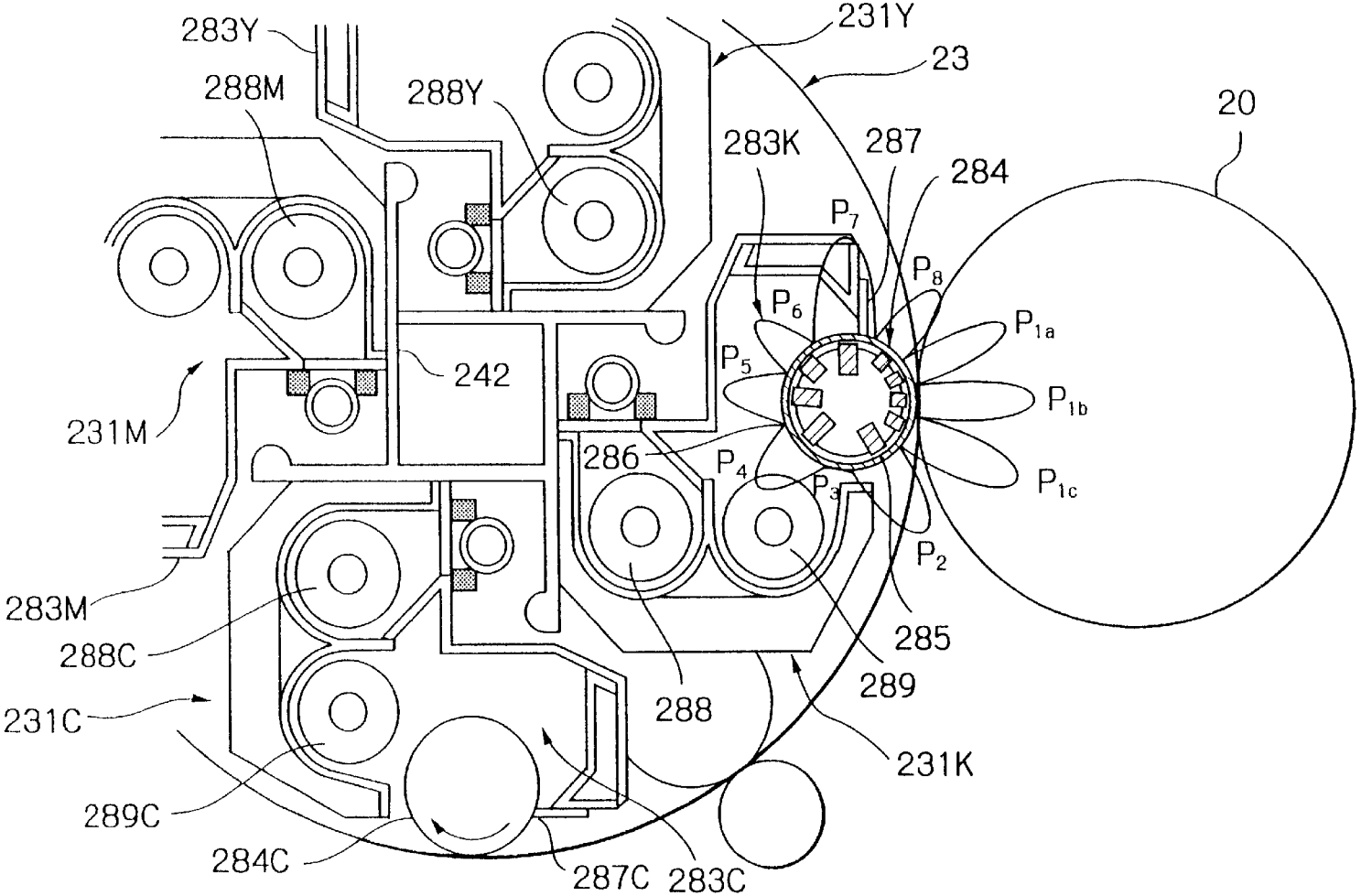
FIG. 83 is a fragmentary view showing a revolver included in the copier of FIG. 82.

FIG. 83 shows the revolver 23 in detail. As shown, the developing sections 231K through 231Y are supported by a hollow, rectangular stay member 242 extending between a front and a rear end plate not shown. The developing sections 231K through 231Y have identical casings 283K through 283Y, respectively. The casings 283K through 283Y each store a two-ingredient type developer of particular color. In the specific condition shown in FIG. 83, the Bk developing section 231 storing a black toner and carrier mixture is located at the developing position where the revolver 23 faces the drum 20. The Y developing section 231Y, M developing section 231M and C developing section 231C storing a yellow toner and carrier mixture, a magenta toner and carrier mixture and a cyan toner and carrier mixture, respectively, are sequentially positioned in the counterclockwise direction, as viewed in FIG. 83.

The developing sections 231K through 231Y are identical in configuration. Therefore, only the Bk developing section 231K will be described hereinafter with the other developing sections 231Y, 231M and 231B being simply distinguished by suffices Y, M and C.

As shown in FIG. 83, a developing roller or developer carrier 284 faces the drum 20. A developing region is formed between the drum 20 and the developing roller 284. The developing roller 284 is made up of a rotatable sleeve 285 and a stationary magnet roller or magnet member 286 accommodated in the sleeve 285. The sleeve 285 is formed of aluminum, brass, stainless steel, conductive resin or similar nonmagnetic material and rotatable clockwise, as viewed in FIG. 83. In the specific configuration, the drum 20 has a diameter of 90 mm and moves at a linear velocity of 200 mm/sec. The sleeve 285 has a diameter of 30 mm and moves at a linear velocity of 300 m/sec; the linear speed ratio of the sleeve 285 to the drum 20 is 1.2. The gap for development between the drum 20 and the sleeve 285 is 0.4 mm.

Figure 84:
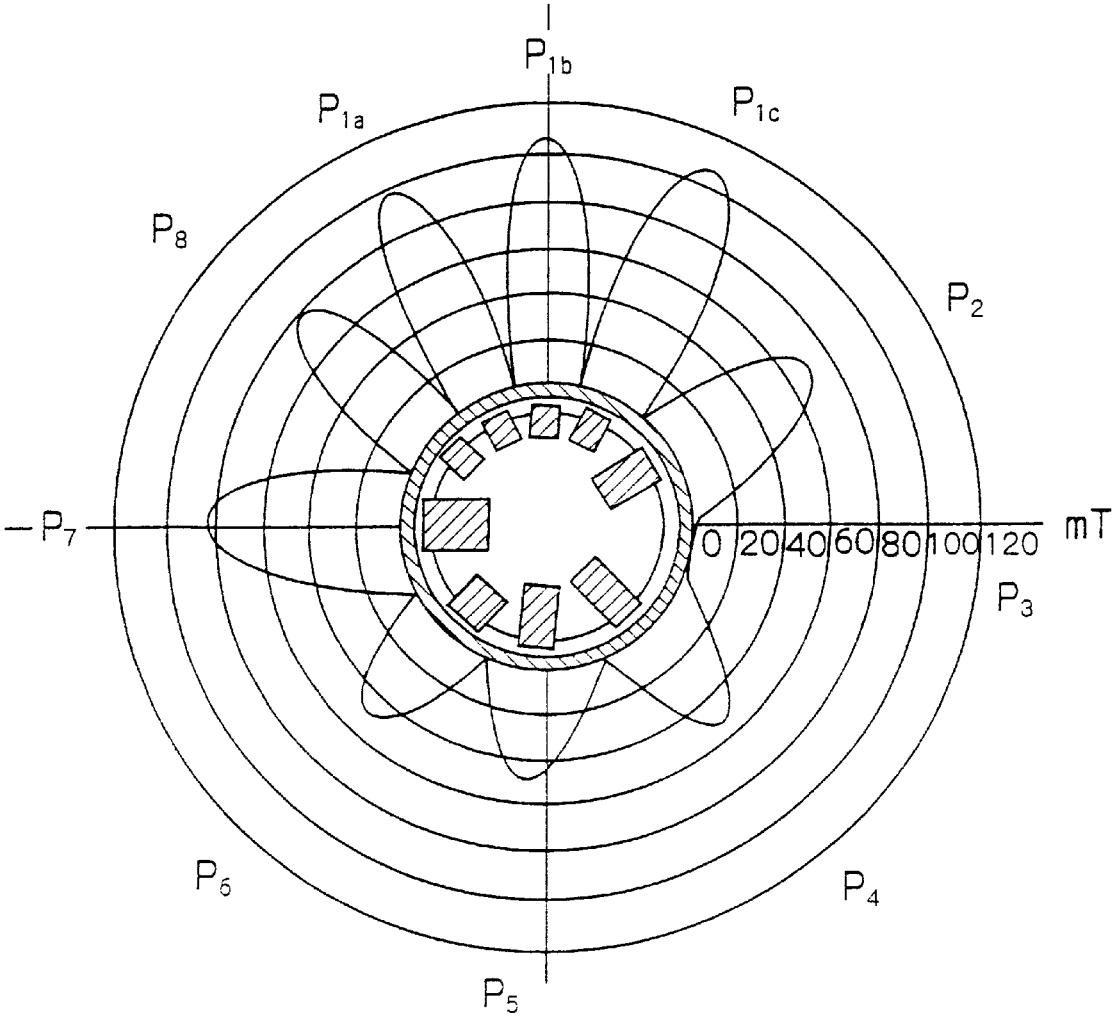
FIG. 84 is a chart showing the magnetic force distribution of a magnet roller included in the revolver and the sizes magnetic forces.

The magnet roller 286 held stationary inside the sleeve 285 causes the carrier grains of the developer to rise in the form of brush chains on the sleeve 285 along the magnetic lines of force thereof. The charged toner grains deposit on such carrier grains, forming a magnet brush. The magnet brush is conveyed in accordance with the rotation of the sleeve 285 in the same direction as the rotation of the sleeve 285 (clockwise). The magnet roller 286 has a plurality of magnetic poles. Specifically, as shown in FIG. 84, a main pole P1*b* causes the developer to rise in the developing region. Auxiliary poles P1*a* and P1*c* help the main pole P1*b* form a main magnetic field for development. Poles P4 and P5 scoop up the developer to the sleeve 285. Poles P6, P7 and P8 convey the developer to the developing region. Poles P2 and P3 convey the developer in the region following the developing region. The poles P1*b*, P1*a*, P1*c*, P4, P5, P6, P7, P8, P2 and P3 each are arranged in the radial direction of the sleeve 285. FIG. 85 lists the flux densities and other factors of the various poles or magnets of the magnet roller 286, which is implemented by an FeNdB bond, for the diameter of 30 mm. FIG. 85 additionally lists the factors of conventional poles or magnets for comparison.

While the magnet roller 286 has 10 poles, it may additionally have two poles between the pole P3 and the doctor for enhancing the scoop-up of the developer and the ability to follow a black solid image. Also, while the individual magnet of the magnet roller is shown as being rectangular, it may be sectorial or annular, if desired.

For the measurement of the magnet roller, use was made of a probe TYPE TS-10A and a gauss meter HGM-8900S available from ADS. A Hall element for measuring magnetic flux densities in the tangential and normal directions was spaced by 0.5 mm from the sleeve surface.

A doctor or metering member 287 is implemented as a blade disposed in the casing 283K for regulating the amount of the developer being conveyed by the developing roller 284 toward the developing region. A first screw 288 conveys the developer blocked by the doctor blade 287 and returned to the casing 283K from the rear to the front in the axial direction. A second screw 289 conveys the developer in the opposite direction to the first screw 288 in the axial direction. A toner content sensor is mounted on the casing 283K below the second screw 289 for sensing the toner content of the developer stored in the casing 283K.

The gap Gp for development and the doctor gap Gd were varied to estimate granularity and the omission of the trailing edge of an image. The doctor gap Gd, which relates to the doctor 287, increases the amount p of scoop-up if great or reduces it if small. The estimation showed that granularity decreases with a decrease in a ratio Gp/p. This means that much developer is packed in the narrow gap Gp and allows the toner to faithfully deposit on a latent image, thereby reducing granularity. As for the omission of a trailing edge, a desirable result was obtained under any condition because of the high developer density in the developing region and the short magnet brush. More specifically, a uniform electric field for development is formed in the developing region and allows a latent image to be faithfully developed. An alternating electric field, of course, will make the toner to easier to move in the developing region and will thereby further improve the situation.

Figure 86:
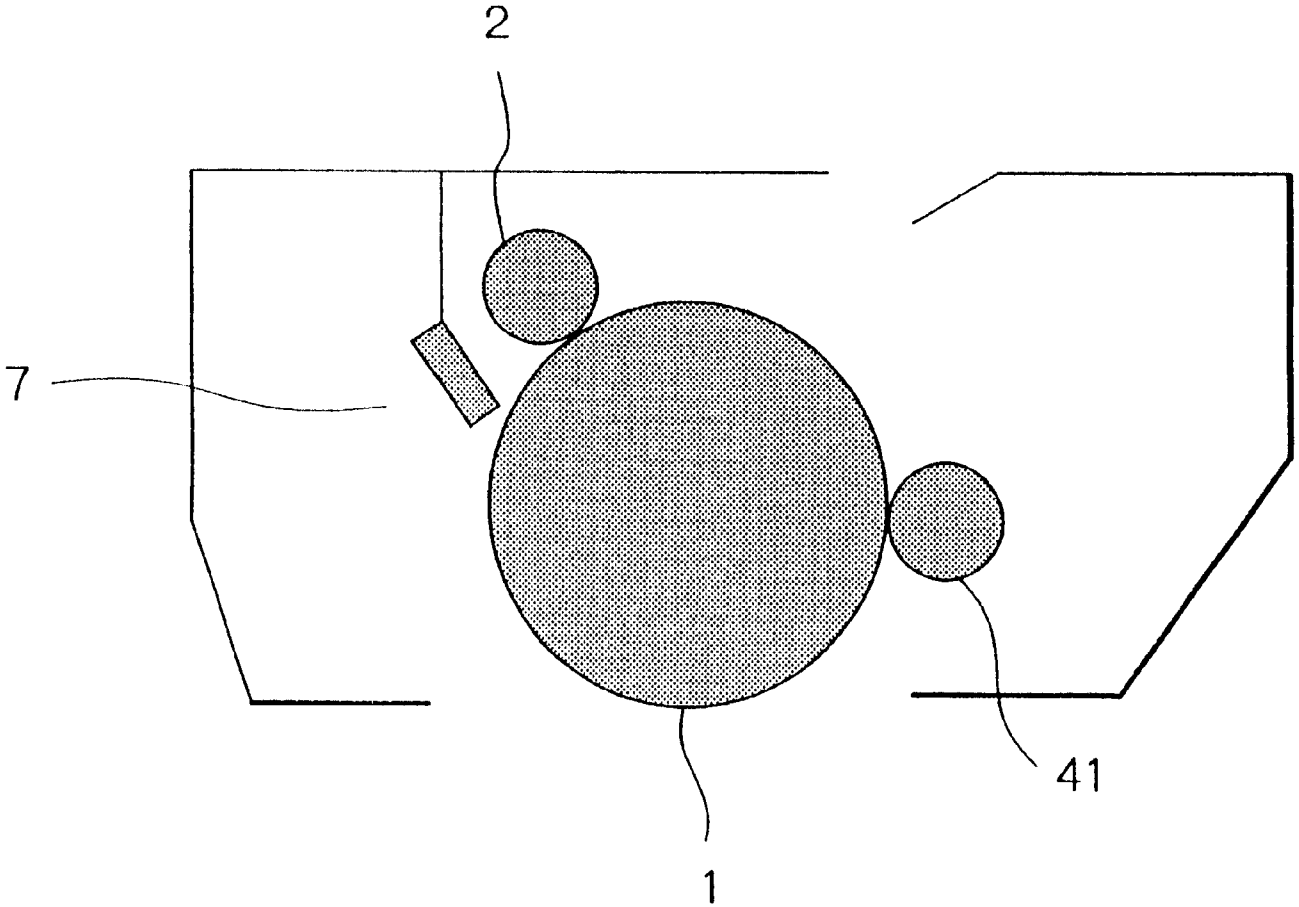
FIG. 86 shows an image forming apparatus including a process cartridge.

FIG. 86 shows an image forming apparatus including a process cartridge. As shown, two or more of the drum 1, charger 2, developing device 4 (developing roller 41) and cleaning means 7 are constructed into a single process cartridge removably mounted to the apparatus body. Although the illustrative embodiment extends the life of the photoconductive element unit and that of the developing device, the lives are not always coincident with each other. The process cartridge allows the photoconductive element unit and developing device to be replaced independently of each other. Further, because the photoconductive element unit and developing device can be arranged independently of each other, it is possible to move the developing roller away from the drum with a simple additional mechanism when development is not under way. This successfully reduces toner filming on the developing roller and further extends the life of the developing device.

In the developing device 41 shown in FIG. 86, a power supply, not shown, applies an AC-biased DC oscillation bias voltage to the sleeve at the time of development. The background potential and image potential lie between the maximum value and the minimum value of the oscillation bias potential. The bias voltage forms an alternating electric field alternating in direction in the developing region. In this electric field, the toner and carrier actively oscillate with the result that the toner flies toward the drum by overcoming an electrostatic restraint acting thereon.

A difference between the maximum value and the minimum value of the above bias voltage (peak-to-peak voltage) should preferably be 0.5 kV to 5 kV. The bias voltage should preferably have a frequency between 1 kHz and 10 kHz. The bias voltage may have a rectangular, sinusoidal or triangular waveform by way of example. While the DC component of the bias lies between the background potential and the image potential, as stated above, it should be closer to the background potential than to the image potential in order to avoid fog ascribable to the toner.

When the bias voltage has a rectangular waveform, a duty ratio should preferably be 50% or below. The duty ratio refers to the ratio of a period of time during which the toner tends to move toward the drum to a single period of the oscillation bias. This allows a great difference to be set between the peak urging the toner toward the drum and the time mean of the bias. Such a difference makes the movement of the toner more active and causes the toner to faithfully deposit on the latent image or potential distribution, thereby reducing granularity and increasing resolution. Moreover, it is possible to reduce a difference between the peak urging the carrier opposite in polarity to the toner toward the drum and the time mean of the bias. This settles the movement of the carrier and thereby noticeably reduces the probability that the carrier deposits on the background of the latent image.

As stated above, the illustrative embodiment reduces the amount of charge to thereby protect the surface of the image carrier from deterioration while enhancing the developing ability. Further, the illustrative embodiment reduces the granularity of an image and improves the reproducibility of thin lines.

Various modifications will become possible for those skilled in the art after receiving the teachings of the present disclosure without departing from the scope thereof.

What is claimed is:

1. An image forming apparatus comprising:

an image carrier;

latent image forming means for uniformly charging a surface of said image carrier and then exposing said surface in accordance with image data to thereby form a latent image on said surface;

a developing device for causing a developer carrier to convey a developer deposited on said developer carrier and containing toner to a developing region where said developer carrier faces said image carrier, said developer developing the latent image to thereby form a corresponding toner image;

bias applying means for applying a bias $V_B$ for development to said developer carrier; and transferring means for transferring the toner image from said image carrier to a recording medium;

wherein a charge potential deposited on said image carrier is 400 V or below in absolute value, and assuming that a potential of said image carrier is lowered to $V_L$ in an exposed portion, that a development potential is $|V_B-V_L|$, that a maximum set value of said development potential to be used for development is $|V_B-V_L|max$, and that said development potential varies in a range satisfying relations:

$$|V_B-V_L| \leqq |V_B-V_L|max+|V_B-V_L|max\times 0.2 \quad (1)$$

$$|V_B-V_L| \geqq |V_B-V_L|max-|V_B-V_L|max\times 0.2 \quad (2)$$

$$|V_B-V_L|max \leqq 300\ V \quad (3)$$

then image density varies by a width of 10% of image density corresponding to the maximum set value of the development potential or less.

2. The apparatus as claimed in claim 1, wherein the bias $V_B$, the potential VL and a potential $V_D$ of an unexposed portion of said image carrier satisfy a relation:

$$0<|V_D|-|V_B|<|V_D-V_L|<250\ V \quad (4)$$

and assuming that a minimum amount X of toner deposition implementing saturation image density on said image carrier is expressed as:

$$X=0.6\times \text{toner grain size}\times \text{toner true specific gravity/transfer ratio} \quad (5)$$

then a maximum amount of toner to deposit on said image carrier is 1.5×X or less.

3. The apparatus as claimed in claim 2, wherein the maximum amount of toner to deposit on said image carrier is 0.6 mg/cm$^2$ or less.

4. The apparatus as claimed in claim 3, wherein a maximum number of layers in which the toner deposits on said image carrier is three.

5. The apparatus as claimed in claim 2, wherein the developer consists of the toner and magnetic grains, and a ratio of said toner used for development to said toner fed by a magnet brush formed on said image carrier is 70% or above.

6. The apparatus as claimed in claim 5, wherein the surface of said image carrier and a surface of said developer carrier move in a same direction as each other in the developing region, and a ratio of a linear velocity of said surface of said developer carrier to a linear velocity of said surface of said image carrier is 3 or below.

7. The apparatus as claimed in claim 2, further comprising control means for maintaining the development potential constant.

8. The apparatus as claimed in claim 2, wherein the developer consists of the toner and magnetic grains, and said developer is deposited on said developer carrier in an amount of 60 mg/cm$^2$ or less.

9. The apparatus as claimed in claim 2, wherein the developer consists of the toner and magnetic grains, and a magnet brush formed on said developer carrier has a height two times as great as a gap for development between said image carrier and said developer carrier or less.

10. The apparatus as claimed in claim 9, wherein a magnetic pole for development positioned on said developer carrier implements a magnetic flux density T, as measured on a surface of said developer carrier, lying in a range of $60 \leqq T \leqq 80$ mT, and the magnetic grains have a saturation magnetization intensity Mc of $30\times 4\Pi\times 10^{-7} \leqq Mc \leqq 140\times 4\Pi\times 10^{-7}$ Wb.m/kg.

11. The apparatus as claimed in claim 2, wherein the developer consists of the toner and magnetic grains, and said toner covers an individual magnetic grain by a ratio of 50% or below.

12. The apparatus as claimed in claim 1, wherein the developer consists of the toner and magnetic grains, and the toner comprises spherical toner whose sphericity is 95% or above.

13. The apparatus as claimed in claim 1, wherein the developer consists of the toner and magnetic grains, said image carrier comprises a conductive base and a photoconductive layer covering said conductive base, and in a zone of said developing region adjoining the surface of said image carrier and where the toner contributing to development is present, a capacitance $C_{TL}$ for a unit area is greater than a capacitance $C_{PC}$ of said photoconductive layer for a unit area.

14. The apparatus as claimed in claim 1, wherein the developer consists of the toner and magnetic grains and has, when deposited on said developer carrier, a dynamic resistance of $10^6\Omega$ or below.

15. The apparatus as claimed in claim 1, wherein the developer consists of the toner and magnetic grains, said developing device includes a metering member for regulating a thickness of a toner layer being conveyed by said developer carrier toward the developing region, and a maximum amount of the toner to deposit on said developer carrier for a unit area is smaller than a maximum amount of toner to deposit on the latent image for a unit area when the development potential has the maximum set value.

16. The apparatus as claimed in claim 15, wherein said metering member comprises a roller contacting said developer carrier via the toner.

17. The apparatus as claimed in claim 1, wherein said developer comprises only the toner, and said developing device comprises a toner feeding member for conveying a two-ingredient type developer, which consists of the toner and magnetic carriers, deposited thereon to a toner feeding region to thereby feed said toner to said developer carrier, and bias applying means for applying a bias for toner feed between said toner feeding member and said developer carrier.

18. The apparatus as claimed in claim 1, wherein a drive torque input to said developing device is 0.15 N.m or below.

19. The apparatus as claimed in claim 1, wherein an additive is applied to the toner by 0.5 parts by mass or above, but 1.8 parts by mass or below.

20. An image forming apparatus comprising:

an image carrier;

latent image forming means for uniformly charging a surface of said image carrier and then exposing said surface in accordance with image data to thereby form a latent image on said surface;

a developing device for causing a developer carrier to convey a developer deposited on said developer carrier and containing toner to a developing region where said developer carrier faces said image carrier, said developer developing the latent image to thereby form a corresponding toner image;

bias applying means for applying a bias $V_B$ for development to said developer carrier; and transferring means for transferring the toner image from said image carrier to a recording medium;

wherein a charge potential deposited on said image carrier is 400 V or below in absolute value, and assuming that a potential of said image carrier is lowered to $V_L$ in an exposed portion, that a development potential is $|V_B-V_L|$, that a maximum set value of said development potential to be used for development is $|V_B-V_L|$max, and that said development potential varies in a range satisfying relations:

$$|V_B-V_L| \leqq |V_B-V_L|\text{max}+50 \text{ V} \quad (1)$$

$$|V_B-V_L| \geqq |V_B-V_L|\text{max}-50 \text{ V} \quad (2)$$

$$|V_B-V_L|\text{max} \leqq 300 \text{ V} \quad (3)$$

then image density varies by a width of 10% of image density corresponding to the maximum set value of the development potential or less.

21. The apparatus as claimed in claim 20, wherein the bias $V_B$, the potential $V_L$ and a potential $V_D$ of an unexposed portion of said image carrier satisfy a relation:

$$0<|V_D|-|V_B|<|V_D-V_L|<250 \text{ V} \quad (4)$$

and assuming that a minimum amount X of toner deposition implementing saturation image density on said image carrier is expressed as:

$$X=0.6\times\text{toner grain size}\times\text{toner true specific gravity/transfer ratio} \quad (5)$$

then a maximum amount of toner to deposit on said image carrier is 1.5×X or less.

22. The apparatus as claimed in claim 21, wherein the maximum amount of toner to deposit on said image carrier is 0.6 mg/cm$^2$ or less.

23. The apparatus as claimed in claim 22, wherein a maximum number of layers in which the toner deposits on said image carrier is three.

24. The apparatus as claimed in claim 21, wherein the developer consists of the toner and magnetic grains, and a ratio of said toner used for development to said toner fed by a magnet brush formed on said image carrier is 70% or above.

25. The apparatus as claimed in claim 24, wherein the surface of said image carrier and a surface of said developer carrier move in a same direction as each other in the developing region, and a ratio of a linear velocity of said surface of said developer carrier to a linear velocity of said surface of said image carrier is 3 or below.

26. The apparatus as claimed in claim 21, further comprising control means for maintaining the development potential constant.

27. The apparatus as claimed in claim 21, wherein the developer consists of the toner and magnetic grains, and said developer is deposited on said developer carrier in an amount of 60 mg/cm$^2$ or less.

28. The apparatus as claimed in claim 21, wherein the developer consists of the toner and magnetic grains, and a magnet brush formed on said developer carrier has a height two times as great as a gap for development between said image carrier and said developer carrier or less.

29. The apparatus as claimed in claim 28, wherein a magnetic pole for development positioned on said developer carrier implements a magnetic flux density T, as measured on a surface of said developer carrier, lying in a range of $60 \leqq T \leqq 80$ mT, and the magnetic grains have a saturation magnetization intensity Mc of $30\times4\Pi\times10^{-7} \leqq Mc \leqq 140\times4\Pi\times10^{-7}$ Wb.m/kg.

30. The apparatus as claimed in claim 21, wherein the developer consists of the toner and magnetic grains, and said toner covers an individual magnetic grain by a ratio of 50% or below.

31. The apparatus as claimed in claim 20, wherein the developer consists of the toner and magnetic grains, and the toner comprises spherical toner whose sphericity is 95% or above.

32. The apparatus as claimed in claim 20, wherein the developer consists of the toner and magnetic grains, said image carrier comprises a conductive base and a photoconductive layer covering said conductive base, and in a zone of said developing region adjoining the surface of said image carrier and where the toner contributing to development is present, a capacitance $C_{TL}$ for a unit area is greater than a capacitance $C_{PC}$ of said photoconductive layer for a unit area.

33. The apparatus as claimed in claim 20, wherein the developer consists of the toner and magnetic grains and has, when deposited on said developer carrier, a dynamic resistance of $10^6\Omega$ or below.

34. The apparatus as claimed in claim 20, wherein the developer consists of the toner and magnetic grains, said developing device includes a metering member for regulating a thickness of a toner layer being conveyed by said developer carrier toward the developing region, and a maximum amount of the toner to deposit on said developer carrier for a unit area is smaller than a maximum amount of toner to deposit on the latent image for a unit area when the development potential has the maximum set value.

35. The apparatus as claimed in claim 34, wherein said metering member comprises a roller contacting said developer carrier via the toner.

36. The apparatus as claimed in claim 20, wherein said developer comprises only the toner, and said developing device comprises a toner feeding member for conveying a two-ingredient type developer, which consists of the toner and magnetic carriers, deposited thereon to a toner feeding region to thereby feed said toner to said developer carrier, and bias applying means for applying a bias for toner feed between said toner feeding member and said developer carrier.

37. The apparatus as claimed in claim 20, wherein a drive torque input to said developing device is 0.15 N.m or below.

38. The apparatus as claimed in claim 20, wherein an additive is applied to the toner by 0.5 parts by mass or above, but 1.8 parts by mass or below.

39. An image forming apparatus comprising:

an image carrier;

latent image forming means for uniformly charging a surface of said image carrier and then exposing said surface in accordance with image data to thereby form a latent image on said surface;

a developing device for causing a developer carrier to convey a developer deposited on said developer carrier and containing toner to a developing region where said developer carrier faces said image carrier, said developer developing the latent image to thereby form a corresponding toner image;

bias applying means for applying a bias $V_B$ for development to said developer carrier; and transferring means for transferring the toner image from said image carrier to a recording medium;

wherein a charge potential deposited on said image carrier is 400 V or below in absolute value, and assuming that a potential of said image carrier is lowered to $V_L$ in an exposed portion, that a development potential is $|V_B-V_L|$, that a maximum set value of said development potential to be used for development is $|V_B-V_L|\max$, and that said development potential varies in a range satisfying relations:

$$|V_B-V_L| \leqq |V_B-V_L|\max + |V_B-V_L|\max \times 0.2 \quad (1)$$

$$|V_B-V_L| \geqq |V_B-V_L|\max - |V_B-V_L|\max \times 0.2 \quad (2)$$

$$|VB-V_L|\max \leqq 300 \text{ V} \quad (3)$$

then image density varies by a width lying in a range of ±0.1 of image density corresponding to the maximum set value of the development potential or less.

40. The apparatus as claimed in claim 39, wherein the bias $V_B$, the potential $V_L$ and a potential $V_D$ of an unexposed portion of said image carrier satisfy a relation:

$$0<|V_D|-|V_B|<|V_D-V_L|<250 \text{ V} \quad (4)$$

and assuming that a minimum amount X of toner deposition implementing saturation image density on said image carrier is expressed as:

$$X=0.6\times\text{toner grain size}\times\text{toner true specific gravity/transfer ratio} \quad (5)$$

then a maximum amount of toner to deposit on said image carrier is 1.5×X or less.

41. The apparatus as claimed in claim 40, wherein the maximum amount of toner to deposit on said image carrier is 0.6 mg/cm$^2$ or less.

42. The apparatus as claimed in claim 41, wherein a maximum number of layers in which the toner deposits on said image carrier is three.

43. The apparatus as claimed in claim 40, wherein the developer consists of the toner and magnetic grains, and a ratio of said toner used for development to said toner fed by a magnet brush formed on said image carrier is 70% or above.

44. The apparatus as claimed in claim 43, wherein the surface of said image carrier and a surface of said developer carrier move in a same direction as each other in the developing region, and a ratio of a linear velocity of said surface of said developer carrier to a linear velocity of said surface of said image carrier is 3 or below.

45. The apparatus as claimed in claim 40, further comprising control means for maintaining the development potential constant.

46. The apparatus as claimed in claim 40, wherein the developer consists of the toner and magnetic grains, and said developer is deposited on said developer carrier in an amount of 60 mg/cm$^2$ or less.

47. The apparatus as claimed in claim 40, wherein the developer consists of the toner and magnetic grains, and a magnet brush formed on said developer carrier has a height two times as great as a gap for development between said image carrier and said developer carrier or less.

48. The apparatus as claimed in claim 47, wherein a magnetic pole for development positioned on said developer carrier implements a magnetic flux density T, as measured on a surface of said developer carrier, lying in a range of $60 \leqq T \leqq 80$ mT, and the magnetic grains have a saturation magnetization intensity Mc of $30\times4\Pi\times10^{-7} \leqq Mc \leqq 140\times4\Pi\times10^{-7}$ Wb.m/kg.

49. The apparatus as claimed in claim 40, wherein the developer consists of the toner and magnetic grains, and said toner covers an individual magnetic grain by a ratio of 50% or below.

50. The apparatus as claimed in claim 39, wherein the developer consists of the toner and magnetic grains, and the toner comprises spherical toner whose sphericity is 95% or above.

51. The apparatus as claimed in claim 39, wherein the developer consists of the toner and magnetic grains, said image carrier comprises a conductive base and a photoconductive layer covering said conductive base, and in a zone of said developing region adjoining the surface of said image carrier and where the toner contributing to development is present, a capacitance $C_{TL}$ for a unit area is greater than a capacitance $C_{PC}$ of said photoconductive layer for a unit area.

52. The apparatus as claimed in claim 39, wherein the developer consists of the toner and magnetic grains and has, when deposited on said developer carrier, a dynamic resistance of $10^6\Omega$ or below.

53. The apparatus as claimed in claim 39, wherein the developer consists of the toner and magnetic grains, said developing device includes a metering member for regulating a thickness of a toner layer being conveyed by said developer carrier toward the developing region, and a maximum amount of the toner to deposit on said developer carrier for a unit area is smaller than a maximum amount of toner to deposit on the latent image for a unit area when the development potential has the maximum set value.

54. The apparatus as claimed in claim 53, wherein said metering member comprises a roller contacting said developer carrier via the toner.

55. The apparatus as claimed in claim 39, wherein said developer comprises only the toner, and said developing device comprises a toner feeding member for conveying a two-ingredient type developer, which consists of the toner and magnetic carriers, deposited thereon to a toner feeding region to thereby feed said toner to said developer carrier, and bias applying means for applying a bias for toner feed between said toner feeding member and said developer carrier.

56. The apparatus as claimed in claim 39, wherein a drive torque input to said developing device is 0.15 N.m or below.

57. The apparatus as claimed in claim 39, wherein an additive is applied to the toner by 0.5 parts by mass or above, but 1.8 parts by mass or below.

58. An image forming apparatus comprising:

an image carrier;

latent image forming means for uniformly charging a surface of said image carrier and then exposing said surface in accordance with image data to thereby form a latent image on said surface;

a developing device for causing a developer carrier to convey a developer deposited on said developer carrier and containing toner to a developing region where said developer carrier faces said image carrier, said developer developing the latent image to thereby form a corresponding toner image;

bias applying means for applying a bias $V_B$ for development to said developer carrier; and transferring means for transferring the toner image from said image carrier to a recording medium;

wherein the bias $V_B$, a lowered potential $V_L$ of an exposed portion of said image carrier and a potential VD of an unexposed portion of said image carrier satisfy a relation:

$$0<|V_D|-|V_B|<|V_D-V_L|<250\text{ V} \quad (1)$$

and assuming that a minimum amount X of toner deposition implementing saturation image density on said image carrier is expressed as:

$$X=0.6\times\text{toner grain size}\times\text{toner true specific gravity/transfer ratio} \quad (2)$$

then a maximum amount of toner to deposit on said image carrier is 1.5×X or less.

59. The apparatus as claimed in claim 58, wherein the developer consists of the toner and magnetic grains, and the toner comprises spherical toner whose sphericity is 95% or above.

60. The apparatus as claimed in claim 58, wherein the developer consists of the toner and magnetic grains, said image carrier comprises a conductive base and a photoconductive layer covering said conductive base, and in a zone of said developing region adjoining the surface of said image carrier and where the toner contributing to development is present, a capacitance $C_{TL}$ for a unit area is greater than a capacitance $C_{PC}$ of said photoconductive layer for a unit area.

61. The apparatus as claimed in claim 58, wherein the developer consists of the toner and magnetic grains and has, when deposited on said developer carrier, a dynamic resistance of 10Ω or below.

62. The apparatus as claimed in claim 58, wherein the developer consists of the toner and magnetic grains, said developing device including a metering member for regulating a thickness of a toner layer being conveyed by said developer carrier toward the developing region, and a maximum amount of the toner to deposit on said developer carrier for a unit area is smaller than a maximum amount of toner to deposit on the latent image for a unit area when the development potential has the maximum set value.

63. The apparatus as claimed in claim 62, wherein said metering member comprises a roller contacting said developer carrier via the toner.

64. The apparatus as claimed in claim 58, wherein said developer comprises only the toner, and said developing device comprises a toner feeding member for conveying a two-ingredient type developer, which consists of the toner and magnetic carriers, deposited thereon to a toner feeding region to thereby feed said toner to said developer carrier, and bias applying means for applying a bias for toner feed between said toner feeding member and said developer carrier.

65. The apparatus as claimed in claim 58, wherein the maximum amount of toner to deposit on said image carrier is 0.6 mg/cm$^2$ or less.

66. The apparatus as claimed in claim 65, wherein a maximum number of layers in which the toner deposits on said image carrier is three.

67. The apparatus as claimed in claim 58, wherein the developer consists of the toner and magnetic grains, and a ratio of said toner used for development to said toner fed by a magnet brush formed on said image carrier is 70% or above.

68. The apparatus as claimed in claim 67, wherein the surface of said image carrier and a surface of said developer carrier move in a same direction as each other in the developing region, and a ratio of a linear velocity of said surface of said developer carrier to a linear velocity of said surface of said image carrier is 3 or below.

69. The apparatus as claimed in claim 58, further comprising control means for maintaining the development potential constant.

70. The apparatus as claimed in claim 58, wherein the developer consists of the toner and magnetic grains, and said developer is deposited on said developer carrier in an amount of 60 mg/cm$^2$ or less.

71. The apparatus as claimed in claim 58, wherein the developer consists of the toner and magnetic grains, and a magnet brush formed on said developer carrier has a height two times as great as a gap for development between said image carrier and said developer carrier or less.

72. The apparatus as claimed in claim 71, wherein a magnetic pole for development positioned on said developer carrier implements a magnetic flux density T, as measured on a surface of said developer carrier, lying in a range of $60\leqq T\leqq 80$ mT, and the magnetic grains have a saturation magnetization intensity Mc of $30\times4\Pi\times10^{-7}\leqq Mc\leqq 140\times4\Pi\times10^{-7}$ Wb.m/kg.

73. The apparatus as claimed in claim 58, wherein the developer consists of the toner and magnetic grains, and said toner covers an individual magnetic grain by a ratio of 50% or below.

74. The apparatus as claimed in claim 58, wherein a drive torque input to said developing device is 0.15 N.m or below.

75. The apparatus as claimed in claim 58, wherein an additive is applied to the toner by 0.5 parts by mass or above, but 1.8 parts by mass or below.

76. In an image forming process unit removably mounted to an image forming apparatus and comprising an image carrier and at least one of a charger constituting latent image forming means, a cleaning device and a developing device, said image forming apparatus comprising:

an image carrier;

latent image forming means for uniformly charging a surface of said image carrier and then exposing said surface in accordance with image data to thereby form a latent image on said surface;

a developing device for causing a developer carrier to convey a developer deposited on said developer carrier and containing toner to a developing region where said developer carrier faces said image carrier, said developer developing the latent image to thereby form a corresponding toner image;

bias applying means for applying a bias $V_B$ for development to said developer carrier; and transferring means for transferring the toner image from said image carrier to a recording medium;

wherein a charge potential deposited on said image carrier is 400 V or below in absolute value, and assuming that a potential of said image carrier is lowered to $V_L$ in an exposed portion, that a development potential is $|V_B-V_L|$, that a maximum set value of said development potential to be used for development is $|V_B-V_L|$max, and that said development potential varies in a range satisfying relations:

$$|V_B-V_L| \leqq |V_B-V_L|\max+|V_B-V_L|\max\times 0.2 \quad (1)$$

$$|V_B-V_L| \geqq |V_B-V_L|\max-|V_B-V_L|\max\times 0.2 \quad (2)$$

$$|V_B-V_L|\max \leqq 300\ \text{V} \quad (3)$$

then image density varies by a width of 10% of image density corresponding to the maximum set value of the development potential or less.

77. In an image forming process unit removably mounted to an image forming apparatus and comprising an image carrier and at least one of a charger constituting latent image forming means, a cleaning device and a developing device, said image forming apparatus comprising:

an image carrier;

latent image forming means for uniformly charging a surface of said image carrier and then exposing said surface in accordance with image data to thereby form a latent image on said surface;

a developing device for causing a developer carrier to convey a developer deposited on said developer carrier and containing toner to a developing region where said developer carrier faces said image carrier, said developer developing the latent image to thereby form a corresponding toner image;

bias applying means for applying a bias $V_B$ for development to said developer carrier; and transferring means for transferring the toner image from said image carrier to a recording medium;

wherein a charge potential deposited on said image carrier is 400 V or below in absolute value, and assuming that a potential of said image carrier is lowered to $V_L$ in an exposed portion, that a development potential is $|V_B-V_L|$, that a maximum set value of said development potential to be used for development is $|V_B-V_L|$max, and that said development potential varies in a range satisfying relations:

$$|V_B-V_L| \leqq |V_B-V_L|\max+50\ \text{V} \quad (1)$$

$$|V_B-V_L| \geqq |V_B-V_L|\max-50\ \text{V} \quad (2)$$

$$|V_B-V_L|\max \leqq 300\ \text{V} \quad (3)$$

then image density varies by a width of 10% of image density corresponding to the maximum set value of the development potential or less.

78. In an image forming process unit removably mounted to an image forming apparatus and comprising an image carrier and at least one of a charger constituting latent image forming means, a cleaning device and a developing device, said image forming apparatus comprising:

an image carrier;

latent image forming means for uniformly charging a surface of said image carrier and then exposing said surface in accordance with image data to thereby form a latent image on said surface;

a developing device for causing a developer carrier to convey a developer deposited on said developer carrier and containing toner to a developing region where said developer carrier faces said image carrier, said developer developing the latent image to thereby form a corresponding toner image;

bias applying means for applying a bias $V_B$ for development to said developer carrier; and transferring means for transferring the toner image from said image carrier to a recording medium;

wherein a charge potential deposited on said image carrier is 400 V or below in absolute value, and assuming that a potential of said image carrier is lowered to $V_L$ in an exposed portion, that a development potential is $|V_B-V_L|$, that a maximum set value of said development potential to be used for development is $|V_B-V_L|$max, and that said development potential varies in a range satisfying relations:

$$|V_B-V_L| \leqq |V_B-V_L|\max+|V_B-V_L|\max\times 0.2 \quad (1)$$

$$|V_B-V_L| \geqq |V_B-V_L|\max-|V_B-V_L|\max\times 0.2 \quad (2)$$

$$|V_B-V_L|\max \leqq 300\ \text{V} \quad (3)$$

then image density varies by a width lying in a range of ±0.1 of image density corresponding to the maximum set value of the development potential or less.

79. In an image forming process unit removably mounted to an image forming apparatus and comprising an image carrier and at least one of a charger constituting latent image forming means, a cleaning device and a developing device, said image forming apparatus comprising:

an image carrier;

latent image forming means for uniformly charging a surface of said image carrier and then exposing said surface in accordance with image data to thereby form a latent image on said surface;

a developing device for causing a developer carrier to convey a developer deposited on said developer carrier and containing toner to a developing region where said developer carrier faces said image carrier, said developer developing the latent image to thereby form a corresponding toner image;

bias applying means for applying a bias $V_B$ for development to said developer carrier; and transferring means for transferring the toner image from said image carrier to a recording medium;

wherein the bias VB, a lowered potential VL of an exposed portion of said image carrier and a potential VD of an unexposed portion of said image carrier satisfy a relation:

$$0<|V_D|-|V_B|<|V_D-V_L|<250\ \text{V} \quad (1)$$

and assuming that a minimum amount X of toner deposition implementing saturation image density on said image carrier is expressed as:

$$X=0.6\times\text{toner grain size}\times\text{toner true specific gravity/transfer ratio} \quad (2)$$

then a maximum amount of toner to deposit on said image carrier is 1.5×X or less.

* * * * *